United States Patent [19]

Saitoh et al.

[11] Patent Number: 4,696,881

[45] Date of Patent: Sep. 29, 1987

[54] MEMBER HAVING LIGHT RECEIVING LAYER WITH SMOOTHLY CONNECTED INTERFACES

[75] Inventors: Keishi Saitoh, Ibaraki; Tetsuo Sueda, Chofu; Kyosuke Ogawa, Sakurashinmachi; Teruo Misumi, Kawasaki; Yoshio Tsuezuki, Toride; Masahiro Kanai, Tokyo, all of Japan

[73] Assignee: Canon Kabushiki Kaisha, Tokyo, Japan

[21] Appl. No.: 752,920

[22] Filed: Jul. 8, 1985

[30] Foreign Application Priority Data

| | | | |
|---|---|---|---|
| Jul. 10, 1984 | [JP] | Japan | 59-141306 |
| Jul. 11, 1984 | [JP] | Japan | 59-142123 |
| Jul. 12, 1984 | [JP] | Japan | 59-143295 |
| Jul. 16, 1984 | [JP] | Japan | 59-146112 |
| Jul. 17, 1984 | [JP] | Japan | 59-146970 |
| Jul. 18, 1984 | [JP] | Japan | 59-150189 |
| Jul. 19, 1984 | [JP] | Japan | 59-148650 |
| Jul. 20, 1984 | [JP] | Japan | 59-149659 |
| Jul. 23, 1984 | [JP] | Japan | 59-151378 |
| Oct. 24, 1984 | [JP] | Japan | 59-222227 |
| Oct. 25, 1984 | [JP] | Japan | 59-223021 |
| Oct. 26, 1984 | [JP] | Japan | 59-224040 |
| Oct. 27, 1984 | [JP] | Japan | 59-225109 |
| Oct. 29, 1984 | [JP] | Japan | 59-225985 |
| Oct. 30, 1984 | [JP] | Japan | 59-226665 |

[51] Int. Cl.[4] ..... G03G 5/085

[52] U.S. Cl. ..... 430/57; 430/69; 430/84

[58] Field of Search ..... 430/56, 57, 58, 65, 430/69, 84, 127

[56] References Cited

U.S. PATENT DOCUMENTS

| | | | |
|---|---|---|---|
| 4,359,514 | 11/1982 | Shimizu et al. | 430/65 |
| 4,492,745 | 1/1985 | Mimura et al. | 430/67 |
| 4,514,483 | 4/1985 | Matsuura et al. | 430/84 |
| 4,592,981 | 6/1986 | Saitoh et al. | 430/69 |
| 4,592,983 | 6/1986 | Saitoh et al. | 430/69 |
| 4,595,644 | 6/1986 | Saitoh et al. | 430/69 |
| 4,600,611 | 7/1986 | Saitoh et al. | 430/69 |

FOREIGN PATENT DOCUMENTS

| | | | |
|---|---|---|---|
| 2733187 | 1/1978 | Fed. Rep. of Germany | 430/65 |
| 56-150754 | 11/1981 | Japan | 430/65 |
| 60-31144 | 2/1985 | Japan | 430/69 |

*Primary Examiner*—John L. Goodrow

*Attorney, Agent, or Firm*—Fitzpatrick, Cella, Harper & Scinto

[57] ABSTRACT

A light-receiving member comprises a substrate and a light-receiving layer of a multi-layer structure having at least one photosensitive layer and a surface layer comprising an morphous material containing silicon atoms and carbon atoms, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

98 Claims, 83 Drawing Figures

FIG. 1
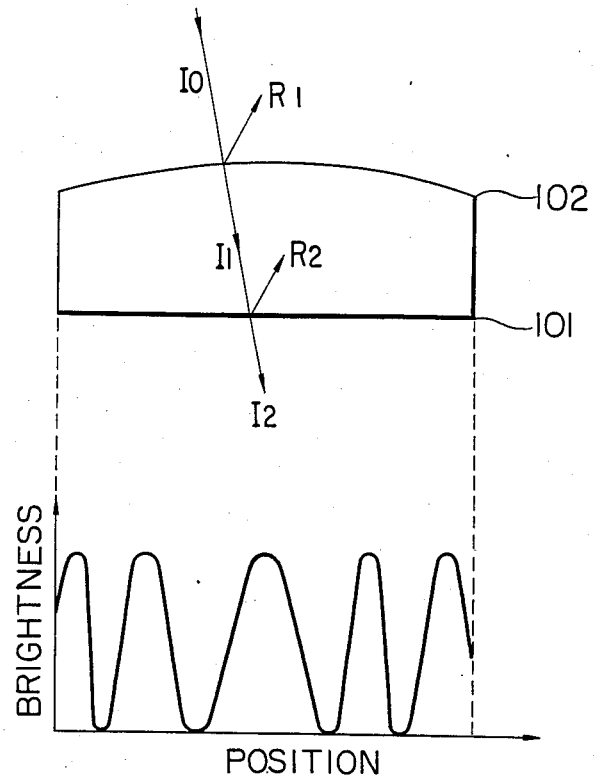
FIG. 2A
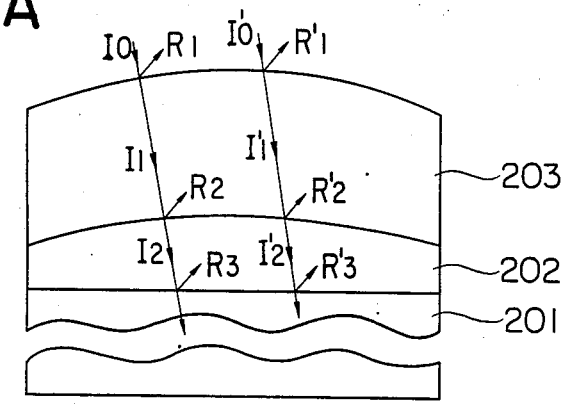
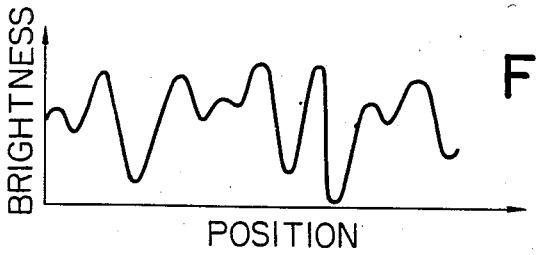
FIG. 2B

MEMBER HAVING LIGHT RECEIVING LAYER WITH SMOOTHLY CONNECTED INTERFACES

CROSS-REFERENCE TO RELATED APPLICATIONS

This application contains subject matter related to commonly assigned, copending application Ser. Nos. 697,141; 699,868; 705,516; 709,888; 720,011; 740,901; 786,970; 725,751; 726,768; 719,980; 739,867; 740,714; 741,300; 753,048; 752,920 and 753,011.

BACKGROUND OF THE INVENTION

1. Field of the Invention

This invention relates to a light receiving member having sensitivity to electromagnetic waves such as light [herein used in a broad sense, including ultraviolet rays visible light, infrared rays, X-rays and gamma-rays]. More particularly, it pertains to a light receiving member suitable for using a coherent light such as laser beam.

2. Description of the Prior Art

As the method for recording a digital image information as an image, there have been well known the methods in which an electrostatic latent image is formed by scanning optically a light receiving member with a laser beam modulated corresponding to a digital image information, then said latent image is developed, followed by processing such as transfer or fixing, if desired, to record an image. Among them, in the image forming method employing electrophotography, image recording has been generally practiced with the use of a small size and inexpensive He-Ne laser or a semiconductor laser (generally having an emitted wavelength of 650–820 nm).

In particular, as the light receiving member for electrophotograhy which is suitable when using a semiconductor laser, an amorphous material containing silicon atoms (hereinafter written briefly as "A-Si") as disclosed in Japanese Laid-open Patent Application Nos. 86341/1979 and 83746/1981 is attracting attention for its high Vickers hardness and non-polluting properties in social aspect in addition to the advantage of being by far superior in matching in its photosensitive region as compared with other kinds of light receiving members.

However, when the photosensitive layer is made of a single A-Si layer, for ensuring dark resistance of $10^{12}$ ohm.cm or higher required for electrophotography while maintaining high photosensitivity, it is necessary to incorporate structurally hydrogen atoms or halogen atoms or boron atoms in addition thereto in controlled form within specific ranges of amounts. Accordingly, control of layer formation is required to be performed severely, whereby tolerance in designing of a light receiving member is considerably limited.

As attempts to enlarge this tolerance in designing, namely to enable effective utilization of its high photosensitivity in spite of somewhat lower dark resistance, there have been proposed a light receiving layer with a multi-layer structure of two or more laminated layers with different conductivity characteristics with formation of a depletion layer within the light receiving layer, as disclosed in Japanese Laid-open Patent Application Nos. 121743/1979, 4053/1982 and 4172/1982, or a light receiving member with a multi-layer structure in which a barrier layer is provided between the substrate and the photosensitive layer and/or on the upper surface of the photosensitive layer, thereby enhancing apparent dark resistance of the light receiving layer as a whole, as disclosed in Japanese Laid-open Patent Application Nos. 52178/1982, 52179/1982, 52180/1982, 58159/1982, 58160/1982 and 58161/1982.

According to such proposals, A-Si type light receiving members have been greatly advanced in tolerance in designing of commercialization thereof or easiness in management of its production and productivity, and the speed of development toward commercialization is now further accelerated.

When carrying out laser recording by use of such a light receiving member having a light receiving layer of a multi-layer structure, due to irregularity in thickness of respective layers, and also because of the laser beam which is an coherent monochromatic light, it is possible that the respective reflected lights reflected from the free surface on the laser irradiation side of the light receiving layer and the layer interface between the respective layers constituting the light receiving layer and between the substrate and the light receiving layer (hereinafter "interface" is used to mean comprehensively both the free surface and the layer interface) may undergo interference.

Such an interference phenomenon results in the so-called interference fringe pattern in the visible image formed and causes a poor image. In particular, in the case of forming a medium tone image with high gradation, bad appearance of the image will become marked.

Moreover, as the wavelength region of the semiconductor laser beam is shifted toward longer wavelength, absorption of said laser beam in the photosensitive layer becomes reduced, whereby the above interference phenomenon becomes more marked.

This point is explained by referring to the drawings.

FIG. 1 shows a light $I_0$ entering a certain layer constituting the light receiving layer of a light receiving member, a reflected light $R_1$ from the upper interface 102 and a reflected light $R_2$ reflected from the lower interface 101.

Now, the average layer thickness of the layer is defined as d, its refractive index as n and the wavelength of the light as $\lambda$, and when the layer thickness of a certain layer is ununiform gently with a layer thickness difference of $\lambda/2n$ or more, changes in absorbed light quantity and transmitted light quantity occur depending on to which condition of $2nd=m\lambda$(m is an integer, reflected lights are strengthened with each other) and $2nd=(m+\frac{1}{2})\lambda$(m is an integer, reflected lights are weakened with each other) the reflected lights $R_1$ and $R_2$ conform.

In the light receiving member of a multi-layer structure, the interference effect as shown in FIG. 1 occurs at each layer, and there ensues a synergistic deleterious influence through respective interferences as shown in FIG. 2. For this reason, the interference fringe corresponding to said interference fringe pattern appears on the visible image transferred and fixed on the transfer member to cause bad images.

As the method for cancelling such an inconvenience, it has been proposed to subject the surface of the substrate to diamond cutting to provide unevenness of ±500 Å–±10000 Å, thereby forming a light scattering surface (as disclosed in Japanese Laid-open Patent Application No. 162975/1983); to provide a light absorbing layer by subjecting the aluminum substrate surface to black Alumite treatment or dispersing carbon, color pigment or dye in a resin (as disclosed in Japanese Laid-open Patent Application No. 165845/1982); and to provide a light scattering reflection preventive layer on the substrate surface by subjecting the aluminum substrate surface to satin-like Alumite treatment or by providing a sandy fine unevenness by sand blast (as disclosed in Japanese Laid-open Patent Application No. 16554/1982).

However, according to these methods of the prior art, the interference fringe pattern appearing on the image could not completely be cancelled.

For example, because only a large number of unevenness with specific sized are formed on the substrate surface according to the first method, although prevention of appearance of interference fringe through light scattering is indeed effected, regular reflection light component yet exists. Therefore, in addition to remaining of the interference fringe by said regular reflection light, enlargement of irradiated spot occurs due to the light scattering effect on the surface of the substrate to be a cause for substantial lowering of resolution.

As for the second method, such a black Alumite treatment is not sufficinent for complete absorption, but reflected light from the substrate surface remains. Also, there are involved various inconveniences. For example, in providing a resin layer containing a color pigment dispersed therein, a phenomenon of degassing from the resin layer occurs during formation of the A-Si photosensitive layer to markedly lower the layer quality of the photosensitive layer formed, and the resin layer suffers from a damage by the plasma during formation of A-Si photosensitive layer to be deteriorated in its inherent absorbing function. Besides, worsening of the surface state deleteriously affects subsequent formation of the A-Si photosensitive layer.

In the case of the third method of irregularly roughening the substrate surface, as shown in FIG. 3, for example, the incident light $I_0$ is partly reflected from the surface of the light receiving layer 302 to become a reflected light $R_1$, with the remainder progressing internally through the light receiving layer 302 to become a transmitted light $I_1$. The transmitted light $I_1$ is partly scattered on the surface of the substrate 301 to become scattered lights $K_1$, $K_2$, $K_3 \ldots K_n$, with the remainder being regularly reflected to become a reflected light $R_2$, a part of which goes outside as an emitted light $R_3$. Thus, since the reflected light $R_1$ and the emitted light $R_3$ which is an interferable component remain, it is not yet possible to extinguish the interference fringe pattern.

On the other hand, if diffusibility of the surface of the substrate 301 is increased in order to prevent multiple reflections within the light receiving layer 302 through prevention of interference, light will be diffused within the light receiving layer 302 to cause halation, whereby resolution is disadvantageously lowered.

Particularly, in a light receiving member of a multi-layer structure, as shown in FIG. 4, even if the surface of the substrate 401 may be irregularly roughened, the reflected light $R_2$ from the first layer 402, the reflected light $R_1$ from the second layer 403 and the regularly reflected light $R_3$ from the surface of the substrate 401 are interfered with each other to form an interference fringe pattern depending on the respective layer thicknesses of the light receiving member. Accordingly, in a light receiving member of a multi-layer structure, it was impossible to completely prevent appearance of interference fringes by irregularly roughening the surface of the substrate 401.

In the case of irregularly roughening the substrate surface according to the method such as sand blasting, etc., the roughness will vary so much from lot to lot, and there is also nonuniformity in roughness even in the same lot, and therefore production control could be done with inconvenience. In addition, relatively large projections with random distributions are frequently formed, hence causing local breakdown of the light receiving layer during charging treatment.

On the other hand, in the case of simply roughening the surface of the substrate 501 regularly, as shown in FIG. 5, since the light-receiving layer 502 is deposited along the uneven shape of the surface of the substrate 501, the slanted plane of the unevenness of the substrate 501 becomes parallel to the slanted plane of the unevenness of the light receiving layer 502.

Accordingly, for the incident light on that portion, $2nd_1 = m\lambda$ or $2nd_1 = (m + \frac{1}{2})\lambda$ holds, to make it a light portion or a dark portion. Also, in the light receiving layer as a whole, since there is nonuniformity in which the maximum difference among the layer thicknesses $d_1$, $d_2$, $d_3$ and $d_4$ of the light receiving layer is $\lambda/2n$ or more, there appears a light and dark fringe pattern.

Thus, it is impossible to completely extinguish the interference fringe pattern by only roughening regularly the surface of the substrate 501.

Also, in the case of depositing a light receiving layer of a multi-layer structure on the substrate, the surface of which is regularly roughened, in addition to the interference between the regularly reflected light from the substrate surface and the reflected light from the light receiving layer surface as explained for light receiving member of a single layer structure in FIG. 3, interferences by the reflected lights from the interfaces between the respective layers participate to make the extent of appearance of interferance fringe pattern more complicated than in the case of the light receiving member of a single layer structure.

SUMMARY OF THE INVENTION

An object of the present invention is to provide a novel light-receiving member sensitive to light, which has cancelled the drawbacks as described above.

Another object of the present invention is to provide a light-receiving member which is suitable for image formation by use of a coherent monochromatic light and also easy in production management.

Still another object of the present invention is to provide a light-receiving member which can cancel the interference fringe pattern appearing during image formation and appearance of speckles on reversal developing at the same time and completely.

Still another object of the present invention is to provide a light-receiving member which is high in dielectric strength and photosensitivity and excellent in electrophotographic characteristics.

Still another object of the present invention is to provide a light-receiving member which can provide an image of high quality which is high in density, clear in halftone and high in resolution and is suitable for electrophotography.

Yet another object of the present invention is to provide a light-receiving member which is excellent in durability, repeated use characteristics, use environmental characteristics, mechanical strength and light-receiving characteristics.

Yet still another object of the present invention is to provide a light-receiving member which can reduce the light reflection from the surface thereof and efficiently utilize the incident light.

According to one aspect of the present invention, there is provided a light-receiving member comprising a substrate and a light-receiving layer of a multi-layer structure having at least one photosensitive layer and a surface layer comprising an amorphous material containing silicon atoms and carbon atoms, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

According to another aspect of the present invention, there is provided a light-receiving member comprising a substrate; and a light-receiving layer of a multi-layer structure having a first layer comprising an amorphlus material containing silicon atoms and germanium atoms, a second layer comprising an amorphous material containing silicon atoms and exhibiting photoconductivity and a surface layer comprising an amorphous material containing silicon atoms and carbon atoms provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

BRIEF DESCRIPTION OF THE DRAWINGS

FIG. 1 is a schematic illustration of interference fringe in general;

FIG. 2 is a schematic illustration of appearance of interference fringe in the case of a multi-layer light-receiving member;

DESCRIPTION OF THE PREFERRED EMBODIMENTS

Referring now to the accompnaying drawings, the present invention is to be described in detail.

Figure 3:
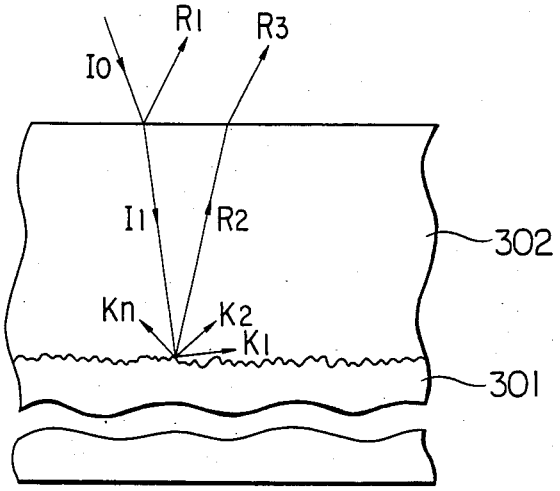
FIG. 3 is a schematic illustration of appearance of interference fringe by scattered light.
Figure 4:
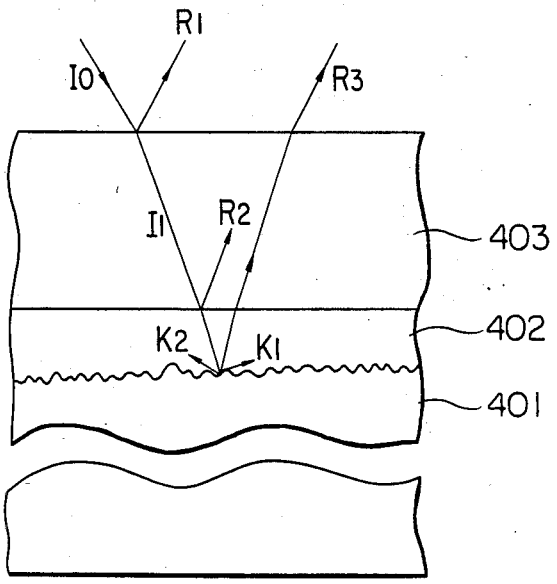
FIG. 4 is a schematic illustration of appearance of interference fringe by scattered light in the case of a multi-layer light-receiving member.
Figure 5:
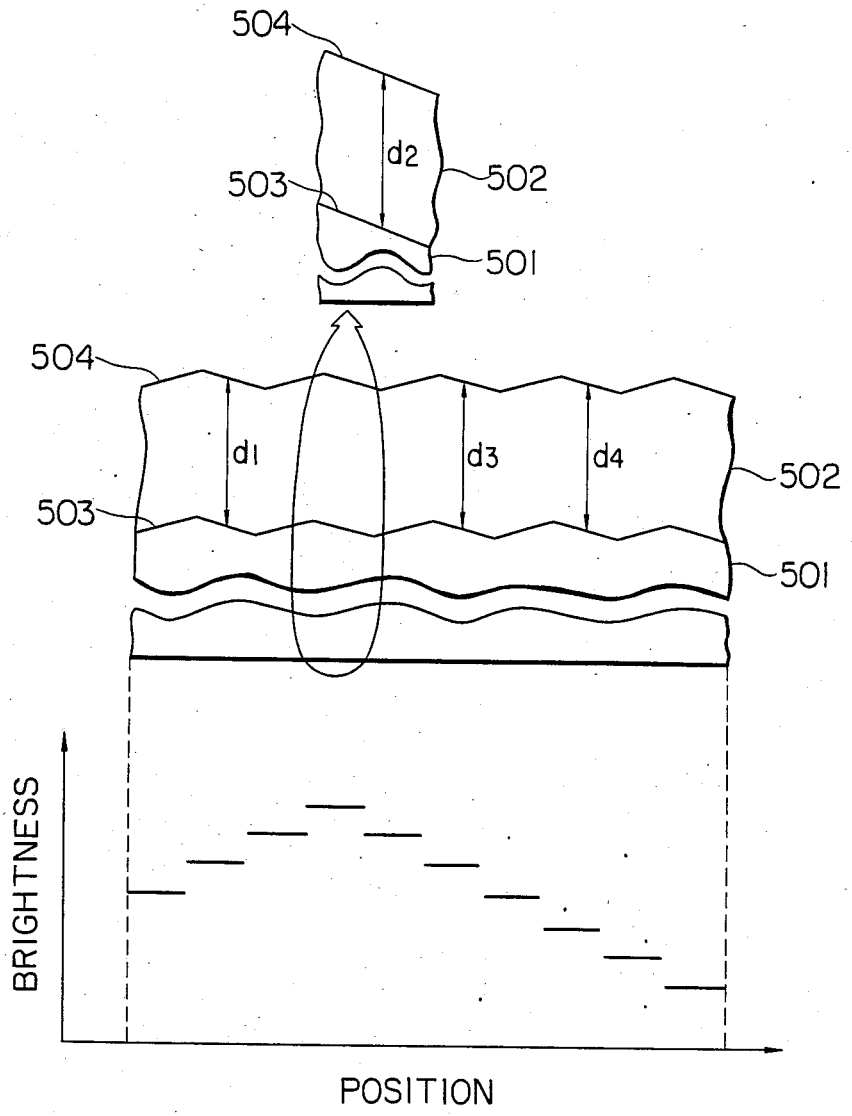
FIG. 5 is a schematic illustration of interference fringe in the case where the interfaces of respective layers of a light-receiving member are parallel to each other.
Figure 6:
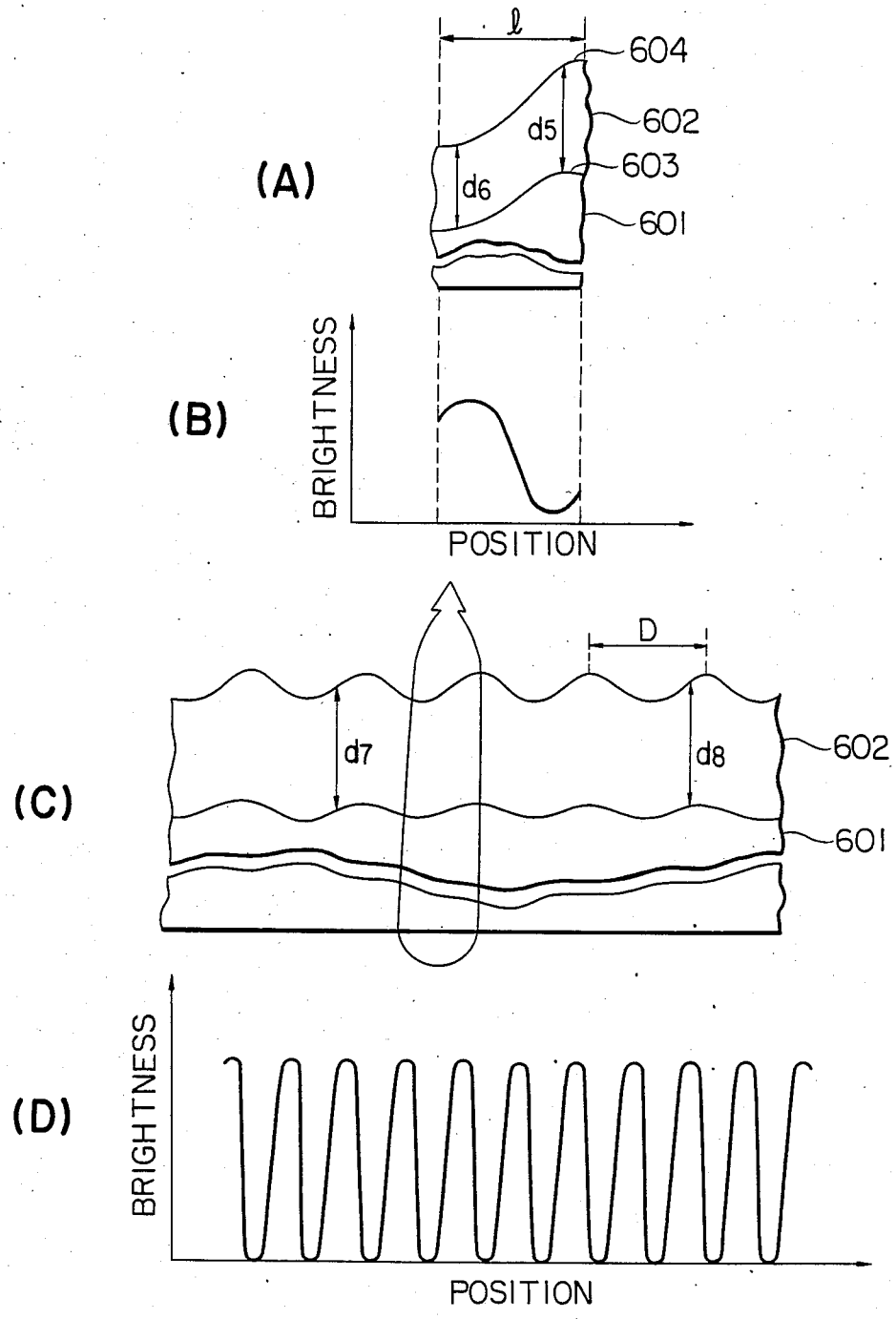
FIG. 6 is a schematic illustration about no appearance of interference fringe in the case of non-parallel interfaces between respective layers of a light-receiving member.

FIG. 6 is a schematic illustration for explanation of the basic principle of the present invention.

In the present invention, on a substrate (not shown) having a fine smooth unevenness smaller than the resolution required for the device, a light-receiving layer of a multi-layer constitution is provided along the uneven slanted plane, with the thickness of the second layer 602 being continuously changed from $d_5$ to $d_6$, as shown enlarged in a part of FIG. 6, and therefore the interface 603 and the interface 604 have respective gradients. Accordingly, the coherent light incident on this minute portion (short range region ) l [indicated schematically in FIG. 6 (C), and its enlarged view shown in FIG. 6 (A)] undergoes interference at said minute portion l to form a minute interference fringe pattern.

Figure 7:
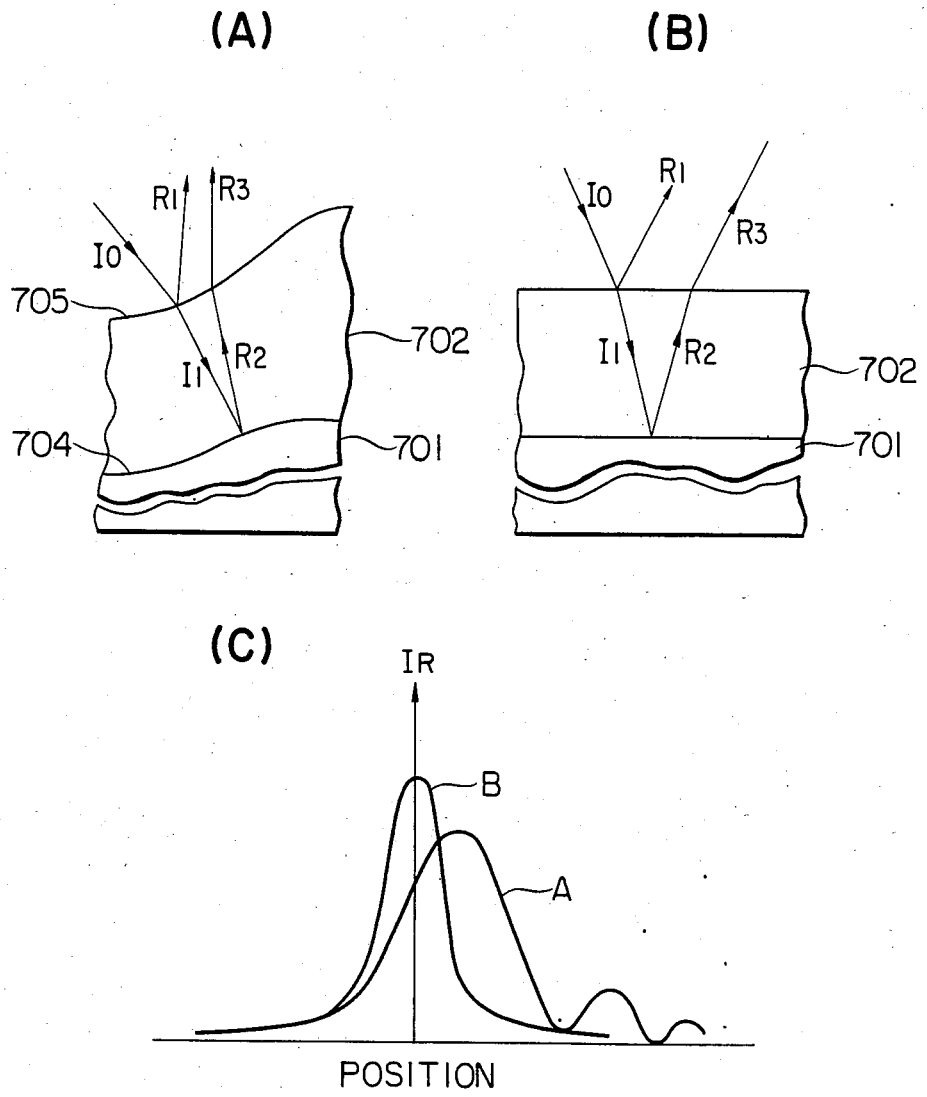
FIG. 7 is a schematic illustration of comparison of the reflected light intensity between the case of parallel interfaces and non-parallel interfaces between the respective layers of a light-receiving member.
Figure 8:
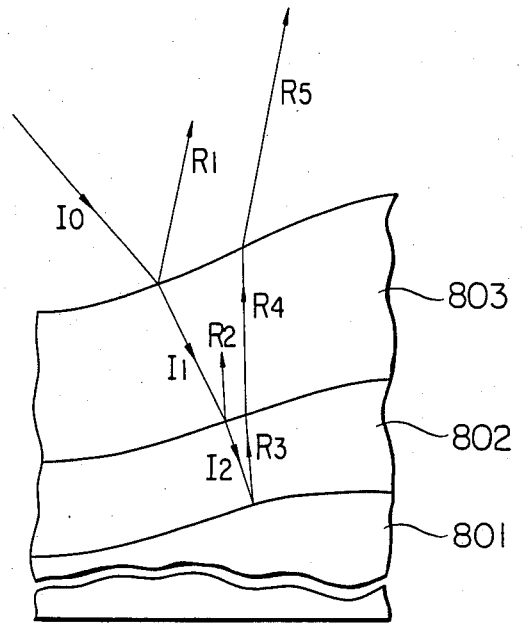
FIG. 8 is a schematic illustration of no appearance of interference fringe in the case of non-parallel interfaces between respective layers as developed.

Also, as shown in FIG. 7, when the interface 703 between the first layer 701 and the second layer 702 and the free surface 704 are non-parallel to each other, the reflected light $R_1$ and the emitted light $R_3$ are different in direction of progress from each other relative to the incident light $I_0$ as shown in FIG. 7 (A), and therefore the degree of interference will be reduced as compared with the case (FIG. 7 (B)) when the interfaces 703 and 704 are parallel to each other.

Accordingly, as shown in FIG. 7 (C), as compared with the case "(B)" where a pair of the interfaces are in parallel relation, the difference in lightness and darkness in the interference fringe pattern becomes negligibly small even if interfered, if any, in the non-parallel case "(A)".

The same is the case, as shown in FIG. 6, even when the layer thickness of the layer 602 may be macroscopically ununiform ($d_7 \neq d_8$), and therefore the incident light quantity becomes uniform all over the layer region (see FIG. 6 (D)).

To describe about the effect of the present invention when coherent light is transmitted from the irradiation side to the first layer in the case of a light-receiving layer of a multi-layer structure, reflected lights $R_1$, $R_2$, $R_3$, $R_4$ and $R_5$ exist in connection with the incident light $I_0$. Accordingly, at the respective layers, the same phenomenon as described with reference to FIG. 7 occurs.

Therefore, when considered for the light-receiving layer as a whole, interference occurs as a synergetic effect of the respective layers and, according to the present invention, appearance of interference can further be prevented as the number of layers constituting the light-receiving layer is increased.

The interference fringe occurring within the minute portion cannot appear on the image, because the size of the minute portion is smaller than the spot size of the irradiated light, namely smaller than the resolution limit. Further, even if appeared on the image, there is no problem at all, since it is less than resolving ability of the eyes.

In the present invention, the slanted plane of unevenness should desirably be mirror finished in order to direct the reflected light assuredly in one direction.

The size l (one cycle of uneven shape) of the minute portion suitable for the present invention is $l \leqq L$, wherein L is the spot size of the irradiation light.

Further, in order to accomplish more effectively the objects of the present invention, the layer thickness difference ($d_5-d_6$) at the minute portion 1 should desirably be as follows:

$d_5-d_6 \geqq \lambda/2n$ (where $\lambda$ is the wavelength of the irradiation light and n is the refractive index of the second layer 602).

In the present invention, within the layer thickness of the minute portion l (hereinafter called as "minute column") in the light-receiving layer of a multi-layer structure, the layer thicknesses of the respective layers are controlled so that at least two interfaces between layers may be in non-parallel relationship, and, provided that this condition is satisfied, any other pair of two interfaces between layers may be in parallel relationship within said minute column.

However, it is desirable that the layers forming parallel interfaces should be formed to have uniform layer thicknesses so that the difference in layer thickness at any two positions may be not more than:

$\lambda/2n$ (n: refractive index of the layer).

In formation of respective layers constituting the light-receiving layer such as the photosensitive layer, the charge injection preventive layer, the barrier layer comprised of an electrically insulating material or the first and second layers, in order to accomplish more effectively and easily the objects of the present invention, the plasma chemical vapor deposition method (PCVD method), the optical CVD method and thermal CVD method can be employed, because the layer thickness can accurately be controlled on the optical level thereby.

The smooth unevenness to be provided on the substrate surface can be formed by fixing a bite having a circular cutting blade at a predetermined position on a cutting working machine such as milling machine, lathe, etc., and cut working accurately the substrate surface by, for example, moving regularly in a certain direction while rotating a cylindrical substrate according to a program previously designed as desired, thereby forming to a desired smooth unevenness shape, pitch and depth. The sinusoidal linear projection produced by the unevenness formed by such a cutting working has a spiral structure with the center axis of the cylindrical substrate as its center.

Figure 9A:
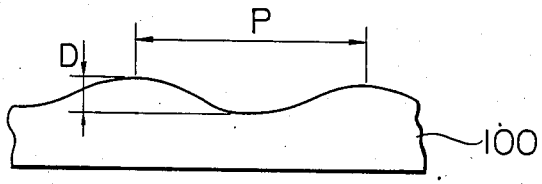
FIG. 9 is a schematic illustration of the surface state of the substrate.
Figure 9B:
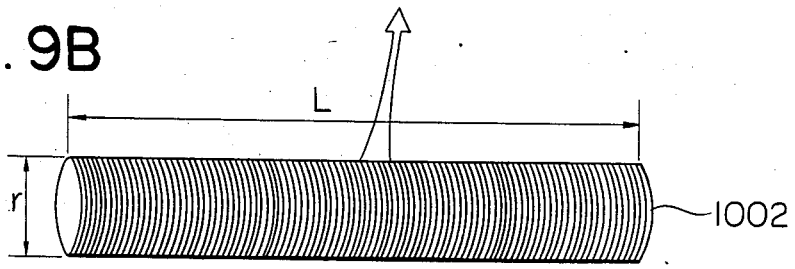

An example of such a structure is shown in FIG. 9. In FIG. 9, L is the length of the substrate, r is the diameter of the substrate, P is the spiral pitch and D is the depth of groove.

The spiral structure of the sinusoidal projection may be made into a multiple spiral structure such as double or triple structure or a crossed spital structure.

Alternatively, a straight line structure along the center axis may also be introduced in addition to the spiral structure.

In the present invention, the respective dimensions of the smooth unevenness provided on the substrate surface under managed condition are set so as to accomplish efficiently the objects of the present invention in view of the following points.

More specifically, in the first place, the A-Si layer constituting the light-receiving layer is sensitive to the structure of the surface on which the layer formation is effected, and the layer quality will be changed greatly depending on the surface condition.

Accordingly, it is necessary to set dimensions of the smooth unevenness to be provided on the substrate surface so that lowering in layer quality of the A-Si layer may not be brought about.

Secondly, when there is an extreme unevenness on the free surface of the light-receiving layer, cleaning cannot completely be performed in cleaning after image formation.

Further, in case of practicing blade cleaning, there is involved the problem that the blade will be damaged more easily.

As the result of investigations of the problems in layer deposition as described above, problems in process of electrophotography and the conditions for prevention of interference fringe pattern, it has been found that the pitch at the recessed portion on the substrate surface should preferably be 0.3 to 500 μm, more preferably 1 to 200 μm, most preferably 5 to 50 μm.

It is also desirable that the maximum depth of the smooth recessed portion should preferably be made 0.1 to 5 μm, more preferably 0.3 to 3 μm, most preferably 0.6 to 2 μm. When the pitch and the maximum depth of the recessed portions on the substrate surface are within the ranges as specified above, the gradient of the slanted plane connecting the minimum value point and the maximum value point, respectively, of the adjacent recessed portion and protruded portion may preferably be 1° to 20°, more preferably 3° to 15°, most preferably 4° to 10°.

On the other hand, the maximum of the difference in the layer thickness based on such an uniformness in layer thickness of the respective layers formed on such a substrate should preferably be made 0.1 μm to 2 μm within the same pitch, more preferably 0.1 μm to 1.5 μm, most preferably 0.2 μm to 1 μm.

The light-receiving layer in the light-receiving member of the present invention has a multi-layer structure constituted of at least one photosensitive layer comprising an amorphous material containing silicon atoms and a surface layer comprising an amorphous material containing silicon atoms and carbon atoms or a multi-layer structure having a first layer comprising an amorphous material containing silicon atoms and germanium atoms, a second layer comprising an amorphous material containing silicon atoms and exhibiting photoconductivity and a surface layer comprising an amorphous material containing silicon atoms and carbon atoms provided successively from the substrate side, and therefore can exhibit very excellent electrical, optical, photoconductive characteristics, dielectric strength and use environmental characteristics.

In particular, the light-receiving member of the present invention is free from any influence from residual potential on image formation when applied for light-receiving member for electrophotography, with its electrical characteristics being stable with high sensitivity, having a high SN ratio as well as excellent fatigue resistance and excellent repeated use characteristic and being capable of providing images of high quality of high density, clear halftone and high resolution repeatedly and stably.

Further, in the case of the light-receiving member of the present invention constituted of a first layer comprising an amorphous material containing silicon atoms and germanium atoms, a second layer comprising an amorphous material containing silicon atoms and exhibiting photoconductivity and a surface layer comprising an amorphous material containing silicon atoms and carbon atoms, it is high in photosensitivity over all the visible light region especially in the longer wave length region, and therefore particularly excellent in matching to semiconductor laser, and rapid in response to light.

Referring to the drawings, the light-receiving member of the present invention is to be described in detail below.

Figure 21:
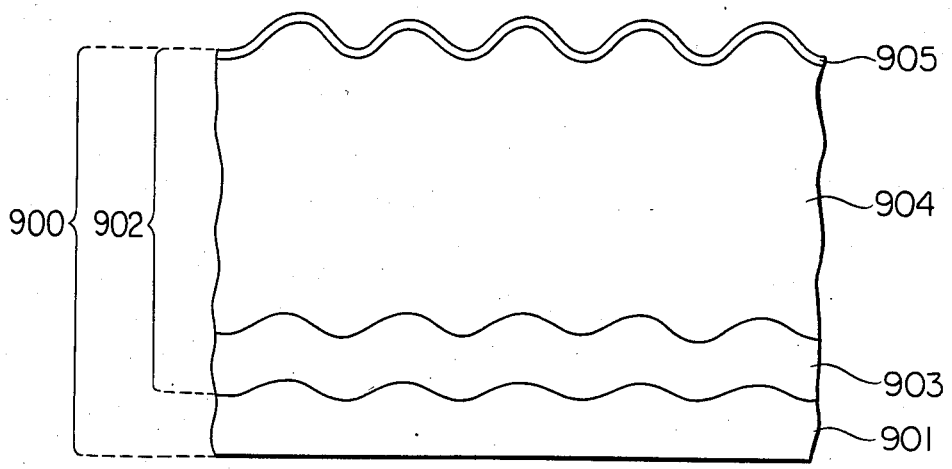

FIG. 21 is a schematic illustration of the layer structure of the light-receiving member according to the first embodiment of the present invention.

The light-receiving member 2100 shown in FIG. 21 has a light-receiving layer 2102 on a substrate 2101 which has been subjected to surface cutting working so as to achieve the objects of the invention, the light-receiving layer 2102 being constituted of a charge injection preventive layer 2103, a photosensitive layer 2104 and a surface layer 2105 from the side of the substrate 2101.

The substrate 2101 may be either electroconductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating substrates should preferably have at least one of the surfaces subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pd, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 2100 in FIG. 21 is to be used as an image forming member for electrophotography, it may desirably be formed into an endless belt or a cylinder for use in continuous copying. The substrate may have a thickness, which is conveniently determined so that a light-receiving member as desired may be formed. When the light-receiving member is required to have flexibility, the substrate is made as thin as possible, so far as the function of the substrate can be exhibited. However, in such a case, the thickness is preferablly 10μ or more from the points of fabrication and handling of the substrate as well as its mechnical strength.

The charge injection preventive layer 2103 is provided for the purpose of preventing injection of charges into the photosensitive layer 2104 from the substrate 2101 side, thereby increasing apparent resistance.

The charge injection preventive layer 2103 is constituted of A-Si containing hydrogen atoms and/or halogen atoms (X) (hereinafter written as "A-Si(H,X)") and also contains a substance (C) for controlling conductivity. As the substance (C) for controlling conductivity to be contained in the charge injection preventive layer 2103, there may be mentioned so called impurities in the field of semiconductors. In the present invention, there may be included p-type impurities giving p-type conductivity characteristics and n-type imprurities giving n-type conductivity characteristics to Si. More specifically, there may be mentioned as p-type impurities atoms belonging to the group III of the periodic table (Group III atoms), such as B (boron), Al (aluminum), Ga (gallium), In (indium), Tl (thallium), etc., particularly preferably B and Ga.

As n-type impurities, there may be included the atoms belonging to the group V of the periodic table (Group V atoms), such as P (phosphorus), As (arsenic), Sb (antimony), Bi (bismuth), etc., particularly preferably P and As.

In the present invention, the content of the substance (C) for controlling conductivity contained in the charge injection preventive layer 2103 may be suitably be selected depending on the charge injection preventing characteristic required, or when the charge injection preventive layer 2103 is provided on the substrate 2101 directly contacted therewith, the organic relationship such as relation with the characteristic at the contacted interface with the substrate 2101. Also, the content of the substance (C) for controlling conductivity is selected suitably with due considerations of the relationships with characteristics of other layer regions provided in direct contact with the above charge injection preventive layer or the characteristics at the contacted interface with said other layer regions.

In the present invention, the content of the substance (C) for controlling conductivity contained in the charge injection preventive layer 2103 should preferably be 0.001 to $5\times10^4$ atomic ppm, more preferably 0.5 to $1\times10^4$ atomic ppm, most preferably 1 to $5\times10^3$ atomic ppm.

In the present invention, by making the content of the substance (C) in the charge injection preventive layer 2103 preferably 30 atomic ppm or more, more preferably 50 atomic ppm or more, most preferably 100 atomic ppm or more, for example, in the case when the substance (C) to be incorporated is a p-type impurity mentioned above, migration of electrons injected from the substrate side into the photosensitive layer can be effectively inhibited when the free surface of the light-receiving layer is subjected to the charging treatment to ⊕ polarity. On the other hand, when the substance (C) to be incorporated is an n-type impurity as mentioned above, migration of positive holes injected from the substrate side into the photosensitive layer can be more effectively inhibited when the free surface of the light-receiving layer is subjected to the charging treatment to ⊖ polarity.

the charge injection preventive layer 2103 may have a thickness preferably of 30 Å to 10 μm, more preferably of 40 Å to 8 μm, most preferably of 50 Å to 5 μm.

The photosensitive layer 2104 is constituted of A-Si(H,X) and has both the charge generating function to generate photocarriers by irradiation with a laser beam and the charge transporting function to transport the charges.

The photosensitive layer 2104 may have a thickness preferably of 1 to 100 μm, more preferably of 1 to 80 μm, most preferably of 2 to 50 μm.

The photosensitive layer 2104 may contain a substance for controlling conductivity of the other polarity than that of the substance for controlling conductivity contained in the charge injection preventive layer 2103, or a substance for controlling conductivity of the same polarity may be contained therein in an amount by far smaller than that practically contained in the charge injection preventive layer 2103.

In such a case, the content of the substance for controlling conductivity contained in the above photosensitive layer 2104 can be determined adequately as desired depending on the polarity or the content of the substance contained in the charge injection preventive layer 2103, but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the charge injection preventive layer 2103 and the photosensitive layer 2104, the content in the photosensitive layer 2104 should preferably be 30 atomic ppm or less.

In the present invention, the amount of hydrogen atoms (H) or the amount of halogen atoms (X) or the sum of the amounts of hydrogen atoms and halogen atoms (H+X) to be contained in the charge injection preventive layer 2103 and the photosensitive layer 2104 should preferably be 1 to 40 atomic %, more preferably 5 to 30 atomic %.

As halogen atoms (X), F, Cl, Br and I may be mentioned and among them, F and Cl may preferably be employed.

In the light-receiving member shown in FIG. 21, a so called barrier layer comprising an electrically insulating material may be provided in place of the charge injection preventive layer 2103. Alternatively, it is also possible to use the barrier layer in combination with the charge injection preventive layer 2103.

As the material for forming the barrier layer, there may be included inorganic insulating materials such as $Al_2O_3$, $SiO_2$, $Si_3N_4$, etc. or organic insulating materials such as polycarbonate, etc.

Figure 10:
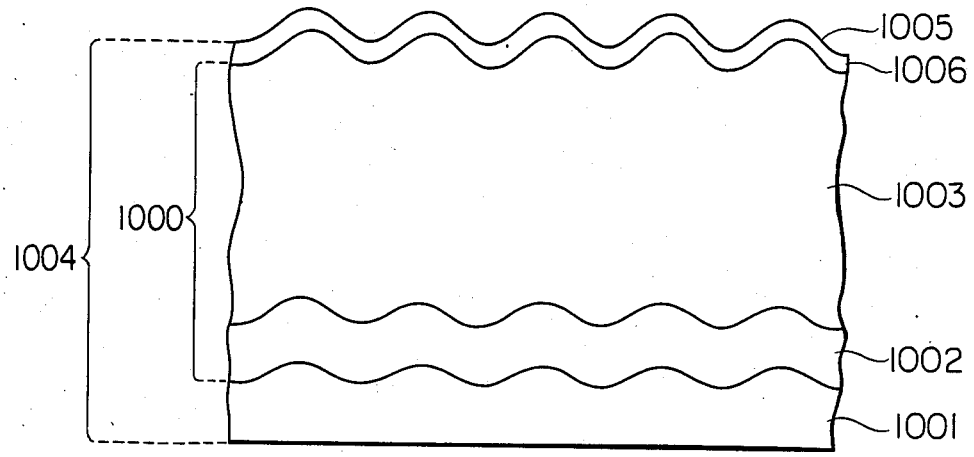
FIG. 10 and FIG. 21 each are schematic illustrations of the layer constitution of the light-receiving member.

FIG. 10 shows a schematic sectional view for illustration of the layer structure of the second embodiment of the light-receiving member of the present invention.

The light-receiving member 1004 as shown in FIG. 10 has a light-receiving layer 1000 on a substrate for light-receiving member 1001, said light-receiving layer 1000 having a free surface 1005 on one end surface.

The light-receiving layer 1000 has a layer structure constituted of a first layer (G) 1002 comprising an amorphous material containing silicon atoms and germanium atoms and, if desired, hydrogen atoms (H) and/or halogen atoms (X) (hereinafter abbreviated as "A-SiGe (H,X)"), a second layer (S) 1003 comprising A-Si containing, if desired, hydrogen atoms (H) and/or halogen atoms (X) (hereinafter abbreviated as A-Si(H,X)) and exhibiting photoconductivity and a surface layer 1005 comprising an amorphous material containing silicon atoms and carbon atoms laminated successively from the substrate 1001 side.

The germanium atoms contained in the first layer (G) 1002 may be contained so that the distribution state may be uniform within the first layer (G), or they can be contained continuously in the layer thickness direction in said first layer (G) 1002, being more enriched at the substrate 1001 side toward the side opposite to the side where said substrate 1001 is provided (the surface layer 1005 side of the light-receiving layer 1001).

When the distribution state of the germanium atoms contained in the first layer (G) is ununiform in the layer thickness direction, it is desirable that the distribution state should be made uniform in the interplanar direction in parallel to the surface of the substrate.

In the present invention, in the second layer (S) provided on the first layer (G), no germanium atoms is contained and by forming a light-receiving layer to such a layer structure, the light-receiving member obtained can be excellent in photosensitivity to the light with wavelengths of all the regions from relatively shorter wavelength to relatively longer wavelength, including visible light region.

Also, when the distribution state of germanium atoms in the first layer (G) is ununiform in the layer thickness direction, the germanium atoms are distributed continuously throughout the whole layer region while giving a change in distribution concentration C of the germanium atoms in the layer thickness direction which is decreased from the substrate toward the second layer (S), and therefore affinity between the first layer (G) and the second layer (S) is excellent. Also, as described as hereinafter, by extremely increasing the distribution concentration C of germanium atoms at the end portion on the substrate side extremely great, the light on the longer wavelength side which cannot substantially be absorbed by the second layer (S) can be absorbed in the first layer (G) substantially completely, when employing a semiconductor laser, whereby interference by reflection from the substrate surface can be prevented.

Also, in the light-receiving member of the present invention, the respective amorphous materials constituting the first layer (G) and the second layer (S) have the common constituent of silicon atoms, and therefore chemical stability can sufficiently be ensured at the laminated interface.

FIGS. 11 through 19 show typical examples of distribution in the layer thickness direction of germanium atoms contained in the first layer region (G) of the light-receiving member in the present invention.

In FIGS. 11 through 19, the abscissa indicates the content C of germanium atoms and the ordinate the layer thickness of the first layer (G), $t_B$ showing the position of the end surface of the first layer (G) on the substrate side and $t_T$ the position of the end surface of the first layer (G) on the side opposite to the substrate side. That is, layer formation of the first layer (G) containing germanium atoms proceeds from the $t_B$ side toward the $t_T$ side.

Figure 11:
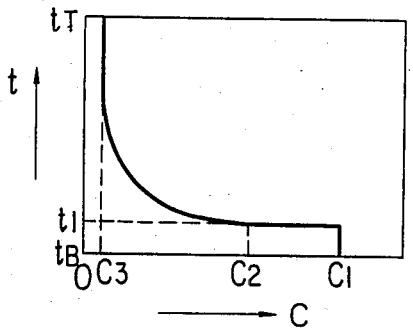
FIGS. 11 through 19 are schematic illustrations of depth profiles of germanium atoms in the first layer.

In FIG. 11, there is shown a first typical embodiment of the depth profile of germanium atoms in the layer thickness direction contained in the first layer (G).

In the embodiment as shown in FIG. 11, from the interface position $t_B$ at which the surface, on which the first layer (G) containing germanium atoms is to be formed, comes into contact with the surface of said first layer (G) to the position $t_1$, germanium atoms are contained in the first layer (G) formed, while the distribution concentration C of germanium atoms taking a constant value of $C_1$, the concentration being gradually decreased from the concentration $C_2$ continuously from the position $t_1$ to the interface position $t_T$. At the interface position $t_T$, the distribution concentration C of germanium atoms is made $C_3$.

Figure 12:
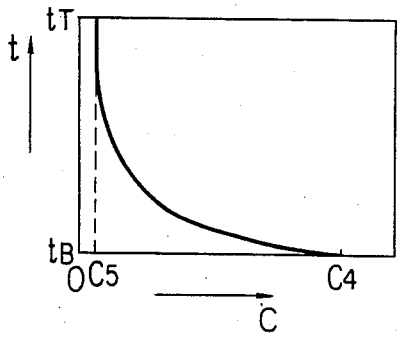

In the embodiment shown in FIG. 12, the distribution concentration C of germanium atoms contained is decreased gradually and continuously from the position $t_B$ to the position $t_T$ from the concentration $C_4$ until it becomes the concentration $C_5$ at the position $t_T$.

Figure 13:
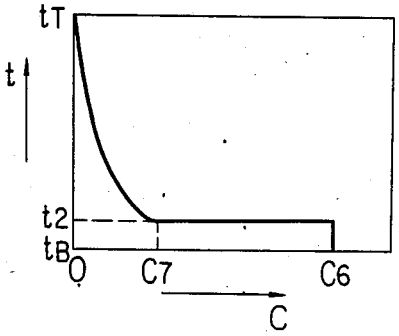

In case of FIG. 13, the distribution concentration C of germanium atoms is made constant as $C_6$ at the position $t_B$, gradually decreased continuously from the position $t_2$ to the position $t_T$, and the concentration C is made substantially zero at the position $t_T$ (substantially zero herein means the content less than the detectable limit).

Figure 14:
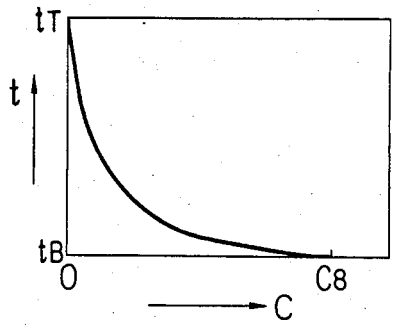

In case of FIG. 14, germanium atoms are decreased gradually and continuously from the position $t_B$ to the position $t_T$ from the concentration $C_8$, until it is made substantially zero at the position $t_T$.

Figure 15:
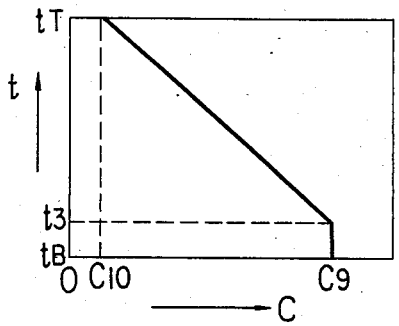

In the embodiment shown in FIG. 15, the distribution concentration C of germanium atoms is constantly $C_9$ between the position $t_B$ and the position $t_3$, and it is made $C_{10}$ at the position $t_T$. Between the position $t_3$ and the position $t_T$, the concentration C is decreased as a first order function from the position $t_3$ to the position $t_T$.

Figure 16:
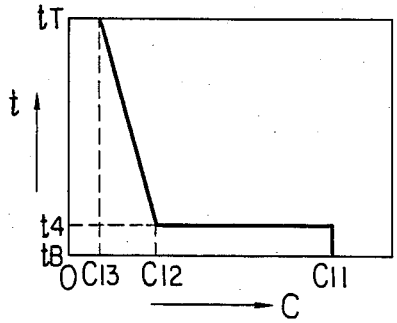

In the embodiment shown in FIG. 16, there is formed a depth profile such that the distribution concentration C takes a constant value of $C_{11}$ from the position $t_B$ to the position $t_4$, and is decreased as a first order function from the concentration $C_{12}$ to the concentration $C_{13}$ from the position $t_4$ to the position $t_T$.

Figure 17:
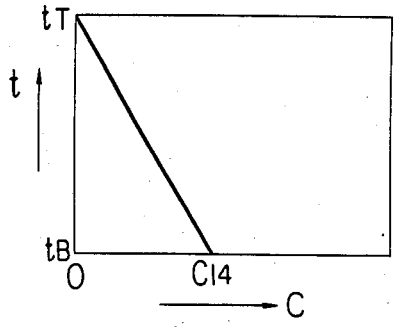

In the embodiment shown in FIG. 17, the distribution concentration C of germanium atoms is decreased as a first order function from the concentration $C_{14}$ to zero from the position $t_B$ to the position $t_T$.

Figure 18:
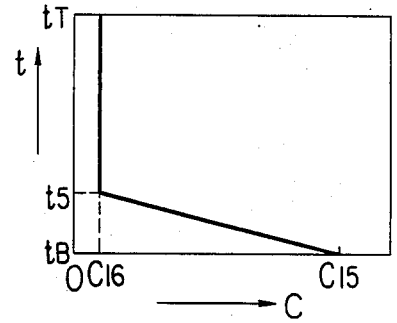

In FIG. 18, there is shown an embodiment, where the distribution concentration C of germanium atoms is decreased as a first order function from the concentration $C_{15}$ to $C_{16}$ from the position $t_B$ to $t_5$ and made constantly at the concentration $C_{16}$ between the position $t_5$ and $t_T$.

Figure 19:
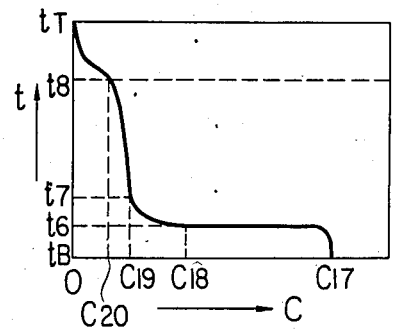

In the embodiment shown in FIG. 19, the distribution concentration C of germanium atoms is at the concentration $C_{17}$ at the position $t_B$, which concentration $C_{17}$ is initially decreased gradually and abruptly near the position $t_6$ to the position $t_6$, until it is made the concentration $C_{18}$ at the position $t_6$.

Between the position $t_6$ and the position $t_7$, the concentration is initially decreased abruptly and thereafter gradually, until it is made the concentration $C_{19}$ at the position $t_7$. Between the position $t_7$ and the position $t_8$, the concentration is decreased very gradually to the concentration $C_{20}$ at the position $t_8$. Between the position $t_8$ and the position $t_T$, the concentration is decreased along the curve having a shape as shown in the Figure from the concentration $C_{20}$ to substantially zero.

As described above about some typical examples of depth profiles of germanium atoms contained in the first layer (G) in the direction of the layer thickness by referring to FIGS. 11 through 19, when the distribution state of germanium atoms is ununiform in the layer thickness direction, the first layer (G) is provided desirably in a depth profile so as to have a portion enriched in distribution concentration C of germanium atoms on the substrate side and a portion depleted in distribution concentration C of germanium atoms considerably lower than that of the substrate side on the interface $t_T$ side.

The first layer (G) constituting the light-receiving member in the present invention is desired to have a localized region (A) containing germanium atoms at a relatively higher concentration on the substrate side as described above.

In the present invention, the localized region (A), as explained in terms of the symbols shown in FIG. 11 through FIG. 19, may be desirably provided within 5μ from the interface position $t_B$.

In the present invention, the above localized region (A) may be made to be identical with the whole of the layer region ($L_T$) on the interface position $t_B$ to the thickness of 5μ, or alternatively a part of the layer region ($L_T$).

It may suitably be determined depending on the characteristics required for the light-receiving layer to be formed, whether the localized region (A) is made a part or whole of the layer region ($L_T$).

The localized region (A) may preferably be formed according to such a layer formation that the maximum value Cmax of the concentrations of germanium atoms in a distribution in the layer thickness direction may preferably be 1000 atomic ppm or more, more preferably 5000 atomic ppm or more, most preferably $1\times10^4$ atomic ppm or more based on silicon atoms.

That is, according to the present invention, it is desirable that the layer region (G) containing germanium atoms is formed so that the maximum value Cmax of the distribution concentration C may exist within a layer thickness of 5μ from the substrate side (the layer region within 5μ thickness from $t_B$).

In the present invention, the content of germanium atoms in the first layer (G), which may suitably be determined as desired so as to acheive effectively the objects of the present invention, may preferably be 1 to $9.5\times10^5$ atomic ppm, more preferably 100 to $8\times10^5$ atomic ppm, most preferably 500 to $7\times10^5$ atomic ppm.

In the present invention, the layer thickness of the first layer (G) and the thickness of the second layer (S) are one of the important factors for accomplishing effectively the objects of the present invention, and therefore sufficient care should desirably be paid in designing of the light-receiving member so that desirable characteristics may be imparted to the light-receiving member formed.

In the present invention, the layer thickness $T_B$ of the first layer (G) may preferably be 30 Å to 50μ, more preferably 40 Å to 40μ, most preferably 50 Å to 30μ.

On the other hand, the layer thickness T of the second layer (S) may be preferably 0.5 to 90μ, more preferably 1 to 80μ, most preferably 2 to 50μ.

The sum of the above layer thicknesses T and $T_B$, namely $(T+T_B)$ may be suitably determined as desired in designing of the layers of the light-receiving member, based on the mutual organic relationship between the characteristics required for both layer regions and the characteristics required for the whole light-receiving layer.

In the light-receiving member of the present invention, the numerical range for the above $(T_B+T)$ may generally be from 1 to 100μ, preferably 1 to 80μ, most preferably 2 to 50μ.

In a more preferred embodiment of the present invention, it is preferred to select the numerical values for respective thicknesses $T_B$ and T as mentioned above so that the relation of $T_B/T \leqq 1$ may be satisfied.

In selection of the numerical values for the thicknesses $T_B$ and T in the above case, the values of $T_B$ and T should preferably be determined so that the relation $T_B/T \leqq 0.9$ most preferably. $T_B/T \leqq 0.8$, may be satisfied.

In the present invention, when the content of germanium atoms in the first layer (G) is $1\times10^5$ atomic ppm or more, the layer thickness $T_B$ should desirably be made considerably thinner, preferably 30μ or less, more preferably 25μ or less, most preferably 20μ or less.

In the present invention, illustrative of halogen atoms (X), which may optionally be incorporated in the first layer (G) and the second layer (S) constituting the light-receiving layer, are fluorine, chlorine, bormine and iodine, particularly preferably fluorine and chlorine.

In the present invention, formation of the first layer (G) constituted of A-SiGe(H,X) x-ray be conducted according to the vacuum deposition method utilizing discharging phenomenon, such as glow discharge method, sputtering method or ion-plating method. For example, for formation of the first layer (G) constituted of A-SiGe(H,X) according to the glow discharge method, the basic procedure comprises introducing a starting gas for Si supply capable of supplying silicon atoms (Si), a starting gas for Ge supply capable of supplying germanium atoms (Ge) optionally together with a starting gas for introduction of hydrogen atoms (H) and/or a starting gas for introduction of halogen atoms (X) into a deposition chamber which can be internally brought to a reduced pressure, and exciting glow discharge in said deposition chamber, thereby effecting layer formation on the surface of a substrate placed at a predetermined position while controlling the depth profile of germanium atoms according to a desired rate of change curve to form a layer constituent of A-SiGe (H,X). Alternatively, for formation according to the sputtering method, when carrying out sputtering by use of two sheets of targets of a target constituted of Si and a target constituted of Ge, or a target of a mixture of Si and Ge in an atmosphere of an inert gas such as Ar, He, etc. or a gas mixture based on these gases, a gas for introduction of hydrogen atoms (H) and/or a gas for introduction of halogen atoms (X) may be introduced, if desired, into a deposition chamber for sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred because of easiness in handling during layer formation and high efficiency for supplying Si.

As the substances which can be used as the starting gases for Ge supply, there may be effectively employed gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. In particular, $GeH_4$, $Ge_2H_6$ and $Ge_3H_8$ are preferred because of easiness in handling during layer formation and high efficiency for supplying Ge.

Effective starting gases for introduction of halogen atoms to be used in the present invention may include a large number of halogenic compounds, as exemplified preferably by halogenic gases, halides, interhalogen compounds, or gaseous or gasifiable halogenic compounds such as silane derivatives substituted with halogens.

Further, there may also be included gaseous or gasifiable hydrogenated silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the light-receiving member of the present invention is formed according to the glow discharge method by employment of such a silicon compound containing halogen atoms, it is possible to form the first layer (G) constituted of A-SiGe containing halogen atoms on a desired substrate without use of a hydrogenated silicon gas as the starting gas capable of supplying Si together with the starting gas for Ge supply.

In the case of forming the first layer (G) containing halogen atoms according to the glow discharge method, the basic procedure comprises introducing, for example, a silicon halide as the starting gas for Si supply, a hydrogenated germanium as the starting gas for Ge supply and a gas such as Ar, $H_2$, He, etc. at a predetermined mixing ratio into the deposition chamber for formation of the first layer (G) and exciting glow discharge to form a plasma atmosphere of these gases, whereby the first layer (G) can be formed on a desired substrate. In order to control the ratio of hydrogen atoms incorporated more easily, hydrogen gas or a gas of a silicon compound containing hydrogen atoms may also be mixed with these gases in a desired amount to form the layer.

Also, each gas is not restricted to a single species, but multiple species may be available at any desired ratio.

For formation of the first layer (G) comprising A-SiGe(H,X) according to the reactive sputtering method or the ion plating method, for example, in the case of the sputtering method, two sheets of a target of Si and a target of Ge or a target of Si and Ge is employed and subjected to sputtering in a desired gas plasma atmosphere. In the case of the ion-plating method, for example, a vaporizing source such as a polycrystalline silicon or a single crystalline silicon and a polycrystalline germanium or a single crystalline germanium may be placed as vaporizing source in an evaporating boat, and the vaporizing source is heated by the resistance heating method or the electron beam method (EB method) to be vaporized, and the flying vaporized product is permitted to pass through a desired gas plasma atmosphere.

In either case of the sputtering method and the ion-plating method, introduction of halogen atoms into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or hydrogenated germanium as mentioned above, may be introduced into a deposition chamber for sputtering, followed by formation of the plasma atmosphere of said gases.

In the present invention, as the starting gas for introduction of halogen atoms, the halides or halo-containing silicon compounds as mentioned above can effectively be used. Otherwise, it is also possible to use effectively as the starting material for formation of the first layer (G) gaseous or gasifiable substances, including halides containing hydrogen atom as one of the constituents, e.g. hydrogen halide such as HF, HCl, HBr, HI, etc.; halo-substituted hydrogenated silicon such as $SiH_2F_2$, $siH_2I_2$, $SiH_2Cl_2$, $SiHCl_3$, $SiH_2Br_2$, $SiHBr_3$, etc.; hydrogenated germanium halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, $GeI_4$, $GeF_2$, $GeCl_2$, $GeBr_2$, $GeI_2$, etc.

Among these substances, halides containing halogen atoms can preferably be used as the starting material for introduction of halogens, because hydrogen atoms, which are very effective for controlling electrical or photoelectric characteristics, can be introduced into the layer simultaneously with introduction of halogen atoms during formation of the first layer (G).

For introducing hydrogen atoms structurally into the first layer (G), other than those as mentioned above, $H_2$ or a hydrogenated silicon such as $SiH_4$, $Si_2H_6$, $Si_3H_8$, $Si_4H_{10}$, etc. together with germanium or a germanium compound for supplying Ge, or a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. together with silicon or a silicon compound for supplying Si can be permitted to co-exist in a deposition chamber, followed by excitation of discharging.

According to a preferred embodiment of the present invention, the amount of hydrogen atoms (H) or the amount of halogen atoms (X) or the sum of the amounts of hydrogen atoms and halogen atoms (H +X) to be contained in the first layer (G) constituting the light-receiving layer to be formed should preferably be 0.01 to 40 atomic %, more preferably 0.05 to 30 atomic %, most preferably 0.1.to 25 atomic %.

For controlling the amount of hydrogen atoms (H) and/or halogen atoms (X) to be contained in the first layer (G), for example, the substrate temperature and/or the amount of the starting materials used for incorporation of hydrogen atoms (H) or halogen atoms (X) to be introduced into the deposition device system, discharging power, etc. may be controlled.

In the present invention, for formation of the second layer (S) constituted of A-Si(H,X), the starting materials (I) for formation of the first layer (G), from which the starting materials for the starting gas for supplying Ge are omitted, are used as the starting materials (II) for formation of the second layer (S), and layer formation can be effected following the same procedure and conditions as in formation of the first layer (G).

More specifically, in the present invention, formation of the second layer region (S) constituted of a-Si(H,X) may be carried out according to the vacuum deposition method utilizing discharging phenomenon such as the glow discharge method, the sputtering method or the ion-plating method. For example, for formation of the second layer (S) constituted of A-Si(H,X) according to the glow discharge method, the basic procedure comprises introducing a starting gas for Si supply capable of supplying silicon atoms (Si) as described above, optionally together with starting gases for introduction of hydrogen atoms (H) and/or halogen atoms (X), into a deposition chamber which can be brought internally to a reduced pressure and exciting glow discharge in said deposition chamber, thereby forming a layer comprising A-Si(H,X) on a desired substrate placed at a predetermined position. Alternatively, for formation according to the sputtering method, gases for introduction of hydrogen atoms (H) and/or halogen atoms (X) may be introduced into a deposition chamber when effecting sputtering of a target constituted of Si in an inert gas such as Ar, He, etc. or a gas mixture based on these gases.

In the present invention, the amount of hydrogen atoms (H) or the amount of halogen atoms (X) or the sum of the amounts of hydrogen atoms and halogen atoms (H +X) to be contained in the second layer (S) constituting the light-receiving layer to be formed should preferably be 1 to 40 atomic %, more preferably 5 to 30 atomic %, most preferably 5 to 25 atomic %.

In the light-receiving member 1004, by incorporating a substance (C) for controlling conductivity in at least the first layer (G) 1002 and/or the second layer (S) 1003, desired conductivity characteristics can be given to the layer containing said substance (C).

In this case, the substance (C) for controlling conductivity may be contained throughout the whole layer region in the layer containing the substance (C) or contained locally in a part of the layer region of the layer containing the substance (C).

Also, in the layer region (PN) containing said substance (C), the distribution state of said substance (C) in the layer thickness direction may be either uniform or nonuniform, but desirably be made uniform within the plane in parallel to the substrate surface. When the distribution state of the substance (C) is nonuniform in the layer thickness direction, and when the substance (C) is to be incorporated in the whole layer region of the first layer (G), said substance (C) is contained in the first layer (G) so that it may be more enriched on the substrate side of the first layer (G).

Thus, in the layer region (PN), when the distribution concentration in the layer thickness direction of the above substance (C) is made nonuniform, optical and electrical junction at the contacted interface with other layers can further be improved.

In the present invention, when the substance (C) for controlling conductivity is incorporated in the first layer (G) so as to be locally present in a part of the layer region, the layer region (PN) in which the substance (C) is to be contained is provided as an end portion layer region of the first layer (G), which is to be determined case by case suitably as desired depending on.

In the present invention, when the above substance (C) is to be incorporated in the second layer (S), it is desirable to incorporate the substance (C) in the layer region including at least the contacted interface with the first layer (G).

When the substance (C) for controlling conductivity is to be incorporated in both the first layer (G) and the second layer (S), it is desirable that the layer region containing the substance (C) in the first layer (G) and the layer region containing the substance (C) in the second layer (S) may contact each other.

Also, the above substance (C) contained in the first layer (G) may be either the same as or different from that contained in the second layer (S), and their contents may be either the same or different.

However, in the present invention, when the above substance (C) is of the same kind in the both layers, it is preferred to make the content in the first layer (G) sufficiently greater, or alternatively to incorporate substances (C) with different electrical characteristics in respective layers desired.

In the present invention; by incorporating a substance (C) for controlling conductivity in at least the first layer (G) and/or the second layer (S) constituting the light-receiving layer, conductivity of the layer region containing the substance (C) [which may be either a part or the whole of the layer region of the first layer (G) and/or the second layer (S)]can be controlled as desired. As a substance (C) for controlling conductivity characteristics, there may be mentioned so called impurities in the field of semiconductors. In the present invention, there may be included p-type impurities giving p-type condutivity characteristics and n-type impurities and/or giving n-type conductivity characteristics to A-Si(H,X) and/or A-SiGe(H,X) constituting the light receiving layer to be formed.

More specifically, there may be mentioned as p-type impurities atoms belonging to the group III of the periodic table (Group III atoms), such as B (boron), Al(aluminum), Ga(gallium), In(indium), Tl(thallium), etc., particularly preferably B and Ga.

As n-type impurities, there may be included the atoms belonging to the group V of the periodic table, such as P (phosphorus), As (arsenic), Sb (antimony), Bi (bismuth), etc., particularly preferably P and As.

In the present invention, the content of the substance (C) for controlling conductivity in the layer region (PN) may be suitably be determined depending on the conductivity required for said layer region (PN), or when said layer region (PN) is provided in direct contact with the substrate, the organic relationships such as relation with the characteristics at the contacted interface with the substrate, etc.

Also, the content of the substance (C) for controlling conductivity is determined suitably with due considerations of the relationships with characteristics of other layer regions provided in direct contact with said layer region or the characteristics at the contacted interface with said other layer regions.

In the present invention, the content of the substance (C) for controlling conductivity contained in the layer region (PN) should preferably be 0.01 to $5\times10^4$ atomic ppm, more preferably 0.5 to $1\times10^4$ atomic ppm, most preferably 1 to $5\times10^3$ atomic ppm.

In the present invention, by making the content of said substance (C) in the layer region (PN) preferably 30 atomic ppm or more, more preferably 50 atomic ppm or more, most preferably 100 atomic ppm or more, for example, in the case when said substance (C) to be incorporated is a p-type impurity as mentioned above, migration of electrons injected from the substrate side into the light-receiving layer can be effectively inhibited when the free surface of the light-receiving layer is subjected to the charging treatment to ⊕ polarity. On the other hand, when the substance to be incorporated is a n-type impurity, migration of positive holes injected from the substrate side into the light-receiving layer may be effectively inhibited when the free surface of the light-receiving layer is subjected to the charging treatment to ⊖ polarity.

In the case as mentioned above, the layer region (Z) at the portion excluding the above layer region (PN) under the basic constitution of the present invention as described above may contain a substance for controlling conductivity of the other polarity, or a substance for controlling conductivity having characteristics of the same polarity may be contained therein in an amount by far smaller than that practically contained in the layer region (PN).

In such a case, the content of the substance (C) for controlling conductivity contained in the above layer region (Z) can be determined adequately as desired depending on the polarity or the content of the substance contained in the layer region (PN), but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the layer region (PN) and the layer region (Z), the content in the layer region (Z) should preferably be 30 atomic ppm or less.

In the present invention, it is also possible to provide a layer region containing a substance for controlling conductivity having one polarity and a layer region containing a substance for controlling conductivity having the other polarity in direct contact with each other, thus providing a so called depletion layer at said contact region.

In short, for example, a layer containing the aforesaid p-type impurity and a layer region containing the aforesaid n-type impurity are provided in the light-receiving layer in direct contact with each other to form the so called p-n junction, whereby a depletion layer can be provided.

FIGS. 27 through 35 show typical examples of the depth profiles in the layer thickness direction of the substance (C) contained in the layer region (PN) in the light-receiving layer of the present invention. In each of these Figures, representations of layer thickness and concentration are shown in rather exaggerated forms for illustrative purpose, since the difference between respective Figures will be indistinct if represented by the real values as such, and it should be understood that these Figures are schematic in nature. As practical distribution, the values of ti ($1 \leqq i \leqq 9$) or Ci ($1 \leqq i \leqq 17$) should be chosen so as to obtain desired distribution concentration lines, or values obtained by multiplying the distribution curve as a whole with an appropriate coefficient should be used.

In FIGS. 27 through 35, the abscissa shows the distribution concentration C of the substance (C), and the ordinate the layer thickness of the layer region (PN), $t_B$ indicating the position of the end surface on the substrate side of the layer region (G) and $t_T$ the position of the end surface on the side opposite to the substrate side. Thus, layer formation of the layer region (PN) containing the substance (C) proceeds from the $t_B$ side toward the $t_T$ side.

Figure 27:
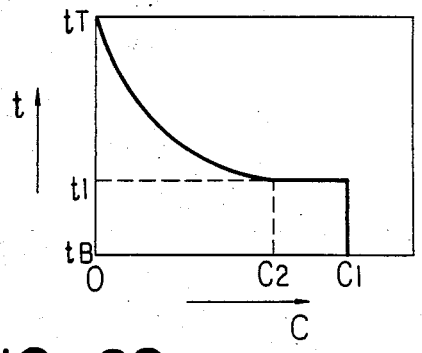
FIGS. 27 through 35 are schematic illustrations of depth profiles of the substance (C) in the layer region (PN)

FIG. 27 shows a first typical example of the depth profile of the substance (C) in the layer thickness direction contained in the layer region (PN).

In the embodiment shown in FIG. 27, from the interface position $t_B$ where the surface at which the layer region (PN) containing the substance (C) contacts the surface of said layer (G) to the position $t_1$, the substance (C) is contained in the layer region (PN) formed while the distribution concentration C of the substance (C) taking a constant value of $C_1$, and the concentration is gradually decreased from the concentration $C_2$ continuously from the position $t_1$ to the interface position $t_T$. At the interface position $t_T$, the distribution concentration C of the substance (C) is made substantially zero (here substantially zero means the case of less than detectable limit).

Figure 28:
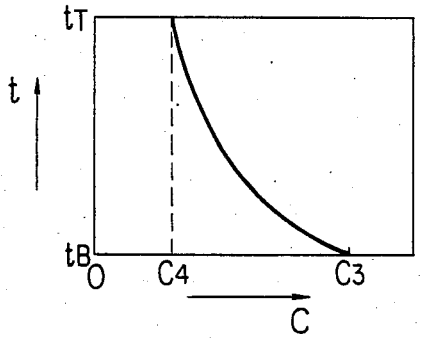

In the embodiment shown in FIG. 28, the distribution concentration C of the substance (C) contained is decreased from the position $t_B$ to the position $t_T$. gradually and continuously from the concentration $C_3$ to the concentration $C_4$ at $t_T$.

Figure 29:
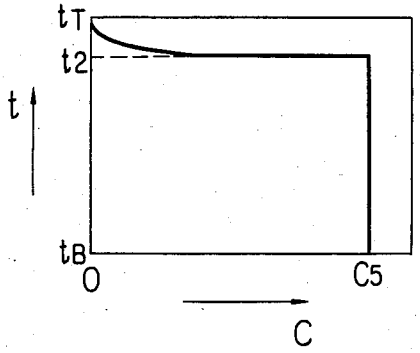

In the case of FIG. 29, from the position $t_B$ to the position $t_2$, the distribution concentration C of the substance (C) is made constantly at $C_5$, while between the position $t_2$ and the position $t_T$, it is gradually and continuously decreased, until the distribution concentration is made substantially zero at the position $t_T$.

Figure 30:
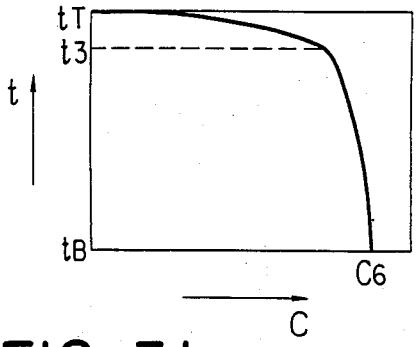

In the case of FIG. 30, the distribution concentration C of the substance (C) is first decreased continuously and gradually from the concentration $C_6$ from the position $t_B$ to the position $t_3$, from where it is abruptly decreased to substantially zero at the position $t_T$.

Figure 31:
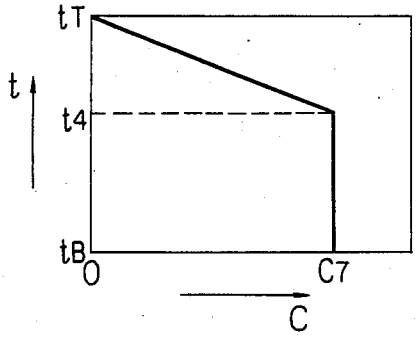

In the embodiment shown in FIG. 31, the distribution concentration of the substance (C) is constantly $C_7$ between the position $t_B$ and the position $t_T$, and the distribution concentration is made zero at the position $t_T$. Between the $t_4$ and the position $t_T$, the distribution concentration C is decreased as a first order function from the position $t_4$ to the position $t_T$.

Figure 32:
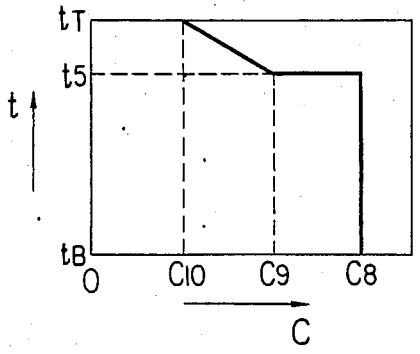

In the embodiment shown in FIG. 32, the distribution concentration C takes a constant value of $C_8$ from the position $t_B$ to the position $t_5$, while it was decreased as a first order function from the concentration $C_9$ to the concentration $C_{10}$ from the position $t_5$ to the position $t_T$.

Figure 33:
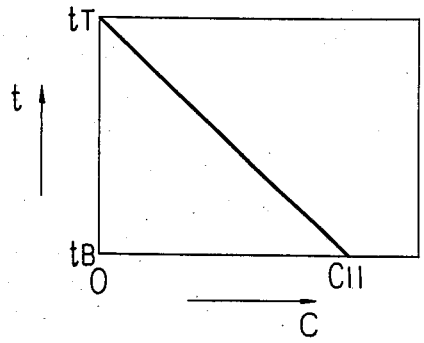

In the embodiment shown in FIG. 33, from the position $t_B$ to the position $t_T$, the distribution concentration C of the substance (C) is decreased continuously as a first order function from the concentration $C_{11}$ to zero.

Figure 34:
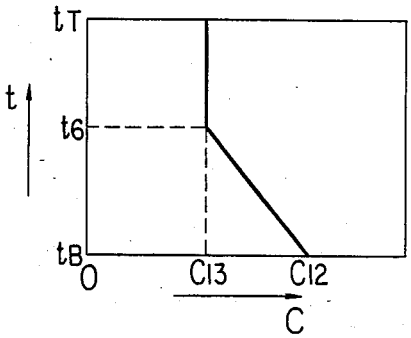

In FIG. 34, there is shown an embodiment, in which, from the position $t_B$ to the position $t_6$, the distribution concentration C of the substance C is decreased as a first order function from the concentration $C_{12}$ to the concentration $C_{13}$, and the concentration is made a constant value of $C_{13}$ between the position $t_6$ and the position $t_T$.

Figure 35:
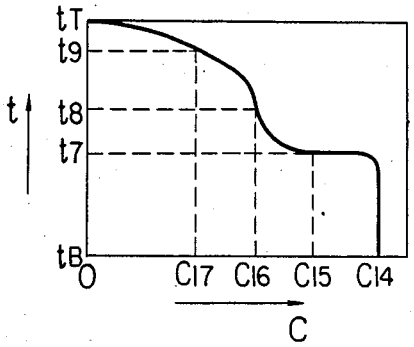

In the embodiment shown in FIG. 35, the distribution concentration C of the substance (C) is $C_{14}$ at the position $t_B$, which is gradually decreased initially from $C_{14}$ and then abruptly near the position $t_7$, where it is made $C_{15}$ at the position $t_7$.

Between the position $t_7$ and the position $t_8$, the concentration is initially abruptly decreased and then moderately gradually, until it becomes $C_{16}$ at the position $t_8$, and between the position $t_8$ and the position $t_9$, the concentration is gradually decreased to reach $C_{17}$ at the position $t_9$. Between the position $t_9$ and the position $t_T$, the concentration is decreased from $C_{17}$, following the curve with a shape as shown in Figure, to substantially zero.

As described above by referring to some typical examples of depth profiles in the layer thickness direction of the substance (C) contained in the layer region (PN) shown FIGS. 27 through 35, it is desirable in the present invention that a depth profile of the substance (C) should be provided in the layer region (PN) so as to have a portion with relatively higher distribution concentration C of the substance (C) on the substrate side, while having a portion on the interface $t_T$ side where said distribution concentration is made considerably lower as compared with the substrate side.

The layer region (PN) constituting the light-receiving member in the present invention is desired to have a localized region (B) containing the substance (C) preferably at a relatively higher concentration on the substrate side as described above.

In the present invention, the localized region (B) as explained in terms of the symbols shown in FIGS. 27 through 35, may be desirably provided within 5μ from the interface position $t_B$.

In the present invention, the above localized region (B) may be made to be identical with the whole of the layer region (L) from the interface position $t_B$ to the thickness of 5μ, or alternatively a part of the layer region (L).

It may suitably be determined depending on the characteristics required for the light-receiving layer to be formed whether the localized region (B) should be made a part or the whole of the layer region (L).

For formation of the layer region (PN) containing the aforesaid substance (C) by incorporating a substance (C) for controlling conductivity such as the group III atoms or the group V atoms structurally into the light-receiving layer, a starting material for introduction of the group III atoms or a starting material for introduction of the group V atoms may be introduced under gaseous state into a deposition chamber together with other starting materials for formation of the respective layers during layer formation.

As the starting material which can be used for introduction of the group III atoms, it is desirable to use those which are gaseous at room temperature under atmospheric pressure or can readily be gasified under layer forming conditions. Typical examples of such starting materials for introduction of the group III atoms, there may be included as the compounds for introduction of boron atoms boron hydrides such as $B_2H_6$, $B_4H_{10}$, $B_5H_9$, $B_5H_{11}$, $B_6H_{10}$, $B_6H_{12}$, $B_6H_{14}$, etc and boron halides such as $BF_3$, $BCl_3$, $BBr_3$, etc. Otherwise, it is also possible to use $AlCl_3$, $GaCl_3$, $Ga(CH_3)_3$, $InCl_3$, $TlCl_3$ and the like.

The starting materials which can effectively be used in the present invention for introduction of the group V atoms may include, for introduction of phosphorus atoms, phosphorus hydrides such as $PH_3$, $P_2H_4$, etc., phosphorus halides such as $PH_4I$, $PF_3$, $PF_5$, $PCl_3$, $PCl_5$, $PBr_3$, $PBr_5$, $PI_3$ and the like. Otherwise, it is possible to utilize $AsH_3$, $AsF_3$, $AsCl_3$, $AsBr_3$, $AsF_5$, $SbH_3$, $SbF_3$, $SbF_5$, $SbCl_3$, $SbCl_5$, SbCl, $BiH_3$, $BiCl_3$, $BiBr_3$ and the like effectively as the starting material for introduction of the group V atoms.

In the light-receiving member of the present invention, for the purpose of obtaining higher photosensitivity and dark resistance, and further for the purpose of improving adhesion between the substrate and the light-receiving layer, at least one kind of atoms selected from oxygen atoms and nitrogen atoms can be contained in the light-receiving layer in either uniform or ununiform distribution state in the layer thickness direction. Such atoms (ON) to be contained in the light-receiving layer may be contained therein throughout the whole layer region of the light-receiving layer or localized by being contained in a part of the layer region of the light-receiving layer.

The distribution concentration C (O N) of the atoms (O N) should desirably be uniform within the plane parallel to the surface of the substrate.

In the present invention, the layer region (O N) where atoms (O N) are contained is provided so as to occupy the whole layer region of the light-receiving layer when it is primarily intended to improve photosensitivity and dark resistance, while it is provided so as to occupy the end portion layer region on the substrate side of the light-receving layer when it is primarily intended to strengthen adhesion between the substrate and the light-receiving layer.

In the former case, the content of atoms (O N) contained in the layer region (O N) should desirably be made relatively smaller in order to maintain high photosensitivity, while in the latter case relatively larger in order to ensure reinforcement of adhesion to the substrate.

In the present invention, the content of the atoms (O N) to be contained in the layer region (O N) provided in the light-receiving layer can be selected suitably in organic relationship with the characteristics required for the layer region (O N) itself, or with the characteristic at the contacted interface with the substrate when the said layer region (O N) is provided in direct contact with the substrate, etc.

When other layer regions are to be provided in direct contact with the layer region (O N), the content of the atoms (O N) may suitably be selected with due considerations about the characteristics of said other layer regions or the characteristics at the contacted interface with said other layer regions.

The amount of the atoms (O N) contained in the layer region (O N) may be determined as desired depending on the characteristics required for the light-receiving member to be formed, but it may preferably be 0.001 to 50 atomic %, more preferably 0.002 to 40 atomic %, most preferably 0.003 to 30 atomic %.

In the present invention, when the layer region (O N) occupies the whole region of the light-receiving layer or, although not occupying the whole region, the proportion of the layer thickness $T_O$ of the layer region (O N) occupied in the layer thickness T of the light-receiving layer is sufficiently large, the upper limit of the content of the atoms (O N) contained in the layer region (O N) should desirably be made sufficiently smaller than the value as specified above.

In the case of the present invention, when the proportion of the layer thickness $T_O$ of the layer region (O N) occupied relative to the layer thickness T of the light-receiving layer is 2/5 or higher, the upper limit of the atoms (O N) contained in the layer region (O N) should desirably be made 30 atomic % or less, more preferably 20 atomic % or less, most preferably 10 atomic % or less.

According to a preferred embodiment of the present invention, it is desirable that the atoms (O N) should be contained in at least the above first layer to be provided directly on the substrate. In short, by incorporating the atoms (O N) at the end portion layer region on the substrate side in the light-receiving layer, it is possible to effect reinforcement of adhesion between the substrate and the light-receiving layer.

Further, in the case of nitrogen atoms, for example, under the co-presence with boron atoms, improvement of dark resistance and improvement of photosensitivity can further be ensured, and therefore they should preferably be contained in a desired amount in the light-receiving layer.

Plural kinds of these atoms (O N) may also be contained in the light-receiving layer. For example, oxygen atoms may be contained in the first layer, nitrogen atoms in the second layer, or alternatively oxygen atoms and nitrogen atoms may be permitted to be co-present in the same layer region.

FIGS. 43 through 51 show typical examples of ununiform depth profiles in the layer thickness direction of the atoms (O N) contained in the layer region (O N) in the light-receiving member of the present invention.

In FIGS. 43 through 51, the abscissa indicates the distribution concentration C of the atoms (O N), and the ordinate the layer thickness of the layer region (O N), $t_B$ showing the position of the end surface of the layer region on the substrate side, while $t_T$ shows the position of the end face of the layer region (O N) opposite to the substrate side. Thus, layer formation of the layer region (O N) containing the atoms (O N) proceeds from the $t_B$ side toward the $t_T$ side.

Figure 43:
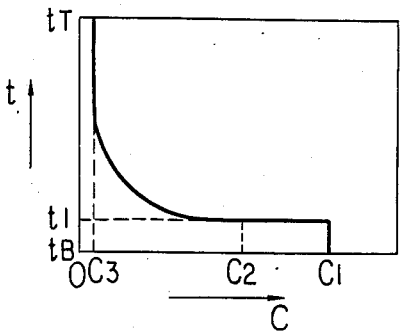
FIGS. 43 through 51 are each schematic illustrations of the depth profile of the atoms (ON) in the layer region (ON)

FIG. 43 shows a first typical embodiment of the depth profile in the layer thickness direction of the atoms (O N) contained in the layer region (O N).

In the embodiment shown in FIG. 43, from the interface position $t_B$ where the surface on which the layer region (O N) containing the atoms (O N) is formed contacts the surface of said layer region (O N) to the position of $t_1$, the atoms (O N) are contained in the layer region (O N) to be formed while the distribution concentration of the atoms (O N) taking a constant value of $C_1$, said distribution concentration being gradually continuously reduced from $C_2$ from the position $t_1$ to the interface position $t_T$, until at the interface position $t_T$, the distribution concentration C is made $C_3$.

Figure 44:
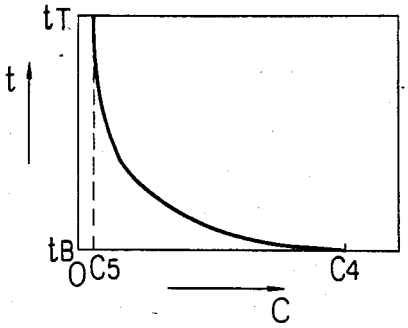

In the embodiment shown in FIG. 44, the distribution concentration C of the atoms (O N) contained is reduced gradually continuously from the concentration $C_4$ from the position $t_B$ to the position $t_T$, at which it becomes the concentration $C_5$.

Figure 45:
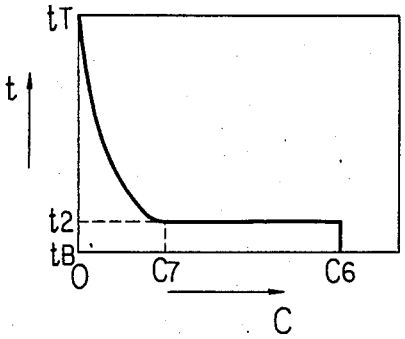

In the case of FIG. 45, from the position $t_B$ to the position $t_2$, the distribution concentration of the atoms (O N) is made constantly at $C_6$, reduced gradually continuously from the concentration $C_7$ between the position $t_2$ and the position $t_T$, until at the position $t_T$, the distribution concentration C is made substantially zero (here substantially zero means the case of less than the detectable level).

Figure 46:
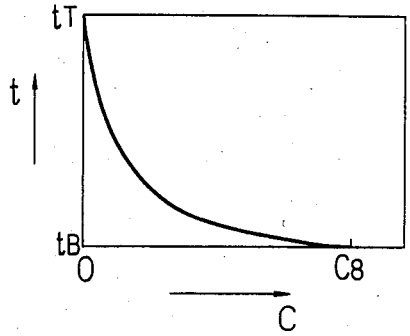

In the case of FIG. 46, the distribution concentration C of the atoms (O N) is reduced gradually continuously from the concentration $C_8$ from the position $t_B$ up to the position $t_T$, to be made substantially zero at the position $t_T$.

Figure 47:
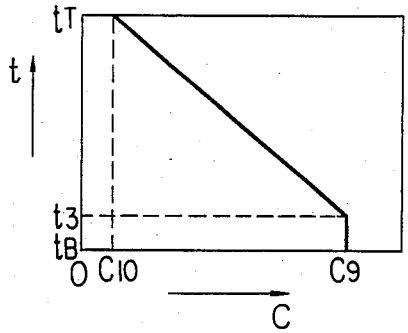

In the embodiment shown in FIG. 47, the distribution concentration C of the atoms (O N) is made constantly $C_9$ between the position $t_B$ and the position $t_3$, and it is made the concentration $C_{10}$ at the position $t_T$. Between the position $t_3$ and the position $t_T$, the distribution concentration C is reduced from the concentration $C_9$ to substantially zero as a first order function from the position $t_3$ to the position $t_T$.

Figure 48:
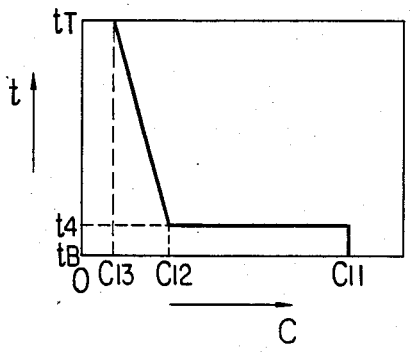

In the embodiment shown in FIG. 48, from the position $t_B$ to the position $t_4$, the distribution concentration C takes a constant value of $C_{11}$, while the distribution state is changed to a first order function in which the concentration is decreased from the concentration $C_{12}$ to the concentration $C_{13}$ from the position $t_4$ to the position $t_T$, and the concentration C is made substantially zero at the position $t_T$.

Figure 49:
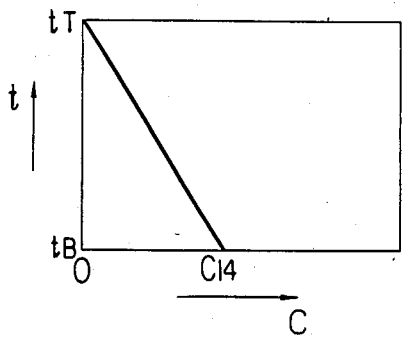

In the embodiment shown in FIG. 49, from the position $t_B$ to the position $t_T$, the distribution concentration C of the atoms (O N) is reduced as a first order function from the concentration $C_{14}$ to substantially zero.

Figure 50:
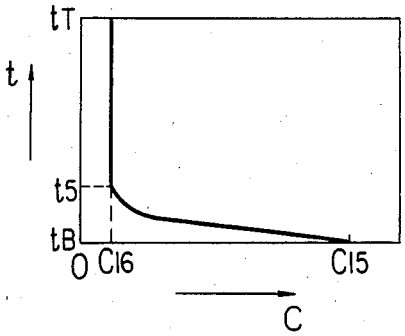

In FIG. 50, there is shown an embodiment, wherein from the position $t_B$ to the position $t_5$, the distribution concentration of the atoms (O N) is reduced approximately as a first order function from the concentration $C_{15}$ to $C_{16}$, and it is made constantly $C_{16}$ between the position $t_5$ and the position $t_T$.

Figure 51:
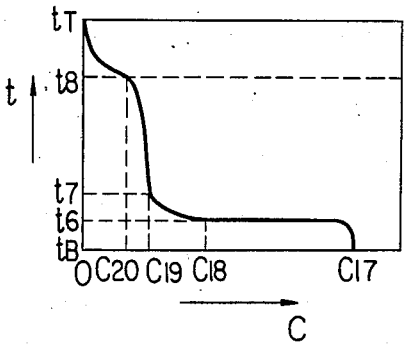

In the embodiment shown in FIG. 51, the distribution concentration C of the atoms (O N) is $C_{17}$ at the position $t_B$, and, toward the position $t_6$, this $C_{17}$ is initially reduced gradually and then abruptly reduced near the position $t_6$, until it is made the concentration $C_{18}$ at the position $t_6$.

Between the position $t_6$ and the position $t_7$, the concentration is initially reduced abruptly and thereafter gently gradually reduced to become $C_{19}$ at the position $t_7$, and between the position $t_7$ and the position $t_8$, it is reduced very gradually to become $C_{20}$ at the position $t_8$. Between the position $t_8$ and the position $t_T$, the concentration is reduced from the concentration $C_{20}$ to substantially zero along a curve with a shape as shown in the Figure.

As described above about some typical examples of depth profiles in the layer thickness direction of the atoms (O N) contained in the layer region (O N) by referring to FIGS. 43 through 51, it is desirable in the present invention that, when the atoms (O N) are to be contained ununiformly in the layer region (O N), the atoms (O N) should be distributed in the layer region (O N) with higher concentration on the substrate side, while having a portion considerably depleted in concentration on the interface $t_T$ side as compared with the substrate side.

The layer region (O N) containing atoms (O N) should desirably be provided so as to have a localized region (B) containing the atoms (O N) at a relatively higher concentration on the substrate side as described above, and in this case, adhesion between the substrate and the light-receiving layer can be further improved.

The above localized region (B) should desirably be provided within 5μ from the interface position $t_B$, as explained in terms of the symbols indicated in FIGS. 43 through 51.

In the present invention, the above localized region (B) may be made the whole of the layer region ($L_T$) from the interface position $t_B$ to 5μ thickness or a part of the layer region ($L_T$).

It may suitably be determined depending on the characteristics required for the light-receiving layer to be formed whether the localized region (B) is made a part or the whole of the layer region ($L_T$).

The localized region (B) should preferably be formed to have a depth profile in the layer thickness direction such that the maximum value Cmax of the distribution concentration of the atoms (O N) may preferably be 500 atomic ppm or more, more preferably 800 atomic ppm or more, most preferably 1000 atomic ppm or more.

In other words, in the present invention, the layer region (O N) containing the atoms (O N) should preferably be formed so that the maximum value Cmax of the distribution concentration C may exist within 5μ layer thickness from the substrate side (in the layer region with 5μ thickness from $t_B$).

In the present invention, when the layer region (O N) is provided so as to occupy a part of the layer region of the light-receiving layer, the depth profile of the atoms (O N) should desirably be formed so that the refractive index may be changed moderately at the interface between the layer region (O N) and other layer regions.

By doing so, reflection of the light incident upon the light-receiving layer from the interface between contacted interfaces can be inhibited, whereby appearance of interference fringe pattern can more effectively be prevented.

It is also preferred that the distribution concentration C of the atoms (O N) in the layer region (O N) should be changed along a line which is changed continuously and moderately, in order to give smooth refractive index change.

In this regard, it is preferred that the atoms (O N) should be contained in the layer region (O N) so that the depth profiles as shown, for example, in FIGS. 43 through 46, FIG. 49 and FIG. 51 may be assumed.

In the present invention, for provision of a layer region (O N) containing the atoms (O N) in the light-receiving layer, a starting material for introduction of the atoms (O N) may be used together with the starting material for formation of the light-receiving layer during formation of the light-receiving layer and incorporated in the layer formed while controlling its amount.

When the glow discharge method is employed for formation of the layer region (O N), a starting material for introduction of the atoms (O N) is added to the material selected as desired from the starting materials for formation of the light-receiving layer as described above. For such a starting material for introduction of the atoms (O N), there may be employed most of gaseous or gasified gasifiable substances containing at least the atoms (O N) as the constituent atoms.

More specifically, there may be included, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$); lower siloxanes containing silicon atom (Si), oxygen atom (O) and hydrogen atom (H) as constituent atoms, such as disiloxane ($H_3SiOSiH_3$), trisiloxane ($H_3SiOSiH_2OSiH_3$), and the like; nitrogen ($N_2$), ammonia ($NH_3$), hydrazine ($H_2NNH_2$), hydrogen azide ($HN_3$), ammonium azide ($NH_4N_3$), nitrogen trifluoride ($F_3N$), nitrogen tetrafluoride ($F_4N$) and so on.

In the case of the sputtering method, as the starting material for introduction of the atoms (O N), there may also be employed solid starting xaterials such as $SiO_2$, $Si_3N_4$ and carbon black in addition to those gasifiable as enumerated for the glow discharge method. These can be used in the form of a target for sputtering together with the target of Si, etc.

In the present invention, when forming a layer region (O N) containing the atoms (O N) during formation of the light-receiving layer, formation of the layer region (O N) having a desired depth profile in the direction of layer thickness formed by varying the distribution concentration C of the atoms (O N) contained in said layer region (O N) may be conducted in the case of glow discharge by introducing a starting gas for introduction of the atoms (O N) the distribution concentration C of which is to be varied into a deposition chamber, while varying suitably its gas flow rate according to a desired change rate curve.

For example, by the manual method or any other method conventionally used such as an externally driven motor, etc., the opening of a certain needle valve provided in the course of the gas flow channel system may be gradually varied. During this operation, the rate of variation is not necessarily required to be linear, but the flow rate may be controlled according to a variation rate curve previously designed by means of, for example, a microcomputer to give a desired content curve.

When the layer region (O N) is formed according to the sputtering method, formation of a desired depth profile of the atoms (O N) in the layer thickness direction by varying the distribution concentration C of the atoms (O N) may be performed first similarly as in the case of the glow discharge method by employing a starting material for introduction of the atoms (O N) under gaseous state and varying suitably as desired the gas flow rate of said gas when introduced into the deposition chamber. Secondly, formation of such a depth profile can also be achieved by previously changing the composition of a target for sputtering. For example, when a target comprising a mixture of Si and $SiO_2$ is to be used, the mixing ratio of Si to $SiO_2$ may be varied in the direction of layer thickness of the target.

In the light-receiving members 2100 and 1004 shown in FIG. 21 and FIG. 10, the surface layer 2105 or 1005 formed on the photosensitive layer 2104 or the second layer 1003 has a free surface and is provided for accomplishing the objects of the present invention primarily in humidity resistance, continuous repeated use characteristic, dielectric strength, use environmental characteristic, mechanical durability and light-receiving characteristic.

The surface layer in the present invention is constituted of an amorphous material containing silicon atoms (Si) and carbon atoms (C), optionally together with hydrogen atoms (H) and/or halogen atoms (X)(hereinafter written as "A-$(Si_xC_{1-x})_y(H,X)_{1-y}$", where $0<x, y\leqq 1$).

Formation of the surface layer constituted of A-$(Si_xC_{1-x})_y(H,X)_{1-y}$ may be performed according to the plasma chemical vapor deposition method (PCVD method) such as glow discharge method, the optical CVD method, the thermal CVD method, the sputtering method, the electron beam method, etc.

These preparation methods may be suitably selected depending on various factors such as the preparation conditions, the extent of the load for capital investment for installations, the production scale, the desirable characteristics required for the light-receiving member to be prepared, etc. For the advantages of relatively easy control of the preparation conditions for preparing light-receiving members having desired characteristics and easy introduction of carbon atoms and halogen atoms together with silicon atoms into the surface layer to be prepared, there may preferably be employed the glow discharge method or the sputtering method. Further, in the present invention, the glow discharge method and the sputtering method may be used in combination in the same device system to form the surface layer.

For formation of the surface layer according to the glow discharge method, starting gases for formation of A-$(Si_xC_{1-x})_y(H,X)_{1-y}$, which may optionally be mixed with a diluting gas at a predetermined mixing ratio, may be introduced into a vacuum deposition chamber in which a substrate is placed, and glow discharge is excited in said deposition chamber to form the gases introduced into a gas plasma, thereby depositing A-$(Si_xC_{1-x})_y(H,X)_{1-y}$ on the layer formed on the above substrate.

In the present invention, as the starting gases for formation of A-$(Si_xC_{1-x})_y(H,X)_{1-y}$, there may be employed most of substances containing at least one of silicon atoms (Si), carbon atoms (C), hydrogen atoms (H) and halogen atoms (X) as constituent atoms which are gaseous substances or gasified substances of readily gasifiable ones.

When employing a starting gas containing Si as constituent atom as one of Si, C, H and X, for example, there may be employed a mixture of a starting gas containing Si as constituent atom, a starting gas containing C as constituent atom and optionally a starting gas containing H as constituent atom and/or a starting gas containing X as constituent atom at a desired mixing ratio, or a mixture of a starting gas containing Si as constituent atom and a starting gas containing C and H as constituent atoms and/or a starting gas containing C and X as constituent atoms also at a desired mixing ratio, or a mixture of a starting gas containing Si as constituent atom and a starting gas containing three constituent atoms of Si, C and H or a starting gas containing three constituent atoms of Si, C and X.

Alternatively, it is also possible to use a mixture of a starting gas containing Si and H as constituent atoms with a starting gas containing C as constituent atom or a mixture of a starting gas containing Si and X as constituent atoms and a starting gas containing C as constituent atom.

In the present invention, suitable halogen atoms (X) contained in the surface layer are F, Cl, Br and I, particularly preferably F and Cl.

In the present invention, the starting gases which can be effectively used for formation of the surface layer may preferably include those which are gaseous under conditions of ordinary temperature and atmospheric pressure or can be readily gasified.

In the present invention, the starting gases effectively used for formation of the surface layer may include silicon hydride gases containing silicon atoms and hydrogen atoms as constituent atoms such as silanes, for example, $SiH_4$, $Si_2H_6$, $Si_3H_8$, $Si_4H_{10}$, etc., compounds containing carbon atoms and hydrogen atoms as constituent atoms such as saturated hydrocarbons having 1 to 4 carbon atoms, ethylenic hydrocarbons having 2 to 4 carbon atoms and acetylenic hydrocarbons having 2 to 3 carbon atoms, single substances of halogen, hydrogen halides, interhalogen compounds, silicon halide, halogen-substituted silicon hydride, silicon hydride, etc.

More specifically, they may include, as the saturated hydrocarbons, methane ($CH_4$), ethane ($C_2H_6$) propane ($C_3H_8$), n-butane (n-$C_4H_{10}$), pentane ($C_5H_{12}$); as the ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as the acetylenic hydrocarbons, acetylene ($C_2H_2$), methyl acetylene ($C_3H_4$), butyne ($C_4H_6$); as the single substances of halogen, fluorine, chlorine, bromine and iodine; as the hydrogen halides, HF, HI, HCl and HBr; as the interhalogen compounds, BrF, ClF, $ClF_3$, $ClF_5$, $BrF_5$, $BrF_3$, $IF_5$, $IF_7$, ICl, IBr; as the silicon halides, $SiF_4$, $Si_2F_6$, $SiCl_3Br$, $SiCl_2Br_2$, $SiClBr_3$, $SiCl_3I$, $SiBr_4$; as the halogen-substituted silicon hydride, $SiH_2F_2$, $SiH_2Cl_2$, $SiH_3Cl$, $SiH_3Br$, $SiH_2Br_2$, $SiHBr_3$, etc.; and so on.

Besides, it is also possible to use halogen-substituted paraffinic hydrocarbons such as $CF_4$, $CCl_4$, $CBr_4$, $CHF_3$, $CH_2F_2$, $CH_3F$, $CH_3Cl$, $CH_3Br$, $CH_3I$, $C_2H_5Cl$, etc.; fluorinated sulfur compounds such as $SF_4$, $SF_6$, etc.; silane derivatives, including alkyl silanes such as $Si(CH_3)_4$, $Si(C_2H_5)_4$, etc. and halogen-containing alkyl silanes such as $SiCl(CH_3)_3$, $SiCl_2(CH_3)_2$, $SiCl_3CH_3$, etc. as effective ones.

These materials for formation of the surface layer may be selected and used as desired in formation of the surface layer so that silicon atoms, carbon atoms and halogen atoms, optionally together with hydrogen atoms, may exist in a predetermined composition ratio in the surface layer.

For example, $Si(CH_3)_4$ as the material capable of easily adding silicon atoms, carbon atoms and hydrogen atoms and forming a layer having desired characteristics and $SiHCl_3$, $SiCl_4$, $SiH_2Cl_2$ or $SiH_3Cl$ as the material for adding halogen atoms may be mixed in a predetermined mixing ratio and introduced under a gaseous state in to a device for formation of a surface layer, followed by excitation of glow discharge, whereby a surface layer comprising A-$(Si_xC_{1-x})_y(Cl+H)_{1-y}$ can be formed.

For formation of the surface layer according to the sputtering method, any of single crystalline or polycrystalline Si wafer, C wafer and wafer containing Si and C as mixed therein is used as a target and subjected to sputtering in an atmosphere of various gases containing, if necessary, halogen atoms and/or hydrogen atoms as constituents. For example, when an Si wafer is used as a target, starting gases for introducing C and H and/or X, which may be diluted with a dilution gas, if desired, are introduced into a a deposition chamber for sputtering to form a gas plasma of these gases therein and effect sputtering of said silicon wafer.

Alternatively, Si and C as separate targets or one target sheet of a mixture of Si and C can be used and sputtering is effected in a gas atmosphere containing, if desired, hydrogen atoms and/or halogen atoms. As the starting gases for introduction of C, H and X, substances for forming the surface layer as shown in the example of the glow discharge method as described above can be used as effective materials also for the sputtering.

In the present invention, the dilution gas to be used in the formation of the surface layer by the glow discharge method or the sputtering method may include the so-called rare gases such as He, Ne and Ar as preferable ones.

The surface layer in the present invention should be carefully formed so that the required characteristics may be given exactly as desired. That is, the substance containing silicon atoms, carbon atoms, and, if necessary, hydrogen atoms and/or halogen atoms as the constituent atoms can take structural forms ranging from crystalline to amorphous and show electrical properties ranging from conductive through semi-conductive to insulating and photoconductive properties ranging from photoconductive to non-photoconductive. Therefore, in the present invention, the preparation conditions are strictly selected as desired so as to form A-$(Si_xC_{1-x})_y(H,X)_{1-y}$ having characteristics desired for the purpose. For example, when the surface layer is to be provided primarily for the purpose of improvement of dielectric strength, A-$(Si_xC_{1-x})_y(H,X)_{1-y}$ is prepared as an amorphous material having marked electric insulating behaviours under the service environment.

Alternatively, when the primary purpose of the formation of the surface layer is an improvement of continuous repeated use characteristics or service environmental characteristics, the degree of the above electric insulating property may be alleviated to some extent and A-$(Si_xC_{1-x})_y(H,X)_{1-y}$ may be prepared as an amorphous material having a sensitivity to some extent to the irradiation light.

In forming the surface layer consisting of A-$(Si_xC_{1-x})_y(H,X)_{1-y}$, the substrate temperature during the layer formation is an important factor having influences on the constitution and the characteristics of the layer to be formed, and it is desired in the present invention to strictly control the substrate temperature during the layer formation so as to obtain A-$(Si_xC_{1-x})_y(H,X)_{1-y}$ having the desired characteristics.

For forming the surface layer, an optimum temperature range is selected in conformity with the method for forming the surface layer to effectively attain the disired objects of the present invention. During the formation of the layer, the substrate temperature is preferably 20° to 400° C., more preferably 50° to 350° C., and most preferably 100° to 300° C. For the formation of the surface layer, the glow discharge method or the sputtering method may be advantageously used, because fine control of the composition ratio of atoms existing in the layer or control of layer thickness can be conducted with relative ease as compared with other methods. In case that the surface layer is formed according to these layer forming methods, the discharging power during the formation of the layer is one of important factors influencing the characteristics of A-$(Si_xC_{1-x})_y(H,X)_{1-y}$ similarly to the aforesaid substrate temperature.

The discharging power condition for the effective preparation with a good productivity of the A-$(Si_xC_{1-x})_y(H,X)_{1-y}$ having characteristics for accomplishing the objects of the present invention may preferably be 10 to 1000 W more preferably 20 to 750 W, and most preferably 50 to 650 W.

The gas pressure in a deposition chamber may preferably be 0.01 to 1 Torr, and more preferably 0.1 to 0.5 Torr.

In the present invention, the above numerical ranges can be mentioned as preferable ones for the substrate temperature, discharging power for the preparation of the surface layer. However, these factors for the formation of the layer are not selected separately and independently of each other, but it is desirable that the optimum values of respective layer forming factors are selected on the basis of mutual organic relationships so that the A-$(Si_xC_{1-x})_y(H,X)_{1-y}$ having desired characteristics may be formed.

The contents of carbon atoms existing in the surface layer are important factors for obtaining the desired characteristics to accomplish the objects of the present invention, similarly to the conditions for preparation of the surface layer. The content of carbon atoms existing in the surface layer in the present invention are selected as desired in view of the species of amorphous material constituting the surface layer and its characteristics.

More specifically, the amorphous material represented by the above formula A-$(Si_xC_{1-x})_y(H,X)_{1-y}$ may be roughly classified into an amorphous material constituted of silicon atoms and carbon atoms (hereinafter referred to as "A-$Si_aC_{1-a}$", where $0<a<1$), an amorphous material constituted of silicon atoms, carbon atoms and hydrogen atoms (hereinafter referred to as A-$(Si_bC_{1-b})_cH_{1-c}$, where $0<b$, $c<1$) and an amorphous material constituted of silicon atoms, carbon atoms, halogen atoms and, if necessary, hydrogen atoms (hereinafter referred to as "A-$(Si_dC_{1-d})_e(H,X)_{1-e}$", where $0-d$, $e<1$).

In the present invention, when the surface layer is made of A-$Si_aC_{1-a}$, the content of carbon atoms in the surface layer may be preferably $1\times10^{-3}$ to 90 atomic %, more preferably 1 to 80 atomic %, and most preferably 10 to 75 atomic %, namely in terms of representation by a in the above A-$Si_aC_{1-a}$, a being preferably 0.1 to 0.99999, more preferably 0.2 to 0.99, and most preferably 0.25 to 0.9.

In the present invention, when the surface layer is made of A-$(Si_bC_{1-b})_cH_{1-c}$, the content of carbon atoms in the surface layer may be preferably $1\times10^{-3}$ to 90 atomic %, more preferably 1 to 90 atomic %, and most preferably 10 to 80 atomic %, the content of hydrogen atoms preferably 1 to 40 atomic %, more preferably 2 to 35 atomic %, and most preferably 5 to 30 atomic %, and the light-receiving member formed when the hydrogen content is within these ranges can be sufficiently applicable as excellent one in the practical aspect.

That is, in terms of the representation by the above A-$(Si_bC_{1-b})_cH_{1-c}$, b is preferably 0.1 to 0.99999, more preferably 0.1 to 0.99, and most preferably 0.15 to 0.9, and c preferably 0.6 to 0.99, more preferably 0.65 to 0.98, and most preferably 0.7 to 0.95.

When the surface layer is made of A-$(Si_dC_{1-d})_e(H,X)_{1-e}$, the content of carbon atoms in the surface layer may be preferably $1\times10^{-3}$ to 90 atomic %, more preferably 1 to 90 atomic %, and most preferably 10 to 80 atomic %, the content of halogen atoms preferably 1 to 20 atomic %. When the content of halogen atoms is within these ranges, the light-receiving member thus prepared is sufficiently applicable in the practical aspect. The content of hydrogen atoms contained if desired may be preferably 19 atomic % or less, and more preferably 13 atomic % or less.

That is, in terms of representation by d and e in the above A-$(Si_dC_{1-d})_e(H,X)_{1-e}$, d is preferably 0.1 to 0.99999, more preferably 0.1 to 0.99, and most preferably 0.15 to 0.9, and e preferably 0.8 to 0.99, more preferably 0.82–0.99, and most preferably 0.85 to 0.98.

The range of the numerical value of layer thickness of the surface layer is one of the important factors for effectively accomplishing the objects of the present invention, and is selected as desired in view of the intended purpose so as to effectively accomplish the objects of the present invention.

The layer thickness of the surface layer must be also selected as desired with due considerations about the relationships with the content of carbon atoms, the relationship with the layer thicknesses of the first layer and the second layer, as well as other organic relationships to the characteristics required for respective layer regions.

In addition, the layer thickness is desirably given considerations from economical view-point such as productivity or capability of mass production.

The surface layer in the present invention desirably has a layer thickness preferably of 0.003 to 30μ, more preferably 0.004 to 20μ, and most preferably 0.005 to 10μ.

The surface layer may be borne to have a function as the protective layer for mechanical durability and an optical function as the reflection preventive layer.

The surface layer should satisfy the following condition in order to exhibit fully its reflection preventive function.

That is, when the refractive index of the surface layer is defined as n, the layer thickness as d, and the wavelength of the light irradiated is as λ, the surface layer is suitable for a reflection preventive layer, if the following condition is satisfied:

$$d=\lambda/4n \text{ (or multiplied by an odd number).}$$

Also, when the refractive index of the second layer is defined as an $n_a$, the refractive index of the surface layer should satisfy the following condition:

$$n=\sqrt{n_a},$$

and the layer thickness d of the surface layer should be:

$$d=\lambda/4n \text{ (or multiplied by an odd number).}$$

to give the surface layer most suitable for reflection preventive layer. When a-Si:H is employed as the second layer, the refractive index of a-Si:H is about 3.3 and therefore a material with a refractive index of 1.82 is suitable as the surface layer. Since a-Si:H can be made to have such a value of refractive index by controlling the content of C and it can also fully satisfy mechanical durability, tight adhesion between layers and electrical characteristics, it is most suitable as the material for the surface layer.

When the surface layer poses priority on the function of reflection preventive layer, the layer thickness of the surface layer should more desirably be 0.05 to 2 μm.

The substrate to be used in the present invention may be either electroconductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. At least one side surface of these substrates is preferably subjected to treatment for imparting electroconductivity, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 1004 in FIG. 10 is to be used as the light-receiving member for electrophotography, it may desirably be formed into an endless belt or a cylinder for use in continuous high speed copying. The substrate may have a thickness, which is conveniently determined so that the light-receiving member as desired may be formed. When the light-receiving member is required to have a flexibility, the substrate is made as thin as possible, so far as the function of a support can be exhibited. However, in such a case, the thickness is generally 10μ or more from the points of fabrication and handling of the substrate as well as its mechanical strength.

Next, an example of the process for producing the light-receiving member of this invention is to be briefly described.

Figure 20:
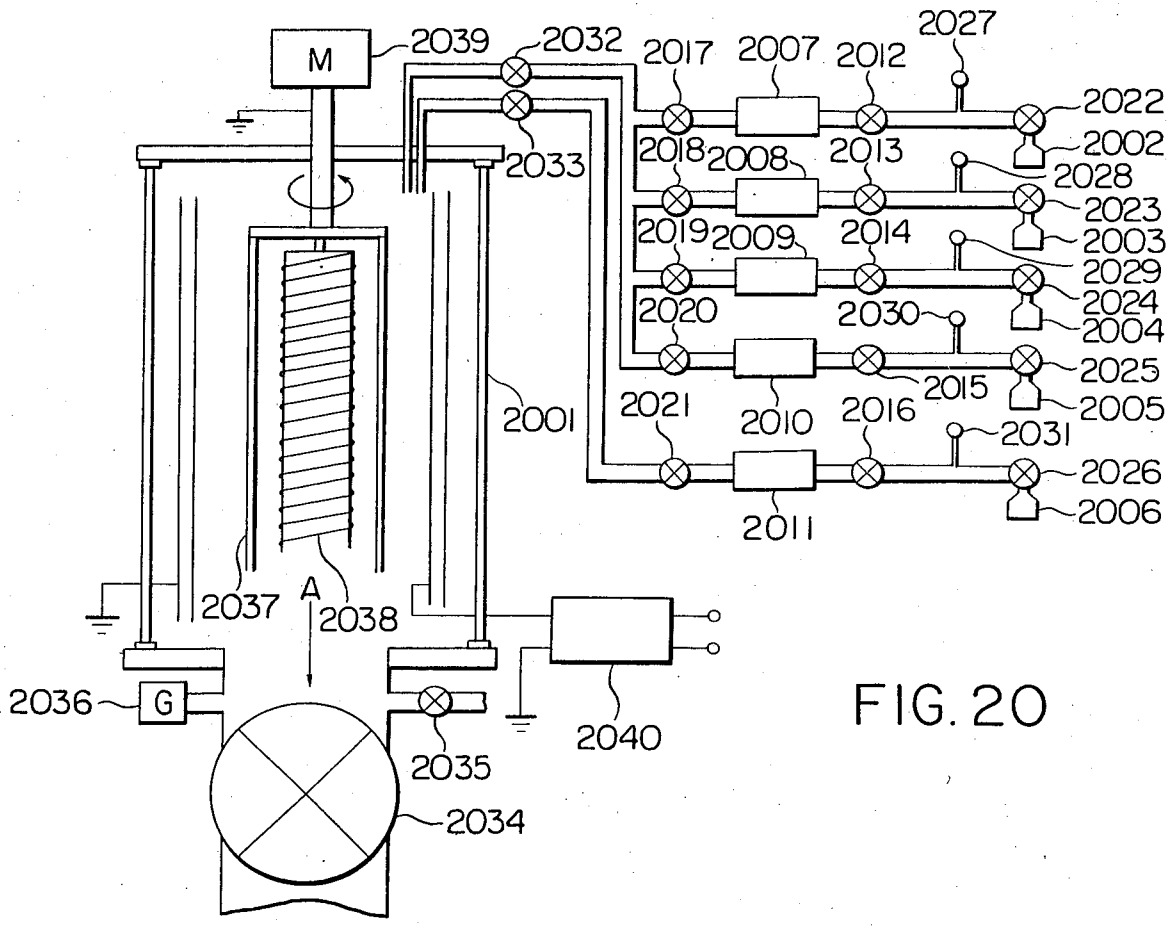
FIG. 20 and FIG. 63 each are schematic illustrations of the vacuum deposition device for preparation of the light-receiving members employed in Examples.

FIG. 20 shows one example of a device for producing a light-receiving member.

In the gas bombs 2002 to 2006, there are hermetically contained starting gases for formation of the light-receiving member of the present invention. For example, 2002 is a bomb containing $SiH_4$ gas (purity 99.999%, hereinafter abbreviated as $SiH_4$), 2003 is a bomb contaiing $GeH_4$ gas (purity 99.999%, hereinafter abbreviated as $GeH_4$), 2004 is a bomb containing NO gas (purity 99.99%, hereinafter abbreviated as NO), 2005 is bomb containing $B_2H_6$ gas diluted with $H_2$ (purity 99.999%, hereinafter abbreviated as $B_2H_6/H_2$), 2006 is a bomb containing $H_2$ gas (purity: 99.999%) and 2045 is a bomb containing $CH_4$ gas (purity: 99.999%).

For allowing these gases to flow into the reaction chamber 2001, on confirmation of the valves 2022 to 2026 and 2044 of the gas bombs 2002 to 2006 and 2045 and the leak valve 2035 to be closed, and the inflow valves 2012 to 2016 and 2043, the outflow valves 2017 to 2021 and 2041 and the auxiliary valves 2032 and 2033 to be opened, the main valve 2034 is first opened to evacuate the reaction chamber 2001 and the gas pipelines. As the next step, when the reading on the vacuum indicator 2036 becomes $5\times10^{-6}$ Torr, the auxiliary valves 2032, 2033 and the outflow valves 2017 to 2021 and 2041 are closed.

Referring now to an example of forming a light-receiving layer on the cylindrical substrate 2037, $SiH_4$ gas from the gas bomb 2002, $GeH_4$ gas from the gas bomb 2003, NO gas from the gas bomb 2004, $B_2H_6/H_2$ gas from the gas bomb 2005 and $H_2$ gas from the gas bomb 2006 are permitted to flow into the mass-flow controllers 2007, 2008, 2009, 2010 and 2011, respectively, by opening the valves 2022, 2023, 2024, 2025 and 2026 and controlling the pressures at the output pressure gauges 2027, 2028, 2029 2030 and 2031 to 1 $Kg/cm^2$ and opening gradually the inflow valves 2012, 2013, 2014, 2015 and 2016, respectively. Subsequently, the outflow valves 2017, 2018, 2019, 2020 and 2021 and the auxiliary valves 2032 and 2033 were gradually opened to permit respective gases to flow into the reaction chamber 2001. The outflow valves 2017, 2018, 2019, 2020 and 2021 are controlled so that the flow rate ratio of $SiH_4$ gas, $GeH_4$ gas, $B_2H_6/H_2$ gas, NO gas and $H_2$ may have a desired value and opening of the main valve 2034 is also controlled while watching the reading on the vacuum indicator 2036 so that the pressure in the reaction chamber 2001 may reach a desired value. And, after confirming that the temperature of the substrate 2037 is set at 50° to 400° C. by the heater 2038, the power source 2040 is set at a desired power to excite glow discharge in the reaction chamber 2001, simultaneously with controlling of the distributed concentrations of germanium atoms and boron atoms to be contained in the layer formed by carrying out the operation to change gradually the openings of the valves 2018, 2020 by the manual method or by means of an externally driven motor, etc. thereby changing the flow rates of $GeH_4$ gas and $B_2H_6$ gas according to previously designed change rate curves.

By maintaining the glow discharge as described above for a desired period time, the first layer (G) is formed on the substrate 2037 to a desired thickness. At the stage when the first layer (G) is formed to a desired thickness, the second layer (S) containing substantially no germanium atom can be formed on the first layer (G) by maintaining glow discharge according to the same conditions and procedure as those in formation of the first layer (G) except for closing completely the outflow valve 2018 and changing, if desired, the discharging conditions. Also, in the respective layers of the first layer (G) and the second layer (S), by opening or closing as desired the outflow valves 2019 or 2020, oxygen atoms or boron atoms may be contained or not, or oxygen atoms or boron atoms may be contained only in a part of the layer region of the respective layers.

When nitrogen atoms are to be contained in place of oxygen atoms, layer formation may be conducted by replacing NO gas in the gas bomb 2004 with $NH_3$ gas. Also, when the kinds of the gases employed are desired to be increased, bombs of desirable gases may be provided additionally before carrying out layer formation similarly. After the formation of the second layer (S), a surface layer mainly consisiting of silicon atoms and carbon atoms may be formed on the second layer (S) to a desired layer thickness by maintaining glow discharge for a desired period of time according to the same conditions and procedure except for adjusting the mass-flow controllers 2007 and 2042 to a predetermined flow rate ratio. During layer formation, for uniformization of the layer formation, it is desirable to rotate the substrate 2037 by means of a motor 2039 at a constant speed.

The present invention is described in more detail by referring to the following Examples.

EXAMPLE 1

In this Example, a semiconductor laser (wavelength: 780 nm) with a spot size of 80 μm was employed. Thus, on a cylindrical aluminum substrate (length (L) 357 mm, outer diameter (r) 80 mm) on which A-Si:H is to be deposited, a spiral groove at a pitch (P) of 25 μm and a depth (D) of 0.8 S was prepared by a lathe. The shape of the groove is shown in FIG. 9.

Figure 63:
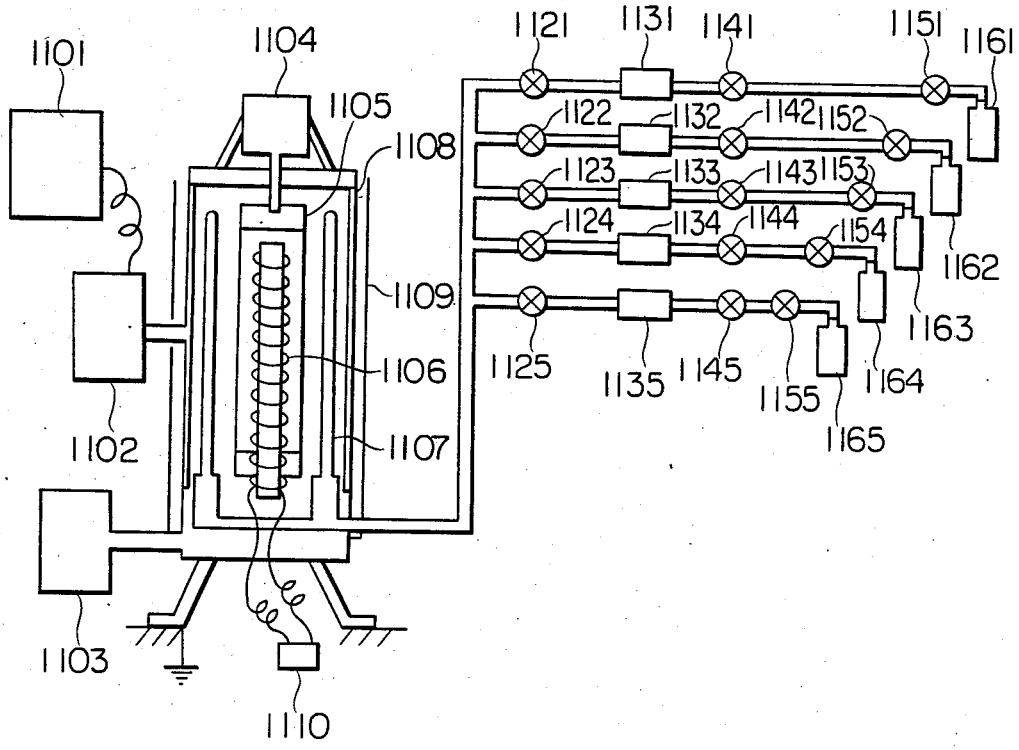

On this aluminum substrate, the charge injection preventive layer and the photosensitive layer were deposited by means of the device as shown in FIG. 63 in the following manner.

First, the constitution of the device is to be explained. 1101 is a high frequency power source, 1102 is a matching box, 1103 is a diffusion pump and a mechanical booster pump, 1104 is a motor for rotation of the aluminum substrate, 1105 is an aluminum substrate, 1106 is a heater for heating the aluminum substrate, 1107 is a gas inlet tube, 1108 is a cathode electrode for introduction of high frequency, 1109 is a shield plate, 1110 is a power source for heater, 1121 to 1125, 1141 to 1145 are valves, 1131 to 1135 are mass flow controllers, 1151 to 1155 are regulators, 1161 is a hydrogen ($H_2$) bomb, 1162 is a silane ($SiH_4$) bomb, 1163 is a diborane ($B_2H_6$) bomb, 1164 is a nitrogen oxide (NO) bomb and 1165 is a methane ($CH_4$) bomb.

Next, the preparation procedure is to be explained. All of the main cocks of the bombs 1161–1165 were closed, all the mass flow controllers and the valves were opened and the deposition device was internally evacuated by the diffusion pump 1103 to $10^{-7}$ Torr. At the same time, the aluminum substrate 1105 was heated by the heater 1106 to 250° C. and maintained constantly at 250° C. After the aluminum substrate 1105 became constantly at 250° C., the valves 1121–1125, 1141–1145 and 1151–1155 were closed, the main cocks of bombs 1161–1165 opened and the diffusion pump 1103 was changed to the mechanical booster pump. The secondary pressure of the valve equipped with regulators 1151–1155 was set at 1.5 $Kg/cm^2$. The mass flow controller 1131 was set at 300 SCCM, and the valves 1141 and 1121 were successively opened to introduce $H_2$ gas into the deposition device.

Next, by setting the mass flow controller 1132 at 150 SCCM, $SiH_4$ gas in 1161 was introduced into the deposition device according to the same procedure as introduction of $H_2$ gas. Then, by setting the mass flow controller 1133 so that $B_2H_6$ gas flow rate of the bomb 1163 may be 1600 Vol. ppm relative to $SiH_4$ gas flow rate, $B_2H_6$ gas was introduced into the deposition device according to the same procedure as introduction of $H_2$ gas.

And, when the inner pressure in the deposition device was stabilized at 0.2 Torr, the high frequency power source 1101 was turned on and glow discharge was generated between the aluminum substrate 1105 and the cathode electrode 1108 by controlling the matching box 1102, and an A-Si:H:B layer (p-type A-Si:H layer containing B) was deposited to a thickness of 5 μm at a high frequency power of 150 W (charge injection preventive layer). After deposition of the 5 μm thick A-Si:H:B layer (p-type), inflow of $B_2H_6$ was stopped by closing the valves 1123 without discontinuing discharging.

And, an A-Si:H layer (non-doped) with a thickness of 20 μm was deposited at a high frequency power of 150 W (photosensitive layer). Then, setting of the mass flow controller 1132 was changed to 35 SCCM and $CH_4$ gas was introduced from the mass flow controller 1135 at which the $CH_4$ gas flow rate in 1165 relative to the $SiH_4$ gas flow rate had previously been set at a flow rate ratio of $SiH_4/CH_4=1/30$ by opening the valve 1125, and A-SiC(H) with a thickness of 0.5 μm was deposited at a high frequency power of 150 W (surface layer).

With high frequence power being turned off and all the gas valves closed, the deposition device was evacuated and the temperature of the aluminum substrate was lowered to room temperature, and the substrate having formed a light-receiving layer thereon was taken out.

Figure 64:
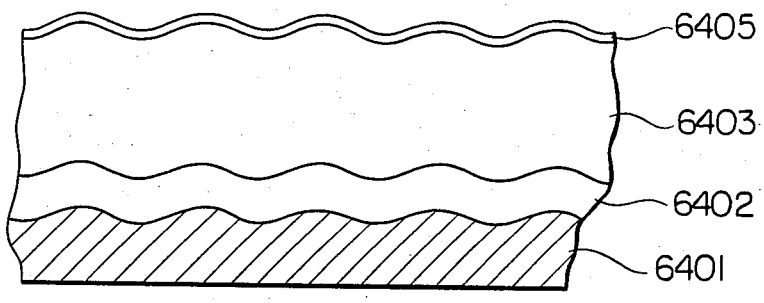
FIGS. 64, 65, 82 and 83 are illustrations of the structures of the light-receiving members prepared in Examples.

Separately, on the cylindrical aluminum substrate with the same surface characteristic, light-receiving layers were formed in the same manner as described above except for changing the discharging power during formation of the charge injection preventive layer, the photosensitive layer and surface layer each to 50 W. As the result, as shown in FIG. 64, the surface of the photosensitive layer 6403 was found to be in parallel to the surface of the substrate 6401. In this case, the difference in the total thickness between the center and both ends of the aluminum substrate was found to be 1 μm.

Figure 65:
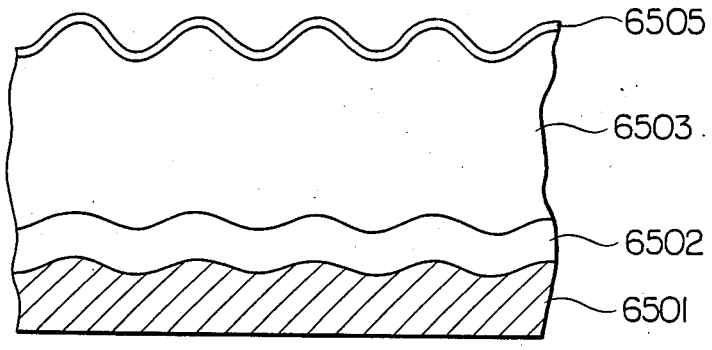

Also, in the case when the above high frequency power was 150 W, as shown in FIG. 65, the surface of the photosensitive layer 6503 was found to be non-parallel to the surface of the substrate 6501. In this case, the difference in the total thickness between the center and both ends of the aluminum substrate was found to be 2 μm.

Figure 26A:
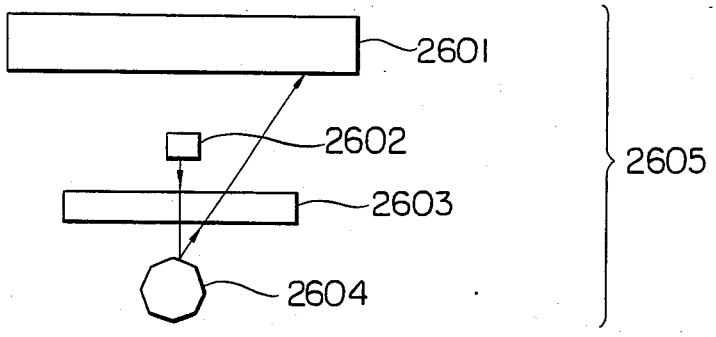
FIG. 26 is a schematic illustration of a device for image exposure employed in Examples.
Figure 26B:
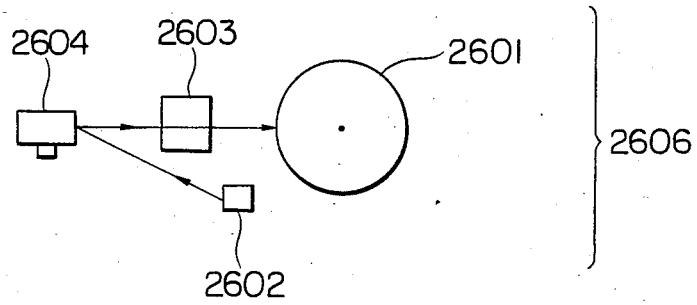

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 at a high frequency power of 50 W during layer formation, an interference fringe pattern was observed.

On the other hand, in the light-receiving member having the surface characteristic as shown in FIG. 65, no interference fringe pattern was observed and the member obtained exhibited practically satisfactory electrophotographic characteristics.

EXAMPLE 2

According to the same method as in Example 1 under the conditions when no interference fringe pattern was observed (high frequency power 150 W), seven substrates having formed layers up to photosensitive layer thereon were prepared.

Subsequently, the hydrogen ($H_2$) bomb of 1161 in the device shown in FIG. 63 is replaced with the argon (Ar) gas bomb, the deposition device cleaned, and on all over the cathode electrode are placed a target for sputtering comprising Si and a target for sputtering comprising graphite to an area ratio as indicated in Table 1A. One substrate having formed layers up to photosensitie layer is set and the deposition device is internally brought to reduced pressure sufficiently with the diffusion pump. Then, argon gas is introduced to 0.015 Torr and glow discharging is excited at a high frequency power of 150 W, followed by sputtering of the surface material, to form a surface layer under the condition shown in Table 1A (Condition No. 101A) (Sample No. 101A).

Similarly, for the remainder of six cylinders, surface layers were deposited under the ccnditions shown in Table 1A (Condition Nos. 102A–107A) (Sample Nos. 102A–107A).

EXAMPLE 3

Except for changing the flow rate ratio of $SiH_4$ gas to $CH_4$ gas during formation of the surface layer to vary the content ratio of silicon atoms to carbon atoms in the surface layer, according to the same method as in Example 1 under the conditions when no interference fringe pattern was observed, respective light-receiving members for electrophotography were prepared. For respective light-receiving members thus obtained, image exposure was effected by laser similarly as in Example 1, and the steps up to transfer were repeated for about 50,000 times, followed by evaluation of images, to obtain the results as shown in Table 2A.

EXAMPLE 4

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as in Example 1 under the conditions when no interference fringe pattern was observed, respective light-receiving members for electrophotography were prepared. For respective light-receiving members thus obtained, image exposure was effected by laser similarly as in Example 1, and the steps up to transfer were repeated for about 50,000 times, followed by evaluation of images, to obtain the results as shown in Table 3A.

EXAMPLE 5

Except for changing the layer thickness of the surface layer, according to the same procedure as in Example 1 under the conditions when no interference fringe pattern was observed, respective light-receiving members for electrophotography were prepared. For the respective light-receiving members thus obtained, the steps of image formation, developing and cleaning were repeated similarly as in Example 12 to obtain the results as shown in Table 4A .

EXAMPLE 6

According to entirely the same method as in Example 1 under the conditions when no interference fringe pattern was observed except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 1 to give practically satisfactory results.

EXAMPLE 7

The surface of a cylindrical aluminum substrate was worked by a lathe as shown in Table 5A. On these cylindrical aluminum substrates (Nos. 501A–508A), light-receiving members for electrophotography were prepared under the same conditions when no interference fringe pattern was observed in Example 1 (high frequency power 150 W) (Nos. 511A–518A). The difference in average layer thickness between the center and the both ends of the aluminum substrate was found to be 2 μm.

The cross-sections of these light-receiving members for electrophotography were observed with an electron microscope for measurement of the difference within the pitch of the photosensitive layer to obtain the results as shown in Table 6A.

These light-receiving members were subjected to image exposure by a semiconductor laser of a wavelength of 780 nm with a spot diameter of 80 μm by means of the device shown in FIG. 26 similarly as in Example 1 to obtain the results as shown in Table 6A.

EXAMPLE 8

Except for the following points, light-receiving members were prepared under the same conditions as in Example 7. The layer thickness of the charge injection preventive layer was made 10 μm. The difference in average layer thickness between the center and both ends of the charge injection preventive layer was found to be 1 μm, and that of the photosensitive layer 2 μm. The thicknesses of the respective layers of No. 511A–518A were measured to obtain the results as shown in Table 7A. For these light-receiving members, in the same image exposure device as in Example 1, image exposure was effected to obtain the results as shown in Table 7A.

EXAMPLE 9

On cylindrical aluminum substrates having the surface characteristics as shown in Table 8A (Nos. 701A–707A), light-receiving members having a silicon oxide layer as charge injection preventive layer provided thereon were prepared in the following manner.

The silicon oxide layer was formed to a thickness of 0.2 μm by controlling the flow rate of $SiH_4$ at 50 SCCM and NO at 60 SCCM, following otherwise the same conditions as in preparation of the charge injection preventive layer as in Example 2.

On the silicon oxide layer were formed a photosensitive layer with a thickness of 20 μm and a surface layer under the same conditions as in Example 2.

The difference in average layer thickness between the center and the both ends of the light-receiving member for electrophotography as prepared above was found to be 1 μm.

When these light-receiving members were observed by an electron microscope, the difference in layer thickness of the silicon oxide layer within the pitch on the surface of the aluminum cylinder was found to be 0.06 μm. Similarly, the difference in layer thickness of the A-Si:H photosensitive layer within each pitch was found to give the results shown in Table 9A. When these light-receiving members for electrophotography were subjected to image exposure by laser beam similarly as in Example 1, the results shown in Table 9A were obtained.

EXAMPLE 10

On cylindrical aluminum susbstrates having the surface characteristics as shown in Table 8A (Nos. 701A–707A), light-receiving members having a silicon nitride layer as charge injection preventive layer provided thereon were prepared in the following manner.

The silicon nitride layer was formed to a thickness of 0.2 μm by replacing NO gas in Example 9 with $NH_3$ gas and controlling the flow rate of $SiH_4$ at 30 SCCM and $NH_3$ at 200 SCCM, following otherwise the same conditions as in preparation of the charge injection preventive layer as in Example 5.

On the silicon nitride layer were formed at a high frequency power of 100 W a photosensitive layer with a thickness of 20 μm and a surface layer under the same conditions as in Example 5.

The difference in average layer thickness between the center and the both ends of the light-receiving member for electrophotography above prepared was found to be 1 μm.

When these light-receiving members were observed by an electron microscope, the difference in layer thickness of the silicon nitride layer within each pitch was found to be 0.05 μm or less. Similarly, the difference in layer thickness of the A-Si:H photosensitive layer within each pitch was found to give the results shown in Table 10A. When these light-receiving members for electrophotography (Nos. 811A–817A) were subjected to image exposure by laser beam similarly as in Example 1, the results shown in Table 10A were obtained.

EXAMPLE 11

On cylindrical aluminum substrates having the surface characteristics as shown in Table 8A (Nos. 701A–707A), light-receiving members having a silicon carbide layer as charge injection preventive layer provided thereon were prepared in the following manner.

In formation of the silicon carbide layer, by employing $CH_4$ gas and $SiH_4$ gas controlling the flow rate of $SiH_4$ gas at 20 SCCM and $CH_4$ gas at 600 SCCM, following otherwise the same conditions as in Example 5 were formed an A-Si:H photosensitive layer with a thickness of 20 μm and a surface layer.

The difference in average layer thickness between the center and the both ends of A-Si:H light-receiving member for electrophotography was found to be 1.5 μm.

When these A-Si:H light-receiving members were observed by an electron microscope, the difference in layer thickness of the silicon carbide layer within each pitch was found to be 0.07 μm or less. On the other hand, the difference in layer thickness of the A-Si:H photosensitive layer within each pitch was found to give the results shown in Table 11A. When these light-receiving members for electrophotography were subjected to image exposure by laser beam similarly as in Example 1, the results shown in Table 11A were obtained (Sample Nos. 911A–917A).

COMPARATIVE EXAMPLE 1

As a comparative test, an a-Si light-receiving member for electrophotography was prepared in entirely the same manner as in the case when the high frequency power was 150 W in Example 1 as described above except for employing an aluminum substrate roughened on its surface by the sand blasting method in place of the aluminum substrate used in preparation of the light-receiving member for electrophotography in Example 1. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 1, clear interference fringe was found to be formed in the black image over all the surface.

EXAMPLE 12

In this Example, a semiconductor laser (wavelength: 780 nm) with a spot size of 80 μm was employed. Thus, on a cylindrical aluminum substrate (length (L) 357 mm, outer diameter (r) 80 mm) on which A-Si:H is to be deposited, a spiral groove at a pitch (P) of 25 μm and a depth (D) of 0.8 S was prepared by a lathe. The shape of the groove is shown in FIG. 9.

On this aluminum substrate, the charge injection preventive layer and the photosensitive layer were deposited by means of the device as shown in FIG. 63 in the following manner.

First, the constitution of the device is to be explained. 1101 is a high frequency power source, 1102 is a matching box, 1103 is a diffusion pump and a mechanical booster pump, 1104 is a motor for rotation of the aluminum substrate, 1105 is an aluminum substrate, 1106 is a heater for heating the aluminum substrate, 1107 is a gas inlet tube, 1108 is a cathode electrode for introduction of high frequency, 1109 is a shield plate, 1110 is a power source for heater, 1121 to 1125, 1141 to 1145 are valves, 1131 to 1135 are mass flow controllers, 1151 to 1155 are regulators, 1161 is a hydrogen ($H_2$) bomb, 1162 is a silane ($SiH_4$) bomb, 1163 is a diborane ($B_2H_6$) bomb, 1164 is a nitrogen oxide (NO) bomb and 1165 is a methane ($CH_4$) bomb.

Next, the preparation procedure is to be explained. All of the main cocks of the bombs 1161–1165 were closed, all the mass flow controllers and the valves were opened and the deposition device was internally evacuated by the diffusion pump 1103 to $10^{-7}$ Torr. At the same time, the aluminum substrate 1105 was heated by the heater 1106 to 250° C. and maintained constantly at 250° C. After the aluminum substrate 1105 became constantly at 250° C., the valves 1121–1125, 1141–1145 and 1151–1155 were closed, the main cocks of bombs 1161–1165 opened and the diffusion pump 1103 was changed to the mechanical booster pump. The secondary pressure of the valve equipped with regulators 1151–1155 was set at 1.5 Kg/cm$^2$. The mass flow controller 1131 was set at 300 SCCM, and the valves 1141 and 1121 were successively opened to introduce $H_2$ gas into the deposition device.

Next, by setting the mass flow controller 1132 at 150 SCCM, $SiH_4$ gas in 1161 was introduced into the deposition device according to the same procedure as introduction of $H_2$ gas. Then, by setting the mass flow controller 1133 so that $B_2H_6$ gas flow rate of the bomb 1163 may be 1600 Vol. ppm relative to $SiH_4$ gas flow rate, $B_2H_6$ gas was introduced into the deposition device according to the same procedure as introduction of $H_2$ gas.

Then, by setting the mass flow controller 1134 so as to control the flow rate of NO gas of 1164 at 3.4 Vol. % based on $SiH_4$ gas flow rate, NO gas was introduced into the deposition device according to the same procedure as introduction of $H_2$.

And, when the inner pressure in the deposition device was stabilized at 0.2 Torr, the high frequency power source 1101 was turned on and glow discharge was generated between the aluminum substrate 1105 and the cathode electrode 1108 by controlling the matching box 1102, and an A-Si:H:B:O layer (p-type A-Si:H layer containing B:O) was deposited to a thickness of 5 μm at a high frequency power of 150 W (charge injection preventive layer). After deposition of the 5 μm thick A-Si:H:B:O layer (p-type), inflow of $B_2H_6$ was stopped by closing the valves 1123 without discontinuing discharging.

And, an A-Si:H layer (non-doped) with a thickness of 20 μm was deposited at a high frequency power of 150 W (photosensitive layer). Then, setting of the mass flow controller 1132 was changed to 35 SCCM and $CH_4$ gas was introduced from the mass flow controller 1135 at which the $CH_4$ gas flow rate in 1165 relative to the $SiH_4$ gas flow rate had previously been set at a flow rate ratio of $SiH_4/CH_4 = 1/30$ by opening the valve 1125, and A-SiC(H) with a thickness of 0.5 μm was deposited at a high frequency power of 150 W (surface layer).

With high frequency power being turned off and all the gas valves closed, the deposition device was evacuated and the temperature of the aluminun substrate was lowered to room temperature, and the substrate having formed a light-receiving layer thereon was taken out.

Separately, on the cylindrical aluminum substrate with the same surface characteristic, the charge injection preventive layer, the photosensitive layer and the surface layer were formed in the same manner as described above except for changing the high frequency power to 40 W. As the result, as shown in FIG. 64, the surface of the photosensitive layer 6403 was found to be in parallel to the surface of the substrate 6401. In this case, the difference in the total thickness between the center and both ends of the aluminum substrate was found to be 1 μm.

Also, in the case when the high frequency power was 150 W, as shown in FIG. 65, the surface of the photosensitive layer 6503 was found to be non-parallel to the surface of the substrate 6501. In this case, the difference in the total thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 at a high frequency power of 40 W during layer formation, an interference fringe pattern was observed.

On the other hand, in the light-receiving member having the surface characteristic as shown in FIG. 65, no interference fringe pattern was observed and the member obtained exhibited practically satisfactory electrophotographic characteristics.

EXAMPLE 13

According to the same method as in Example 12 under the conditions when no interference fringe pattern was observed (high frequency power 150 W), seven substrates having formed layers up to photosensitive layer thereon were prepared.

Subsequently, the hydrogen ($H_2$) bomb of 1161 in the device shown in FIG. 63 is replaced with the argon (Ar) gas bomb, the deposition device cleaned, and on all over the cathode electrode are placed a target for sputtering comprising Si and a target for sputtering comprising graphite to an area ratio as indicated in Table 1B. One substrate having formed layers up to photosensitie layer is set and the deposition device is internally brought to reduced pressure sufficiently with the diffusion pump. Then, argon gas is introduced to 0.015 Torr and glow discharging is excited at a high frequency power of 150 W, followed by sputtering of the surface material, to form a surface layer under the condition shown in Table 1B (Condition No. 101B) (Sample No. 101B).

Similarly, for the remainder of six cylinders, surface layers were deposited under the conditions shown in Table 1B (Condition Nos. 102B–107B) (Sample Nos. 102B–107B).

EXAMPLE 14

Except for changing the flow rate ratio of $SiH_4$ gas to $CH_4$ gas during formation of the surface layer to vary the content ratio of silicon atoms to carbon atoms in the surface layer, according to the same method as in Example 12 under the conditions when no interference fringe pattern was observed, respective light-receiving members for electrophotography were prepared. For respective light-receiving members thus obtained, image exposure was effected by laser similarly as in Example 12, and the steps up to transfer were repeated for about 50,000 times, followed by evaluation of images, to obtain the results as shown in Table 2B .

EXAMPLE 15

Except for changing the flow rate ratio of $SiH_4$ gas $SiF_4$ gas to $CH_4$ gas during formation of the surface layer to vary the content ratio of silicon atoms to carbon atoms in the surface layer, according to the same method as in Example 12 under the conditions when no interference fringe pattern was observed, respective light-receiving members for electrophotography were prepared. For respective light-receiving members thus obtained, image exposure was effected by laser similarly as in Example 12, and the steps up to transfer were repeated for about 50,000 times, followed by evaluation of images, to obtain the results as shown in Table 3B .

EXAMPLE 16

Except for changing the layer thickness of the surface layer, according to the same procedure as in Example 12 under the conditions when no interference fringe pattern was observed, respective light-receiving members for electrophotography were prepared. For the respective light-receiving members thus obtained, the steps of image formation, developing and cleaning were repeated similarly as in Example 12 to obtain the results as shown in Table 4B.

EXAMPLE 17

According to entirely the same method as in Example 12 under the conditions when no interference fringe pattern was observed except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 12 to give practically satisfactory results.

EXAMPLE 18

The surface of a cylindrical aluminum substrate was worked by a lathe as shown in Table 5B. On these cylindrical aluminum substrates (Nos. 501B–508B), light-receiving members for electrophotography were prepared under the same conditions when no interference fringe pattern was observed in Example 12 (high frequency power 160 W) (Nos. 511B–518B). The difference in average layer thickness between the center and the both ends of the aluminum substrate was found to be 2.2 μm.

The cross-sections of these light-receiving members for electrophotography were observed with an electron microscope for measurement of the difference within the pitch of the photosensitive layer to obtain the results as shown in Table 6B .

These light-receiving members were subjected to image exposure by a semiconductor laser of a wavelength of 780 nm with a spot diameter of 80 μm by means of the device shown in FIG. 26 similarly as in Example 12 to obtain the results as shown in Table 6B.

EXAMPLE 19

Except for the following points, light-receiving members (Nos. 611B–618B) were prepared under the same conditions as in Example 18. The layer thickness of the charge injection preventive layer was made 10 μm. The difference in average layer thickness between the center and both ends of the charge injection preventive layer was found to be 1.2 μm, and that of the photosensitive layer 2.3 μm. The thicknesses of the respective layers of Nos. 611B–618B were measured to obtain the results as shown in Table 7B. For these light-receiving members, in the same image exposure device as in Example 12, image exposure was effected to obtain the results as shown in Table 7B.

EXAMPLE 20

On cylindrical aluminum substrates having the surface characteristics shown in Table 5B (Nos. 501B–508B), light-receiving members having charge injection preventive layers containing nitrogen provided thereon were prepared under the conditions shown in Table 8B (Nos. 401B–408B).

The cross-sections of the light-receiving members prepared under the above conditions were observed with an electron microscope. The difference in average layer thickness between the center and the both ends of the charge injection preventive layer was found to be 0.09 μm. The difference in average layer thickness of the photosensitive layer was found to be 3 μm.

The layer thickness difference within the short range of the photosensitive layer in each light-receiving member was found to have the value shown in Table 9B.

For respective light-receiving members, image exposure was effected by laser beam similarly as in Example 12 to obtain the results as shown in Table 9B.

EXAMPLE 21

On cylindrical aluminum substrates having the surface characteristics shown in Table 5B (Nos. 501B–508B), charge injection preventive layers containing nitrogen provided thereon were prepared under the conditions shown in Table 10B (Nos. 501B–508B).

The cross-sections of the light-receiving members prepared under the above conditions were observed with an electron microscope. The difference in average layer thickness between the center and the both ends of the charge injection preventive layer was found to be 0.3 μm. The difference in average layer thickness of the photosensitive layer was found to be 3.2 μm.

The layer thickness difference within the short range of the photosensitive layer in each light-receiving member was found to have the value shown in Table 11B.

For respective light-receiving members, image exposure was effected by laser beam similarly as in Example 12 to obtain the results as shown in Table 11B.

EXAMPLE 22

On cylindrical aluminum substrates having the surface characteristics shown in Table 5B (Nos. 501B–508B), charge injection preventive layers containing carbon were prepared under the conditions shown in Table 12B (Nos. 1301B–1308B).

The cross-sections of the light-receiving members prepared under the above conditions were observed with an electron microscope. The difference in average layer thickness between the center and the both ends of the charge injection preventive layer was found to be 0.08 μm. The difference in average layer thickness of the photosensitive layer was found to be 2.5 μm.

The layer thickness difference within the short range of the photosensitive layer in each light-receiving member was found to have the value shown in Table 13B.

For respective light-receiving members, image exposure was effected by laser beam similarly as in Example 12 to obtain the results as shown in Table 13B .

EXAMPLE 23

On cylindrical aluminum substrates having the surface characteristics shown in Table 5B (Nos. 501B–508B), charge injection preventive layers containing carbon were prepared under the conditions shown in Table 14B (Nos. 1501B–1508B).

The cross-sections of the light-receiving members prepared under the above conditions were observed with an electron microscope. The difference in average layer thickness between the center and the both ends of the charge injection preventive layer was found to be 1.1 μm. The difference in average layer thickness of the photosensitive layer was found to be 3.4 μm.

The layer thickness difference within the short range of the photosensitive layer in each light-receiving member was found to have the value shown in Table 15B.

For respective light-receiving members, image exposure was effected by laser beam similarly as in Example 12 to obtain the results as shown in Table 15B .

COMPARATIVE EXAMPLE 2

As a comparative test, an a-Si light-receiving member for electrophotography was prepared in entirely the same manner as in the case when the high frequency power was 150 W in Example 12 as described above except for employing an aluminum substrate roughened on its surface by the sand blasting method in place of the aluminum substrate used in preparation of the light-receiving member for electrophotography in Example 12. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 12, clear interference fringe was found to be formed in the black image over all the surface.

EXAMPLE 24

In this Example, a semiconductor laser (wavelength: 780 nm) with a spot size of 80 μm was employed. Thus, on a cylindrical aluminum substrate (length (L) 357 mm, outer diameter (r) 80 mm) on which A-Si:H is to be deposited, a spiral groove at a pitch (P) of 25 μm and a depth (D) of 0.8 S was prepared by a lathe. The shape of the groove is shown in FIG. 9.

On this aluminum substrate, the charge injection preventive layer and the photosensitive layer were deposited by means of the device as shown in FIG. 63 in the following manner.

First, the constitution of the device is to be explained. 1101 is a high frequency power source, 1102 is a matching box, 1103 is a diffusion pump and a mechanical booster pump, 1104 is a motor for rotation of the aluminum substrate, 1105 is an aluminum substrate, 1106 is a heater for heating the aluminum substrate, 1107 is a gas inlet tube, 1108 is a cathode electrode for introduction of high frequency, 1109 is a shield plate, 1110 is a power source for heater, 1121 to 1125, 1141 to 1145 are valves, 1131 to 1135 are mass flow controllers, 1151 to 1155 are regulators, 1161 is a hydrogen ($H_2$) bomb, 1162 is a silane ($SiH_4$) bomb, 1163 is a diborane ($B_2H_6$) bomb, 1164 is a nitrogen oxide (NO) bomb and 1165 is a methane ($CH_4$) bomb.

Next, the preparation procedure is to be explained. All of the main cocks of the bombs 1161–1165 were closed, all the mass flow controllers and the valves were opened and the deposition device was internally evacuated by the diffusion pump 1103 to $10^{-7}$ Torr. At the same time, the aluminum substrate 1105 was heated by the heater 1106 to 250° C. and maintained constantly at 250° C. After the aluminum substrate 1105 became constantly at 250° C., the valves 1121–1125, 1141–1145 and 1151–1155 were closed, the main cocks of bombs 1161–1165 opened and the diffusion pump 1103 was changed to the mechanical booster pump. The secondary pressure of the valve equipped with regulators 1151–1155 was set at 1.5 Kg/cm$^2$. The mass flow controller 1131 was set at 300 SSCM, and the valves 1141 and 1121 were successively opened to introduce $H_2$ gas into the deposition device.

Next, by setting the mass flow controller 1132 at 150 SCCM, $SiH_4$ gas in 1161 was introduced into the deposition device according to the same procedure as introduction of $H_2$ gas Then, by setting the mass flow controller 1133 so that $B_2H_6$ gas flow rate of the bomb 1163 may be 1600 Vol. ppm relative to $SiH_4$ gas flow rate, $B_2H_6$ gas was introduced into the deposition device according to the same procedure as introduction of $H_2$ gas.

Then, by setting the mass flow controller 1134 so as to control the flow rate of NO gas of 1164 at 3.4 Vol. % based on $SiH_4$ gas flow rate, NO gas was introduced into the deposition device according to the same procedure as introduction of $H_2$.

And, when the inner pressure in the deposition device was stabilized at 0.2 Torr, the high frequency power source 1101 was turned on and glow discharge was generated between the aluminum substrate 1105 and the cathode electrode 1108 by controlling the matching box 1102, and an A-Si:H:B:O layer (p-type A-Si:H layer containing B:O) was deposited to a thickness of 5 μm at a high frequency power of 160 W (charge injection preventive layer).

During layer formation, NO gas flow rate was changed relative to $SiH_4$ gas flow rate as shown in FIG. 49 until the NO gas flow rate became zero no completion of layer formation. After deposition of the 5 μm thick A-Si:H:B:O layer (p-type), inflow of $B_2H_6$ and NO gas stopped by closing the valves 1123 without discontinuing discharging.

And, an A-Si:H layer (non-doped) with a thickness of 20 μm was deposited at a high frequency power of 150 W (photosensitive layer).

Then, setting of the mass flow controller 1132 was changed to 35 SCCM and $CH_4$ gas was introduced from the mass flow controller 1135 at which the $CH_4$ gas flow rate in 1165 relative to the $SiH_4$ gas flow rate had previously been set at a flow rate ratio of $SiH_4/CH_4=1/30$ by opening the valve 1125, and A-SiC(H) with a thickness of 0.5 μm was deposited at a high frequency power of 150 W (surface layer).

With high frequency power being turned off and all the gas valves closed, the depositione device was evacuated and the temperature of the aluminum substrate was lowered to room temperature, and the substrate having formed a light-receiving layer thereon was taken out (Sample No. 1-1C).

Separately, on the cylindrical aluminum substrate with the same surface characteristic, the charge injection preventive layer, the photosensitive layer and the surface layer were formed in the same manner as described above except for changing the high frequency power to 40 W. As the result, as shown in FIG. 64, the surface of the photosensitive layer 6403 was found to be in parallel to the surface of the substrate 6401. In this case, the difference in the total thickness between the center and both ends of the aluminum substrate was found to be 1 μm (Sample No. 1-2C).

Also, in the case when the above high frequency power was 160 W, as shown in FIG. 65, the surface of the photosensitive layer 6503 was found to be non-parallel to the surface of the substrate 6501. In this case, the difference in the total layer thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 (Sample No. 1-2C) during layer formation at 40 W of high frequency power, an interference fringe pattern was observed.

On the other hand, in the light-receiving member having the surface characteristic as shown in FIG. 65 (Sample No. 1-1C), no interference fringe pattern was observed and the member obtained exhibited practically satisfactory electrophotographic characteristics.

EXAMPLE 25

According to the same method as in Example 24 under the conditions when no interference fringe pattern was observed (high frequency power 160 W), seven substrates having formed layers up to photosensitive layer thereon were prepared.

Subsequently, the hydrogen ($H_2$) bomb of 1161 in the device shown in FIG. 63 is replaced with the argon (Ar) gas bomb, the deposition device cleaned, and on all over the cathode electrode are placed a target for sputtering comprising Si and a target for sputtering comprising graphite to an area ratio as indicated in Table 1C. One substrate having formed layers up to photosensitie layer is set and the deposition device is internally brought to reduced pressure sufficiently with the diffusion pump. Then, argon gas is introduced to 0.015 Torr and glow discharging is excited at a high frequency power of 150 W, followed by sputtering of the surface material, to form a surface layer under the condition shown in Table 1C (Condition No. 101C) (Sample No. 101C).

Similarly, for the remainder of six cylinders, surface layers were deposited under the conditions shown in Table 1C (Condition Nos. 102C-107C) (Sample Nos. 102C–107C).

EXAMPLE 26

Except for changing the flow rate ratio of $SiH_4$ gas to $CH_4$ gas during formation of the surface layer to vary the content ratio of silicon atoms to carbon atoms in the surface layer, according to the same method as in Example 24 under the conditions when no interference fringe pattern was observed, respective light-receiving members for electrophotography were prepared. For respective light-receiving members thus obtained, image exposure was effected by laser similarly as in Example 24, and the steps up to transfer were repeated for about 50,000 times, followed by evaluation of images, to obtain the results as shown in Table 2C .

EXAMPLE 27

Except for changing the flow rate ratio of $SiH_4$ gas $SiF_4$ gas to $CH_4$ gas during formation of the surface layer to vary the content ratio of silicon atoms to carbon atoms in the surface layer, according to the same method as in Example 24 under the conditions when no interference fringe pattern was observed, respective light-receiving members for electrophotography were prepared. For respective light-receiving members thus obtained, image exposure was effected by laser similarly as in Example 24, and the steps up to transfer were repeated for about 50,000 times, followed by evaluation of images, to obtain the results as shown in Table 3C.

EXAMPLE 28

Except for changing the layer thickness of the surface layer, according to the same procedure as in Example 24 under the conditions when no interference fringe pattern was observed, respective light-receiving members for electrophotography were prepared. For the respective light-receiving members thus obtained, the steps of image formation, developing and cleaning were repeated similarly as in Example 24 to obtain the results as shown in Table 4C.

EXAMPLE 29

According to entirely the same method as in Example 24 under the conditions when no interference fringe pattern was observed except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 24 to give practically satisfactory results.

EXAMPLE 30

The surface of a cylindrical aluminum substrate was worked by a lathe as shown in Table 5C. On these cylindrical aluminum substrates (Nos. 501C–508C), light-receiving members for electrophotography were prepared under the same conditions when no interference fringe pattern was observed in Example 24 (high frequency power 160 W) (Nos. 511C–518C). The difference in average layer thickness between the center and the both ends of the aluminum substrate was found to be 2.2 μm.

The cross-sections of these light-receiving members for electrophotography were observed with an electron microscope for measurement of the difference within the pitch of the photosensitive layer to obtain the results as shown in Table 6C.

These light-receiving members were subjected to image exposure by a semiconductor laser of a wavelength of 780 nm with a spot diameter of 80 μm by means of the device shown in FIG. 26 similarly as in Example 24 to obtain the results as shown in Table 6C.

EXAMPLE 31

Except for the following points, light-receiving members were prepared under the same conditions as in Example 30 (Nos. 311C–318C). The layer thickness of the charge injection preventive layer was made 10 μm. The difference in average thickness between the center and both ends of the charge injection layer was found to be 1.2 μm, and that of the photosensitive layer 2.3 μm. The thicknesses of the respective layers of Nos. 311C–318C were measured to obtain the results as shown in Table 7C. For these light-receiving members, in the same image exposure device as in Example 24, image exposure was effected to obtain the results as shown in Table 7C.

EXAMPLE 32

On cylindrical aluminum substrates having the surface characteristics shown in Table 5C (Nos. 501C–508C), charge injection preventive layers containing nitrogen provided thereon were prepared under the conditions shown in Table 8C (Nos. 401C–408C).

The cross-sections of the light-receiving members prepared under the above conditions were observed with an electron microscope. The difference in average layer thickness between the center and the both ends of the charge injection preventive layer was found to be 0.09 μm. The difference in average layer thickness of the photosensitive layer was found to be 3 μm.

The layer thickness difference within the short range of the photosensitive layer in each light-receiving member was found to have the value shown in Table 9C.

For respective light-receiving members, image exposure was effected by laser beam similarly as in Example 24 to obtain the results as shown in Table 9C.

EXAMPLE 33

On cylindrical aluminum substrates having the surface characteristics shown in Table 5C (Nos. 501C–508C), charge injection preventive layers containing nitrogen provided thereon were prepared under the conditions shown in Table 10C (501C–508C).

The cross-sections of the light-receiving members prepared under the above conditions were observed with an electron microscope. The difference in average layer thickness between the center and the both ends of the charge injection preventive layer was found to be 0.3 μm. The difference in average layer thickness of The photosensitive layer was found to be 3.2 μm.

The layer thickness difference within the short range of the photosensitive layer in each light-receiving member was found to have the value shown in Table 11C.

For respective light-receiving members, image exposure was effected by laser beam similarly as in Example 24 to obtain the results as shown in Table 11C.

EXAMPLE 34

On cylindrical aluminum substrates having the surface characteristics shown in Table 5C (Nos. 501C–508C), charge injection preventive layers containing carbon were prepared under the conditions shown in Table 12C (Nos. 1001C–1008C).

The cross-sections of the light-receiving members prepared under the above conditions were observed with an electron microscope. The difference in average layer thickness between the center and the both ends of the charge injection preventive layer was found to be 0.08 μm. The difference in average layer thickness of the photosensitive layer was found to be 2.5 μm.

The layer thickness difference within the short range of the photosensitive layer in each light-receiving member (Sample Nos. 1001C–1008C) was found to have the value shown in Table 13C.

For respective light-receiving members (Sample Nos. 1001C–1008C), image exposure was effected by laser beam similarly as in Example 24 to obtain the results as shown in Table 13C.

EXAMPLE 35

On cylindrical aluminum substrates having the surface characteristics shown in Table 5C (Nos. 501C–508C), charge injection preventive layers containing carbon were prepared under the conditions shown in Table 14C (Nos. 1501C–1508C).

The cross-sections of the light-receiving members prepared under the above conditions were observed with an electron microscope. The difference in average layer thickness between the center and the both ends of the charge injection preventive layer was found to be 1.1 μm. The difference in average layer thickness of the photosensitive layer was found to be 3.4 μm.

The layer thickness difference within the short range of the photosensitive layer in each light-receiving member was found to have the value shown in Table 15C.

For respective light-receiving members, image exposure was effected by laser beam similarly as in Example 24 to obtain the results as shown in Table 15C.

EXAMPLE 36

By means of the preparation device shown in FIG. 63, on cylindrical aluminum substrate (Cylinder No. 105), layer formation was performed under the respective conditions shown in Tables 16C to 19C, following the change rate curves of gas flow rate ratio shown in FIGS. 66 through 69 to vary the gas flow rate ratio of NO to $SiH_4$, following otherwise the same conditions and the procedures as in Example 24, to prepare respective light-receiving members for electrophotography (Sample Nos. 1301C–1304C).

The light-receiving members thus obtained were subjected to evaluation of characteristics similarly as in Example 24. As the result, no interference fringe pattern was observed at all with naked eyes, and satisfactory good electrophotographic characteirstics were exhibited as suited for the object of the present invention.

EXAMPLE 37

Figure 66:
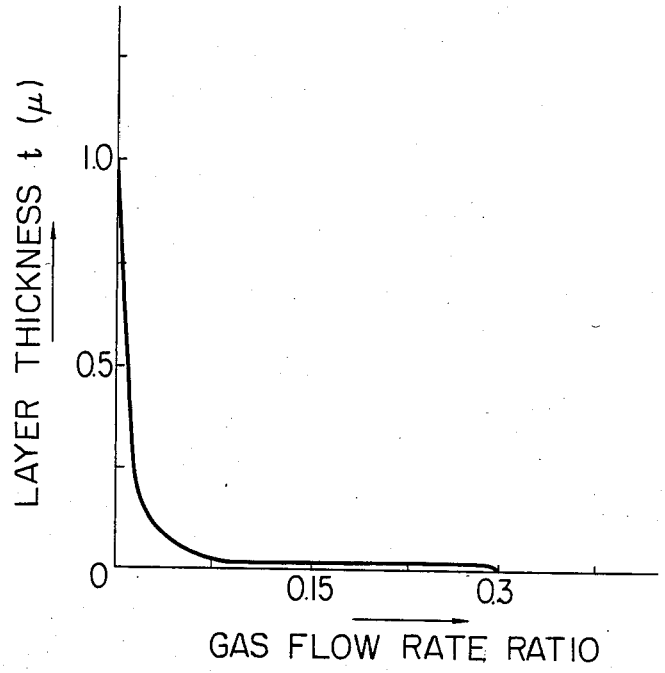
Figure 67:
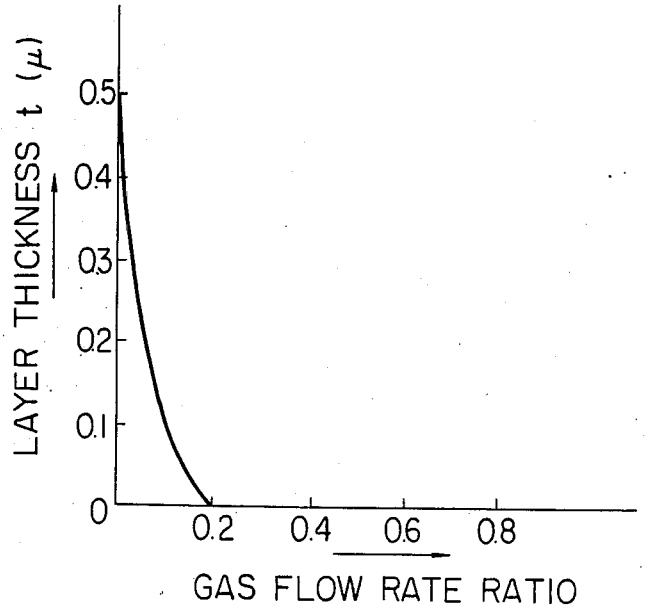

By means of the preparation device shown in FIG. 63, on cylindrical aluminum substrate (Cylinder No. 105), layer formation was performed under the respective conditions shown in Table 20C, following the change rate curves of gas flow rate ratio shown in FIG. 66 to vary the gas flow rate ratio of NO to $SiH_4$, following otherwise the same conditions and the procedures as in Example 24, to prepare respective light-receiving members for electrophotography.

The light-receiving members thus obtained were subjected to evaluation of characteristics similarly as in Example 24. As the result, no interference fringe pattern was observed at all with naked eyes, and satisfactory good electrophotographic characteristics were exhibited as suited for the object of the present invention.

COMPARATIVE EXAMPLE 3

As a comparative test, an a-Si light-receiving member for electrophotography was prepared in entirely the same manner as in the case when the high frequency power was 150 W in Example 24 as described above except for employing an aluminum substrate roughened on its surface by the sand blasting method in place of the aluminum substrate used in preparation of the light-receiving member for electrophotography in Example 24. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 24, clear interference fringe was found to be formed in the black image over all the surface.

EXAMPLE 38

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving members for electrophotography were deposited on the above aluminum substrate following various procedures under the conditions as shown in Table 7D using the deposition device as shown in FIG. 20 (Sample No. 1–1D).

Deposition of the surface layer was carried out as follows.

After formation of the second layer, the mass flow controllers corresponding to respective gases were set so that the $CH_4$ gas flow rate relative to the $SiH_4$ gas flow rate may be $SiH_4/CH_4$1/30 as shown in Table 7D, and a-SiC(H) with a thickness of 0.5 μm was deposited at a high frequency power of 150 W.

Figure 82:
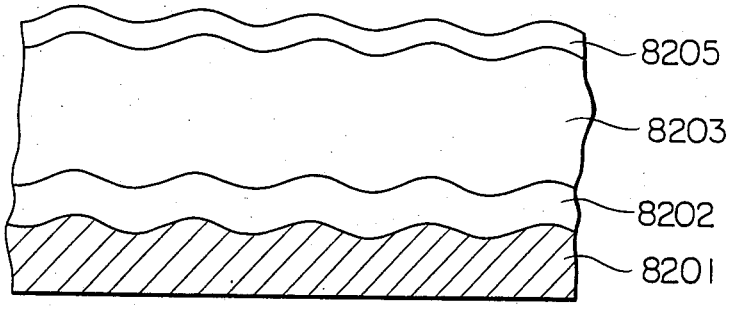

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layer between the center and the both ends of the aluminum substrate was found to be 1 μm (Sample No. 1–2D).

Figure 83:
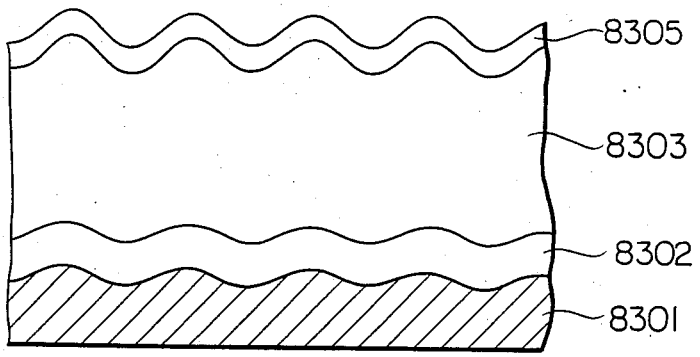

On the other hand, in the case of the above Sample No. 1–1D, the surface of the surface layer 8305 and the surface of the substrate 8301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 with a semiconductor laser (wavelength of laser beam: 780 nm, spot diameter 80 μm), followed by development and transfer to obtain images. In the light-receiving member having the surface characteristic as shown in FIG. 82, interference fringe pattern was observed.

On the other hand, in the light-receiving member having the surface characteristic as shown in FIG. 83, no interference fringe pattern was observed to give practically satisfactory electrophotographic characteristics.

EXAMPLE 39

After formation of layers up to the second layer similarly as in the case of Sample No. 1-1D in Example 38, hydrogen ($H_2$) gas bomb was replaced with argon (Ar) bomb, the deposition device cleaned, and on all over the cathode electrode were placed a target or sputtering comprising Si and a target for sputtering comprising graphite to an area ratio shown in Sample No. 101D in Table 1D. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, thereby depositing a surface layer of Sample No. 101D in Table 1D on the above substrate.

Similarly, except for varying the target area ratio of Si to graphite to form the surface layer as shown in Sample Nos. 102D to 107D in Table 1D, light-receiving members were prepared in the same manner as described above.

For the respective light-receiving members for electrophotography, image exposure was effected by laser similarly as in Example 38 and the steps to transfer were repeated for about 50,000 times, followed by evaluation of images. The results as shown in Table 1D were obtained.

EXAMPLE 40

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1D in Example 38 respective light-receiving members for electrophotography were prepared. For respective light-receiving members thus obtained, image exposure was effected by laser similarly as in Example 38, and the steps up to transfer were repeated for about 50,000 times, followed by evaluation of images, to obtain the results as shown in Table 2D.

EXAMPLE 41

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1D in Example 38 respective light-receiving members for electrophotography were prepared. For respective light-receiving members thus obtained, image exposure was effected by laser similarly as in Example 38, and the steps up to transfer were repeated for about 50,000 times, followed by evaluation of images, to obtain the results as shown in Table 3D.

EXAMPLE 42

Except for changing the layer thickness of the surface layer, according to the same method as the case of Sample No. 1-1D in Example 38 respective light-receiving members for electrophotography were prepared. For the respective light-receiving members thus obtained, the steps of image formation, developing and cleaning were repeated similarly as in Example 38 to obtain the results as shown in Table 4D.

EXAMPLE 43

According to entirely the same method as the case of Sample No. 1-1D in Example 38 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 38 to give practically satisfactory results.

EXAMPLE 44

The surface of a cylindrical aluminum substrate was worked by a lathe as shown in Table 5D. On these cylindrical aluminum substrates (Nos. 101D-108D), light-receiving members for electrophotography were prepared under the same conditions as the case of Sample No. 1-1D in Example 38 (Nos. 111D-118D). The difference in average layer thickness between the center and the both ends of the aluminum substrate was found to be 2.2 μm.

The cross-sections of these light-receiving members for electrophotography were observed with an electron microscope for measurement of the difference within the pitch of the light-receiving layer to obtain the results as shown in Table 6D.

These light-receiving members were subjected to image exposured by a semiconductor laser of a wavelength of 780 nm with a spot diameter of 80 μm by means of the device shown in FIG. 26 similarly as in Example 38 to obtain the results as shown in Table 6D.

EXAMPLE 45

Under the conditions shown in Table 8D, light-receiving members for electrophotography were formed similarly as in the case of Sample No. 1-1D in Example 38 .

For these light-receiving members for electrophotography, by means of the same device as in Example 38, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 46

Under the conditions shown in Table 9D, light-receiving members for electrophotography were formed similarly as in the case of Sample No. 1-1D in Example 38.

For these light-receiving members for electrophotography, by means of the same device as in Example 38, image exposure was effected, followed by developing, transfer and fixing, to obtain visible images on plain papers. Such an image forming process was repeated 100.000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 47

Under the conditions shown in Table 10D, light-receiving members for electrophotography were formed similarly as in the case of Sample No. 1-1D in Example 38.

For these light-receiving members for electrophotography, by means of the same device as in Example 38, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

COMPARATIVE EXAMPLE 4

As a comparative test, an a-Si light-receiving member for electrophotography was prepared in entirely the same manner as in the case Sample No. 1-1D in Example 38 as described above except for employing an aluminum substrate roughened on its surface by the sand blasting method in place of the aluminum substrate used in preparation of the light-receiving member for electrophotography in Example 38. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 38, clear interference fringe was found to be formed in the black image over all the surface.

EXAMPLE 48

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving members for electrophotography were deposited on the above aluminum substrate following various procedures under the conditions as shown in Table 7E using the deposition device as shown in FIG. 20 (Sample No. 1-1E).

Figure 22:
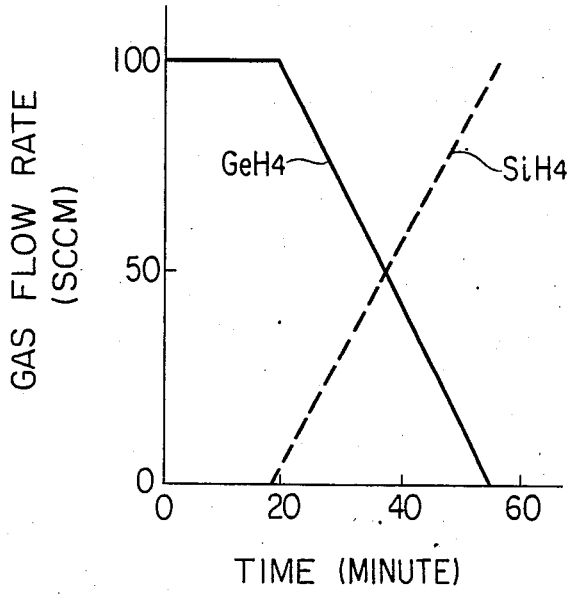
FIGS. 22 through 25, FIGS. 36 through 42, FIGS. 52 through 62 and FIGS. 66 through 81 are schematic illustrations showing changes in gas flow rates of respective gases in Examples.

In preparation of the first layer of a-(Si:Ge):H layer, the mass flow controllers 2007 and 2008 were controlled by a computer (HP9845B) so that the flow rates of $GeH_4$ and $SiH_4$ might be as shown in FIG. 22.

Deposition of the surface layer was carried out as follows.

After formation of the second layer, the mass flow controllers corresponding to respective gases were set so that the $CH_4$ gas flow rate relative to the $SiH_4$ gas flow rate may be $SiH_4/CH_4=1/30$ as shown in Table 7E, and a-SiC(H) with a thickness of 0.5 μm was deposited at a high frequency power of 150 W.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layer between the center and the both ends of the aluminum substrate was found to be 1 μm (Sample No. 1-2E).

On the other hand, in the case of the above Sample No. 1-1E, the surface of the surface layer 8305 and the surface of the substrate 8301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 with a semiconductor laser (wavelength of laser beam: 780 nm, spot diameter 80 μm), followed by development and transfer to obtain images. In the light-receiving member having the surface characteristic as shown in FIG. 82, interference fringe pattern was observed.

On the other hand, in the light-receiving member having the surface characteristic as shown in FIG. 83, no interference fringe pattern was observed to give practically satisfactory electrophotographic characteristics.

EXAMPLE 49

After formation of layers up to the second layer similarly as in the case of Sample No. 1-1E in Example 48, hydrogen ($H_2$) gas bomb was replaced with argon (Ar) bomb, the deposition device cleaned, and on all over the cathode electrode were placed a target or sputtering comprising Si and a target for sputtering comprising graphite to an area ratio shown in Sample No. 101E in Table 1E. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, thereby depositing a surface layer of Sample No. 101E in Table 1E on the above substrate.

Similarly, except for varying the target area ratio of Si to graphite to form the surface layer as shown in Sample Nos. 102E to 107E in Table 1E, light-receiving members were prepared in the same manner as described above.

For the respective light-receiving members for electrophotography, image exposure was effected by laser similarly as in Example 48 and the steps to transfer were repeated for about 50,000 times, followed by evaluation of images. The results as shown in Table 1E were obtained.

EXAMPLE 50

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1E in Example 48 respective light-receiving members for electrophotography were prepared. For respective light-receiving members thus obtained, image exposure was effected by laser similarly as in Example 48, and the steps up to transfer were repeated for about 50,000 times, followed by evaluation of images, to obtain the results as shown in Table 2E.

EXAMPLE 51

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1E in Example 48 respective light-receiving members for electrophotography were prepared. For respective light-receiving members thus obtained, image exposure was effected by laser similarly as in Example 48, and the steps up to transfer were repeated for about 50,000 times, followed by evaluation of images, to obtain the results as shown in Table 3E.

EXAMPLE 52

Except for changing the layer thickness of the surface layer, according to the same method as the case of Sample No. 1-1E in Example 48 respective light-receiving members for electrophotography were prepared. For the respective light-receiving members thus obtained, the steps of image formation, developing and cleaning were repeated similarly as in Example 48 to obtain the results as shown in Table 4E.

EXAMPLE 53

According to entirely the same method as the case of Sample No. 1-1E in Example 48 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 48 to give practically satisfactory results.

EXAMPLE 54

The surface of a cylindrical aluminum substrate was worked by a lathe as shown in Table 5E. On these cylindrical aluminum substrates (Nos. 101E-108E), light-receiving members for electrophotography were prepared under the same conditions as the case of Sample No. 1-1E in Example 48 (Nos. 111E-118E). The difference in average layer thickness between the center and the both ends of the aluminum substrate was found to be 2.2 μm.

The cross-sections of these light-receiving members for electrophotography were observed with an electron microscope for measurement of the difference within the pitch of the light-receiving layer to obtain the results as shown in Table 6E.

These light-receiving members were subjected to image exposure by a semiconductor laser of a wavelength of 780 nm with a spot diameter of 80 μm by means of the device shown in FIG. 26 similarly as in Example 48 to obtain the results as shown in Table 6E.

EXAMPLE 55

Under the conditions shown in Table 7E, light-receiving members for electrophotography were formed similarly as in the case of Sample No. 1-1E in Example 48.

Figure 23:
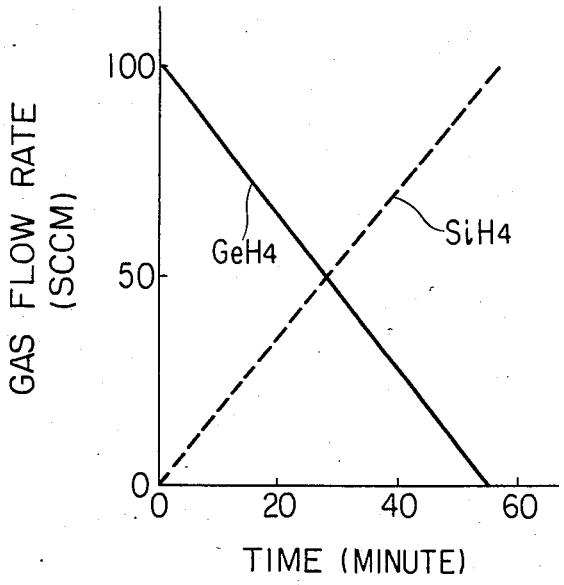

In preparation of the first layer of A-(Si:Ge):H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23 .

For these light-receiving members for electrophotography, by means of the same device as in Example 48, image exposure was effected, followed by developing, transfer and fixing, to obtain visible images on plain papers Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 56

Under the conditions shown in Table 8E, light-receiving members for electrophotography were formed similarly as in the case of Sample No. 1-1E in Example 48.

Figure 24:
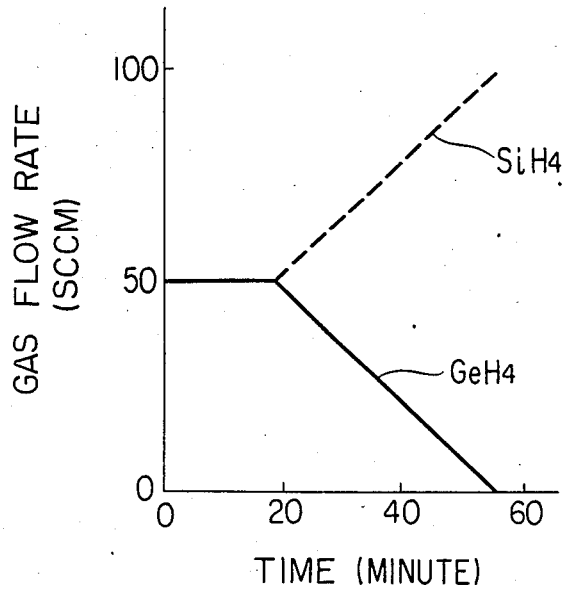

In preparation of the first layer of A-(Si:Ge):H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 24.

For these light-receiving members for electrophotography, by means of the same device as in Example 48, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 57

Under the conditions shown in Table 8E, light-receiving members for electrophotography were formed similarly as in the case of Sample No. 1-1E in Example 48.

Figure 25:
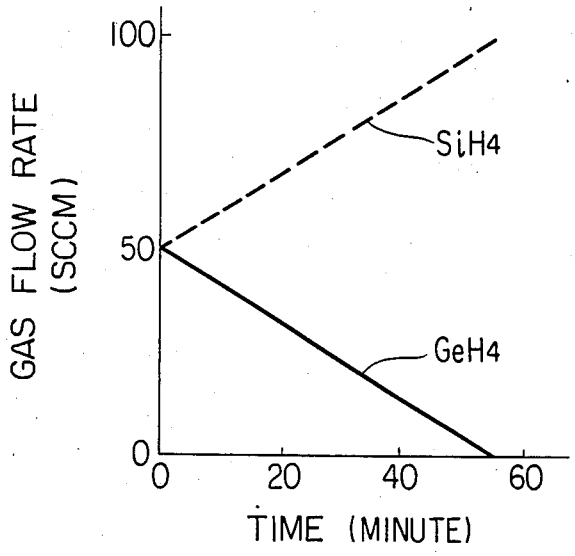

In preparation of the first layer of A-(Si:Ge):H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 25.

For these light-receiving members for electrophotography, by means of the same device as in Example 48, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

COMPARATIVE EXAMPLE 5

As a comparative test, an a-Si light-receiving member for electrophotography was prepared in entirely the same manner as in the case Sample No. 1-1E in Example 48 as described above except for employing an aluminum substrate roughened on its surface by the sand blasting method in place of the aluminum substrate used in preparation of the light-receiving member for electrophotography in Example 48. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 48, clear interference fringe was found to be formed in the black image over all the surface.

EXAMPLE 58

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving members for electrophotography were deposited on the above aluminum substrate following various procedures under the conditions as shown in Table 7F using the deposition device as shown in FIG. 20 (Sample No. 1-1F).

Deposition of the surface layer was carried out as follows.

After formation of the second layer, the mass flow controllers corresponding to respective gases were set so that the $CH_4$ gas flow rate relative to the $SiH_4$ gas flow rate may be $SiH_4/CH_4=1/30$ as shown in Table 7F, and a-SiC(H) with a thickness of 0.5 μm was deposited at a high frequency power of 150 W.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layer between the center and the both ends of the aluminum substrate was found to be 1 μm (Sample No. 1-2F).

On the other hand, in the case of the above Sample No. 1-1F, the surface of the surface layer 8305 and the surface of the substrate 8301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 with a semiconductor laser (wavelength of laser beam: 780 nm, spot diameter 80 μm), followed by development and transfer to obtain images. In the light-receiving member having the surface characteristic as shown in FIG. 82, interference fringe pattern was observed.

On the other hand, in the light-receiving member having the surface characteristic as shown in FIG. 83, no interference fringe pattern was observed to give practically satisfactory electrophotographic characteristics.

EXAMPLE 59

After formation of layers up to the second layer similarly as in the case of Sample No. 1-1F in Example 58, hydrogen ($H_2$) gas bomb was replaced with argon (Ar) bomb, the deposition device cleaned, and on all over the cathode electrode were placed a target or sputtering comprising Si and a target for sputtering comprising graphite to an area ratio shown in Sample No. 101F in Table 1F. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, thereby depositing a surface layer of Sample No. 101F in Table 1F on the above substrate.

Similarly, except for varying the target area ratio of Si to graphite to form the surface layer as shown in Sample Nos. 102F to 107F in Table 1F, light-receiving members were prepared in the same manner as described above.

For the respective light-receiving members for electrophotography, image exposure was effected by laser similarly as in Example 58 and the steps to transfer were repeated for about 50,000 times, followed by evaluation of images. The results as shown in Table 1F were obtained.

EXAMPLE 60

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1F in Example 58 respective light-receiving members for electrophotography were prepared. For respective light-receiving members thus obtained, image exposure was effected by laser similarly as in Example 58, and the steps up to transfer were repeated for about 50,000 times, followed by evaluation of images, to obtain the results as shown in Table 2F.

EXAMPLE 61

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1F in Example 58 respective light-receiving members for electrophotography were prepared. For respective light-receiving members thus obtained, image exposure was effected by laser similarly as in Example 58, and the steps up to transfer were repeated for about 50,000 times, followed by evaluation of images, to obtain the results as shown in Table 3F.

EXAMPLE 62

Except for changing the layer thickness of the surface layer, according to the same method as the case of Sample No. 1-1F in Example 58 respective light-receiving members for electrophotography were prepared. For the respective light-receiving members thus obtained, the steps of image formation, developing and cleaning were repeated similarly as in Example 58 to obtain the results as shown in Table 4F.

EXAMPLE 63

According to entirely the same method as the case of Sample No. 1-1F in Example 58 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 58 to give practically satisfactory results.

EXAMPLE 64

The surface of a cylindrical aluminum substrate was worked by a lathe as shown in Table 5F. On these cylindrical aluminum substrates (Nos. 101F-108F), light-receiving members for electrophotography were prepared under the same conditions as the case of Sample No. 1-1F in Example 58 (Nos. 111F-118F). The difference in average layer thickness between the center and the both ends of the aluminum substrate was found to be 2.2 μm.

The cross-sections of these light-receiving members for electrophotography were observed with an electron microscope for measurement of the difference within the pitch of the light-receiving layer to obtain the results as shown in Table 6F.

These light-receiving members were subjected to image exposured by a semiconductor laser of a wavelength of 780 nm with a spot diameter of 80 μm by means of the device shown in FIG. 26 similarly as in Example 58 to obtain the results as shown in Table 6F.

EXAMPLE 65

Under the conditions shown in Table 8F, light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 66

Under the conditions shown in Table 9F, light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 67

Under the conditions shown in Table 10F light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 68

Under the conditions shown in Table 11F, light-receiving members for electrophotography were formed similarly as in the case of Sample No. 1-1F in Example 58.

For these light-receiving members for electrophotography, by means of the same device as in Example 58 image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 69

Under the conditions shown in Table 12F, light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 70

Under the conditions shown in Table 13F, light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 71

Under the conditions shown in Table 14F, light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 72

Under the conditions shown in Table 15F, light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 73

Under the conditions shown in Table 16F, light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 74

Under the conditions shown in Table 17F, light-receiving members for electrophotography were formed similarly as in the case of Sample No. 1-1F in Example 58.

For these light-receiving members for electrophotography, by means of the same device as in Example 58. image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 75

Under the conditions shown in Table 18F, light-receiving members for electrophotography were formed similarly as in the case of Sample No. 1-1F in Example 58.

For these light-receiving members for electrophotography, by means of the same device as in Example 58. image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 76

Under the conditions shown in Table 19F, light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 77

Under the conditions shown in Table 20F, light-receiving members for electrophotography were formed similarly as in the case of Sample No. 1-1F in Example 58.

For these light-receiving members for electrophotography, by means of the same device as in Example 58, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 78

The case of Sample No. 1-1F in Example 58 and Examples 65 to 77 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as the case of Sample No. 1-1F in Example 58 and in Examples 65 to 77.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 6

As a comparative test, an a-Si light-receiving member for electrophotography was prepared in entirely the same manner as in the case Sample No. 1-1F in Example 58 as described above except for employing an aluminum substrate roughened on its surface by the sand blasting method in place of the aluminum substrate used in preparation of the light-receiving member for electrophotography in Example 58. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 58, clear interference fringe was found to be formed in the black image over all the surface.

EXAMPLE 79

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving members for electrophotography were deposited on the above aluminum substrate following various procedures under the conditions as shown in Table 7G using the deposition device as shown in FIG. 20 (Sample No. 1-1G).

In preparation of the first layer of a-(Si:Ge):H layer, the mass flow controllers 2007 and 2008 were controlled by a computer (HP9845B) so that the flow rates of $GeH_4$ and $SiH_4$ might be as shcwn in FIG. 22.

After formation of the second layer, the mass flow controllers corresponding to resPective gases were set so that the $CH_4$ gas flow rate relative to the $SiH_4$ gas flow rate may be $SiH_4/CH_4=1/30$ as shown in Table 7G , and a-SiC(H) with a thickness of 0.5 μm was deposited at a high frequency power of 150 W.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layer between the center and the both ends of the aluminum substrate was found to be 1 μm (Sample No. 1-2G).

On the other hand, in the case of the above Sample No. 1-1G, the surface of the surface layer 8305 and the surface of the substrate 8301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 with a semiconductor laser (wavelength of laser beam: 780 nm, spot diameter 80 μm), followed by development and transfer to obtain images. In the light-receiving member having the surface characteristic as shown in FIG. 82, interference fringe pattern was observed.

On the other hand, in the light-receiving member having the surface characteristic as shown in FIG. 83, no interference fringe pattern was observed to give practically satisfactory electrophotographic characteristics.

EXAMPLE 80

After formation of layers up to the second layer similarly as in the case of Sample No. 1-1G in Example 79 hydrogen ($H_2$) gas bomb was replaced with argon (Ar) bomb, the deposition device cleaned, and on all over the cathode electrode were placed a target or sputtering comprising Si and a target for sputtering comprising graphite to an area ratio shown in Sample No. 101G in Table 1G. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, thereby depositing a surface layer of Sample No. 101G in Table 1G on the above substrate.

Similarly, except for varying the target area ratio of Si to graphite to form the surface layer as shown in Sample Nos. 102G to 107G in Table 1G, light-receiving members were prepared in the same manner as described above.

For the respective light-receiving members for electrophotography, image exposure was effected by laser similarly as in Example 79 and the steps to transfer were repeated for about 50,000 times, followed by evaluation of images. The results as shown in Table 1G were obtained.

EXAMPLE 81

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1G in Example 79 respective light-receiving members for electrophotography were prepared. For respective light-receiving members thus obtained, image exposure was effected by laser similarly as in Example 79, and the steps up to transfer were repeated for about 50,000 times, followed by evaluation of images, to obtain the results as shown in Table 2G.

EXAMPLE 82

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1 G in Example 79 respective light-receiving members for electrophotography were prepared. For respective light-receiving members thus obtained, image exposure was effected by laser similarly as in Example 79, and the steps up to transfer were repeated for about 50,000 times, followed by evaluation of images, to obtain the results as shown in Table 3G .

EXAMPLE 83

Except for changing the layer thickness of the surface layer, according to the same method as the case of Sample No. 1-1G in Example 79 respective light-receiving members for electrophotography were prepared. For the respective light-receiving members thus obtained, the steps of image formation, developing and cleaning were repeated similarly as in Example 79 to obtain the results as shown in Table 4G.

EXAMPLE 84

According to entirely the same method as the case of Sample No. 1-1G in Example 79 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 79 to give practically satisfactory results.

EXAMPLE 85

The surface of a cylindrical aluminum substrate was worked by a lathe as shown in Table 5G . On these cylindrical aluminum substrates (Nos. 101G-108G), light-receiving members for electrophotography were prepared under the same conditions as the case of Sample No. 1-1G in Example 79 (Nos. 111G-118G). The difference in average layer thickness between the center and the both ends of the aluminum substrate was found to be 2.2 μm.

The cross-sections of these light-receiving members for electrophotography were observed with an electron microscope for measurement of the difference within the pitch of the light-receiving layer to obtain the results as shown in Table 6G.

These light-receiving members were subjected to image exposure by a semiconductor laser of a wavelength of 780 nm with a spot diameter of 80 μm by means of the device shown in FIG. 26 similarly as in Example 79 to obtain the results as shown in Table 6G.

EXAMPLE 86

Under the conditions shown in Iable 7G, light-receiving members for electrophotography were formed similarly as in the case of Sample No. 1-1G in Example 79.

In preparation of the first layer of A-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same device as in Example 79, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copYing for 100,000 times.

EXAMPLE 87

Under the conditions shown in Table 8G, light-receiving members for electrophctography were formed similarly as in the case of Sample No. 1-1G in Example 79.

In preparation of the first layer of A-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

For these light-receiving members for electrophotography, by means of the same device as in Example 79, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 88

Under the conditions shown in Table 8G, light-receiving members for electrophotography were formed similarly as in the case of Sample No. 1-1G in Example 79.

In preparation of the first layer of A-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same device as in Example 79, image exposure was effected, followed by developing, transfer and fixing, to obtain visible images on plain papers. Such an image forming proces: was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 89

Under the conditions shown in Table 9G, light-receiving members for electrophotography were formed similarly as in the case of Sample No. 1-1G in Example 79.

In preparation of the first layer of A-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

For thcse light-receiving members for electrophotography, by means of the same device as in Example 79, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copYing for 100,000 times.

EXAMPLE 90

Under the conditions shown in Table 10G, light-receiving members for electrophotography were formed similarly as in the case of Sample No. 1-1G in Example 79.

In preparation of the first layer of A-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 24.

For these light-receiving members for electrophotography, by means of the same device as in Example 79, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 91

Under the conditions shown in Table 11G, light-receiving members for electrophotography were formed similarly as in the case of Sample No. 1-1G in Example 79.

In preparation of the first layer of A-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 25.

For these light-receiving members for electrophotography, by means of the same device as in Example 9, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 92

Under the conditions shown in Table 12G, light-receiving members for electrophotography were formed similarly as in the case of Sample No. 1-1G in Example 79.

In preparation of the first layer of A-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving memters for electrophotography, by means of the same device as in Example 79, image exposure was effected, follcwed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 93

The case of Sample No. 1-1G in Example 79 and Examples 86 to 92 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as the case of Sample No. 1-1G in Example 79 and in Examples 86 to 92.

For these light-receiving members for electrophotography, image exposure was effected by means of an image exposure device as shown in FIG. 26 (wavelength of laser beam: 780 nm, spot diameter 60 $\mu$m), followed by development and transfer, to obtair images. All of the images were free from interference fringe pattern and practically satisfactory.

COMPARATIVE EXAMPLE 7

As a comparative test, an a-Si light-receiving member for electrophotography was prepared in entirely the same manner as in the case of Sample No. 1-1G in Example 79 as described above except for employing an aluminum substrate roughened on its surface by the sand blasting method in place of the aluminum substrate used in preparation of the light-receiving member for electrophotography in Example 79. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 $\mu$m.

When the same measurement was conducted by mounting the light-receiving member for electrophotography for comparative purpose on the device shown in FIG. 26 employed in Example 79, clear interference fringe was found to be formed in the black image over all the surface.

EXAMPLE 94

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, a-Si light-receiving members for electrophotography were deposited on the above aluminum substrate following various proceduree under the conditions as shown in Table 7H using the deposition device as shown in FIG. 20 (Sample No. 1-1H).

Deposition of the surface layer was carried out as follows.

After formation of the second layer, the mass flow controllers corresponding to respective gases were set so that the $CH_4$ gas flow rate relative to the $SiH_4$ gas flow rate may be $SiH_4/CH_4=1/30$ as shown in Table 7H, and a-SiC(H) with a thickness of 0.5 μm was deposited at a high frequency power of 150 W.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layer between the center and the both ends of the aluminum substrate was found to be 1 μm (Sample No. 1-1H).

On the other hand, in the case of the above Sample No. 1-1H, the surface of the surface layer 8305 and the surface of the substrate 8301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shcwn in FIG. 26 with a semiconductor laser (wavelength of laser beam: 80 nm, spot diameter 80 μm), followed by development and transfer to obtain images. In the light-receiving member having the surface characteristic as shown in FIG. 82, interference fringe pattern was observed.

On the other hand, in the light-receiving member having the surface characteristic as shown in FIG. 83, no interference fringe pattern was observed to give practically satisfactory electrophotographic characteristics.

EXAMPLE 95

After formation of layers up to the second layer similarly as in the case of Sample No. 1-1H in Example 94, hydrogen ($H_2$) gas bomb was replaced with argon (Ar) bomb, the deposition device cleaned, and on all over the cathode electrode were placed a target for sputtering comprising Si and a target for sputtering comprising graphite to an area ratio shown in Sample No. 101H in Table 1H. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, thereby depositing a surface layer of Sample No. 101H in Table 1H on the above substrate.

Similarly, except for varying the target area ratio of Si to graphite to form the surface layer as shown in Sample Nos. 102H to 107H in Table 1H, light-receiving members were prepared in the same manner as described above.

For the respective light-receiving members for electrophotography, image exposure was effected by laser similarly as in Example 94 and the steps to transfer were repeated for about 50,000 times, followed by evaluation of images. The results as shown in Table 1H were obtained.

EXAMPLE 96

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1H in Example 94 respective light-receiving members for electrophotography were prepared. For respective light-receiving members thus obtained, image exposure was effected by laser similarly as in Example 94, and the steps up to transfer were repeated for about 50,000 times, followed by evaluation of images, to obtain the results as shown in Table 2H.

EXAMPLE 97

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1H in Example 94 respective light-receiving members for electrophotography were prepared. For respective light-receiving members thus obtained, image exposure was effected by laser similarly as in Example 94, and the steps up to transfer were repeated for about 50,000 times, followed by evaluation of images, to obtain the results as shown in Table 3H.

EXAMPLE 98

Except for changing the layer thickness of the surface layer, according to the same method as the case of Sample No. 1-1H in Example 94 respective light-receiving members for electrophotography were prepared. For the respective light-receiving members thus obtained, the steps of image formation, developing and cleaning were repeated similarly as in Example 94 to obtain the results as shown in Table 4H .

EXAMPLE 99

According to entirely the same method as the case of Sample No. 1-1H in Example 94 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 94 to give practically satisfactory results.

EXAMPLE 100

The surface of a cylindrical aluminum substrate was worked by a lathe as shown in Table 5H. On these cylindrical aluminum substrates (Nos. 101H-108H), light-receiving members for electrophotography were prepared under the same conditions as the case of Sample No. 1-1H in Example 94 (Nos. 111H-118H). The difference in average layer thickress between the center and the both ends of the aluminum substrate was found to be 2.2 μm.

The cross-sections of these light-receiving members for electrophotography were observed with an electron microscope for measurement of the difference within the pitch of the light-receiving layer to obtain the results as shown in Table 6H.

These light-receiving members were subjected to image exposure by a semiconductor laser of a wavelength of 780 nm with a spot diameter of 80 μm by means of the device shown in FIG. 26 similarly as in Example 94 to obtain the results as shown in Table 6H.

EXAMPLE 101

Under the conditions shown in Table 8H, light-receiving members for electrophotography were formed similarly as in the case of Sample No. 1-1H in Example 94.

For these light-receiving members for electrophotography, by means of the same device as in Example 94, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 102

Under the conditions shown in Table 9H, light-receiving members for electrophotography were formed similarly as in the case of Sample No. 1-1H in Example 94.

For these light-receiving members for electrophotography, by means of the same device as in Example 94, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 103

Under the conditions shown in Table 10H, light-receiving members for electrophotography were formed similarly as in the case of Sample No. 1-1H in Example 94.

For these light-receiving members for electrophotography, by means of the same device as in Example 94, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 104

Under the conditions shown in Table 11H, light-receiving members for electrophotography were formed similarly as in the case of Sample No. 1-1H in Example 94.

Figure 60:
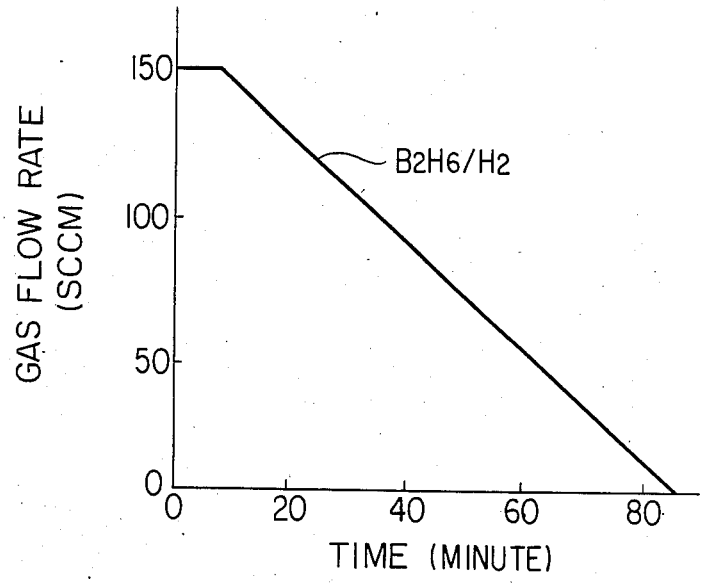

The boron containing layer was formed by controlling the mass flow controller 2010 for $B_2H_6/H_2$ by a computer (HP9845B) so that the flow rate of $B_2H_6/H_2$ may become as shown in FIG. 60 .

For these light-receiving members for electrophotography, by means of the same device as in Example 94, image exposure was effected, followed oy developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 105

Under the conditions shown in Table 12H, light-receiving members for electrophotography were formed similarly as in the case of Sample No. 1-1H in Example 94.

Figure 61:
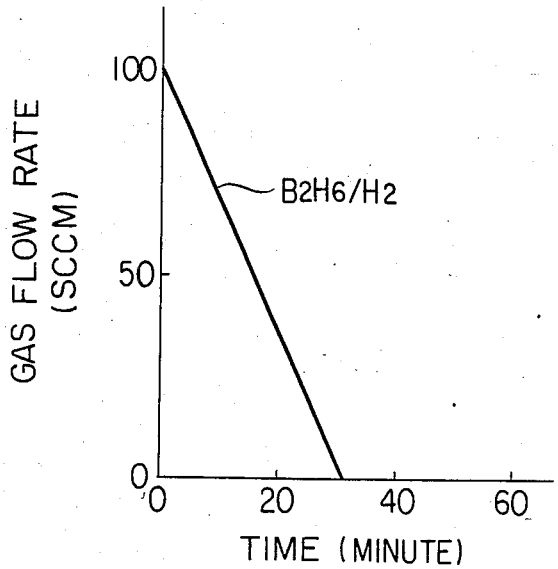

The boron containing layer was formed by controlling the mass flow controller 2010 for $B_2H_6/H_2$ by a computer (HP9845B) so that the flow rate of $B_2H_6/H_2$ may become as shown in FIG. 61.

For these light-receiving members for electrophotography, by means of the same device as in Example 94, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 106

Under the conditions shown in Table 13H, light-receiving members for electrophotography were formed similarly as in the case of Sample No. 1-1H in Example 94.

Figure 78:
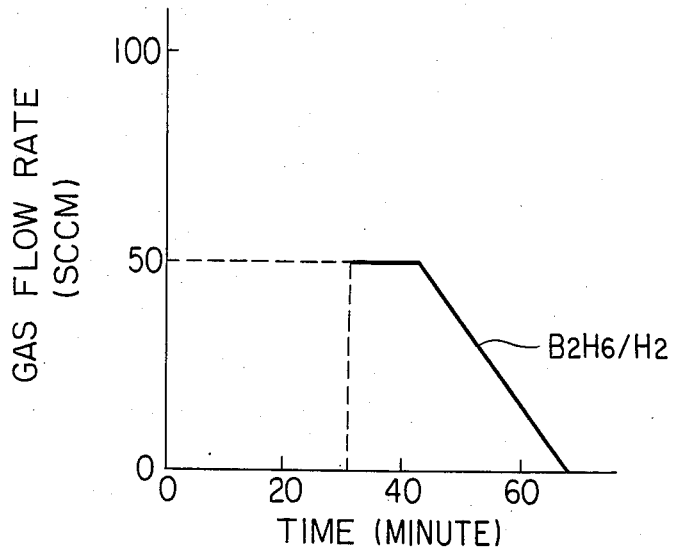

The boron containing layer was formed by controlling the mass flow controller 2010 for $B_2H_6/H_2$ by a computer (HP9845B) so that the flow rate of $B_2H_6/H_2$ may become as shown in FIG. 78.

For these light-receiving members for electrophotography, by means of the same device as in Example 94, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 107

Under the conditions shown in Table 14H, light-receiving members for electrophotography were formed similarly as in the case of Sample No. 1-1H in Example 94.

Figure 81:
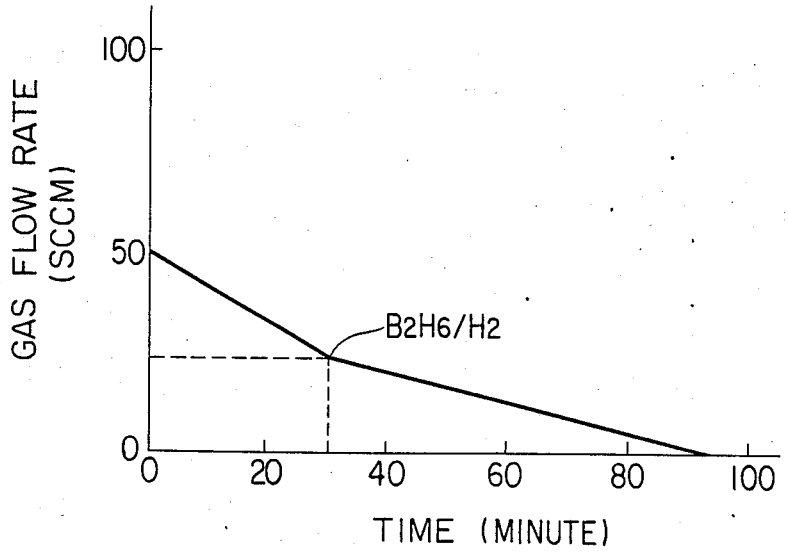

The boron containing layer was formed by controlling the mass flow controller 2010 for $B_2H_6/H_2$ by a computer (HP9845B) so that the flow rate of $B_2H_6/H_2$ may become as shown in FIG. 81.

For these light-receiving members for electrophotography, by means of the same device as in Example 94, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 108

The case of Sample No. 1-1H in Example 94 and Examples 101 to 107 were repeated except that $PH_3$ gas diluted to 3000 vol ppm with $H_2$ was employed in place of $B_2H_6$ gas diluted to 3000 vol ppm with $H_2$ to prepare light-receiving members fcr electrophotography respectively.

Other preparation conditions were the same as the case of Sample No. 1-1H in Example 94 and in Examples 101 to 107.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 8

As a comparative test, an a-Si light-receiving member for electrophotography was prepared in entirely the same manner as in the case of Sample Nos. 1-1H in Example 94 as described above except for employing an aluminum substrate roughened on its surface by the sand blasting method in place of the aluminum substrate used in preparation of the light-receiving member fot electrophotography in Example 94. The surface condition of the aluminum substrate subjected to the surface roughening treatment according to the sand blasting method was measured by the Universal Surface Shape Measuring Instrument (SE-3C) produced by Kosaka Research Institute before providion of the light-receiving layer. As the result, the average surface roughness was found to be 1.8 μm.

When the same measurement was conducted by mounting the light-receiving member for electrophotography for comparative purpose on the device shown in FIG. 26 employed in Example 94, clear interference fringe was found to be formed in the black image over all the surface.

EXAMPLE 109

An aluminum substrate having the shape as shown in FIG. 9 (spiral groove surface shape with length (L): 357 mm, outerdiameter (r) 80 mm; pitch (P) 25 μm; depth (D) 0.8 μm) was prepared.

Next, a-Si light-receiving members for electrophotography were deposited on the above aluminum substrate following various procedures under the conditions as shown in Table 7I using the deposition device as shown in FIG. 20 (Sample No 1-1I).

Figure 36:
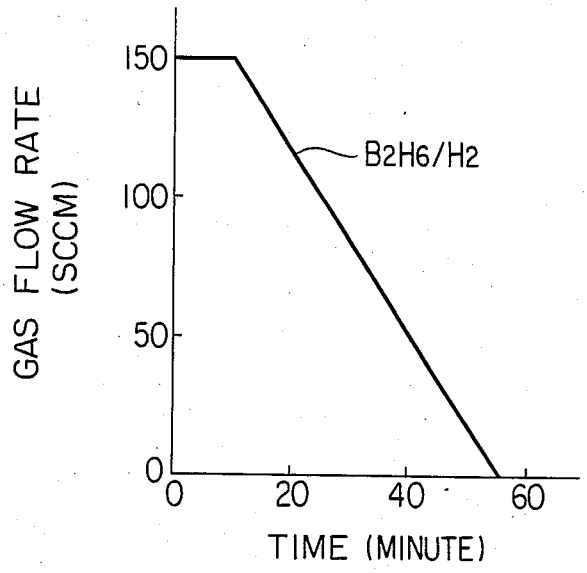

In preparation of the first layer, the mass flow controllers 2007, 2008 and 2010 were conrolled by a computer (HP9845B) so that the flow rates of $GeH_4$, $SiH_4$ and $B_2H_6/H_2$ might be as shown in FIG. 22 and FIG. 36.

Deposition of the surface layer was carried out as follows.

After formation of the second layer, the mass flow controllers corresponding to respective gases were set so that the $CH_4$ *gas flow rate relative to the SiH4* gas flow rate may be $SiH_4/CH_4=1/30$ as shown in Table 7I, and a-SiC(H) with a thickness of 0.5 μm was deposited at a high frequency power of 150 W.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layar between the center and the both ends of the aluminum substrate was found to be 1 μm (Sample No. 1-2I).

On the other hand, in the case of the above Sample No. 1-1I, the surface of the surface layer 8305 and the surface of the substrate 8301 were found to be non-parallel to each other a shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 with a semiconductor laser (wavelength of laser beam: 780 nm, spot diameter 80 μm), followed by development and transfer to obtain images. In the light-receiving member having the surface characteristic as shown in FIG. 82, interference fringe pattern was observed.

On the other hand, in the light-receiving member having the surface characteristic as shown in FIG. 83, no interference fringe pattern was observed to give practically satisfactory electrophotographic characteristics.

EXAMPLE 110

After formation of layers up to the second layer similarly as in the case of Sample No. 1-1I in Example 109, hydrogen ($H_2$) gas bomb was replaced with argon (Ar) bomb, the deposition device cleaned, and on all over the cathode electrode were placed a target for sputtering comprising Si and a target for sputtering comprising graphite to an area ratio shown in Sample No. 101I in Table 1I. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, ttereby depositing a surface layer of Sample No. 101I in Table 1I on the above substrate.

Similarly, except for varying the target area ratio of Si to graphite to form the surface layer as shown in Sample Nos. 102I to 107I in Table 1I, light-receiving members were prepared in the same manner as described above.

For the respective light-receiving members for electrophotography, image exposure was effected by laser similarly as in Example 109 and the steps to transfer were repeated for about 50,000 times, followed by evaluation of images. The results as shown in Table 1I were obtained.

EXAMPLE 111

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1I in Example 109 respective light-receiving members for electrophotography were prepared. For respective light-receiving members thus obtained, image exposure was effected by laser similarly as in Example 109 and the steps up to transfer were repeated for about 50,000 times, followed by evaluation of images, to obtain the results as shown in Table 2I.

EXAMPLE 112

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1I in Example 109 respective light-receiving members for electrophotography were prepared. For respective light-receiving members thus obtained, image exposure was effected by laser similarly as in Example 109, and the steps up to transfer were repeated for about 50,000 times, followed by evaluation of images, to obtain the results as shown in Table 3I.

EXAMPLE 113

Except for changing the layer thickness of the surface layer, according to the same method as the case of Sample No. 1-1I in Example 109 respective light-receiving members for electrophotography were prepared. For the respective light-receiving members thus obtained, the steps of image formation, developing and cleaning were repeated similarly as in Example 109 to obtain the results as shown in Table 4I.

EXAMPLE 114

According to entirely the same method as the case of Sample No. 1-1I in Example 109 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 109 to give practically satisfactory results.

EXAMPLE 115

The surface of a cylindrical aluminum substrate was worked by a lathe as shown in Table 5I. On these cylindrical aluminum substrates (Nos. 101I-108I), light-receiving members for electrophotography were prepared under the same conditions as the case of Sample No. 1-1I in Example 109 (Nos. 111I-118I). The difference in average layer thickness between the center and the both ends of the aluminum substrate was found to be 2.2 μm.

The cross-sections of these light-receiving members for electrophotography were observed with an electron microscope for measurement of the difference within the pitch of the light-receiving layer to obtain the results as shown in Table 6I .

These light-receiving members were subjected to image exposure by a semiconductor laser of a wavelength of 780 nm with a spot diameter of 80 μm by means of the device shown in FIG. 26 similarly as in Example 109 to obtain the results as shown in Table 6I.

EXAMPLE 116

Under the conditions shown in Table 7I, light-receiving members for electrophotography were formed similarly as in the case of Sample No. 1-1I in Example 109.

Figure 37:
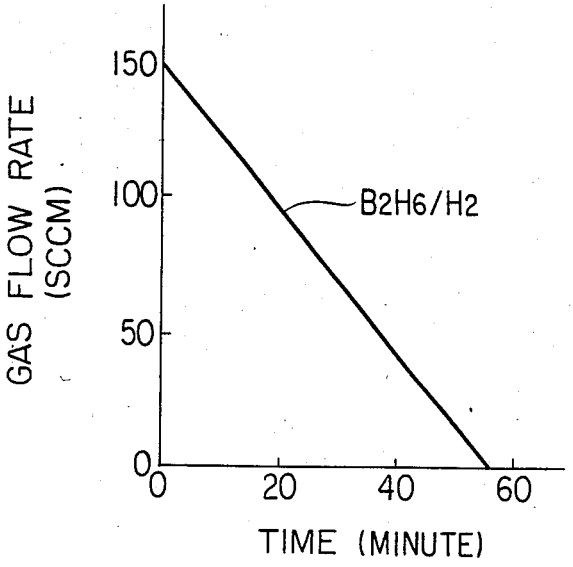

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 23 and FIG. 37.

For these light-receiving members for electrophotography, by means of the same device as in Example 109, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 117

Under the conditions shown in Table 8I, light-receiving members for electrophotography were formed similarly as in the case of Sample No. 1-1I in Example 109.

Figure 38:
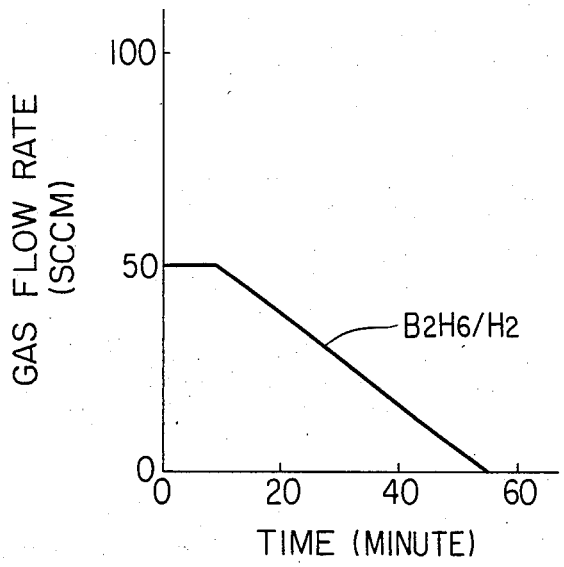

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 24 and FIG. 38.

For these light-receiving members for electrophotography, by means of the same device as in Example 109, image exposure was effected, followed by developing, transfer and fixing, to obtain visible images on plain papers. Such as image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 118

Under the conditions shown in Table 8I, light-receiving members for electrophotography were formed similarly as in the case of Sample No. 1-1I in Example 109.

Figure 39:
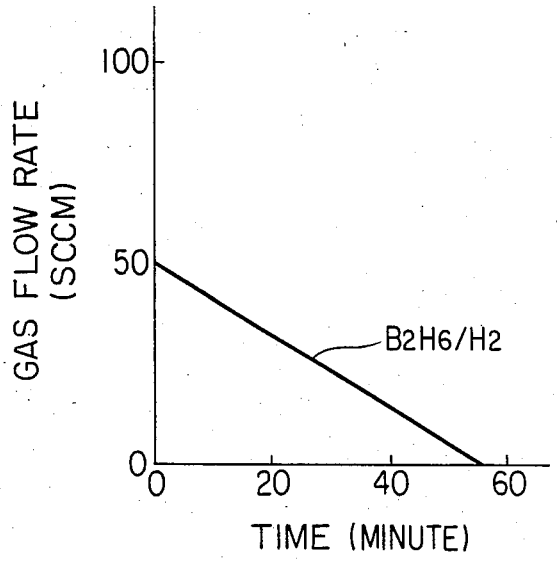

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 25 and FIG. 39.

For these light-receiving members for electrophotography, by means of the same device as in Example 109, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 119

Under the conditions shown in Table 9I, light-receiving members for electrophotography were formed similarly as in the case of Sample No. 1-1I in Example 109.

Figure 40:
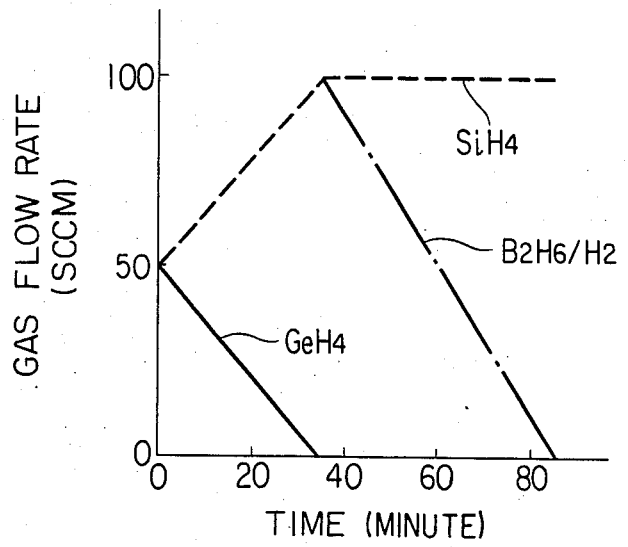

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 40.

For these light-receiving members for electrophotography, by means of the same device as in Example 109, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 120

Under the conditions shown in Table 10I, light-receiving members for electrophotography were formed similarly as in the case of Sample No. 1-1I in Example 109.

Figure 41:
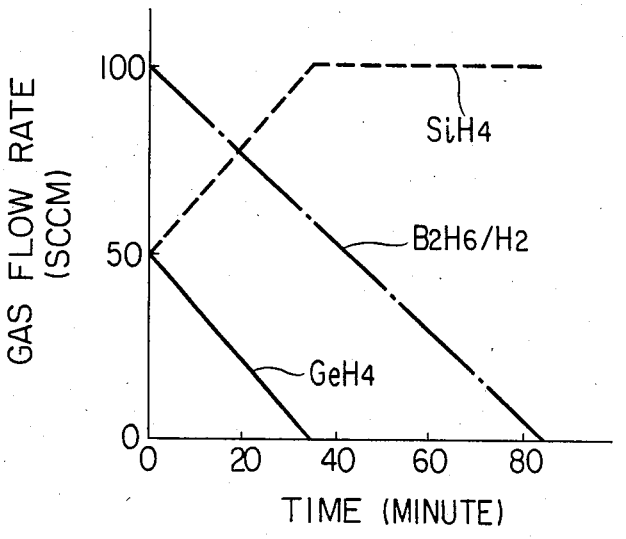

In preparation of the first layer and layer A, the mass flow controllers 2007, 2008 and 2010 were controlled by a computer (HP9845B) so that the flow rates of $GeH_4$, $SiH_4$ and B might be as shown in FIG. 41.

For these light-receiving members for electrophotography, by means of the same device as in Example 109, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 121

Under the conditions shown in Table 11I, light-receiving members for electrophotography were formed similarly as in the case of Sample No. 1-1I in Example 109.

Figure 42:
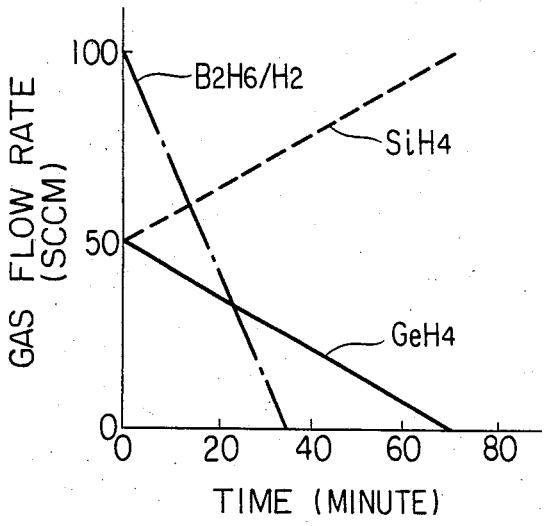

In preparation of the first layer and layer A, the mass flow controllers 2007, 2008 and 2010 were controlled by a computer (HP9845B) so that the flow rates of $GeH_2$, $SiH_4$ and $B_2H_6/H_2$ might be as shown in FIG. 42.

For these light-receiving members for electrophotography, by means of the same device as in Example 109, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

COMPARATIVE EXAMPLE 9

As a comparative test, an a-Si light-receiving member for electrophotography was prepared in entirely the same manner as in the case of Sample No. 1-1I in Example 109 as described above except for employing an aluminum substrate roughened on its surface by the sand blasting method in place of the aluminum substrate used in preparation of the light-receiving member for electrography in Example 109. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 $\mu$m.

When the same measurement was conducted by mounting the light-receiving member for electrophotography for comparative purpose on the device shown in FIG. 26 employed in Example 109, clear interference fringe was found to be formed in the black image over all the surface.

EXAMPLE 122

In this Example, a semiconductor laser (wavelength: 780 nm) with a spot size of 80 $\mu$m was employed. Thus, on a cylindrical aluminum substrate [length (L) 357 mm, outer diameter (r) 80 mm] a spiral groove was formed with pitch (P) 25 $\mu$m and depth (D) 0.8 S was formed. The form of the groove is shown in FIG. 9.

Next, under the conditions as shown in Table 1aJ, by use of the film deposition device as shown in FIG. 20, an A-Si type light-receiving member for electrophotography having a surface layer laminated thereon was prepared following predetermined operational procedures.

NO gas was introduced, while controlling the flow rate by setting the mass flow controller so that its initial value may be 3.4 Vol % based on the sum of $SiH_4$ gas flow rate and $GeH_4$ gas flow rate.

Deposition of the surface layer formed primarily of silicon atoms and carbon atoms was carried out as follows.

That is, after deposition of the second layer, as shown in Table 1aJ, the mass flow controllers for respective gases were set so that the flow rate ratio of the $CH_4$ gas flow rate relative to $SiH_4$ might be $SiH_4/CH_4=1/30$, and glow discharge was excited at a high frequency power of 150 W to form a surface layer.

Separately, on the cylindrical aluminum substrate having the same characteristic, a light-receiving layer was formed similarly as in the above case except for changing the discharging power in formation of the first layer, the second layer and the surface layer to 40 W. As the result, the surface of the light-receiving layer was found to be in parallel to the surface of the substrate 8201 as shown in FIG. 82. In this case, the difference in the whole layer thickness between the center and the both ends of the aluminum substrate was found to be 1 μm (Sample No. 1-2J).

On the other hand, in the case when the above high frequency power was made 160 W, the surface of the light-receiving layer and the surface of the substrate 8301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82 obtained at a high frequency power of 40 W during layer formation, an interference fringe pattern was observed.

On the other hand, in the light-receiving member having the surface characteristic as shown in FIG. 83, no interference fringe pattern was observed to give practically satisfactory electrophotographic characteristics.

EXAMPLE 123

After formation of layers up to the second layer similarly as in the case of Sample No. 1-1J in Example 122, hydrogen ($H_2$) gas bomb was replaced with argon (Ar) bomb, the deposition device cleaned, and on all over the cathode electrode were placed a target for sputtering comprising Si and a target for sputtering comprising graphite to an area ratio shown in Sample No. 101J in Table 1J. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, thereby depositing a surface layer of Sample No. 101J in Table 1J on the above substrate.

Similarly, except for varying the target area ratio of Si to graphite to form the surface layer as shown in Sample Nos. 102J to 107J in Table 1J, light-receiving members were prepared in the same manner as described above.

For the respective light-receiving members for electrophotography, image exposure was effected by laser similarly as in Example 122, and the steps to transfer were repeated for about 50,000 times, followed by evaluation of images. The results as shown in Table 1J were obtained.

EXAMPLE 124

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1J in Example 122, respective light-receiving members for electrophotography were prepared. For respective light-receiving members thus obtained, image exposure was effected by laser similarly as in Example 122, and the steps up to transfer were repeated for about 50,000 times, followed by evaluation of images, to obtain the results as shown in Table 2J.

EXAMPLE 125

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1J in Example 122, respective light-receiving members for electrophotography were prepared. For respective light-receiving members thus obtained, image exposure was effected by laser similarly as in Example 122, and the steps up to transfer were repeated for about 50,000 times, followed by evaluation of images, to obtain the results as shown in Table 3J.

EXAMPLE 126

Except for changing the layer thickness of the surface layer, according to the same procedure as the case of Sample No. 1-1J in Example 122, respective light-receiving members for electrophotography were prepared. For the respective light-receiving members thus obtained, the steps of image formation, developing and cleaning were repeated similarly as in Example 122 to obtain the results as shown in Table 4J.

EXAMPLE 127

According to entirely the same method as the case of Sample No. 1-1J in Example 122 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 122 to give practically satisfactory results.

EXAMPLE 128

The surface of a cylindrical aluminum substrate was worked by a lathe as shown in Table 5J. On these cylindrical aluminum substrates (Cylinder Nos. 101J–108J), light-receiving members for electrophotography were prepared under the same conditions when no interference fringe pattern was observed in Example 122 (high frequency power 160 W) (Sample Nos. 111J–118J). The difference in average layer thickness between the center and the both ends of the aluminum substrate was found to be 2.2 μm.

The cross-section of these light-receiving members for electrophotography were observed with an electron microscope for measurement of the difference within the pitch of the second layer to obtain the results as shown in Table 6J.

These light-receiving members were subjected to image exposure by a semiconductor laser of a wavelength of 780 nm with a spot diameter of 80 μm by means of the device shown in FIG. 26 similarly as in Example 122 to obtain the results as shown in Table 6J.

EXAMPLE 129

Under the conditions shown in Table 7J, light-receiving members for electrophotography were formed similarly as in the case of Sample No. 1-1J in Example 122.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 130

Under the conditions shown in Table 8J, light-receiving members for electrophotography were formed similarly as in the case of Sample No. 1-1J in Example 122.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 131

Under the conditions shown in Table 9J, light-receiving members for electrophotography were formed similarly as in the case of Sample No. 1-1J in Example 122.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 132

Under the conditions shown in Table 10J, light-receiving members for electrophotography were formed similarly as in the case of Sample No. 1-1J in Example 122.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 133

During formation of the first layer, NO gas flow rate was changed relative to the sum of $SiH_4$ gas flow rate and $GeH_4$ gas flow rate as shown in FIG. 49 until the NO gas flow rate became zero on completion of layer formation, following the same conditions as in the case of a high frequency power of 160 W in Example 122, to prepare a light-receiving member for electrophotography.

Separately, on the cylindrical aluminum substrate having the same characteristic, a light-receiving layer was formed similarly as in the above case except for changing the discharging power in formation of the first layer, the second layer and the surface layer to 40 W. As the result, the surface of the light-receiving layer was found to be in parallel to the surface of the substrate 8201 as shown in FIG. 82. In this case, the difference in the whole layer between the center and the both ends of the aluminum substrate 8201 was found to be 1 μm.

On the other hand, in the case when the above high frequency power was made 160 W, the surface of the light-receiving layer and the surface of the substrate 301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82 obtained at a high frequency power of 40 W during layer formation, an interference fringe pattern was observed.

On the other hand, in the light-receiving member having the surface characteristic as shown in FIG. 83, no interference fringe pattern was observed to give practically satisfactory electrophotographic characteristics.

EXAMPLE 134

Under the conditions shown in Table 11J, light-receiving members for electrophotography were formed similarly as in the case of Sample No. 1-1J in Example 122.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 135

Under the conditions shown in Table 12J, light-receiving members for electrophotography were formed similarly as in the case of Sample No. 1-1J in Example 122.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 136

Under the conditions shown in Table 13J, light-receiving members for electrophotography were formed similarly as in the case of Sample No. 1-1J in Example 122.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 137

Under the conditions shown in Table 14J, light-receiving members for electrophotography were formed similarly as in the case of Sample No. 1-1J in Example 122.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 138

Under the conditions shown in Tables 15J through 18J, light-receiving members for electrophotography were formed similarly as in the case of Sample No. 1-1J in Example 122.

During the layer formation, the flow rate ratio of NO gas flow rate to $SiH_4$ gas flow rate was changed according to the change rate curvesas shown in FIGS. 66 through 69.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 139

Under the conditions shown in Table 19J, light-receiving members for electrophotography were formed similarly as in the case of Sample No. 1-1J in Example 122.

During the layer formation, the flow rate ratio of NO gas flow rate to $SiH_4$ gas flow rate was changed according to the change rate curve as shown in FIG. 66.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 140

Under the conditions shown in Tables 20J and 21J, light-receiving members for electrophotography were formed similarly as in the case of Sample No. 1-1J in Example 122.

Figure 68:
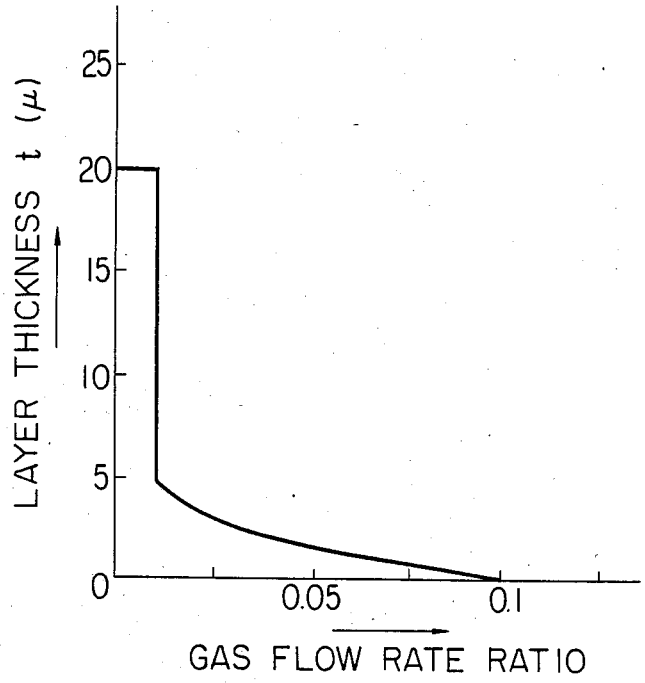
Figure 69:
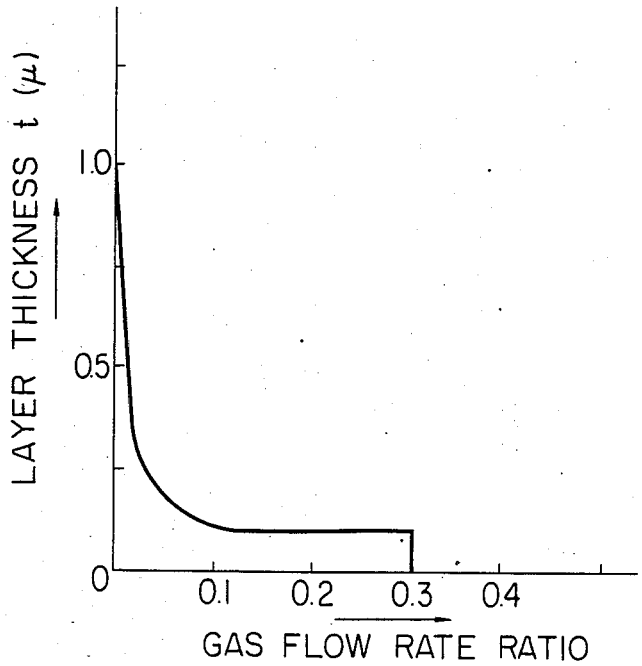
Figure 70:
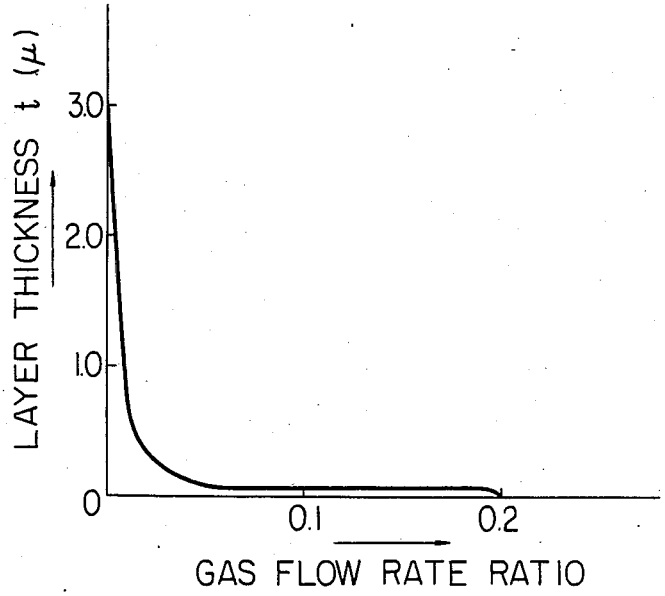

During the layer formation, the flow rate ratios of $NH_3$ gas flow rate to $SiH_4$ gas flow rate and $N_2O$ gas flow rate to $SiH_4$ gas flow rate were changed according to the change rate curves as shown in FIG. 68.

For these light-receiving members for electrophotography, by means of the same device as in Example 122, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

COMPARATIVE EXAMPLE 10

As a comparative test, an A-Si light-receiving member for electrophotography was prepared in entirely the same manner as in the case of Sample No. 1-1J in Example 122 as described above except for employing an aluminum substrate roughened on its surface by the sand blasting method in place of the aluminum substrate used in preparation of the light-receiving member for electrography in Example 122. The surface condition of the aluminum substrate subjected to the surface roughening treatment according to the sand blasting method was measured by the Universal Surface Shape Measuring Instrement (SE-3C) produced by Kosaka Research Institute before provision of the light-receiving layer. As the result, the average surface roughness was found to be 1.8 μm.

When the same measurement was conducted by mounting the light-receiving meber for electrophotography for comparative purpose on the device shown in FIG. 26 employed in Example 122, clear interference fringe was found to be formed in the black image over all the surface.

EXAMPLE 141

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, A-Si light-receiving members for electrophotography were deposited on the above aluminum substrate following various procedures under the conditions as shown in Table 7K using the film deposition device as shown in FIG. 20 (Sample No. 1-1K).

In preparation of the first layer the mass flow controllers 2007 and 2008 were controlled by a computer (HP9845B) so that the flow rates of $GeH_4$ and $SiH_4$ might be as shown in FIG. 22. Also, deposition of the surface layer was carried out as follows.

After formation of the second layer, the mass flow controllers corresponding to respective gases were set so that the $CH_4$ gas flow rate relative to the $SiH_4$ gas flow rate may be $SiH_4/CH_4=1/30$ as shown in Table 7K, and A-SiC(H) with a thickness of 0.5 μm was deposited at a high frequency power of 150 W.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layer thickness between the center and the both ends of the aluminum substrate was found to be 1 μm (Sample No. 1-2K).

On the other hand, in the case of the above Sample No. 1-1K, the surface of the surface layer 8305 and the surface of the substrate 8301 were found to be non-parallel to each other as shown in FIG. 83. In this case, the difference in average layer thickness between the center and both ends of the aluminum substrate was found to be 2 μm.

The light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotographic characteristics.

EXAMPLE 142

After formation of layers up to the second layer similarly as in the case of Sample No. 1-1K in Example 141, hydrogen ($H_2$) gas bomb was replaced with argon (Ar) bomb, the deposition device cleaned, and on all over the cathode electrode were placed a target for sputtering comprising Si and a target for sputtering comprising graphite to an area ratio shown in Sample No. 101K in Table 1K. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, thereby forming a surface layer of Sample No. 101K in Table 1K on the above substrate.

Similarly, except for varying the target area ratio of Si to graphite to form the surface layer as shown in Sample Nos. 102K to 107K in Table 1K, light-receiving members were prepared in the same manner as described above.

For the respective light-receiving members for electrophotography, image exposure was effected by laser similarly as in Example 141, and the steps to transfer were repeated for about 50,000 times, followed by evaluation of images. The results as shown in Table 1K were obtained.

EXAMPLE 143

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-K in Example 141 respective light-receiving members for electrophotography were prepared. For respective light-receiving members thus obtained, image exposure was effected by laser similarly as in Example 141, and the steps up to transfer were repeated for about 50,000 times, followed by evaluation of images, to obtain the results as shown in Table 2K.

EXAMPLE 144

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1K in Example 141 respective light-receiving members for electrophotography were prepared. For respective light-receiving members thus obtained, image exposure was effected by laser similarly as in Example 141, and the steps up to transfer were repeated for 50,000 times, followed by evaluation of images, to obtain the results as shown in Table 3K.

EXAMPLE 145

Except for changing the layer thickness of the surface layer, according to the same procedure as the case of Sample No. 1-1K in Example 141 respective light-receiving members for electrophotography were prepared. For the respective light-receiving members thus obtained, the steps of image formation, developing and cleaning were repeated similarly as in Example 141 to obtain the results as shown in Table 4K.

EXAMPLE 146

According to entirely the same method as the case of Sample No. 1-1K in Example 141 except for changing the discharging power during formation of the surface layer to 300 W and making the average layer thickness 2μm, respective light-receiving members for electrophotography were prepared. The differece in average layer thickness between the center and the both ends of the surface layer of the light-receiving member thus obtained was found to be 0.5μm. The layer thickness difference at minute portion was found to be 0.1μm.

In such light-receiving members for electrophotography, no interference fringe pattern was observed and, the steps of image formation, developing and cleaning were repeated by the same device as in Example 141 to give practically satisfactory results.

EXAMPLE 147

The surface of a cylindrical aluminum substrate was worked by a lathe as shown in Table 5K. On these cylindrical aluminum substrates (Cylinder Nos. 101K–108K), light-receiving members for electrophotography were prepared under the same condition as the case of Sample No. 1-1K in Example 141. (No. 111K–118K). The difference in average layer thickness between the center and the both ends of the aluminum substrate was found to be 2.2μm.

The cross-sections of these light-receiving members for electrophotography were observed with an electron microscope for measurement of the difference within the pitch of the light-receiving layer to obtain the results as shown in Table 6K.

These light-receiving members were subjected to image exposure by a semiconductor laser of a wavelength of 780 nm with a spot diameter of 80 μm by means of the device shown in FIG. 26 similary as in Example 141 to obtain the results as shown in Table 6K.

EXAMPLE 148

Under the conditions shown in Table 8K, light-receiving members for electrophotography were formed similarly as in the case of Sample No. 1-1K in Example 141.

In preparation of the first layer, the mass flow controllers 2007 and 2008 were controlled by a computer (HP9845B) so that the flow rates of $GeH_4$ and $SiH_4$ might be as shown in FIG. 23.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 149

Under the conditions shown in Table 9K, light-receiving members for electrophotography were formed similarly as in the case of Sample No. 1-1K in Example 141.

In preparation of the first layer, the mass flow controllers 2007 and 2008 were controlled by a computer (HP9845B) so that the flow rates of $GeH_4$ and $SiH_4$ might be as shown in FIG. 24.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 150

Under the conditions shown in Table 10K, light-receiving members for electrophotography were formed similarly as in the case of Sample No. 1-1K in Example 141.

In preparation of the first layer, the mass flow controllers 2007 and 2008 were controlled by a computer (HP9845B) so that the flow rates of $GeH_4$ and $SiH_4$ might be as shown in FIG. 25.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 151

A light-receiving member for electrophotography was prepared following the same condition and the procedure as described in Example 150 except for changing $NH_3$ gas employed in Example 150 to NO gas.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 152

A light-receiving member for electrophotography was prepared following the same condition and the procedure as described in Example 150 except for changing $NH_3$ gas employed in Example 150 to $N_2O$ gas.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 153

A light-receiving member for electrophotography was prepared following the same procedure as in the case of Sample No. 1-1K in Example 141 except for changing the flow rate ratio of NO gas according to the change rate curve of gas flow rate ratio shown in FIG.

70 under the conditions as shown in Table 11K with lapse of layer formation time.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 154

Figure 71:
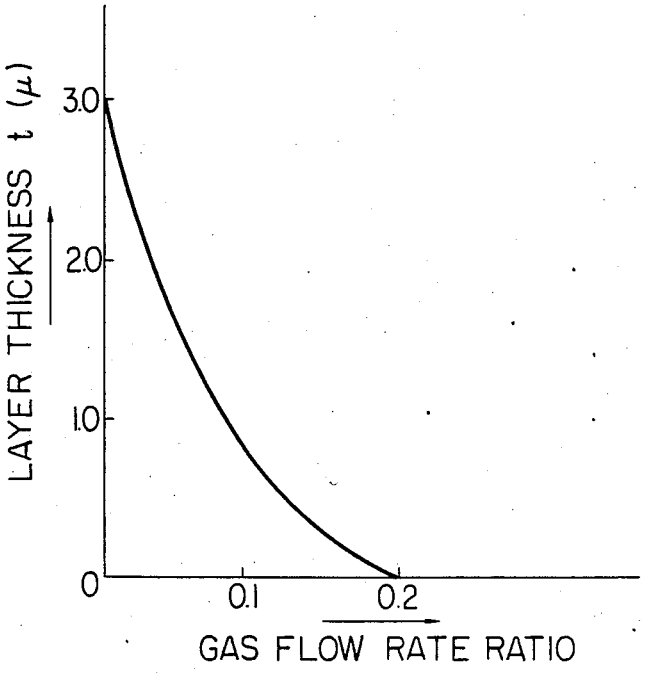

A light-receiving member for electrophotography was prepared following the same procedure as in the case of Sample No. 1-1K in Example 141 except for changing the flow rate ratio of $NH_3$ gas according to the change rate curve of gas flow rate ratio shown in FIG. 71 under the conditions as shown in Table 12K with lapse of layer formation time.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 155

Figure 58:
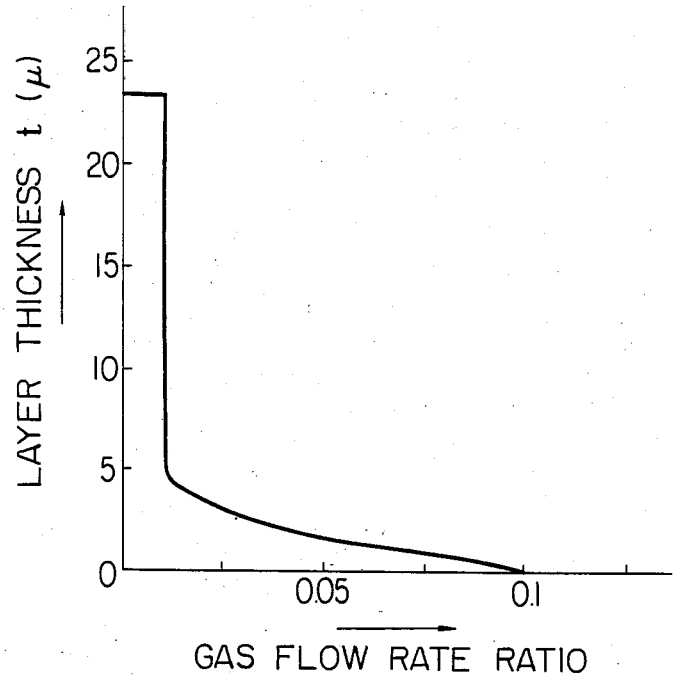

A light-receiving member for electrophotography was prepared following the same procedure as in the case of Sample No. 1-1K in Example 141 except for changing the flow rate ratio of NO gas according to the change rate curve of gas flow rate ratio shown in FIG. 58 under the conditions as shown in Table 13K with lapse of layer formation time.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 156

A light-receiving member for electrophotography was prepared following the same condition and the procedure as described in Example 155 except for changing NO gas employed in Example 155 to $NH_3$ gas.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 157

A light-receiving member for electrophotography was prepared following the same condition and the procedure as described in Example 155 except for changing NO gas employed in Example 155 to $N_2O$ gas.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 158

Figure 72:
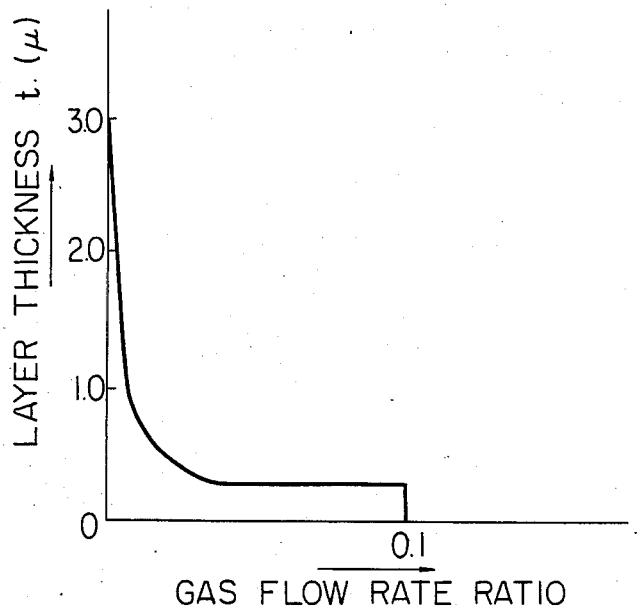

A light-receiving member for electrophotography was prepared following the same procedure as in the case of Sample No. 1-1K in Example 141 except for changing the flow rate ratio of $N_2O$ gas according to the change rate curve of gas flow rate ratio shown in FIG. 72 under the conditions as shown in Table 14K with lapse of layer formation time.

For these light-receiving members for electrophotography, by means of the same device as in Example 141, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

COMPARATIVE EXAMPLE 11

As a comparative test, an A-Si light-receiving member for electrophotography was prepared in entirely the same manner as in the case of Sample No. 1-1K in Example 141 as described above except for employing an aluminum substrate roughened on its surface by the sand blasting method in place of the aluminum substrate used in preparation of the light-receiving member for electrophotography in Example 141. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 $\mu$m.

When the same measurement was conducted by mounting the light-receiving member for electrophotography for comparative purpose on the device shown in FIG. 26 employed in Example 141, clear interference fringe was found to be formed in the black image over all the surface.

EXAMPLE 159

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, A-Si light-receiving members for electrophotography were deposited on the above aluminum substrate following various procedures under the conditions as shown in Table 7L using the film deposition device as shown in FIG. 20 (Sample No. 1-1L).

Deposition of the surface layer was carried out as follows.

After formation of the second layer, the mass flow controllers corresponding to respective gases were set so that the $CH_4$ gas flow rate relative to the $SiH_4$ gas flow rate may be $SiH_4/CH_4=1/30$ as shown in Table 7L, and A-SiC(H) with a thickness of 0.5 μm was deposited at a high frequency power of 150 W.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layer between the center and the both ends of the aluminum substrate was found to be 1 μm (Sample No. 1-2L).

On the other hand, in the case of the above Sample No. 1-1L, the surface of the surface layer 8305 and the surface of the substrate 8301 were found to be non-parallel to each other as shown in FIG. 83. In this case, the difference in average layer thickness between the center and both ends of the aluminum substrate was found to be 2 μm.

The light-receiving members for electrophotography as prepared above were subjected to image exposure by means of a device as shown in FIG. 27 with a semiconductor laser (wavelength of laser beam: 780 nm, spot diameter 80 μm), followed by development and transfer to obtain images. In the light-receiving member having the surface characteristic as shown in FIG. 82, interference fringe pattern was observed.

On the other hand, in the light-receiving member having the surface characteristic as shown in FIG. 83, no interference fringe pattern was observed to give practically satisfactory electrophotographic characteristics.

EXAMPLE 160

After formation of layers up to the second layer similarly as in the case of Sample No. 1-1K in Example 159, hydrogen ($H_2$) gas bomb was replaced with argon (Ar) bomb, the deposition device cleaned, and on all over the cathode electrode were placed a target for sputtering comprising Si and a target for sputtering comprising graphite to an area ratio shown in Sample No. 101L in Table 1L. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, thereby forming a surface layer of Sample No. 101L in Table 1L on the above substrate.

Similarly, except for varying the target area ratio of Si to graphite to form the surface layer as shown in Sample Nos. 102L to 107L in Table 1L, light-receiving members were prepared in the same manner as described above.

For the respective light-receiving members for electrophotography, image exposure was effected by laser similarly as in Example 159, and the steps to transfer were repeated for about 50,000 times, followed by evaluation of images. The results as shown in Table 1L were obtained.

EXAMPLE 161

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1L in Example 159 respective light-receiving members for electrophotography were prepared. For respective light-receiving members thus obtained, image exposure was effected by laser similarly as in Example 1, and the steps up to transfer were repeated for about 50,000 times, followed by evaluation of images, to obtain the results as shown in Table 2L.

EXAMPLE 162

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1L in Example 159, respective light-receiving members for electrophotography were prepared. For respective light-receiving members thus obtained, image exposure was effected by laser similarly as in Example 159, and the steps up to transfer were repeated for about 50,000 times, followed by evaluation of images, to obtain the results as shown in Table 3L.

EXAMPLE 163

Except for changing the layer thickness of the surface layer, according to the same procedure as the case of Sample No. 1-1L in Example 159, respective light-receiving members for electrophotography were prepared. For the respective light-receiving members thus obtained, the steps of image formation, developing and cleaning were repeated similarly as in Example 159 to obtain the results as shown in Table 4L.

EXAMPLE 164

According to the entirely the same method as the case of Sample No. 1-1L in Example 159 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 159 to give practically satisfactory results.

EXAMPLE 165

The surface of a cylindrical aluminum substrate was worked by a lathe as shown in Table 5L. On these cylindrical aluminum substrates (Nos. 101L–108L), light-receiving members for electrophotography were prepared under the same conditions when interference fringe pattern disappeared in Example 159 (Nos. 111L–118L). The difference in average layer thickness between the center and the both ends of the aluminum substrate was found to be 2.2 μm.

The cross-sections of these light-receiving members for electrophotography were observed with an electron microscope for measurement of the difference within the pitch of the light-receiving layer to obtain the results as shown in Table 6L.

These light-receiving members were subjected to image exposure by a semiconductor laser of a wavelength of 780 nm with a spot diameter of 80 μm by means of the device shown in FIG. 27 similarly as in Example 159 to obtain the results as shown in Table 6L.

EXAMPLE 166

Under the conditions shown in Table 8L, light-receiving members for electrophotography were formed similarly as in the case of Sample No. 1-1L in Example 159.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 167

Under the conditions shown in Table 9L, light-receiving members for electrophotography were formed similarly as in the case of Sample No. 1-1L in Example 159.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 168

Under the conditions shown in Table 10L, light-receiving members for electrophotography were formed similarly as in the case of Sample No. 1-1L in Example 159.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 169

Under the conditions shown in Table 11L, light-receiving members for electrophotography were formed similarly as in the case of Sample No. 1-1L in Example 159.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 170

Under the conditions shown in Table 12L, light-receiving members for electrophotography were formed similarly as in the case of Sample No. 1-1L in Example 159.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 171

Under the conditions shown in Table 13L, light-receiving members for electrophotography were formed similarly as in the case of Sample No. 1-1L in Example 159.

Figure 74:
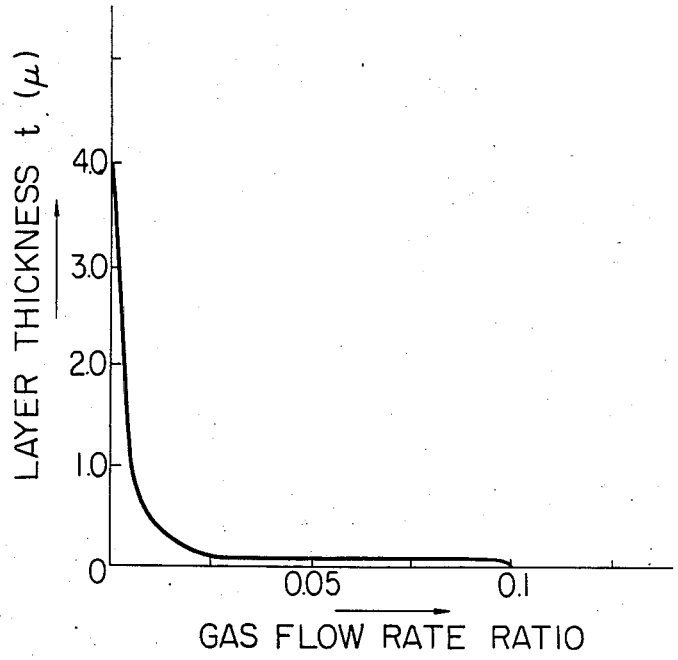

During the layer formation, the flow rate ratio of NO gas flow rate to the sum of $SiH_4$ gas flow rate and $GeH_4$ gas flow rate was changed according to the change rate curves as shown in FIG. 74.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 172

Under the conditions shown in Table 14L, light-receiving members for electrophotography were formed similarly as in the oase of Sample No. 1-1L in Example 159.

Figure 75:
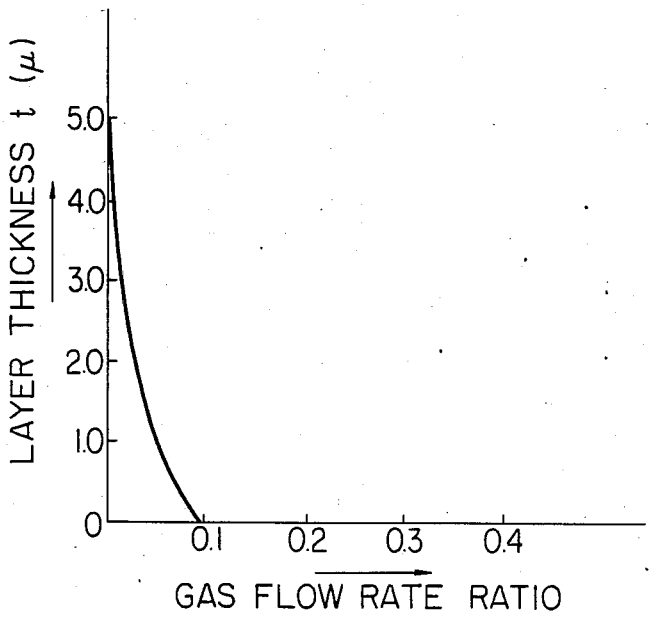

During the layer formation, the flow rate ratio of $NH_3$ gas flow rate to the sum of $GeH_4$ gas flow rate and $SiH_4$ gas flow rate was changed according to the change rate curves as shown in FIG. 75.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 173

Under the conditions shown in Table 15L, light-receiving members for electrophotography were formed similarly as in the case of Sample No. 1-1L in Example 159.

Figure 57:
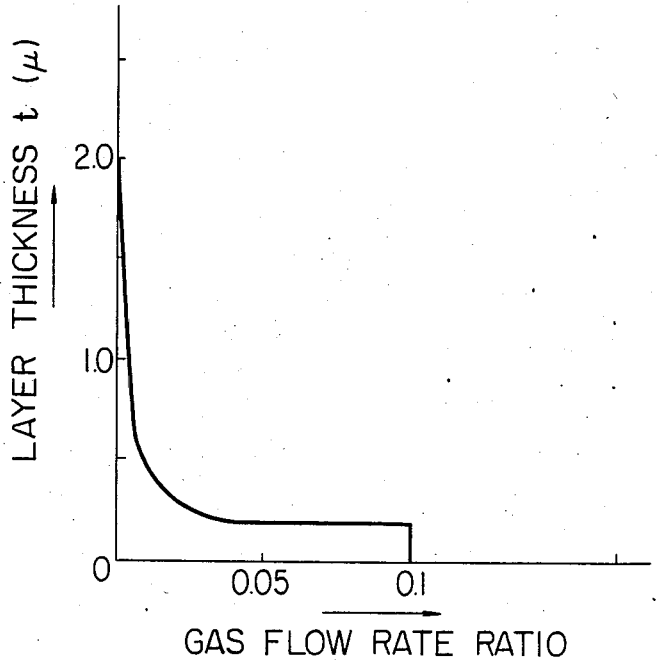

During the layer formation, the flow rate ratio of $N_2O$ gas flow rate to the sum of $GeH_4$ gas flow rate and $SiH_4$ gas flow rate was changed according to the change rate curves as shown in FIG. 57.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 174

Under the conditions shown in Table 16L, light-receiving members for electrophotography were formed similarly as in the case of Sample No. 1-1L in Example 159.

Figure 76:
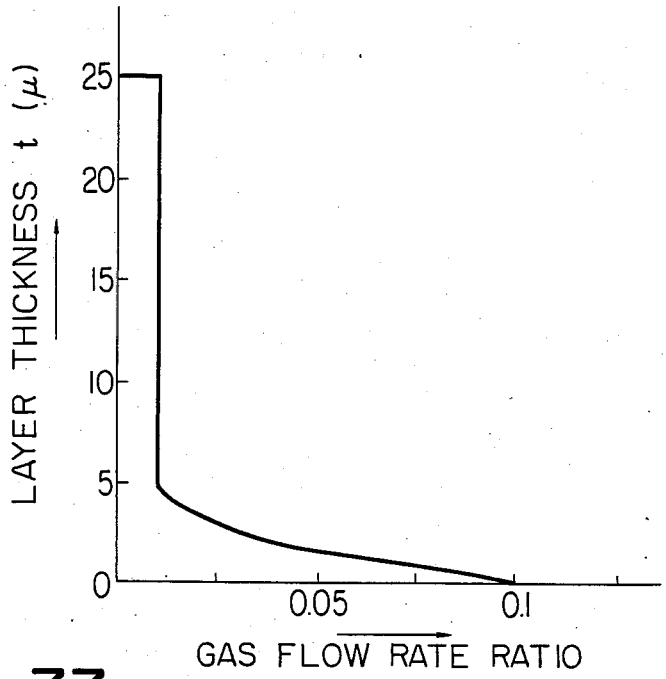

During the layer formation, the flow rate ratio of NO gas flow rate to the sum of $GeH_4$ gas flow rate $SiH_4$ gas flow rate was changed according to the change rate curves as shown in FIG. 76.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 175

Under the conditions shown in Table 17L, light-receiving members for electrophotography were formed similarly as in the case of Sample No. 1-1L in Example 159.

Figure 77:
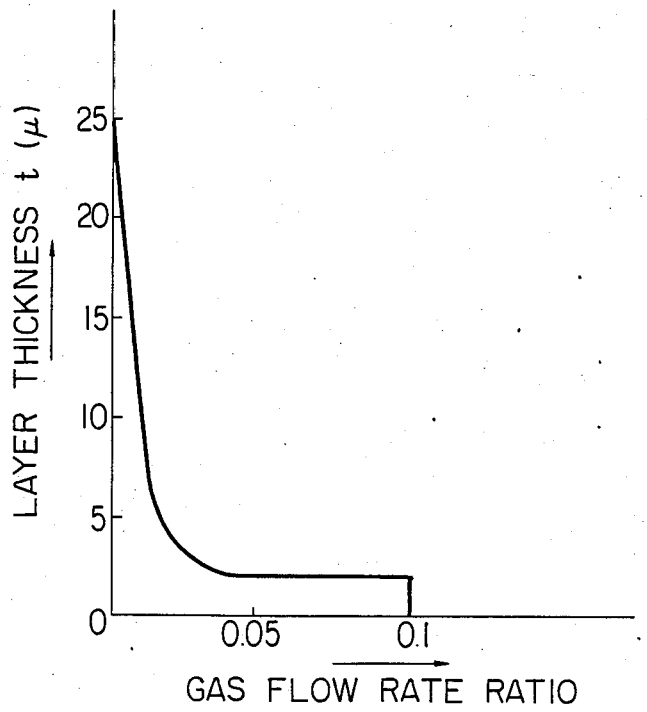

During the layer formation, the flow rate ratio of $NH_3$ gas flow rate to the sum of $GeH_4$ gas flow rate $SiH_4$ gas flow rate was changed according to the change rate curves as shown in FIG. 77.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 176

Under the conditions shown in Table 18L, light-receiving members for electrophotography were formed similarly as in the case of Sample No. 1-1L in Example 159.

Figure 73:
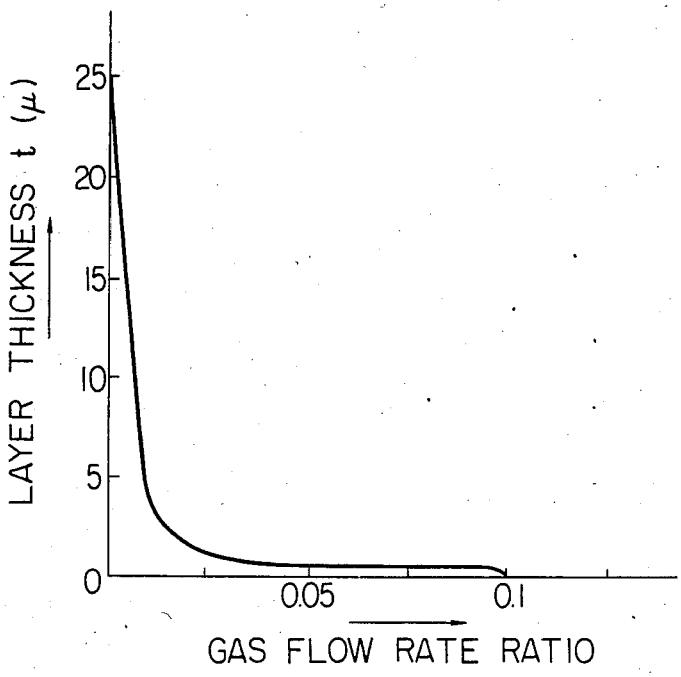

During the layer formation, the flow rate ratio of $N_2O$ gas flow rate to the sum of $GeH_4$ gas flow rate $SiH_4$ gas flow rate was changed according to the change rate curves as shown in FIG. 73.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 177

Under the conditions shown in Table 19L, light-receiving members for electrophotography were formed similarly as in the case of Sample No. 1-1L in Example 159.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 178

Under the conditions shown in Table 20L, light-receiving members for electrophotography were formed similarly as in the case of Sample No. 1-1L in Example 159.

For these light-receiving members for electrophotography, by means of the same device as in Example 159, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 179

The case of Sample No. 1-1L in Example 159 and Examples 166 to 178 were repeated except that $PH_3$ gas diluted to 3000 vol ppm with $H_2$ was employed in place of $B_2H_6$ gas diluted to 3000 vol ppm with $H_2$ to prepare light-receiving members for electrophotography, respectively.

Other preparation conditions were the same as the case of Sample No. 1-1L in Example 159 and in Examples 166 to 178.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 12

As a comparative test, an a-Si light-receiving member for electrophotography was prepared in entirely the same manner as in the case of Sample No. 1-1L in Example 159 as described above except for employing an aluminum substrate roughened on its surface by the sand blasting method in place of the aluminum substrate used in preparation of the light-receiving member for electrophotography in Example 159. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 159, clear interference fringe was found to be formed in the black image over all the surface.

EXAMPLE 180

On a cylindrical aluminum substrate (length (L) 357 mm, outer diameter (r) 80 mm) a spiral groove was formed with pitch (P) 25 μm and depth (D) 0.8 S was formed. The form of the groove is shown in FIG. 9.

Next, under the conditions as shown in Table 7M, by use of the film deposition device as shown in FIG. 20, an A-Si type light-receiving member for electrophotography was prepared following predetermined operational procedures (Sample No. 1-1M).

In preparation of the first layer of A-SiGe:H:B:O layer, the mass flow controllers 2007, 2008 and 2010 were controlled by a computer (HP9845B) so that the flow rates of $GEH_4$ and $SiH_4$ might be as shown in FIG. 22.

Deposition of the surface layer formed primarily of silicon atoms and carbon atoms was carried out as follows.

That is, after deposition of the second layer, as shown in Table 7M, the mass flow controllers for respective gases were set so that the flow rate ratio of the $CH_4$ gas flow rate relative to $SiH_4$ gas flow rate may be $SiH_4/CH_4 = 1/30$, and glow discharge was excited at a high frequency power of 150 W to form a surface layer.

Separately, on the cylindrical aluminum substrate having the same characteristic, a light-receiving layer was formed similarly as in the above case except for changing the discharging power in formation of both the first layer, the second layer and the surface layer to 40 W. As the result, the surface of the light-receiving layer was found to be in parallel to the surface of the substrate 8201 as shown in FIG. 82. In this case, the difference in the whole layer between the center and the both ends of the aluminum substrate was found to be 1 μm (Sample No. 1-1M).

On the other hand, in the case when the above high frequency power was made 150 W, the surface of the light-receiving layer and the surface of the substrate 8301 were found to be non-parallel to each other as shown in FIG. 83. In this case, the difference in average layer thickness between the center and both ends of the aluminum substrate was found to be 2 μm.

The two kinds of light-receiving members for electrophotography as prepared above were subjected to image exposure by means of a device as shown in FIG. 26 with a semiconductor laser (wavelength of laser beam: 780 nm, spot diameter 80 μm), followed by development and transfer to obtain images. In the light-receiving member having the surface characteristic as shown in FIG. 82 obtained at a high frequency power of 40 W during layer formation, interference fringe pattern was observed.

On the other hand, in the light-receiving member having the surface characteristic as shown in FIG. 83, no interference fringe pattern was observed to give practically satisfactory electrophotographic characteristics.

EXAMPLE 181

After formation of layers up to the second layer similarly as in the case of Sample No. 1-1M in Example 180, hydrogen ($H_2$) gas bomb was replaced with argon (Ar) bomb, the deposition device cleaned, and an all over the cathode electrode were placed a target for sputtering comprising Si and a target for sputtering comprising graphite to an area ratio shown in Sample No. 101M in Table 1M. The above light-receiving member was set and the deposition device was sufficiently evacuated by means of a diffusion pump. Then, argon gas was introduced to 0.015 Torr and glow discharge was excited at a high frequency power of 150 W to effect sputtering of the surface material, thereby depositing a surface layer of Sample No. 101M in Table 1M on the above substrate.

Similarly, except for varying the target area ratio of Si to graphite to form the surface layer as shown in Sample Nos. 102M to 107M in Table 1M, light-receiving members were prepared in the same manner as described above.

For the respective light-receiving members for electrophotography, image exposure was effected by laser similarly as in Example 180, and the steps to transfer were repeated for about 50,000 times, followed by evaluation of images. The results as shown in Table 1M were obtained.

EXAMPLE 182

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1M in Example 180, respective light-receiving members for electrophotography were prepared. For respective light-receiving members thus obtained, image exposure was effected by laser similarly as in Example 180, and the steps up to transfer were repeated for about 50,000 times, followed by evaluation of images, to obtain the results as shown in Table 2M.

EXAMPLE 183

Except for changing the flow rate ratio of $SiH_4$ gas and $SiF_4$ gas to $CH_4$ gas during formation of the surface layer to vary the content ratio of silicon atoms to carbon atoms in the surface layer, according to the same method as the case of Sample No. 1-1M in Example 180, respective light-receiving members for electrophotography were prepared. For respective light-receiving members thus obtained, image exposure was effected by laser similarly as in Example 180, and the steps up to transfer were repeated for about 50,000 times, followed by evaluation of images, to obtain the results as shown in Table 3M.

EXAMPLE 184

Except for changing the layer thickness of the surface layer, according to the same procedure as the case of Sample No. 1-1M in Example 180, respective light-receiving members for electrophotography were prepared. For the respective light-receiving members thus obtained, the steps of image formation, developing and cleaning were repeated similarly as in Example 180 to obtain the results as shown in Table 4M.

EXAMPLE 185

According to the entirely the same method as the case of Sample No. 1-1M in Example 180 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 180 to give practically satisfactory results.

EXAMPLE 186

The surface of a cylindrical aluminum substrate was worked by a lathe as shown in Table 5M. On these cylindrical aluminum substrates (Cylinder Nos. 101M–108M), light-receiving members for electrophotography were prepared under the same conditions when no interference fringe pattern was observed in Example 180 (high frequency power 160 W) (Sample Nos. 111M–118M). The difference in average layer thickness between the center and the both ends of the aluminum substrate was found to be 2.2 μm.

The cross-sections of these light-receiving members for electrophotography were observed with an electron microscope for measurement of the difference within the pitch of the second layer to obtain the results as shown in Table 6M.

These light-receiving members were subjected to image exposured by a semiconductor laser of a wavelength of 780 nm with a spot diameter of 80 μm by means of the device shown in FIG. 26 similarly as in Example 180 to obtain the results as shown in Table 6M.

EXAMPLE 187

In formation of the first layer of a-SiGe:H:B:O layer under the conditions shown in Table 7M, except for controlling the mass flow controllers 2008 and 2007 for $GeH_4$ and $SiH_4$ so that the flow rates of $GeH_4$ and $SiH_4$ may be as shown in FIG. 23, the same procedure in the case of the sample No. 1-1M in Example 180 was followed to prepare a light-receiving member for electrophotography.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 188

A A-Si type light-receiving member for electrophotography was prepared following the same condition and the procedure as described in Example 187 except for changing NO gas employed in Example 187 to $NH_3$ gas.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 189

A A-Si type light-receiving member for electrophotography was prepared following the same conduction and the procedure as the case of Sample No. 1-1M in Example 187 except for changing NO gas employed in Example 187 to $N_2O$ gas.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 190

Under the conditions shown in Table 8M, light-receiving members for electrophotography were formed similarly as in the case of Sample No. 1-1M in Example 180.

In preparation of the first layer of A-SiGe:H: B:N layer, the mass flow controllers 2007 and 2008 for $GeH_4$ and $SiH_4$ were controlled by a computer (HP9845B) so that the flow rates of $GeH_4$ and $SiH_4$ might be as shown in FIG. 24.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 191

Under the conditions shown in Table 8M, light-receiving members for electrophotography were formed similarly as in the case of Sample No. 1-1M in Example 180.

In preparation of the first layer of A-SiGe: H:B:N layer, the mass flow controllers 2007 and 2008 for $GeH_4$ and $SiH_4$ were controlled by a computer (HP9845B) so that the flow rates of $GeH_4$ and $SiH_4$ might be as shown in FIG. 25.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 192

A light-receiving member for electrophotography was prepared following the same condition and the procedure as described in Example 190 except for changing $NH_3$ gas employed in Example 190 to NO gas.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 193

A light-receiving member for electrophotography was prepared following the same condition and the procedure as described in Example 190 except for changing $NH_3$ gas employed in Example 190 to $N_2O$ gas.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 194

Under the conditions shown in Table 9M, light-receiving members for electrophotography were formed similarly as in the case of Sample No. 1-1M in Example 180.

In preparation of the first layer of A-SiGe:H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 22.

During the layer formation, the flow rate ratio of $N_2O$ gas relative to the sum of $GeH_4$ and and $SiH_4$ gas was changed according to the change rate curve shown in FIG. 72.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 195

A light-receiving member for electrophotography was prepared following the same condition and the procedure as described in Example 194 except for changing $N_2O$ gas employed in Example 194 to NO gas.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 196

A light-receiving member for electrophotography was prepared following the same condition and the procedure as described in Example 194 except for changing $N_2O$ gas employed in Example 194 to $NH_3$ gas For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 197

Under the conditions shown in Table 10M, light-receiving members for electrophotography were formed similarly as in the case of Sample No. 1-1M in Example 180.

In preparation of the first layer of A-SiGe:H:B:O layer, the mass flow controllers 2008 and 2007 for $GeH_4$ and $SiH_4$ were controlled by a computer (HP9845B) so that the flow rates of $GeH_4$ and $SiH_4$ might be as shown in FIG. 24.

During the layer formation, the flow rate ratio of NO gas relative to the sum of $GeH_4$ gas and $SiH_4$ gas was changed according to the change rate curve shown in FIG. 58.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 198

Under the conditions shown in Table 11M, light-receiving members for electrophotography were formed similarly as in the case of Sample No. 1-1M in Example 180.

In preparation of the first layer of A-SiGe:H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 25.

Figure 79:
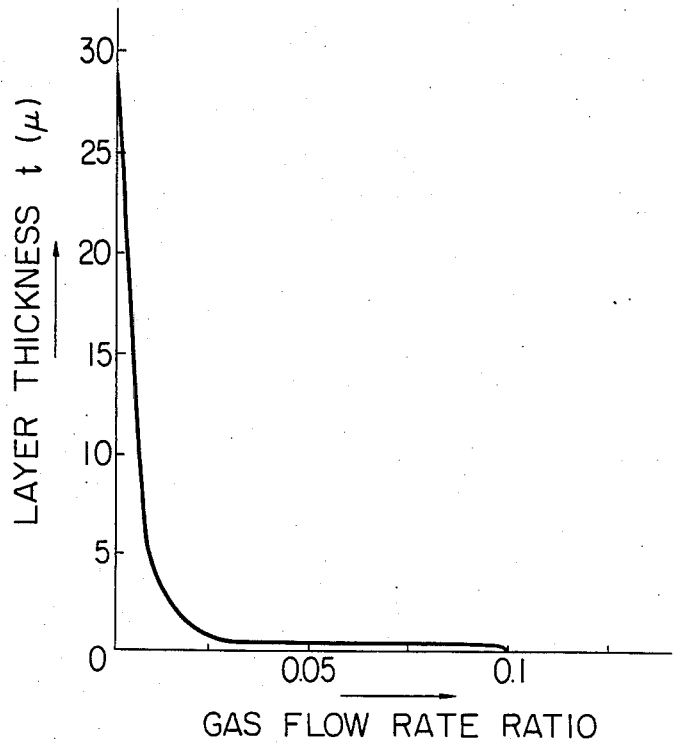

During the layer formation, the flow rate ratio of $NH_3$ gas relative to the sum of $GeH_4$ gas and $SiH_4$ gas was changed according to the change rate curve shown in FIG. 79.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 199

Under the conditions shown in Table 12H, light-receiving members for electrophotography were formed similarly as in the case of Sample No. 1-1M in Example 180.

In preparation of the first layer of A-SiGe:H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 23.

Figure 80:
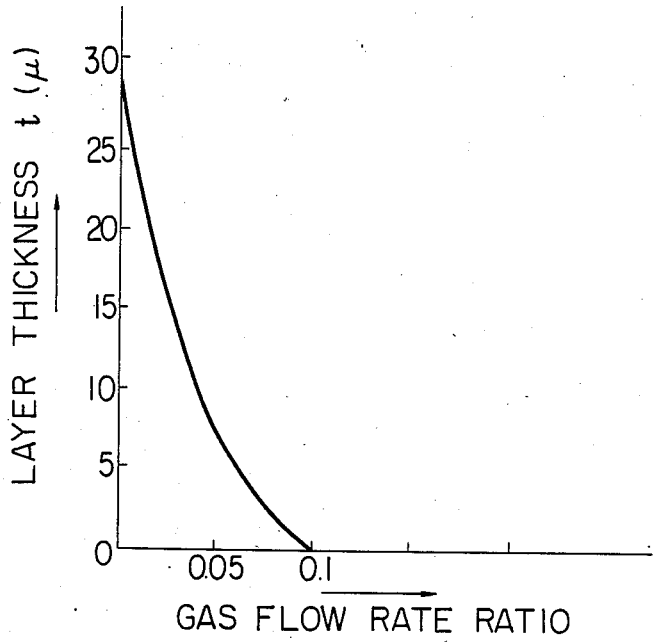

During the layer formation, the flow rate ratio of $N_2O$ gas relative to the sum of $GeH_4$ gas and $SiH_4$ gas was changed according to the change rate curve shown in FIG. 80.

For these light-receiving members for electrophotography, by means of the same device as in Example 180, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 200

Examples 187 to 199 were repeated except that $PH_3$ gas diluted to 3000 vol ppm with $H_2$ was employed in place of $B_2H_6$ gas diluted to 3000 vol ppm with $H_2$ to prepare light-receiving members for electrophotography, respectively.

Other preparation conditions were same as in Examples 187 to 199.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 13

As a comparative test, an A-Si light-receiving member for electrophotography was prepared in entirely the same manner as in the case of Sample No. 1-1M in Example 180 as described above except for employing an aluminum substrate roughened on its surface by the sand blasting method in place of the aluminum substrate used in preparation of the light-receiving member for electrophotography in Example 180. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 180, clear interference fringe was found to be formed in the black image over all the surface.

EXAMPLE 201

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, A-Si light-receiving members for electrophotography were deposited on the above aluminum substrate following various procedures under the conditions as shown in Table 7N using the film deposition device as shown in FIG. 20 (Sample No. 1-1N).

Deposition of the surface layer was carried out as follows.

After formation of the second layer, the mass flow controllers corresponding to respective gases were set so that the $CH_4$ gas flow rate relative to the $SiH_4$ gas flow rate may be $SiH_4/CH_4=1/30$ as shown in Table 7N, and A-SiC(H) with a thickness of 0.5 μm was deposited at a high frequency power of 150 W.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layer between the center and the both ends of the aluminum substrate was found to be 1 μm (Sample No. 1-1N).

On the other hand, in the case of the above Sample No. 1-1N, the surface of the surface layer 8305 and the surface of the substrate 8301 were found to be non-parallel to each other as shown in FIG. 83. In this case, the difference in average layer thickness between the center and both ends of the aluminum substrate was found to be 2 μm.

The light-receiving members for electrophotography as prepared above were subjected to image exposure by means of a device as shown in FIG. 30 (wavelength of laser beam: 780 nm, spot diameter 80 μm), followed by development and transfer to obtain images. In the light-receiving member having the surface characteristic as shown in FIG. 82, interference fringe pattern was observed.

On the other hand, in the light-receiving member having the surface characteristic as shown in FIG. 83, no interference fringe pattern was observed to give practically satisfactory electrophotographic characteristics.

EXAMPLE 202

After formation of layers up to the second layer similarly as in the case of Sample No. 1-1N in Example 201, hydrogen ($H_2$) gas bomb was replaced with argon (Ar) bomb, the deposition device cleaned, and on all over the cathode electrode were placed a target or sputtering comprising Si and a target for sputtering comprising graphite to an area ratio shown in Sample No. 101N in Table 1N. The above light-receiving member was set and the deposition device was sufficiently evacuated by means of a diffusion pump. Then, argon gas was introduced to 0.015 Torr and glow discharging gas excited at a high frequency power of 50 W to effect sputtering of the surface material, thereby forming a surface layer of Sample No. 101N in Table 1N on the above substrate.

Similarly, except for varying the target area ratio of Si to graphite to form the surface layer as shown in Sample Nos. 102N to 107N in Table 1N, light-receiving members were prepared in the same manner as described above.

For the respective light-receiving members for electrophotography, image exposure was effected by laser similarly as in Example 201, and the steps to transfer were repeated for about 50,000 times, followed by evaluation of images. The results as shown in Table 1N were obtained.

EXAMPLE 203

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1N in Example 201, respective light-receiving members for electrophotography were prepared. For respective light-receiving members thus obtained, image exposure was effected by laser similarly as in Example 201, and the steps up to transfer were repeated for about 50,000 times, followed by evaluation of images, to obtain the results as shown in Table 2N.

EXAMPLE 204

Except for changing the flow rate ratio of $SiH_4$ gas, $SiF_4$gas to $CH_4$ gas during formation of the surface layer to vary the content ratio of silicon atoms to carbon atoms in the surface layer, according to the same method as the case of Sample No. 1-1N in Example 201 respective light-receiving members for electrophotography were prepared. For respective light-receiving members thus obtained, image exposure was effected by laser similarly as in Example 201, and the steps up to transfer were repeated for about 50,000 times, followed by evaluation of images, to obtain the results as shown in Table 3N.

EXAMPLE 205

Except for changing the layer thickness of the surface layer, according to the same procedure as the case of Sample No. 1-1N in Example 201, respective light-receiving members for electrophotography were prepared. For the respective light-receiving members thus otained, the steps of image formation, developing and cleaning were repeated to obtain the results as shown in Table 4N.

EXAMPLE 206

According to entirely the same method as the case of Sample No. 1-1N in Example 201 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 201 to give practically satisfactory results.

EXAMPLE 207

The surface of a cylindrical aluminum substrate was worked by a lathe as shown in Table 5N. On these cylindrical aluminum substrate (Nos. 101N–108N), light-receiving members for electrophotography were prepared under the same conditions as the case of Sample No. 1-1N in Example 201 (Nos. 111N–118N). The difference in average layer thickness between the center and the both ends of the aluminum substrate was found to be 2.2 μm.

The cross-sections of these light-receiving members for electrophotography were observed with an electron microscope for measurement of the difference within the pitch of the light-receiving layer to obtain the results as shown in Table 6N.

These light-receiving members were subjected to image exposured by a semiconductor laser of a wavelength of 780 nm with a spot diameter of 80 μm by means of the device shown in FIG. 26 similarly as in Example 201 to obtain the results as shown in Table 6N.

EXAMPLE 208

Under the conditions shown in Table 8N, light-receiving members for electrophotography were formed similarly as in the case of Sample No. 1-1N in Example 201.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial state and the image after copying for 100,000 times.

EXAMPLE 209

Under the conditions shown in Table 9N, light-receiving members for electrophotography were formed similarly as in the case of Sample No. 1-1N in Example 201.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 210

Under the conditions shown in Table 10N, light-receiving members for electrophotography were formed similarly as in the case of Sample No. 1-1N in Example 201.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 211

A light-receiving member for electrophotography was prepared following the same condition and the procedure as described in Example 209 except for changing $N_2O$ gas employed in Example 209 to $NH_3$ gas.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 212

A light-receiving member for electrophotography was prepared following the same condition and the procedure as described in Example 210 except for changing NO gas employed in Example 210 to $N_2O$ gas.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 213

Under the conditions shown in Table 11N, light-receiving members for electrophotography were prepared similarly as in the case of Sample No. 1-1N in Example 201.

Figure 56:
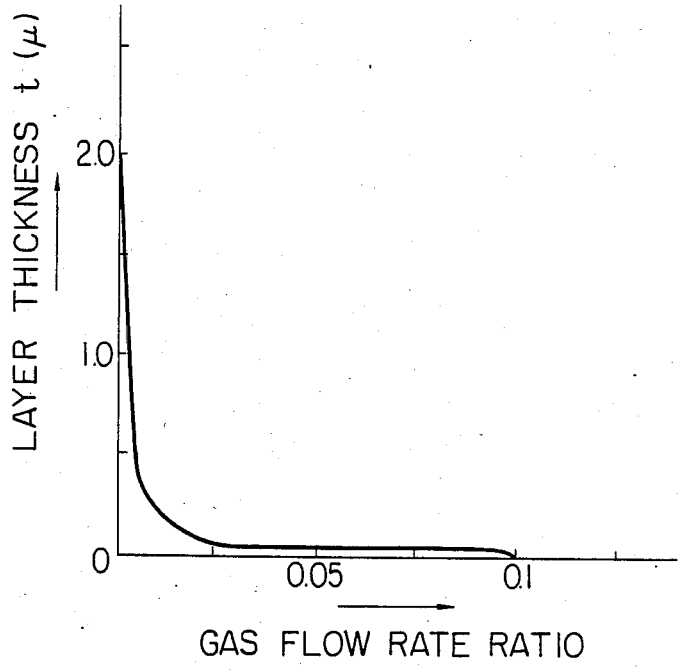

In formation of the boron containing layer, the respective mass flow controllers for $B_2H_6/H_2$ and $NH_3$ 2010 and 2009 were controlled by a computer (HP9845B) so that the flow rate of $B_2H_6/H_2$ might be as shown in FIG. 60 and the flow rate of $NH_3$ as shown in FIG. 56.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 214

A light-receiving member for electrophotography was prepared following the same condition and the procedure as described in Example 213 except for changing $NH_3$ gas employed in Example 213 to NO gas.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 215

A light-receiving member for electrophotography was prepared following the same condition and the procedure as described in Example 213 except for changing $NH_3$ gas employed in Example 213 to $N_2O$ gas.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 216

Under the conditions shown in Table 12N, light-receiving members for electrophotography were formed similarly in the of Sample No. 1-1N in Example 201.

In formation of the boron containing layer, the respective mass flow controllers for $B_2H_6/H_2$ and $N_2O$ 2010 and 2009 were controlled by a computer (HP9845B) so that the flow rate of $B_2H_6/H_2$ might be as shown in FIG. 61 and the flow rate of $N_2O$ as shown in FIG. 57.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 217

A light-receiving member for electrophotography was prepared following the same condition and the procedure as described in Example 216 except for changing $N_2O$ gas employed in Example 216 to NO gas.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 218

A light-receiving member for electrophotography was prepared following the same condition and the procedure as described in Example 216 except for changing $N_2O$ gas employed in Example 216 to $NH_3$ gas.

For these light-receiving members for electrophotography by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 219

Under the conditions shown in Table 13N, light-receiving members for electrophotography were formed similarly as in the case of Sample No. 1-1N in Example 201.

Figure 62:
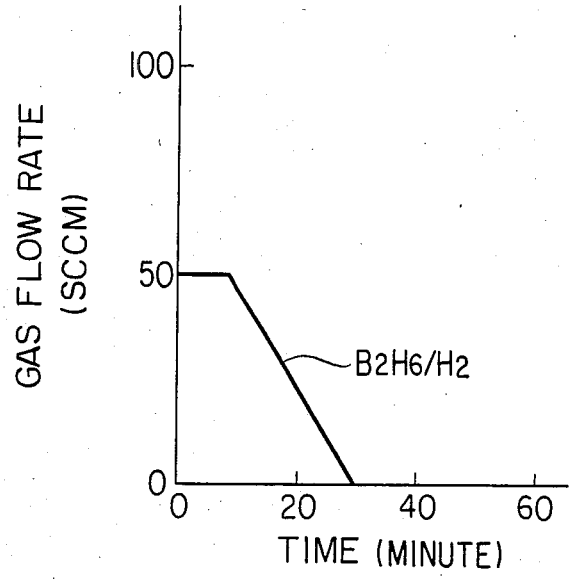

In formation of the boron containing layer, the respective mass flow controllers for $B_2H_6/H_2$ and NO 2010 and 2009 were controlled by a computer (HP9845B) so that the flow rate of $B_2H_6/H_2$ might be as shown in FIG. 62 and the flow rate of NO as shown in FIG. 58.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 220

A light-receiving member for electrophotography was prepared following the same condition and the procedure as described in Example 219 except for changing NO gas employed in Example 219 to $NH_3$ gas.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 221

A light-receiving member for electrophotography was prepared following the same condition and the procedure as described in Example 219 except for changing NO gas employed in Example 219 to $N_2O$ gas.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 222

Under the conditions shown in Table 14N, light-receiving members for electrophotography were formed similarly as in the case of Sample No. 1-1N in Example 201.

Figure 59:
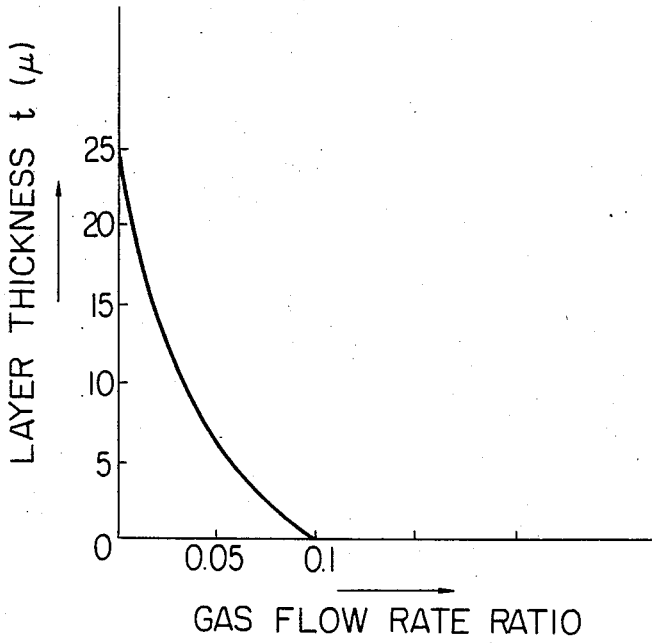

In formation of the boron containing layer, the respective mass flow controllers for $B_2H_6/H_2$ and $NH_3$ 2010 and 2009 were controlled by a computer (HP9845B) so that the flow rate of $B_2H_6/H_2$ might be as shown in FIG. 39 and the flow rate of $NH_3$ as shown in FIG. 59.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 223

A light-receiving member for electrophotography was prepared following the same condition and the procedure as described in Example 222 except for changing $NH_3$ gas employed in Example 222 to NO gas.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained Also, the images were of high quality, without any difference between the image at the initial stage and the image after copying for 100,000 times.

EXAMPLE 224

A light-receiving member for electrophotography was prepared following the same condition and the procedure as described in Example 222 except for changing $NH_3$ gas employed in Example 222 to $N_2O$ gas.

For these light-receiving members for electrophotography, by means of the same device as in Example 201, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 225

The case of Sample No. 1-1N in Example 201 and Examples 208 to 224 were repeated except that $PH_3$ gas diluted to 3000 vol ppm with $H_2$ was employed in place of $B_2H_6$ gas diluted to 3000 vol ppm with $H_2$ to prepare light-receiving members for electrophotography, respectively.

Other preparation conditions were the same as the case of Sample No. 1-1N in Example 201 in Examples 208 to 224.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 14

As a comparative test, an A-Si light-receiving member for electrophotography was prepared in entirely the same manner as in the case of Sample No. 1-1N in Example 201 as described above except for employing an aluminum substrate roughened on its surface by the sand blasting method in place of the aluminum substrate used in preparation of the light-receiving member for electrophotography in Example 201. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 201, clear interference fringe was found to be formed in the black image over all the surface.

EXAMPLE 226

An aluminum substrate having the shape as shown in FIG. 9 (spiral groove surface shape with length (L): 357 mm, outerdiameter (r): 80 mm; pitch (P) 25 μm; depth (D) 0.8 μm) was prepared.

Next, A-Si light-receiving members for electrophotography were deposited on the above aluminum substrate following various procedures under the conditions as shown in Table 7P using the deposition device as shown in FIG. 20 (Sample No. 1-1P).

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 22 and FIG. 36.

Also, deposition of the surface layer was carried out as follows. Thus, after formation of the second layer, the mass flow controllers corresponding to respective gases were set so that the $CH_4$ gas flow rate relative to the $SiH_4$ gas lfow rate may be $SiH_4/CH_4=1/30$ as shown in Table 7P, and A-SiC(H) with a thickness of 0.5 μm was deposited at a high frequency power of 150 W.

Separately, on the cylindrical aluminum substrate having the same characteristic, a light-receiving layer was formed similarly as in the above case except for changing the discharging power in formation of both the first layer and the second layer to 50 W. As the result, the surface of the surface layer 8205 was found to be in parallel to the surface of the substrate 8201 as shown in FIG. 82. In this case, the difference in the whole layer between the center and the both ends of the aluminum substrate was found to be 1 μm (Sample No. 1-2P).

On the other hand, in the case of the above Sample No. 1-1P, the surface of the surface layer 8305 and the surface of the substrate 8301 were found to be non-parallel to each other as shown in FIG. 83. In this case, the difference in average layer thickness between the center and both ends of the aluminum substrate was found to be 2 μm.

The light-receiving members for electrophotography as prepared above were subjected to image exposure by means of a device as shown in FIG. 26 (wavelength of laser beam: 780 nm, spot diameter 80 μm), followed by development and transfer to obtain images. In the light-receiving member having the surface characteristic as shown in FIG. 82, an interference fringe pattern was observed.

On the other hand, in the light-receiving member having the surface characteristic as shown in FIG. 83, no interference fringe pattern was observed to give practically satisfactory electrophotography characteristics.

EXAMPLE 227

After formation of layers up to the second layer similarly as in the case of Sample No. 1-1P in Example 226, hydrogen ($H_2$) gas bomb was replaced with argon (Ar) bomb, the deposition device cleaned, and on all over the cathode electrode were placed a target for sputtering comprising Si and a target for sputtering comprising graphite to an area ratio shown in Sample No. 101P in Table 1P. The above light-receiving member was set and the deposition device was sufficiently evacuated by means of a diffusion pump. Then, argon gas was introduced to 0.015 Torr and glow discharging was excited at a high frequency power of 150 W to effect sputtering of the surface material, thereby forming a surface layer of Sample No. 101P in Table 1P on the above substrate.

Similarly, except for varying the target area ratio of Si to graphite to form the surface layer as shown in Sample Nos. 102P to 107P in Table 1P, light-receiving members were prepared in the same manner as described above.

For the respective light-receiving members for electrophotography, image exposure was effected by laser similarly as in Example 226, and the steps to transfer were repeated for about 50,000 times, followed by evaluation of images. The results as shown in Table 1P were obtained.

EXAMPLE 228

Except for changing the flow rate ratio of $SiH_4$ gas to $CH_4$ gas during formation of the surface layer to vary the content ratio of silicon atoms to carbon atoms in the surface layer, according to the same method as the case of Sample No. 1-1P in Example 226 respective light-receiving members for electrophotography were prepared. For respective light-receiving members thus obtained, image exposure was effected by laser similarly as in Example 226, and the steps up to transfer were repeated for about 50,000 times, followed by evaluation of images, to obtain the results as shown in Table 2P.

EXAMPLE 229

Except for changing the flow rate ratio of $SiH_4$ gas, $SiF_4$ gas to $CH_4$ gas during formation of the surface layer to vary the content ratio of silicon atoms to carbon atoms in the surface layer, according to the same method as the case of Sample No. 1-1P in Example 226 respective light-receiving members for electrophotography were prepared. For respective light-receiving members thus obtained, image exposure was effected by laser similarly as in Example 226, and the steps up to transfer were repeated for about 50,000 times, followed by evaluation of images, to obtain the results as shown in Table 3P.

EXAMPLE 230

Except for changing the layer thickness of the surface layer, according to the same procedure as the case of Sample No. 1-1P in Example 226 respective light-receiving members for electrophotography were prepared. For the respective light-receiving members thus obtained, the steps of image formation, developing and cleaning were repeated similarly as in Example 226 to obtain the results as shown in Table 4P.

EXAMPLE 231

According to entirely the same method as the case of Sample No. 1-1P in Example 226 except for changing the discharging power during formation of the surface layer to 300 W and making the average layer thickness 2 μm, respective light-receiving members for electrophotography were prepared. The difference in average layer thickness between the center and the both ends of the surface layer of the light-receiving member thus obtained was found to be 0.5 μm. The layer thickness difference at minute portion was found to be 0.1 μm.

In such light-receiving members for electrophotography, no interference fringe pattern was observed and, the steps of image formation, developing and cleaning were repeated by the same device as in Example 226 to give practically satisfactory results.

EXAMPLE 232

The surface of a cylindrical aluminum substrate was worked by a lathe as shown in Table 5P. On these cylindrical aluminum substrates (Cylinder Nos. 101P–108P), light-receiving members for electrophotography were prepared under the same conditions as the case of Sample No. 1-1P in Example 226 (Sample Nos. 111P–118P). The difference in average layer thickness between the center and the both ends of the aluminum substrate was found to be 2.2 μm.

The cross-sections of these light-receiving members for electrophotography were observed with an electron microscope for measurement of the difference within the pitch of the light-receiving layer to obtain the results as shown in Table 6P.

These light-receiving members were subjected to image exposure by a semiconductor laser of a wavelength of 780 nm with a spot diameter of 80 μm by means of the device shown in FIG. 26 similarly as in Example 226 to obtain the results as shown in Table 6P.

EXAMPLE 233

In formation of the first layer, except for controlling the mass flow controllers 2007, 2008 and 2010 so that the flow rates of $GeH_4$, $SiH_4$ and $B_2H_6/H_2$ may be as shown in FIG. 23 and FIG. 37, the same procedure in the case of the Sample No. 1-1P in Example 226 was followed to prepare a light-receiving layer for electrophotography.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 234

Under the conditions shown in Table 8P, light-receiving members for electrophotography were formed similarly as in the case of Sample No. 1-1P in Example 226.

In formation of the first layer, the respective mass flow controllers 2007, 2008 and 2010 were controlled by a computer (HP9845B) so that the flow rates of $GeH_4$, $SiH_4$ and $B_2H_6/H_2$ might be as shown in FIG. 24 and FIG. 38.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 235

In formation of the first layer, except for controlling the mass flow controllers 2007, 2008 and 2010 so that the flow rates of $GeH_4$, $SiH_4$ and $B_2H_6/H_2$ may be as shown in FIG. 25 and FIG. 39, the same procedure in Example 234 was followed to prepare a light-receiving layer for electrophotography.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 236

Under the conditions shown in Table 9P, light-receiving members for electrophotography were formed similarly as in the case of Sample No. 1-1P in Example 226.

In formation of the first layer and layer A, the respective mass flow controllers 2007, 2008 and 2010 were controlled by a computer (HP9845B) so that the flow rates of $GeH_4$, $SiH_4$ and $B_2H_6/H_2$ might be as shown in FIG. 40.

For these light-receiving members for electrphotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 237

Under the conditions shown in Table 10P, light-receiving members for electrophotography were formed similarly as in the case of Sample No. 1-1P in Example 226.

In formation of the first layer and layer A, the respective mass flow controllers 2007, 2008 and 2010 were controlled by a computer (HP9845B) so that the flow rates of $GeH_4$, $SiH_4$ and $B_2H_6/H_2$ might be as shown in FIG. 41.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial state and the image after copying for 100,000 times.

EXAMPLE 238

Under the conditions shown in Table 11P, light-receiving members for electrophotography were formed similarly as in the case of Sample No. 1-1P in Example 226.

In formation of the first layer and layer A, the respective mass flow controllers 2007, 2008 and 2010 were controlled by a computer (HP9845B) so that the flow rates of $GeH_4$, $SiH_4$ and $B_2H_6/H_2$ might be as shown in FIG. 42.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 239

A light-receiving member for electrophotography was prepared following the same conditions as the case of Sample No. 1-1P in Example 226 except for changing NO gas employed in Example 226 to $NH_3$ gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 240

A light-receiving member for electrophotography was prepared following the same condition as the case of Sample No. 1-1P in Example 226 except for changing NO gas employed in Example 226 to $N_2O$ gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 241

A light-receiving member for electrophotography was prepared following the same condition and the procedure as described in Example 234 except for changing $NH_3$ gas employed in Example 234 to NO gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 242

A light-receiving member for electrophotography was prepared following the same condition and the procedure as described in Example 234 except for changing $NH_3$ gas employed in Example 234 to $N_2O$ gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 243

A light-receiving member for electrophotography was prepared following the same condition and the procedure as described in Example 236 except for changing $N_20$ gas employed in Example 236 to NO gas.

For these light-receiving members for electrophotography, by means of the same device as in Example 226, image exposure was effected, followed by developing, transfer and fixing, to obtain visible images to plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 244

A light-receiving member for electrophotography was prepared following the same condition and the procedure as described in Example 236 except for changing $N_2O$ gas employed in Example 236 to $NH_3$ gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 245

Under the conditions shown in Table 12P, light-receiving members for electrophotography were formed similarly as in the case of Sample No. 1-1P in Example 226.

Figure 52:
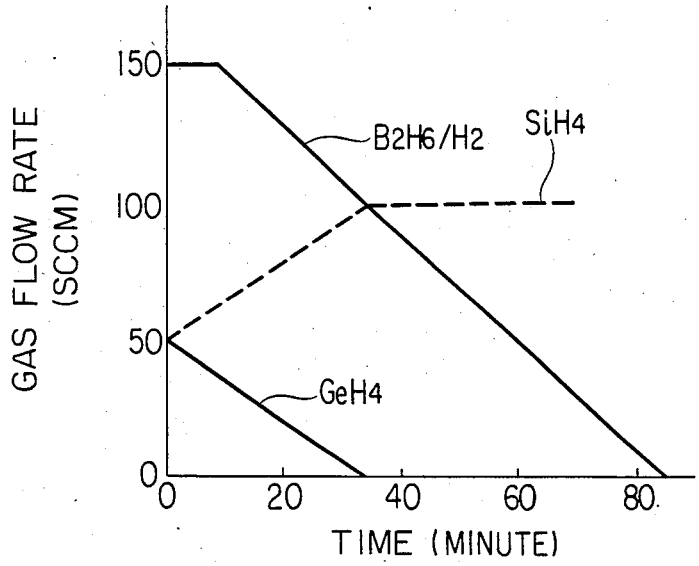

The mass flow controllers 2007, 2008, 2010 and 2009 were controlled by a computer (HP9845B) so that the flow rates of $SiH_4$, $GeH_4$ and $B_2N_6/H_2$ gases might be as shown in FIG. 52 and the flow rate of $NH_3$ during formation of the nitrogen containing layer might be as shown in FIG. 56.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 246

A light-receiving member for electrophotography was prepared following the same condition and the procedure as described in Example 245 except for changing $NH_3$ gas employed in Example 245 to NO gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 247

A light-receiving member for electrophotography was prepared following the same condition and the procedure as described in Example 245 except for changing $NH_3$ gas employed in Example 245 to $N_2O$ gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 248

Under the conditions shown in Table 13P, light-receiving members for electrophotography were formed similarly as in the case of Sample No. 1-1P in Example 226.

Figure 53:
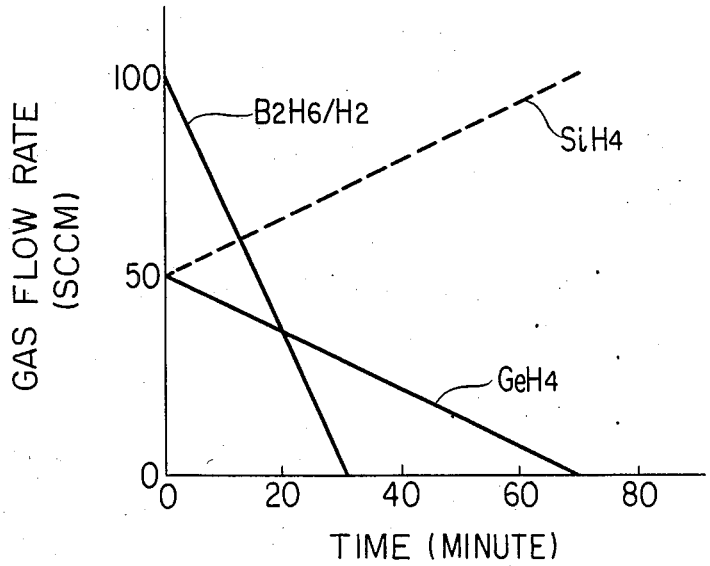

The mass flow controllers 2007, 2008, 2010 and 2009 were controlled by a computer (HP9845B) so that the flow rates of $SiH_4$, $GeH_4$ and $B_2H_6/H_2$ gases might be as shown in FIG. 53 and the flow rate of $N_2O$ during formation of the oxygen containing layer might be as shown in FIG. 57.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 249

A light-receiving member for electrophotography was prepared following the same condition and the procedure as described in Example 248 except for changing $N_2O$ gas employed in Example 248 to NO gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 250

A light-receiving member for electrophotography was prepared following the same condition and the procedure as described in Example 248 except for changing $N_2O$ gas employed in Example 248 to $NH_3$ gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 251

Under the conditions shown in Table 14P, light-receiving members for electrophotography were formed similarly as in the case of Sample No. 1-1P in Example 226.

Figure 54:
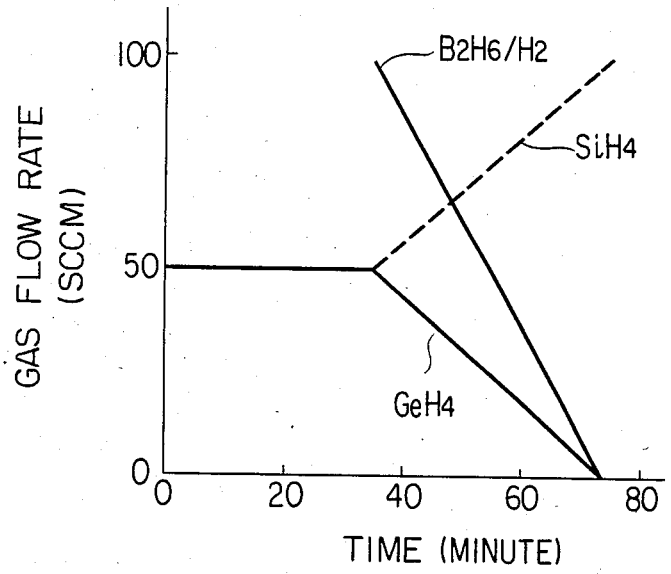

The mass flow controllers 2007, 2008, 2010 and 2009 were controlled by a computer (HP9845B) so that the flow rates of $SiH_4$, $GeH_4$ and $B_2N_6/H_2$ gases might be as shown in FIG. 54 and the flow rate of NO during formation of the oxygen containing layer might be as shown in FIG. 58.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 252

A light-receiving member for electrophotography was prepared following the same condition and the procedure as described in Example 251 except for changing NO gas employed in Example 251 to $NH_3$ gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 253

A light-receiving member for electrophotography was prepared following the same condition and the procedure as described in Example 251 except for changing NO gas employed in Example 251 to $N_2O$ gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 254

Under the conditions shown in Table 15P, light-receiving members for electrophotography were formed similarly as in the case of Sample No. 1-1P in Example 226.

Figure 55:
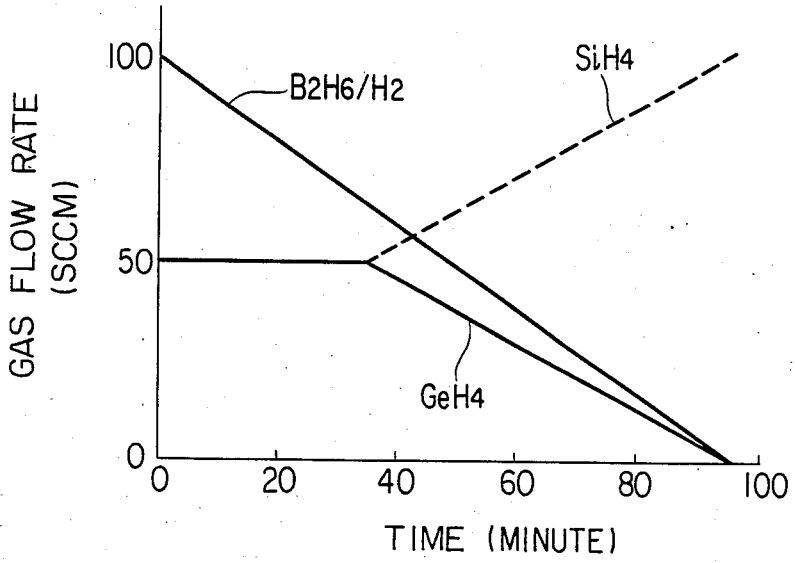

The mass flow controllers 2007, 2008, 2010 and 2009 were controlled by a computer (HP9845B) so that the flow rates of $SiH_4$, $GeH_4$ and $B_2H_6/H_2$ gases might be as shown in FIG. 55 and the flow rate of $NH_3$ during formation of the nitrogen containing layer might be as shown in FIG. 59.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 255

A light-receiving member for electrophotography was prepared following the same condition and the procedure as described in Example 254 except for changing $NH_3$ gas employed in Example 254 to NO gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 256

A light-receiving member for electrophotography was prepared following the same condition and the procedure as described in Example 254 except for changing $NH_3$ gas employed in Example 254 to $N_2O$ gas.

For these light-receiving members for electrophotography, by means of the same device as in Example 226, image exposure was effected, followed by developing, transfer and fixing, to obtain visible images on plain papers. Such an image forming process was repeated 100,000 times continuously.

In all of the images obtained in this case, no interference fringe was observed at all and practically satisfactory characteristics could be obtained. Also, the images were of high quality, without any difference between the image at the initial stage and the image after copying for 100,000 times.

EXAMPLE 257

The case of Sample No. 1-1P in Example 226 and Examples 233 to 256 were repeated except that $PH_3$ gas diluted to 3000 vol ppm with $H_2$ was employed in place of $P_2H_6$ gas diluted to 3000 vol ppm with $H_2$ to prepare light-receiving members for electrophotography, respectively.

Other preparation conditions were the same as the case of Sample No. 1-1P in Example 226 and in Examples 233 to 256.

For these light-receiving members for electrophotography, image exposure was effected by means of an image exposure device as shown in FIG. 26 (wavelength of laser beam: 780 nm, spot diameter 80 $\mu$m), followed by development and transfer, to obtain images. All of the images were free from interference fringe pattern and practically satisfactory.

COMPARATIVE EXAMPLE 15

As a comparative test, an A-Si light-receiving member for electrophotography was prepared in entirely the same manner as in the case of Sample No. 1-1P in Example 226 as described above except for employing an aluminum substrate roughened on its surface by the sand blasting method in place of the aluminum substrate used in preparation of the light-receiving member for electrophotography in Example 226. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 $\mu$m.

When the same measurement was conducted by mounting the light-receiving member for electrophotography for comparative purpose on the device shown in FIG. 26 employed in Example 226, clear interference fringe was found to be formed in the black image over all the surface.

TABLE 1A

| | Sample No. | | | | | | |
|---|---|---|---|---|---|---|---|
| | 101A | 102A | 103A | 104A | 105A | 106A | 107A |
| Si:C Target (Area ratio) | 9:1 | 6.5:3.5 | 4:6 | 2:8 | 1:9 | 0.5:9.5 | 0.2:8.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎ . . . Very good
○ . . . Good
Δ . . . Practically satisfactory
X . . . Image defect formed

TABLE 2A

| | Sample No. | | | | | | | |
|---|---|---|---|---|---|---|---|---|
| | 201A | 202A | 203A | 204A | 205A | 206A | 207A | 208A |
| $SiH_4$:$CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎ . . . Very good
○ . . . Good
Δ . . . Practically satisfactory
X . . . Image defect formed

TABLE 3A

| | Sample No. | | | | | | | |
|---|---|---|---|---|---|---|---|---|
| | 301A | 302A | 303A | 304A | 305A | 306A | 307A | 308A |
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎ . . . Very good
○ . . . Good
Δ . . . Practically satisfactory
X . . . Image defect formed

TABLE 4A

| Sample No. | Thickness of surface layer (μ) | Results |
|---|---|---|
| 4001A | 0.001 | Image defect liable to occur |
| 4002A | 0.02 | No image defect formed up to successive copying for 20,000 times |
| 4003A | 0.05 | Stable up to successive copying for 50,000 times |
| 4004A | 1 | Stable up to successive copying for 200,000 times |

TABLE 5A

| NO. | 501A | 502A | 503A | 504A | 505A | 506A | 507A | 508A |
|---|---|---|---|---|---|---|---|---|
| Pitch (μm) | 620 | 190 | 110 | 49 | 38 | 26 | 11 | 4.9 |
| Depth (μm) | 1.1 | 11 | 1.9 | 2.2 | 1.8 | 0.9 | 0.25 | 1.9 |
| Angle (degree) | 0.2 | 6.6 | 2.0 | 5.1 | 5.4 | 4.0 | 2.6 | 38 |

TABLE 6A

| | NO. | | | | | | | |
|---|---|---|---|---|---|---|---|---|
| | 511A | 512A | 513A | 514A | 515A | 516A | 517A | 518A |
| | Cylinder No. | | | | | | | |
| | 201A | 202A | 203A | 204A | 205A | 206A | 207A | 208A |
| Difference in layer (μm) thickness | 0.04 | 0.06 | 0.14 | 0.15 | 0.3 | 0.2 | 0.11 | 2.8 |
| Interference fringe | X | X | ○ | ○ | ◎ | ◎ | Δ | X |

X . . . Practically unusable
Δ . . . Practically satisfactory
○ . . . Practically very good
◎ . . . Practically excellent

TABLE 7A

| | NO. | | | | | | | |
|---|---|---|---|---|---|---|---|---|
| | 611A | 612A | 613A | 614A | 615A | 616A | 617A | 618A |
| | Cylinder No. | | | | | | | |
| | 201A | 202A | 203A | 204A | 205A | 206A | 207A | 208A |
| Difference in layer thickness of first layer (μm) | 0.05 | 0.05 | 0.06 | 0.18 | 0.31 | 0.22 | 0.71 | 2.4 |

TABLE 7A-continued

| | NO. | | | | | | | |
|---|---|---|---|---|---|---|---|---|
| | 611A | 612A | 613A | 614A | 615A | 616A | 617A | 618A |
| | Cylinder No. | | | | | | | |
| | 201A | 202A | 203A | 204A | 205A | 206A | 207A | 208A |
| Difference in layer thickness of second layer (μm) | 0.06 | 0.06 | 0.1 | 0.2 | 0.35 | 0.32 | 0.81 | 3.2 |
| Interference fringe | X | X | ○ | ◎ | ◎ | ◎ | Δ | X |

X . . . Practically unusable
Δ . . . Practically satisfactory
○ . . . Practically very good
◎ . . . Practically excellent

TABLE 8A

| NO. | 701A | 702A | 703A | 704A | 705A | 706A | 707A |
|---|---|---|---|---|---|---|---|
| Pitch (μm) | 41 | 32 | 26 | 21 | 11 | 4.9 | 2.1 |
| Depth (μm) | 3.51 | 2.6 | 0.9 | 1.1 | 0.71 | 0.11 | 0.51 |
| Angle (degree) | 9.7 | 9.2 | 4.0 | 6 | 7.4 | 2.6 | 26 |

TABLE 9A

| | NO. | | | | | | |
|---|---|---|---|---|---|---|---|
| | 711A | 712A | 713A | 714A | 715A | 716A | 717A |
| | Cylinder No. | | | | | | |
| | 201A | 202A | 203A | 204A | 205A | 206A | 207A |
| Difference in layer thick-ness (μm) | 0.11 | 0.12 | 0.32 | 0.26 | 0.71 | 0.11 | 2.2 |
| Interference fringe | Δ | ○ | ◎ | ◎ | ◎ | Δ | X |

TABLE 10A

| | NO. | | | | | | |
|---|---|---|---|---|---|---|---|
| | 811A | 812A | 813A | 814A | 815A | 816A | 817A |
| | Cylinder No. | | | | | | |
| | 201A | 202A | 203A | 204A | 205A | 206A | 207A |
| Difference in layer (μm) thickness | 0.06 | 0.11 | 0.12 | 0.33 | 0.52 | 0.06 | 2.15 |
| Interference fringe | X | Δ | ○ | ◎ | ◎ | X | X |

X . . . Practically unusable
Δ . . . Practically satisfactory
○ . . . Practically very good
◎ . . . Practically excellent

TABLE 11A

| | NO. | | | | | | |
|---|---|---|---|---|---|---|---|
| | 911A | 912A | 913A | 914A | 915A | 916A | 917A |
| | Cylinder No. | | | | | | |
| | 201A | 202A | 203A | 204A | 205A | 206A | 207A |
| Difference in layer (μm) thickness | 0.11 | 0.32 | 0.04 | 0.31 | 0.9 | 0.12 | 2.51 |
| Interference fringe | Δ | ◎ | ◎ | ◎ | ◎ | ○ | X |

X . . . Practically unusable
Δ . . . Practically satisfactory
○ . . . Practically very good
◎ . . . Practically excellent

TABLE 1B

| | Sample No. | | | | | | |
|---|---|---|---|---|---|---|---|
| | 101B | 102B | 103B | 104B | 105B | 106B | 107B |
| Si:C Target (Area ratio) | 9:1 | 6.5:3.5 | 4:6 | 2:8 | 1:9 | 0.5:9.5 | 0.2:8.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎— Very good
○ — Good
Δ — Practically satisfactory
X — Image defect formed

TABLE 2B

| | Sample No. | | | | | | | |
|---|---|---|---|---|---|---|---|---|
| | 201B | 202B | 203B | 204B | 205B | 206B | 207B | 208B |
| $SiH_4$:$CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎— Very good
○ — Good
Δ— Practically satisfactory
X — Image defect formed

TABLE 3B

| | Sample No. | | | | | | | |
|---|---|---|---|---|---|---|---|---|
| | 301B | 302B | 303B | 304B | 305B | 306B | 307B | 308B |
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content | 9:1 | 7:3 | 5.5:4.5 | 4:6 | 3:7 | 2:8 | 1.2:8.8 | 0.8:9.2 |

TABLE 3B-continued

| | Sample No. | | | | | | | |
|---|---|---|---|---|---|---|---|---|
| | 301B | 302B | 303B | 304B | 305B | 306B | 307B | 308B |
| ratio) | | | | | | | | |
| Image quality evaluation | Δ | ○ | ◎ | ◎ | ◎ | ○ | Δ | X |

◎— Very good
○ —Good
Δ — Practically satisfactory
X — Image defect formed

TABLE 4B

| Sample No. | Thickness of surface layer (μ) | Results |
|---|---|---|
| 4001B | 0.001 | Image defect liable to occur |
| 4002B | 0.02 | No image defect formed up to successive copying for 20,000 times |
| 4003B | 0.05 | Stable up to successive copying for 50,000 times |
| 4004B | 1 | Stable up to successive copying for 200,000 times |

TABLE 5B

| NO. | 501B | 502B | 503B | 504B | 505B | 506B | 507B | 508B |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6B

| | NO. | | | | | | | |
|---|---|---|---|---|---|---|---|---|
| | 511B | 512B | 513B | 514B | 515B | 516B | 517B | 518B |
| | Cylinder No. | | | | | | | |
| | 201B | 202B | 203B | 204B | 205B | 206B | 207B | 208B |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X — Practically unusable
Δ — Practically satisfactory
○ — Practically very good
◎— Practically excellent

TABLE 7B

| | NO. | | | | | | | |
|---|---|---|---|---|---|---|---|---|
| | 611B | 612B | 613B | 614B | 615B | 616B | 617B | 618B |
| | Cylinder No. | | | | | | | |
| | 501B | 502B | 503B | 504B | 505B | 506B | 507B | 508B |
| Difference in layer thickness of first layer (μm) | 0.05 | 0.041 | 0.1 | 0.19 | 0.31 | 0.22 | 0.1 | 2.6 |
| Difference in layer thickness of second layer (μm) | 0.06 | 0.07 | 0.11 | 0.22 | 0.41 | 0.32 | 0.1 | 3.6 |
| Interference fringe | X | X | ○ | ◎ | ◎ | ◎ | Δ | X |

X — Practically unusable
Δ — Practically satisfactory
○ — Practically very good
◎— Practically excellent

TABLE 8B

| | Starting gas | Flow rate (SCCM) | High frequency power (W) | Layer thickness (μm) |
|---|---|---|---|---|
| Charge injection preventive layer | $H_2$ | 300 | 160 | 3 |
| | $SiH_4$ | 150 | | |
| | $NH_3$ | 30 | | |
| | $B_2H_6$ | 0.24 | | |
| Photosensitive layer | $H_2$ | 300 | 300 | 20 |
| | $SiH_4$ | 300 | | |
| Surface layer | $SiH_4$ | 20 | 300 | 0.32 |
| | $CH_4$ | 600 | | |

TABLE 9B

| | NO. | | | | | | | |
|---|---|---|---|---|---|---|---|---|
| | 401B | 402B | 403B | 404B | 405B | 406B | 407B | 408B |
| | Cylinder No. | | | | | | | |
| | 501B | 502B | 503B | 504B | 505B | 506B | 507B | 508B |
| Difference in layer thickness (μm) | 0.07 | 0.08 | 0.17 | 0.20 | 0.42 | 0.33 | 0.11 | 2.8 |
| Interference fringe | X | X | ○ | ◎ | ◎ | ◎ | Δ | X |

X — Practically unusable
Δ — Practically satisfactory
○ — Practically very good
◎— Practically excellent

TABLE 10B

| | Starting gas | Flow rate (SCCM) | High frequency power (W) | Layer thickness (μm) |
|---|---|---|---|---|
| Charge injection preventive layer | $H_2$ | 300 | 160 | 5 |
| | $SiH_4$ | 150 | | |
| | $NH_3$ | 15 | | |
| | $B_2H_6$ | 0.3 | | |
| Photosensitive layer | $H_2$ | 300 | 200 | 20 |
| | $SiH_4$ | 300 | | |
| Surface layer | $SiH_4$ | 20 | 300 | 0.5 |
| | $CH_4$ | 600 | | |

TABLE 11B

| | NO. | | | | | | | |
|---|---|---|---|---|---|---|---|---|
| | 501B | 502B | 503B | 504B | 505B | 506B | 507B | 508B |
| | Cylinder No. | | | | | | | |
| | 501B | 502B | 503B | 504B | 505B | 506B | 507B | 508B |
| Difference in layer thickness of first layer (μm) | 0.05 | 0.07 | 0.1 | 0.21 | 0.31 | 0.22 | 0.1 | 2.6 |
| Difference in layer thickness second layer (μm) | 0.06 | 0.08 | 0.1 | 0.2 | 0.41 | 0.35 | 0.1 | 3.5 |
| Interference | X | X | ○ | ◎ | ◎ | ◎ | Δ | X |

TABLE 11B-continued

| | NO. | | | | | | | |
|---|---|---|---|---|---|---|---|---|
| | 501B | 502B | 503B | 504B | 505B | 506B | 507B | 508B |
| | Cylinder No. | | | | | | | |
| | 501B | 502B | 503B | 504B | 505B | 506B | 507B | 508B |
| fringe | | | | | | | | |

X — Practically unusable
Δ — Practically satisfactory
O — Practically very good
◎— Practically excellent

TABLE 12B

| | Starting gas | Flow rate (SCCM) | High frequency power (W) | Layer thickness (μm) |
|---|---|---|---|---|
| Charge injection preventive layer | $H_2$ | 300 | 170 | 2.8 |
| | $SiH_4$ | 150 | | |
| | $CH_4$ | 15 | | |
| | $B_2H_6$ | 0.45 | | |
| Photosensitive layer | $H_2$ | 300 | 200 | 21 |
| | $SiH_4$ | 300 | | |
| Surface layer | $SiH_4$ | 20 | 300 | 0.5 |
| | $CH_4$ | 600 | | |

TABLE 13B

| | NO. | | | | | | | |
|---|---|---|---|---|---|---|---|---|
| | 1301B | 1302B | 1303B | 1304B | 1305B | 1306B | 1307B | 1308B |
| | Cylinder No. | | | | | | | |
| | 501B | 502B | 503B | 504B | 505B | 506B | 507B | 508B |
| Difference in layer thickness (μm) | 0.07 | 0.09 | 0.16 | 0.19 | 0.46 | 0.35 | 0.1 | 3.2 |
| Interference fringe | X | X | O | O | ◎ | ◎ | Δ | X |

X — Practically unusable
Δ — Practically satisfactory
O — Practically very good
◎— Practically excellent

TABLE 14B

| | Starting gas | Flow rate (SCCM) | High frequency power (W) | Layer thickness (μm) |
|---|---|---|---|---|
| Charge injection preventive layer | $H_2$ | 300 | 170 | 5.1 |
| | $SiH_4$ | 160 | | |
| | $CH_4$ | 16 | | |
| | $B_2H_6$ | 0.4 | | |
| Photosensitive layer | $H_2$ | 300 | 220 | 22 |
| | $SiH_4$ | 300 | | |
| Surface layer | $SiH_4$ | 20 | 300 | 0.7 |
| | $CH_4$ | 600 | | |

TABLE 15B

| | NO. | | | | | | | |
|---|---|---|---|---|---|---|---|---|
| | 1501B | 1502B | 1503B | 1504B | 1505B | 1506B | 1507B | 1508B |
| | Cylinder No. | | | | | | | |
| | 501B | 502B | 503B | 504B | 505B | 506B | 507B | 508B |
| Difference in layer thickness of first layer (μm) | 0.05 | 0.06 | 0.1 | 0.22 | 0.31 | 0.21 | 0.1 | 2.7 |
| Difference in layer thickness of second layer (μm) | 0.07 | 0.08 | 0.11 | 0.35 | 0.45 | 0.31 | 0.1 | 3.5 |
| Interference fringe | X | X | O | ◎ | ◎ | ◎ | Δ | X |

X — Practically unusable
Δ — Practically satisfactory
O — Practically very good
◎— Practically excellent

TABLE 1C

| | Sample No. | | | | | | |
|---|---|---|---|---|---|---|---|
| | 101C | 102C | 103C | 104C | 105C | 106C | 107C |
| Si:C Target (Area ratio) | 9:1 | 6.5:3.5 | 4:6 | 2:8 | 1:9 | 0.5:9.5 | 0.2:8.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | O | ◎ | ◎ | O | Δ | X |

◎ . . . Very good
O . . . Good
Δ . . . Practically satisfactory
X . . . Image defect formed

TABLE 2C

| | Sample No. | | | | | | | |
|---|---|---|---|---|---|---|---|---|
| | 201C | 202C | 203C | 204C | 205C | 206C | 207C | 208C |
| $SiH_4$:$CH_4$ (Flow rate ratio) | 9:1 | 3:4 | 4:3 | 1:10 | 1:30 | 1:60 | 1:100 | 1:150 |
| Si:C | 9:1 | 7:3 | 5.5:4.5 | 4:6 | 3:7 | 2:8 | 1.2:8.8 | 0.8:9.2 |

TABLE 2C-continued

| | Sample No. | | | | | | | |
|---|---|---|---|---|---|---|---|---|
| | 201C | 202C | 203C | 204C | 205C | 206C | 207C | 208C |
| (Content ratio) Image quality evaluation | Δ | O | ◎ | ◎ | ◎ | O | Δ | X |

◎ . . . Very good
O . . . Good
Δ . . . Practically satisfactory
X . . . Image defect formed

TABLE 3C

| | Sample No. | | | | | | | |
|---|---|---|---|---|---|---|---|---|
| | 301C | 302C | 303C | 304C | 305C | 306C | 307C | 308C |
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | O | ◎ | ◎ | ◎ | O | Δ | X |

◎ . . . Very good
O . . . Good
Δ . . . Practically satisfactory
X . . . Image defect formed

TABLE 4C

| Sample No. | Thickness of surface layer (μ) | Results |
|---|---|---|
| 4001C | 0.001 | Image defect liable to occur |
| 4002C | 0.02 | No image defect formed up to successive copying for 20,000 times |
| 4003C | 0.05 | Stable up to successive copying for 50,000 times |
| 4004C | 1 | Stable up to successive copying for 200,000 times |

TABLE 5C

| NO. | 501C | 502C | 503C | 504C | 505C | 506C | 507C | 508C |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6C

| | NO. | | | | | | | |
|---|---|---|---|---|---|---|---|---|
| | 511C | 512C | 513C | 514C | 515C | 516C | 517C | 518C |
| | Cylinder No. | | | | | | | |
| | 501C | 502C | 503C | 504C | 505C | 506C | 507C | 508 |
| Difference in layer thickness (μm) | 0.06 | 0.08 | 0.16 | 0.18 | 0.41 | 0.31 | 0.11 | 3.2 |
| Interference fringe, electrophotographic characteristics | X | X | O | O | ◎ | ◎ | Δ | X |

X — Practically unusable
Δ — Practically satisfactory
O — Practically very good
◎— Practically excellent

TABLE 7C

| | NO. | | | | | | | |
|---|---|---|---|---|---|---|---|---|
| | 311C | 312C | 313C | 314C | 315C | 316C | 317C | 318C |
| | Cylinder No. | | | | | | | |
| | 501C | 502C | 503C | 504C | 505C | 506C | 507C | 508C |
| Difference in layer thickness of first layer (μm) | 0.05 | 0.041 | 0.1 | 0.19 | 0.31 | 0.22 | 0.1 | 2.6 |
| Difference in layer thickness of second layer (μm) | 0.06 | 0.07 | 0.11 | 0.22 | 0.41 | 0.32 | 0.1 | 3.6 |
| Interference fringe, electrophotographic characteristics | X | X | O | ◎ | ◎ | ◎ | Δ | X |

X — Practically unusable
Δ — Practically satisfactory
O — Practically very good
◎— Practically excellent

TABLE 8C

| | Starting gas | Flow rate (SCCM) | High frequency power (W) | Layer thickness (μm) |
|---|---|---|---|---|
| Charge injection preventive layer | $H_2$ | 300 | 160 | 3 |
| | $SiH_4$ | 150 | | |
| | $NH_3$ | 30 | | |
| | $B_2H_6$ | 0.24 | | |
| Photosensitive layer | $H_2$ | 300 | 300 | 20 |
| | $SiH_4$ | 300 | | |
| Surface layer | $SiH_4$ | 20 | 300 | 0.32 |
| | $CH_4$ | 600 | | |

TABLE 9C

| | NO. | | | | | | | |
|---|---|---|---|---|---|---|---|---|
| | 401C | 402C | 403C | 404C | 405C | 406C | 407C | 408C |
| | Cylinder No. | | | | | | | |
| | 501C | 502C | 503C | 504C | 505C | 506C | 507C | 508C |
| Difference in layer thick- | 0.07 | 0.08 | 0.17 | 0.20 | 0.42 | 0.33 | 0.11 | 2.8 |

TABLE 9C-continued

| | NO. | | | | | | | |
|---|---|---|---|---|---|---|---|---|
| | 401C | 402C | 403C | 404C | 405C | 406C | 407C | 408C |
| | Cylinder No. | | | | | | | |
| | 501C | 502C | 503C | 504C | 505C | 506C | 507C | 508C |
| ness (μm) | | | | | | | | |
| Interference fringe, electro-photographic characteristics | X | X | O | ◎ | ◎ | ◎ | Δ | X |

X — Practically unusable
Δ — Practically satisfactory
O — Practically very good
◎— Practically excellent

TABLE 10C

| | Starting gas | Flow rate (SCCM) | High frequency power (W) | Layer thickness (μm) |
|---|---|---|---|---|
| Charge injection preventive layer | $H_2$ | 300 | 160 | 5 |
| | $SiH_4$ | 150 | | |
| | $NH_3$ | 15 | | |
| | $B_2H_6$ | 0.3 | | |
| Photosensitive layer | $H_2$ | 300 | 200 | 20 |
| | $SiH_4$ | 300 | | |
| Surface layer | $SiH_4$ | 20 | 300 | 0.5 |
| | $CH_4$ | 600 | | |

TABLE 11C-continued

| | NO. | | | | | | | |
|---|---|---|---|---|---|---|---|---|
| | 501C | 502C | 503C | 504C | 505C | 506C | 507C | 508C |
| | Cylinder No. | | | | | | | |
| | 501C | 502C | 503C | 504C | 505C | 506C | 507C | 508C |
| second layer (μm) | | | | | | | | |
| Interference fringe, electro-photographic characteristics | X | X | O | ◎ | ◎ | ◎ | Δ | X |

X — Practically unusable
Δ — Practically satisfactory
O — Practically very good
◎— Practically excellent

TABLE 12C

| | Starting gas | Flow rate (SCCM) | High frequency power (W) | Layer thickness (μm) |
|---|---|---|---|---|
| Charge injection preventive layer | $H_2$ | 300 | 170 | 2.8 |
| | $SiH_4$ | 150 | | |
| | $CH_4$ | 15 | | |
| | $B_2H$ | 0.45 | | |
| Photosensitive layer | $H_2$ | 300 | 200 | 21 |
| | $SiH_4$ | 300 | | |
| Surface layer | $SiH_4$ | 20 | 300 | 0.5 |
| | $CH_4$ | 600 | | |

TABLE 13C

| | NO. | | | | | | | |
|---|---|---|---|---|---|---|---|---|
| | 1001C | 1002C | 1003C | 1004C | 1005C | 1006C | 1007C | 1008C |
| | Cylinder No. | | | | | | | |
| | 501C | 502C | 503C | 504C | 505C | 506C | 507C | 508C |
| Difference in layer thickness (μm) | 0.07 | 0.09 | 0.16 | 0.19 | 0.46 | 0.35 | 0.1 | 3.2 |
| Interference fringe, electro-photographic characteristics | X | X | O | O | ◎ | ◎ | Δ | X |

X . . . Practically unusable
Δ . . . Practically satisfactory
O . . . Practically very good
◎ . . Practically excellent

TABLE 11C

| | NO. | | | | | | | |
|---|---|---|---|---|---|---|---|---|
| | 501C | 502C | 503C | 504C | 505C | 506C | 507C | 508C |
| | Cylinder No. | | | | | | | |
| | 501C | 502C | 503C | 504C | 505C | 506C | 507C | 508C |
| Difference in layer thickness of first layer (μm) | 0.05 | 0.07 | 0.1 | 0.21 | 0.31 | 0.22 | 0.1 | 2.6 |
| Difference in layer thickness of | 0.06 | 0.08 | 0.1 | 0.2 | 0.41 | 0.35 | 0.1 | 3.5 |

TABLE 14C

| | Starting gas | Flow rate (SCCM) | High frequency power (W) | Layer thickness (μm) |
|---|---|---|---|---|
| Charge injection preventive layer | $H_2$ | 300 | 170 | 5.1 |
| | $SiH_4$ | 160 | | |
| | $CH_4$ | 16 | | |
| | $B_2H_6$ | 0.4 | | |
| Photosensitive layer | $H_2$ | 300 | 230 | 22 |
| | $SiH_4$ | 300 | | |
| Surface layer | $SiH_4$ | 20 | 300 | 0.7 |
| | $CH_4$ | 600 | | |

TABLE 15C

| | NO. | | | | | | | |
|---|---|---|---|---|---|---|---|---|
| | 1201C | 1202C | 1203C | 1204C | 1205C | 1206C | 1207C | 1208C |
| | Cylinder No. | | | | | | | |
| | 501C | 502C | 503C | 504C | 505C | 506C | 507C | 508C |
| Difference in layer thickness of first layer (μm) | 0.05 | 0.06 | 0.1 | 0.22 | 0.31 | 0.21 | 0.1 | 2.7 |
| Difference in layer thickness of second layer | 0.07 | 0.08 | 0.11 | 0.35 | 0.45 | 0.31 | 0.1 | 3.5 |

TABLE 15C-continued

| | NO. | | | | | | | |
|---|---|---|---|---|---|---|---|---|
| | 1201C | 1202C | 1203C | 1204C | 1205C | 1206C | 1207C | 1208C |
| | Cylinder No. | | | | | | | |
| | 501C | 502C | 503C | 504C | 505C | 506C | 507C | 508C |
| (μm) Interference fringe, electrophotographic characteristics | X | X | ○ | ◎ | ◎ | ◎ | Δ | X |

X . . . Practically unusable
Δ . . . Practically satisfactory
◎ . . . Practically very good
○ . . Practically excellent

TABLE 16C

| | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4$/He = 0.05 NO | $SiH_4$ = 50 | NO/$SiH_4$ = 3/10~0 | 150 | 12 | 1 |
| Second layer | $SiH_4$/He = 0.05 | $SiH_4$ = 50 | | 150 | 12 | 20 |

(Sample No. 1301C)

TABLE 17C

| | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4$/He = 0.05 $B_2H_6$/He = 0.0001 NO | $SiH_4$ = 50 | $B_2H_6$/$SiH_4$ = 0.0004 NO/ $SiH_4$ = 2/10~0 | 150 | 12 | 0.5 |
| Second layer | $SiH_4$/He = 0.05 | $SiH_4$ = 50 | | 150 | 12 | 20 |

(Sample No. 1302C)

TABLE 18C

| | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4$/He = 0.05 $B_2H_6$/He = 0.0001 NO | $SiH_4$ = 50 | $B_2H_6$/$SiH_4$ = 0.00002 NO/ $SiH_4$ = 1/10~1/100 | 160 | 14 | 5 |
| Second layer | $SiH_4$/He = 0.05 NO | $SiH_4$ = 50 | NO/$SiH_4$ = 1/100 | 160 | 14 | 15 |

(Sample No. 1303C)

TABLE 19C

| | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4$/He = 0.05 $B_2H_6$/He = 0.0001 NO | $SiH_4$ = 50 | $B_2H_6$/$SiH_4$ = 0.00002 NO/ $SiH_4$ = 3/10~0 | 160 | 14 | 1.0 |
| Second layer | $SiH_4$/He = 0.05 $B_2H_6$/He = 0.0001 | $SiH_4$ = 50 | $B_2H_6$/$SiH_4$ = 0.00002 | 160 | 12 | 15 |

(Sample No. 1304C)

TABLE 20C

| | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4$/He = 0.05 $PH_3$/He = 0/0001 NO | $SiH_4$ = 50 | $PH_3$/$SiH_4$ = 0.00003 NO/ $SiH_4$ = 3/10~0 | 170 | 15 | 1 |
| Second | $SiH_4$/He = 0.05 | $SiH_4$ = 50 | | 170 | 15 | 20 |

TABLE 20C-continued

| Gases employed | Flow rate (SCCM) | Flow rate ratio | Discharging power (W) | Layer formation rate (Å/sec) | Layer thickness (μm) |
|---|---|---|---|---|---|
| layer | | | | | |

(Sample No. 1305C)

TABLE 1D

| | Sample No. | | | | | | |
|---|---|---|---|---|---|---|---|
| | 101D | 102D | 103D | 104D | 105D | 106D | 107D |
| Si:C Target (Area ratio) | 9:1 | 8.5:3.5 | 4:6 | 2:8 | 1:9 | 0.5:9.5 | 0.2:8.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎ . . . Very good
○ . . . Good
Δ . . . Practically satisfactory
X . . . Image defect formed

TABLE 2D

| | Sample No. | | | | | | | |
|---|---|---|---|---|---|---|---|---|
| | 201D | 202D | 203D | 204D | 205D | 206D | 207D | 208D |
| $SiH_4$:$CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎ . . . Very good
○ . . . Good
Δ . . . Practically satisfactory
X . . . Image defect formed

TABLE 3D

| | Sample No. | | | | | | | |
|---|---|---|---|---|---|---|---|---|
| | 301D | 302D | 303D | 304D | 305D | 306D | 307D | 308D |
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎ . . . Very good
○ . . . Good
Δ . . . Practically satisfactory
X . . . Image defect formed

TABLE 4D

| Sample No. | Thickness of surface layer (μ) | Results |
|---|---|---|
| 4001D | 0.001 | Image defect liable to occur |
| 4002D | 0.02 | No image defect formed up to successive copying for 20,000 times |
| 4003D | 0.05 | Stable up to successive copying for 50,000 times |
| 4004D | 1 | Stable up to successive copying for 200,000 times |

TABLE 5D

| Cylinder No. | 101D | 102D | 103D | 104D | 105D | 106D | 107D | 108 |
|---|---|---|---|---|---|---|---|---|
| Pitch (μm) | 600 | 200 | 100 | 50 | 40 | 25 | 10 | 5.0 |

TABLE 5D-continued

| Cylinder No. | 101D | 102D | 103D | 104D | 105D | 106D | 107D | 108 |
|---|---|---|---|---|---|---|---|---|
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6D

| | Sample No. | | | | | | | |
|---|---|---|---|---|---|---|---|---|
| | 111D | 112D | 113D | 114D | 115D | 116D | 117D | 118D |
| | Cylinder No. | | | | | | | |
| | 101D | 102D | 103D | 104D | 105D | 106D | 107D | 108D |
| Difference in layer (μm) thickness | 0.06 | 0.08 | 0.16 | 0.18 | 0.41 | 0.31 | 0.11 | 3.2 |
| Interference | X | X | ○ | ○ | ◎ | ◎ | Δ | X |

TABLE 6D-continued

| | Sample No. | | | | | | | |
|---|---|---|---|---|---|---|---|---|
| | 111D | 112D | 113D | 114D | 115D | 116D | 117D | 118D |
| | Cylinder No. | | | | | | | |
| | 101D | 102D | 103D | 104D | 105D | 106D | 107D | 108D |
| fringe | | | | | | | | |

X . . . Practically unusable
Δ . . . Practically satisfactory
O . . . Practically very good
◎ . . Practically excellent

TABLE 7D

| | Starting gas | Flow rate (SCCM) | Dis-charging power (W) | Deposition rate (Å/sec) | Layer thickness (μm) |
|---|---|---|---|---|---|
| First layer | $H_2$ | 300 | 100 | 10 | 1 |
| | $GeH_4$ | 50 | | | |
| | $SiH_4$ | 100 | | | |
| Second layer | $H_2$ | 300 | 300 | 24 | 20 |
| | $SiH_4$ | 300 | | | |
| Surface layer | $SiH_4$ | 20 | 150 | 1 | 0.5 |
| | $CH_4$ | 600 | | | |

TABLE 8D

| | Starting gas | Flow rate (SCCM) | Dis-charging power (W) | Deposition rate (Å/sec) | Layer thickness (μm) |
|---|---|---|---|---|---|
| First layer | $H_2$ | 300 | 100 | 14 | 3 |
| | $GeH_4$ | 100 | | | |

TABLE 8D-continued

| | Starting gas | Flow rate (SCCM) | Dis-charging power (W) | Deposition rate (Å/sec) | Layer thickness (μm) |
|---|---|---|---|---|---|
| | $SiH_4$ | 50 | | | |
| Second layer | $H_2$ | 300 | 300 | 24 | 20 |
| | $SiH_4$ | 300 | | | |

TABLE 9D

| | Starting gas | Flow rate (SCCM) | Dis-charging power (W) | Deposition rate (Å/sec) | Layer thickness (μm) |
|---|---|---|---|---|---|
| First layer | $H_2$ | 300 | 100 | 12 | 5 |
| | $GeH_4$ | 50 | | | |
| | $SiH_4$ | 100 | | | |
| Second layer | $H_2$ | 300 | 300 | 24 | 20 |
| | $SiH_4$ | 300 | | | |

TABLE 10D

| | Starting gas | Flow rate (SCCM) | Dis-charging power (W) | Deposition rate (Å/sec) | Layer thickness (μm) |
|---|---|---|---|---|---|
| First layer | $H_2$ | 300 | 100 | 8 | 7 |
| | $GeH_4$ | 15 | | | |
| | $SiH_4$ | 135 | | | |
| Second layer | $H_2$ | 300 | 300 | 24 | 20 |
| | $SiH_4$ | 300 | | | |

TABLE 1E

| | Sample No. | | | | | | |
|---|---|---|---|---|---|---|---|
| | 101E | 102E | 103E | 104E | 105E | 106E | 107E |
| Si:C Target (Area ratio) | 9:1 | 8.5:3.5 | 4:6 | 2:8 | 1:9 | 0.5:9.5 | 0.2:8.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | O | ◎ | ◎ | O | Δ | X |

◎ . . . Very good
O . . . Good
Δ . . . Practically satisfactory
X . . . Image defect formed

TABLE 2E

| | Sample No. | | | | | | | |
|---|---|---|---|---|---|---|---|---|
| | 201E | 202E | 203E | 204E | 205E | 206E | 207E | 208E |
| $SiH_4$:$CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | O | ◎ | ◎ | ◎ | O | Δ | X |

◎ . . . Very good
O . . . Good
Δ . . . Practically satisfactory
X . . . Image defect formed

TABLE 3E

| | Sample No. | | | | | | | |
|---|---|---|---|---|---|---|---|---|
| | 301E | 302E | 303E | 304E | 305E | 306E | 307E | 308E |
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C | 9:1 | 7:3 | 5.5:4.5 | 4:6 | 3:7 | 2:8 | 1.2:8.8 | 0.8:9.2 |

TABLE 3E-continued

| | Sample No. | | | | | | | |
|---|---|---|---|---|---|---|---|---|
| | 301E | 302E | 303E | 304E | 305E | 306E | 307E | 308E |
| (Content ratio) Image quality evaluation | Δ | O | ◎ | ◎ | ◎ | O | Δ | X |

◎ . . . Very good
O . . . Good
Δ . . . Practically satisfactory
X . . . Image defect formed

TABLE 4E

| Sample No. | Thickness of surface layer (μm) | Results |
|---|---|---|
| 4001E | 0.001 | Image defect liable to occur |
| 4002E | 0.02 | No image defect formed up to successive copying for 20,000 times |
| 4003E | 0.05 | Stable up to successive copying for 50,000 times |
| 4004E | 1 | Stable up to successive copying for 200,000 times |

TABLE 5E

| Cylinder No. | 101E | 102E | 103E | 104E | 105E | 106E | 107E | 108E |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6E

| | Sample No. | | | | | | | |
|---|---|---|---|---|---|---|---|---|
| | 111E | 112E | 113E | 114E | 115E | 116E | 117E | 118E |
| | Cylinder No. | | | | | | | |
| | 101E | 102E | 103E | 104E | 105E | 106E | 107E | 108E |
| Difference in layer (μm) thickness | 0.06 | 0.08 | 0.16 | 0.18 | 0.41 | 0.31 | 0.11 | 3.2 |
| Interference fringe | X | X | O | O | ◎ | ◎ | Δ | X |

X . . . Practically unusable
Δ . . . Practically satisfactory
O . . . Practically very good
◎ . . Practically excellent

TABLE 7E

| Layer constitution | Starting gas | Flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$ | 300<br>100 → 0<br>0 → 100<br>$GeH_4$ + $SiH_4$ = 100 | 100 | 9 | 3 |
| Second layer | $H_2$<br>$SiH_4$ | 300<br>300 | 300 | 24 | 20 |
| Surface layer | $SiH_4$<br>$CH_4$ | 20<br>600 | 150 | 1 | 0.5 |

TABLE 8E

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$ | 300<br>50 → 0<br>50 → 100<br>$GeH_4$ + $SiH_4$ = 100 | 100 | 9 | 3 |
| Second layer | $H_2$<br>$SiH_4$ | 300<br>300 | 300 | 24 | 20 |

TABLE 1F

| | Sample No. | | | | | | |
|---|---|---|---|---|---|---|---|
| | 101F | 102F | 103F | 104F | 105F | 106F | 107F |
| Si:C Target (Area ratio) | 9:1 | 8.5:3.5 | 4:6 | 2:8 | 1:9 | 0.5:9.5 | 0.2:8.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | O | ◎ | ◎ | O | Δ | X |

◎— Very good
O — Good
Δ — Practically satisfactory
X — Image defect formed

TABLE 2F

| | Sample No. | | | | | | | |
|---|---|---|---|---|---|---|---|---|
| | 201F | 202F | 203F | 204F | 205F | 206F | 207F | 208F |
| $SiH_4$:$CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | O | ◎ | ◎ | ◎ | O | Δ | X |

◎— Very good
O — Good
Δ — Practically satisfactory
X — Image defect formed

TABLE 3F

| | Sample No. | | | | | | | |
|---|---|---|---|---|---|---|---|---|
| | 301F | 302F | 303F | 304F | 305F | 306F | 307F | 308F |
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality | Δ | O | ◎ | ◎ | ◎ | O | Δ | X |

TABLE 3F-continued

| | Sample No. | | | | | | | |
|---|---|---|---|---|---|---|---|---|
| | 301F | 302F | 303F | 304F | 305F | 306F | 307F | 308F |
| evaluation | | | | | | | | |

◎— Very good
○ — Good
Δ — Practically satisfactory
X — Image defect formed

TABLE 4F

| Sample No. | Thickness of surface layer (μ) | Results |
|---|---|---|
| 4001F | 0.001 | Image defect liable to occur |
| 4002E | 0.02 | No image defect formed up to successive copying for 20,000 times |
| 4003F | 0.05 | Stable up to successive copying for 50,000 times |
| 4004F | 1 | Stable up to successive copying for 200,000 times |

TABLE 5F

| Cylinder No. | 101F | 102F | 103F | 104F | 105F | 106F | 107F | 108F |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6F

| | Sample No. | | | | | | | |
|---|---|---|---|---|---|---|---|---|
| | 111F | 112F | 113F | 114F | 115F | 116F | 117F | 118F |
| | Cylinder No. | | | | | | | |
| | 101F | 102F | 103F | 104F | 105F | 106F | 107F | 108F |
| Difference in layer thickness | 0.06 | 0.08 | 0.16 | 0.18 | 0.41 | 0.31 | 0.11 | 3.2 |

TABLE 6F-continued

| | Sample No. | | | | | | | |
|---|---|---|---|---|---|---|---|---|
| | 111F | 112F | 113F | 114F | 115F | 116F | 117F | 118F |
| | Cylinder No. | | | | | | | |
| | 101F | 102F | 103F | 104F | 105F | 106F | 107F | 108F |
| (μm) Interference fringe | X | X | ○ | ○ | ◎ | ◎ | Δ | X |

X . . . Practically unusable
Δ . . . Practically satisfactory
○ . . . Practically very good
◎ . . Practically excellent

TABLE 7F

| Layer constitution | Starting gas | Flow rate (SCCM) | Discharging power (W) | Deposition rate (Å/Sec) | Layer thickness (μm) |
|---|---|---|---|---|---|
| First layer | $H_2$ | 300 | 100 | 10 | 3 |
| | $GeH_4$ | 50 | | | |
| | $SiH_4$ | 50 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |
| Surface layer | $SiH_4$ | 20 | 150 | 1 | 0.5 |
| | $CH_4$ | 600 | | | |

TABLE 8F

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $B_2H_6/H_2$ (= 3000 vol ppm) | 100 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 9F

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ (= 3000 vol ppm) | 50 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 10F

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ (= 3000 vol ppm) | 150 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 11F

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 25 | | | |
| | | $SiH_4$ | 75 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 12F

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 13F

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 14F

| Layer constitution | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 10 | 5 |
| | $GeH_4$ | 50 | | | |
| | $SiH_4$ | 50 | | | |
| | $B_2H_6/H_2$ (= 3000 vol ppm) | 100 | | | |
| Second | $H_2$ | 300 | 300 | 24 | 20 |

TABLE 14F-continued

TABLE 14F-continued

| | | | | | |
|---|---|---|---|---|---|
| | | Dis- | Layer | | |
| layer | $SiH_4$ | 300 | | | |

TABLE 15F

| Layer constitution | | Starting gas | Flow rate (SCCM) | Discharging power (W) | Deposition rate (Å/Sec) | Layer thickness (μm) |
|---|---|---|---|---|---|---|
| First Layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 16F

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 17F

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

| Layer constitution | Starting gas | Gas flow rate (SCCM) | charging power (W) | Deposition rate (Å/Sec) | thickness (μm) |
|---|---|---|---|---|---|

TABLE 18F

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 19F

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 20F

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 100 | | | |

TABLE 1G

| | Sample No. | | | | | | |
|---|---|---|---|---|---|---|---|
| | 101G | 102G | 103G | 104G | 105G | 106G | 107G |
| Si:C Target (Area ratio) | 9:1 | 8.5:3.5 | 4:6 | 2:8 | 1:9 | 0.5:9.5 | 0.2:8.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎— Very good
○ — Good
Δ — Practically satisfactory
X — Image defect formed

TABLE 2G

| | Sample No. | | | | | | | |
|---|---|---|---|---|---|---|---|---|
| | 201G | 202G | 203G | 204G | 205G | 206G | 207G | 208G |
| $SiH_4$:$CH_4$ (Flow rate | 9:1 | 3:4 | 4:3 | 1:10 | 1:30 | 1:60 | 1:100 | 1:150 |

TABLE 2G-continued

| | Sample No. | | | | | | | |
|---|---|---|---|---|---|---|---|---|
| | 201G | 202G | 203G | 204G | 205G | 206G | 207G | 208G |
| ratio) Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎— Very good
○ — Good
Δ — Practically satisfactory
X — Image defect formed

TABLE 3G

| | Sample No. | | | | | | | |
|---|---|---|---|---|---|---|---|---|
| | 301G | 302G | 303G | 304G | 305G | 306G | 307G | 308G |
| $SiH_2$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎— Very good
○ — Good
Δ — Practically satisfactory
X — Image defect formed

TABLE 4G

| Sample No. | Thickness of surface layer (μ) | Results |
|---|---|---|
| 4001G | 0.001 | Image defect liable to occur |
| 4002G | 0.02 | No image defect formed up to successive copying for 20,000 times |
| 4003G | 0.05 | Stable up to successive copying for 50,000 times |
| 4004G | 1 | Stable up to successive |

TABLE 4G-continued

| Sample No. | Thickness of surface layer (μ) | Results |
|---|---|---|
| | | copying for 200,000 times |

TABLE 5G

| Cylinder No. | 101G | 102G | 103G | 104G | 105G | 106G | 107G | 108G |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6G

| | Sample No. | | | | | | | |
|---|---|---|---|---|---|---|---|---|
| | 111G | 112G | 113G | 114G | 115G | 116G | 117G | 118G |
| | Cylinder No. | | | | | | | |
| | 101G | 102G | 103G | 104G | 105G | 106G | 107G | 108G |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X . . . Practically unusable
Δ . . . Practically satisfactory
○ . . . Practically very good
◎. . . Practically excellent

TABLE 7G

| Layer constitution | Starting gas | Flow rate (SCCM) | Discharging power (W) | Deposition rate (Å/Sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ = 3000 ppm | 100 | | | |
| | | $GeH_4 + SiH_4$ = 100 | | | |
| Second layer | $H_2$ | 300 | 300 | 24 | 20 |
| | $SiH_4$ | 300 | | | |
| Surface layer | $SiH_4$ | 20 | 150 | 1 | 0.5 |
| | $CH_4$ | 600 | | | |

TABLE 8G

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 3 |
| | | $GeH_4$ | 100 → 0 | | | |
| | | $SiH_4$ | 0 → 100 | | | |
| | | $B_2H_6/H_2$ = 3000 ppm | 100 | | | |
| | | | $GeH_4 + SiH_4$ = 100 | | | |
| Second layer | Layer A | $H_2$ | 300 | 100 | 8 | 5 |
| | | $SiH_4$ | 100 | | | |
| | | $B_2H_6/H_2$ = 3000 ppm | 100 | | | |
| | Layer B | $H_2$ | 300 | 300 | 24 | 20 |
| | | $SiH_4$ | 300 | | | |

TABLE 9G

| Layer constitution | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ = 3000 ppm | 100 | | | |
| | | $GeH_4 + SiH_4$ = 100 | | | |
| Second layer | $H_2$ | 300 | 300 | 24 | 20 |
| | $SiH_4$ | 300 | | | |

TABLE 10G

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ = 3000 ppm | 50 | | | |
| | | | $GeH_4 + SiH_4$ = 100 | | | |
| Second layer | Layer A | $H_2$ | 300 | 100 | 8 | 5 |
| | | $SiH_4$ | 100 | | | |
| | | $B_2H_6/H_2$ = 3000 ppm | 100 | | | |
| | Layer B | $H_2$ | 300 | 300 | 24 | 20 |
| | | $SiH_4$ | 300 | | | |

TABLE 11G

| Layer constitution | | Starting gas | Gas Gas flow rate (SCCM) | Discharging power (W) | Deposition rate (Å/Sec) | Layer thickness (μm) |
|---|---|---|---|---|---|---|
| First layer | | $H_2$<br>$GeH_4$<br>$SiH_4$ | 300<br>50→0<br>50→100<br>$GeH_4 + SiH_4 =$ 100 | 100 | 10 | 3 |
| Second layer | Layer A | $H_2$<br>$SiH_4$<br>$B_2H_6/H_2 =$ 3000 ppm | 300<br>100<br>100 | 100 | 8 | 5 |
| | Layer B | $H_2$<br>$SiH_4$ | 300<br>300 | 300 | 24 | 20 |

TABLE 12G

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$<br>$GeH_4$<br>$SiH_4$<br>$B_2H_6/H_2 =$ 3000 ppm | 300<br>100 → 50<br>0 → 50<br>100 | 100 | 10 | 1.5 |
| | Layer B | $H_2$<br>$GeH_4$<br>$SiH_4$ | 300<br>50 → 0<br>50 → 100 | 100 | 10 | 1.5 |
| Second layer | | $H_2$<br>$SiH_4$ | 300<br>300 | 100 | 24 | 20 |

TABLE 1H

| | Sample No. | | | | | | |
|---|---|---|---|---|---|---|---|
| | 101H | 102H | 103H | 104H | 105H | 106H | 107H |
| Si:C Target (Area ratio) | 9:1 | 8.5:3.5 | 4:6 | 2:8 | 1:9 | 0.5:9.5 | 0.2:8.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎— Very good
○ — Good
Δ — Practically satisfactory
X — Image defect formed

TABLE 2H

| | Sample No. | | | | | | | |
|---|---|---|---|---|---|---|---|---|
| | 201H | 202H | 203H | 204H | 205H | 206H | 207H | 208H |
| $SiH_4:CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎— Very good
○ — Good
Δ — Practically satisfactory
X — Image defect formed

TABLE 3H

| | Sample No. | | | | | | | |
|---|---|---|---|---|---|---|---|---|
| | 301H | 302H | 303H | 304H | 305H | 306H | 307H | 308H |
| $SiH_4:SiF_4:CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎— Very good
○ — Good
Δ — Practically satisfactory
X — Image defect formed

TABLE 4H

| Sample No. | Thickness of surface layer (μ) | Results |
|---|---|---|
| 4001H | 0.001 | Image defect liable to occur |
| 4002H | 0.02 | No image defect formed up to successive copying for 20,000 times |
| 4003H | 0.05 | Stable up to successive copying for 50,000 times |
| 4004H | 1 | Stable up to successive copying for 200,000 times |

TABLE 5H

| Cylinder No. | 101H | 102H | 103H | 104H | 105H | 106H | 107H | 108H |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6H

| | Sample No. | | | | | | | |
|---|---|---|---|---|---|---|---|---|
| | 111H | 112H | 113H | 114H | 115H | 116H | 117H | 118H |
| | Cylinder No. | | | | | | | |
| | 101H | 102H | 103H | 104H | 105H | 106H | 107H | 108H |
| Difference in layer thickness (μm) | 0.06 | 0.8 | 0.16 | 0.18 | 0.41 | 0.31 | 0.11 | 3.2 |
| Interference fringe | X | X | ○ | ○ | ◎ | ◎ | Δ | X |

X . . . Practically unusable
Δ . . . Practically satisfactory
○ . . . Practically very good
◎ . . . Practically excellent

TABLE 7H

| Layer constitution | Starting gas | Flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6/H_2$ = 3000 ppm | 300<br>100<br>100<br>$B_2H_6/(GeH_4 + SiH_4)$ = 3/100 → 0 | 100 | 10 | 1 |
| Second layer | $H_2$<br>$SiH_4$ | 300<br>300 | 300 | 24 | 20 |
| Surface layer | $SiH_4$<br>$CH_4$ | 20<br>600 | 150 | 1 | 0.5 |

TABLE 8H

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6/H_2$ = 3000 ppm | 300<br>100<br>50<br>$B_2H_6/(GeH_4 + SiH_4)$ = 5/100 → 0 | 100 | 14 | 3 |
| Second layer | $H_2$<br>$SiH_4$ | 300<br>300 | 300 | 24 | 20 |

TABLE 9H

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6/H_2$ = 3000 ppm | 300<br>50<br>100<br>$B_2H_6/(GeH_4 + SiH_4)$ = 1/100 → 0 | 100 | 12 | 5 |
| Second layer | $H_2$<br>$SiH_4$ | 300<br>300 | 300 | 24 | 20 |

TABLE 10H

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6/H_2$ = 3000 ppm | 300<br>15<br>135<br>$B_2H_6/(GeH_4 + SiH_4)$ = 1 100 → 0 | 100 | 8 | 7 |
| Second layer | $H_2$<br>$SiH_4$ | 300<br>300 | 300 | 24 | 20 |

TABLE 11H

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$<br>$GeH_4$<br>$SiH_4$<br>$B_2H_6/H_2$ = 3000 ppm | 300<br>50<br>50<br>150 → 110 | 100 | 10 | 2 |
| Second layer | Layer A | $H_2$<br>$SiH_4$<br>$B_2H_6/H_2$ = 3000 ppm | 300<br>100<br>110 → 0 | 100 | 10 | 3 |
| | Layer B | $H_2$<br>$SiH_4$ | 300<br>300 | 300 | 24 | 20 |

TABLE 12H

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ = 3000 ppm | 100 → 0 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 13H

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ = 3000 ppm | 50 → 0 | | | |
| Second layer | | $H_2$ | 300 | 300 | 24 | 20 |
| | | $SiH_4$ | 300 | | | |

TABALE 14H

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ = 3000 ppm | 50 → 25 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ = 3000 ppm | 25 → 0 | | | |
| Second layer | | $H_2$ | 300 | 300 | 24 | 20 |
| | | $SiH_4$ | 300 | | | |

TABLE 1I

| | Sample No. | | | | | | |
|---|---|---|---|---|---|---|---|
| | 101I | 102I | 103I | 104I | 105I | 106I | 107I |
| Si:C Target (Area ratio) | 9:1 | 8.5:3.5 | 4:6 | 2:8 | 1:9 | 0.5:9.5 | 0.2:8.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

TABLE 1I-continued

◎— Very good
○ — Good
Δ — Practically satisfactory
X — Image defect formed

TABLE 2I

| | Sample No. | | | | | | | |
|---|---|---|---|---|---|---|---|---|
| | 201I | 202I | 203I | 204I | 205I | 206I | 207I | 208I |
| $SiH_4$:$CH_4$ | 9:1 | 3:4 | 4:3 | 1:10 | 1:30 | 1:60 | 1:100 | 1:150 |

TABLE 2I-continued

| | Sample No. | | | | | | | |
|---|---|---|---|---|---|---|---|---|
| | 201I | 202I | 203I | 204I | 205I | 206I | 207I | 208I |
| (Flow rate ratio) Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎— Very good
○ — Good
Δ — Practically satisfactory
X — Image defect formed

TABLE 3I

| | Sample No. | | | | | | | |
|---|---|---|---|---|---|---|---|---|
| | 301I | 302I | 303I | 304I | 305I | 306I | 307I | 308I |
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎— Very good
○ — Good
Δ — Practically satisfactory
X — Image defect formed

TABLE 4I

| Sample No. | Thickness of surface layer (μ) | Results |
|---|---|---|
| 4001I | 0.001 | Image defect liable to occur |
| 4002I | 0.02 | No image defect formed up to successive copying for 20,000 times |
| 4003I | 0.05 | Stable up to successive copying for 50,000 times |
| 4004I | 1 | Stable up to successive copying for 200,000 times |

TABLE 5I

| Cylinder No. | 101I | 102I | 103I | 104I | 105I | 106I | 107I | 108I |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6I

| | Sample No. | | | | | | | |
|---|---|---|---|---|---|---|---|---|
| | 111I | 112I | 113I | 114I | 115I | 116I | 117I | 118I |
| | Cylinder No. | | | | | | | |
| | 101I | 102I | 103I | 104I | 105I | 106I | 107I | 108I |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X . . . Practically unusable
Δ . . . Practically satisfactory
○ . . . Practically very good
◎. . . Practically excellent

TABLE 7I

| Layer constitution | Starting gas | Flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6$/$H_2$ = 3000 ppm | 300<br>100 → 0<br>0 → 100<br>150 → 0<br>$GeH_4$ + $SiH_4$ = 100 | 100 | 9 | 3 |
| Second layer | $H_2$<br>$SiH_4$ | 300<br>300 | 300 | 24 | 20 |
| Surface layer | $SiH_4$<br>$CH_4$ | 20<br>600 | 150 | 1 | 0.5 |

TABLE 8I

| Layer constitution | Starting gas | Gas flow rate (SCCM) | Discharging power (W) | Deposition rate (Å/Sec) | Layer thickness (μm) |
|---|---|---|---|---|---|
| First layer | $H_2$<br>$GeH_4$<br>$SiH_4$<br>$B_2H_6$/$H_2$ = 3000 ppm | 300<br>50 → 0<br>50 → 100<br>50 → 0<br>$GeH_4$ + $SiH_4$ + 100 | 100 | 9 | 3 |
| Second layer | $H_2$<br>$SiH_4$ | 300<br>300 | 300 | 24 | 20 |

TABLE 9I

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$<br>$GeH_4$<br>$SiH_4$ | 300<br>50 → 0<br>50 → 100 | 100 | 10 | 2 |
| Second layer | Layer A | $H_2$<br>$SiH_4$<br>$B_2H_6$/$H_2$ = 3000 ppm | 300<br>100<br>100 → 0 | 100 | 10 | 3 |

TABLE 9I-continued

| Layer constitution | | Starting gas | Gas flow rate (SCCM) | Discharging power (W) | Deposition rate (Å/Sec) | Layer thickness (μm) |
|---|---|---|---|---|---|---|
| | Layer B | $H_2$<br>$SiH_4$ | 300<br>300 | 300 | 24 | 20 |

TABLE 10I

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$<br>$GeH_4$<br>$SiH_4$<br>$B_2H_6/H_2$ = 3000 ppm | 300<br>50 → 0<br>50 → 100<br>100 → | 100 | 10 | 2 |
| Second layer | Layer A | $H_2$<br>$SiH_4$<br>$B_2H_6/H_2$ = 3000 ppm | 300<br>100<br>→ 0 | 100 | 10 | 3 |
| | Layer B | $H_2$<br>$SiH_4$ | 300<br>300 | 300 | 24 | 20 |

Note:
The symbol represents continuity of change in the gas flow rate.

TABLE 11I

| Layer constitution | | Starting gas | Gas flow rate (SCCM) | Discharging power (W) | Deposition rate (Å/Sec) | Layer thickness (μm) |
|---|---|---|---|---|---|---|
| First layer | Layer A | $H_2$<br>$GeH_4$<br>$SiH_4$<br>$B_2H_6/H_2$ = 3000 ppm | 300<br>50 → 25<br>50 → 75<br>100 → 0 | 100 | 10 | 2 |
| | Layer B | $H_2$<br>$GeH_4$<br>$SiH_4$ | 300<br>25 → 0<br>75 → 100 | 100 | 10 | 2 |
| Second layer | | $H_2$<br>$SiH_4$ | 300<br>300 | 300 | 24 | 20 |

TABLE 1aJ

| | Starting gas | Gas flow rate (SCCM) | Discharging power (W) | Layer thickness (μm) |
|---|---|---|---|---|
| First layer | $H_2$<br>$GeH_4$<br>$SiH_4$<br>NO | 300<br>50<br>100 | 160 | 5 |
| Second layer | $H_2$<br>$SiH_4$ | 300<br>300 | 150 | 20 |
| Surface layer | $SiH_4$<br>$CH_4$ | 20<br>600 | 150 | 0.32 |

TABLE 1J

| | Sample No. | | | | | | |
|---|---|---|---|---|---|---|---|
| | 101J | 102J | 103J | 104J | 105J | 106J | 107J |
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |

TABLE 1J-continued

| | Sample No. | | | | | | |
|---|---|---|---|---|---|---|---|
| | 101J | 102J | 103J | 104J | 105J | 106J | 107J |
| Image quality evaluation | Δ | ○ | ◎ | ◎ | ○ | Δ | X |

◎— Very good
○ — Good
Δ — Practically satisfactory
X — Image defect formed

TABLE 2J

| | Sample No. | | | | | | | |
|---|---|---|---|---|---|---|---|---|
| | 201J | 202J | 203J | 204J | 205J | 206J | 207J | 208J |
| $SiH_4$:$CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |

TABLE 2J-continued

| | Sample No. | | | | | | | |
|---|---|---|---|---|---|---|---|---|
| | 201J | 202J | 203J | 204J | 205J | 206J | 207J | 208J |
| Image quality evaluation | Δ | ○ | ◎ | ◎ | ◎ | ○ | Δ | X |

◎— Very good
○ — Good
Δ — Practically satisfactory
X — Image defect formed

TABLE 3J

| | Sample No. | | | | | | | |
|---|---|---|---|---|---|---|---|---|
| | 301J | 302J | 303J | 304J | 305J | 306J | 307J | 308J |
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎— Very good
○ — Good
Δ — Practically satisfactory
X — Image defect formed

TABLE 4J

| Sample No. | Thickness of surface layer (μ) | Results |
|---|---|---|
| 401J | 0.001 | Image defect liable to occur |
| 402J | 0.02 | No image defect formed up to successive copying for 20,000 times |
| 403J | 0.05 | Stable up to successive copying for 50,000 times |
| 404J | 1 | Stable up to successive copying for 200,000 times |

TABLE 5J

| NO. | 101J | 102J | 103J | 104J | 105J | 106J | 107J | 108J |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6J

| | No. | | | | | | | |
|---|---|---|---|---|---|---|---|---|
| | 111J | 112J | 113J | 114J | 115J | 116J | 117J | 118J |
| | Cylinder No. | | | | | | | |
| | 101J | 102J | 103J | 104J | 105J | 106J | 107J | 108J |
| Difference in layer thickness (μm) | 0.06 | 0.08 | 0.16 | 0.18 | 0.41 | 0.31 | 0.11 | 3.2 |
| Interference fringe | X | X | ○ | ◎ | ◎ | ◎ | Δ | X |

X . . . Practically unusable
Δ . . . Practically satisfactory
○ . . . Practically very good
◎. . . Practically excellent

TABLE 7J

| Layer | Starting gas | Flow rate (SCCM) | High frequency power (W) | Layer thickness (μm) |
|---|---|---|---|---|
| First layer | $H_2$ | 300 | 160 | 3 |
| | $SiH_4$ | 100 | | |
| | $GeH_4$ | 50 | | |
| | $NH_3$ | 30 | | |
| Second layer | $H_2$ | 300 | 300 | 20 |
| | $SiH_4$ | 300 | | |

TABLE 8J

| Layer | Starting gas | Flow rate (SCCM) | High frequency power (W) | Layer thickness (μm) |
|---|---|---|---|---|
| First layer | $H_2$ | 300 | 160 | 5 |
| | $SiH_4$ | 100 | | |
| | $GeH_4$ | 50 | | |
| | $NH_3$ | 15 | | |
| Second layer | $H_2$ | 300 | 200 | 20 |
| | $SiH_4$ | 300 | | |
| | $NH_3$ | 15 | | |

TABLE 9J

| Layer | Starting gas | Flow rate (SCCM) | High frequency power (W) | Layer thickness (μm) |
|---|---|---|---|---|
| First layer | $H_2$ | 300 | 170 | 2.8 |
| | $SiH_4$ | 50 | | |
| | $GeH_4$ | 100 | | |
| | $N_2O$ | 15 | | |
| Second layer | $H_2$ | 300 | 200 | 21 |
| | $SiH_4$ | 300 | | |
| | $N_2O$ | 15 | | |

TABLE 10J

| Layer | Starting gas | Flow rate (SCCM) | High frequency power (W) | Layer thickness (μm) |
|---|---|---|---|---|
| First layer | $H_2$ | 300 | 170 | 5.1 |
| | $SiH_4$ | 100 | | |
| | $GeH_4$ | 60 | | |
| | $N_2O$ | 16 | | |
| Second layer | $H_2$ | 300 | 230 | 22 |
| | $SiH_4$ | 300 | | |

TABLE 11J

| Layer | Starting gas | Flow rate (SCCM) | High frequency power (W) | Layer thickness (μm) |
|---|---|---|---|---|
| First layer | $H_2$ | 300 | 160 | 3 |
| | $SiH_4$ | 50 | | |
| | $GeH_4$ | 100 | | |
| | $NH_3$ | 30~0 | | |
| Second layer | $H_2$ | 300 | 300 | 20 |
| | $SiH_4$ | 300 | | |

TABLE 12J

| Layer | Starting gas | Flow rate (SCCM) | High frequency power (W) | Layer thickness (μm) |
|---|---|---|---|---|
| First layer | $H_2$ | 300 | 160 | 5 |
| | $SiH_4$ | 100 | | |
| | $GeH_4$ | 50 | | |
| | $NH_3$ | 15~0 | | |
| Second layer | $H_2$ | 300 | 200 | 20 |
| | $SiH_4$ | 300 | | |
| | $NH_3$ | | | |

TABLE 13J

| Layer | Starting gas | Flow rate (SCCM) | High frequency power (W) | Layer thickness (μm) |
|---|---|---|---|---|
| First layer | $H_2$ | 300 | 170 | 2.8 |
| | $SiH_4$ | 100 | | |
| | $GeH_4$ | 50 | | |
| | $N_2O$ | 15~0 | | |
| Second layer | $H_2$ | 300 | 200 | 21 |
| | $SiH_4$ | 300 | | |

TABLE 14J

| Layer | Starting gas | Flow rate (SCCM) | High frequency power (W) | Layer thickness (μm) |
|---|---|---|---|---|
| First layer | $H_2$ | 300 | 170 | 5.1 |
| | $SiH_4$ | 100 | | |
| | $GeH_4$ | 60 | | |
| | $N_2O$ | 16~0 | | |
| Second layer | $H_2$ | 300 | 230 | 22 |
| | $SiH_4$ | 300 | | |
| | $N_2O$ | | | |

TABLE 15J

| Layer constitution | Gases employed | Flow Rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 150 | 12 | 1 |
| Second layer | $SiH_4/He = 0.05$ | $SiH_4 = 50$ | | 150 | 12 | 20 |

TABLE 16J

| Layer constitution | Gases employed | Flow Rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 2/10 \sim 0$ | 150 | 12 | 0.5 |
| Second layer | $SiH_4/He = 0.05$ | $SiH_4 = 50$ | | 150 | 12 | 20 |

TABLE 17J

| Layer constitution | Gases employed | Flow Rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 1/10 \sim 1/100$ | 160 | 14 | 5 |
| Second layer | $SiH_4/He = 0.05$ | $SiH_4 = 50$ | | 160 | 14 | 15 |

TABLE 18J

| Layer constitution | Gases employed | Flow Rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 160 | 14 | 1.0 |
| Second layer | $SiH_4/He = 0.05$ | $SiH_4 = 50$ | | 160 | 12 | 15 |

TABLE 19J

| Layer constitution | Gases employed | Flow Rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 170 | 15 | 1 |
| Second layer | $SiH_4/He = 0.05$ | $SiH_4 = 50$ | | 170 | 15 | 20 |

TABLE 20J

| Layer constitution | Gases employed | Flow Rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$GeH_4/He = 0.05$<br>$NH_3$ | $SiH_4 + GeH_4 = 50$ | $NH_3/(SiH_4 + GeH_4) = 1/10 \sim 1/100$ | 160 | 14 | 5 |
| Second layer | $SiH_4/He = 0.05$<br>$NH_3$ | $SiH_4 = 50$ | $NH_3/SiH_4 = 1/100$ | 160 | 14 | 15 |

TABLE 21J

| Layer constitution | Gases employed | Flow Rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$GeH_4/He = 0.05$<br>$N_2O$ | $SiH_4 + GeH_4 = 50$ | $CH_4/(SiH_4 + GeH_4) = 1/10 \sim 1/100$ | 160 | 14 | 5 |
| Second layer | $SiH_4/He = 0.05$<br>$N_2O$ | $SiH_4 = 50$ | $CH_4/SiH_4 = 1/100$ | 160 | 14 | 15 |

TABLE 1K

| Sample No. | 101K | 102K | 103K | 104K | 105K | 106K | 107K |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎. . . Very good
○ . . . Good
Δ . . . Practically satisfactory
X . . . Image defect formed

TABLE 2K

| Sample No. | 201K | 202K | 203K | 204K | 205K | 206K | 207K | 208K |
|---|---|---|---|---|---|---|---|---|
| $SiH_4:CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎. . . Very good
○ . . . Good
Δ . . . Practically satisfactory
X . . . Image defect formed

TABLE 3K

| Sample No. | 301K | 302K | 303K | 304K | 305K | 306K | 307K | 308K |
|---|---|---|---|---|---|---|---|---|
| $SiH_4:SiF_4:CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎. . . Very good
○ . . . Good
Δ . . . Practically satisfactory
X . . . Image defect formed

TABLE 4K

| Sample No. | Thickness of surface layer (μ) | Results |
|---|---|---|
| 401K | 0.001 | Image defect liable to occur |
| 402K | 0.02 | No image defect formed up to successive copying for 20,000 times |
| 403K | 0.05 | Stable up to successive copying for 50,000 times |
| 404K | 1 | Stable up to successive copying for 200,000 times |

TABLE 5K

| NO. | 101K | 102K | 103K | 104K | 105K | 106K | 107K | 108K |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6K

| | No. | | | | | | | |
|---|---|---|---|---|---|---|---|---|
| | 111K | 112K | 113K | 114K | 115K | 116K | 117K | 118K |
| | Cylinder No. | | | | | | | |
| | 101K | 102K | 103K | 104K | 105K | 106K | 107K | 108K |
| Difference in layer thickness (μm) | 0.06 | 0.08 | 0.16 | 0.18 | 0.41 | 0.31 | 0.11 | 3.2 |
| Interference fringe | X | X | ○ | ◎ | ◎ | ◎ | Δ | X |

X . . . Practically unusable
Δ . . . Practically satisfactory
○ . . . Practically very good
◎. . . Practically excellent

TABLE 7K

| | Starting gas | Flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4$ + $SiH_4$ + 100 | | | |
| | NO | 10 | | | |
| Second layer | $H_2$ | 300 | 300 | 24 | 20 |
| | $SiH_4$ | 300 | | | |
| Surface layer | $SiH_4$ | 20 | 150 | 1 | 0.5 |
| | $CH_4$ | 600 | | | |

TABLE 8K

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4$ + $SiH_4$ = 100 | | | |
| | $N_2O$ | 10 | | | |
| Second layer | $H_2$ | 300 | 300 | 24 | 20 |
| | $SiH_4$ | 300 | | | |

TABLE 9K

| | Starting gas | Gas flow rate (SCCM) | Discharging power (W) | Deposition rate (Å/Sec) | Layer thickness (μm) |
|---|---|---|---|---|---|
| First | $H_2$ | 300 | 100 | 9 | 3 |

TABLE 9K-continued

| | Starting gas | Gas flow rate (SCCM) | Discharging power (W) | Deposition rate (Å/Sec) | Layer thickness (μm) |
|---|---|---|---|---|---|
| layer | $GeH_4$ | 50 → 0 | | | |
| | $SiH_4$ | 50 → 100 | | | |
| | | $GeH_4$ + $SiH_4$ = 100 | | | |
| | $NH_3$ | 10 | | | |
| Second layer | $H_2$ | 300 | 300 | 24 | 20 |
| | $SiH_4$ | 300 | | | |

TABLE 10K

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | | $GeH_4$ + $SiH_4$ = 100 | | | |
| | $NH_3$ | 6 | | | |
| Second layer | $H_2$ | 300 | 300 | 24 | 20 |
| | $SiH_4$ | 300 | | | |
| | $NH_3$ | 6 | | | |

TABLE 11K

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4$ + $SiH_4$ = 100 | | | |
| | NO | 20 → 0 | | | |
| Second layer | $H_2$ | 300 | 300 | 24 | 20 |
| | $SiH_4$ | 300 | | | |

TABLE 12K

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4$ + $SiH_4$ = 100 | | | |
| | $NH_3$ | 20 → 0 | | | |
| Second layer | $H_2$ | 300 | 300 | 24 | 20 |
| | $SiH_4$ | 300 | | | |

TABLE 13K

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4$ + $SiH_4$ = 100 | | | |
| | NO | 10 → * | | | |
| Second layer | $H_2$ | 300 | 300 | 24 | 20 |
| | $SiH_4$ | 300 | | | |

TABLE 13K-continued

| | Starting gas | Gas flow rate (SCCM) | Dis-charging power (W) | Deposition rate (Å/Sec) | Layer thickness (μm) |
|---|---|---|---|---|---|
| | NO | * → 0 | | | |

Note: The symbol * represents continuity of change in th gas flow rate. The same note applies to Table 13L.

TABLE 14K

| | Starting gas | Gas flow rate (SCCM) | Dis-charging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4$ + $SiH_4$ = 100 | | | |
| | $N_2O$ | 10 → 0 | | | |
| Second layer | $H_2$ | 300 | 300 | 24 | 20 |
| | $SiH_4$ | 300 | | | |

TABLE 4L

| Sample No. | Thickness of surface layer (μ) | Results |
|---|---|---|
| 401L | 0.001 | Image defect liable to occur |
| 402L | 0.02 | No image defect formed up to successive copying for 20,000 times |
| 403L | 0.05 | Stable up to successive copying for 50,000 times |
| 404L | 1 | Stable up to successive copying for 200,000 times |

TABLE 5L

| NO. | 101L | 102L | 103L | 104L | 105L | 106L | 107L | 108L |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 1L

| Sample No. | 101L | 102L | 103L | 104L | 105L | 106L | 107L |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎. . . Very good
○ . . . Good
Δ . . . Practically satisfactory
X . . . Image defect formed

TABLE 2L

| Sample No. | 201L | 202L | 203L | 204L | 205L | 206L | 207L | 208L |
|---|---|---|---|---|---|---|---|---|
| $SiH_4$:$CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎. . . Very good
○ . . . Good
Δ . . . Practically satisfactory
X . . . Image defect formed

TABLE 3L

| Sample No. | 301L | 302L | 303L | 304L | 305L | 306L | 307L | 308L |
|---|---|---|---|---|---|---|---|---|
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎. . . Very good
○ . . . Good
Δ . . . Practically satisfactory
X . . . Image defect formed

TABLE 6L

| | No. | | | | | | | |
|---|---|---|---|---|---|---|---|---|
| | 111L | 112L | 113L | 114L | 115L | 116L | 117L | 118L |
| | Cylinder No. | | | | | | | |
| | 101L | 102L | 103L | 104L | 105L | 106L | 107L | 108L |
| Difference in layer thickness (μm) | 0.06 | 0.08 | 0.16 | 0.18 | 0.41 | 0.31 | 0.11 | 3.2 |
| Interference fringe | X | X | ○ | ◎ | ◎ | ◎ | Δ | X |

X . . . Practically unusable
Δ . . . Practically satisfactory
○ . . . Practically very good
◎ . . Practically excellent

TABLE 7L

| | Starting gas | Flow Rate (SCCM) | Dis-charging power (W) | Deposition rate (Å/Sec) | Layer thickness (μm) |
|---|---|---|---|---|---|
| First layer | $H_2$ | 300 | 100 | 10 | 3 |
| | $GeH_4$ | 50 | | | |
| | $SiH_4$ | 50 | | | |
| | $B_2H_6/H_2$ (= 3000 vol ppm) | 100 | | | |
| | NO | 10 | | | |
| Second layer | $H_2$ | 300 | 300 | 24 | 20 |
| | $SiH_4$ | 300 | | | |
| Surface layer | $SiH_4$ | 20 | 150 | 1 | 0.5 |
| | $CH_4$ | 600 | | | |

TABLE 8L

| Layer constitution | | Starting gas | Gas flow rate (SCCM) | Discharg-ing power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $B_2H_6/H_2$ (= 3000 vol ppm) | 100 | | | |
| | | $NH_3$ | 11 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | | | | |

TABLE 9L

| Layer constitution | | Starting gas | Gas flow rate (SCCM) | Discharg-ing power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ (= 3000 vol ppm) | 50 | | | |
| | | $N_2O$ | 10 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 10L

| Layer constitution | | Starting gas | Gas flow rate (SCCM) | Discharg-ing power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ (= 3000 vol ppm) | 150 | | | |
| | | NO | 10 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | NO | 10 | | | |
| | Layer B | $H_2$ | 300 | 300 | 24 | 20 |
| | | $SiH_4$ | 300 | | | |
| | | NO | 10 | | | |

TABLE 11L

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 25 | | | |
| | | $SiH_4$ | 75 | | | |
| | | $NH_3$ | 12 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | $NH_3$ | 12 | | | |
| | Layer B | $H_2$ | 300 | 300 | 24 | 20 |
| | | $SiH_4$ | 300 | | | |
| | | $NH_3$ | 12 | | | |

TABLE 12L

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | $N_2O$ | 8 | | | |
| | Layer B | $H_2$ | 300 | 100 | 10 | 2 |
| | | $GeH_4$ | 50 | | | |
| | | $SiH_4$ | 50 | | | |
| | | $N_2O$ | 8 | | | |
| Second layer | | $H_2$ | 300 | 300 | 24 | 20 |
| | | $SiH_4$ | 300 | | | |
| | | $CH_4$ | 8 | | | |

TABLE 13L

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | NO | 10~ ✣ | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | NO | ✣~0 | | | |
| Second layer | | $H_2$ | 300 | 300 | 24 | 20 |
| | | $SiH_4$ | 300 | | | |

TABLE 14L

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 10 | 5 |
| | $GeH_4$ | 50 | | | |
| | $SiH_4$ | 50 | | | |
| | $B_2H_6/H_2$ (= 3000 | 100 | | | |

TABLE 14L-continued

| | Starting gas | Gas flow rate (SCCM) | Discharging power (W) | Deposition rate (Å/Sec) | Layer thickness (μm) |
|---|---|---|---|---|---|
| | vol ppm) | | | | |
| | $NH_3$ | 10~0 | | | |
| Second layer | $H_2$ | 300 | 300 | 24 | 20 |
| | $SiH_4$ | 300 | | | |

TABLE 15L

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | $N_2O$ | 10~0 | | | |
| | Layer B | $H_2$ | 300 | 100 | 8 | 3 |

TABLE 15L-continued

| Layer constitution | Starting gas | Flow rate (SCCM) | Discharging power (W) | Deposition rate (Å/Sec) | Layer thickness (μm) |
|---|---|---|---|---|---|
| | $SiH_4$ | 100 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |

TABLE 16L

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 | | | |
| | | NO | 10~✣ | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | | NO | ✣~✣ ✣ | | | |
| | Layer B | $H_2$ | 300 | 300 | 24 | 20 |
| | | $SiH_4$ | 300 | | | |
| | | NO | ※※~0 | | | |

Note:
The symbols and represent continuity of change in the gas flow rate respectively. The same note applies to the subsequent other tables.

TABLE 17L

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 | | | |
| | | $NH_3$ | 10~※ | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | | $NH_3$ | ※~※※ | | | |
| | Layer B | $H_2$ | 300 | 300 | 24 | 20 |
| | | $SiH_4$ | 300 | | | |
| | | $NH_3$ | ※※~0 | | | |

TABLE 18L

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $N_2O$ | 10~※ | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| | | $N_2O$ | ※~※※ | | | |
| Second layer | | $H_2$ | 300 | 300 | 24 | 20 |
| | | $SiH_4$ | 300 | | | |
| | | $CH_4$ | ※~0 | | | |

TABLE 19L

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | NO | 8 | | | |
| | Layer E | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 20L

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $NH_3$ | 11 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 1M

| Sample No. | 101M | 102M | 103M | 104M | 105M | 106M | 107M |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎. . . Very good
○ . . . Good
Δ . . . Practically satisfactory
X . . . Image defect formed

TABLE 2M

| Sample No. | 201M | 202M | 203M | 204M | 205M | 206M | 207M | 208M |
|---|---|---|---|---|---|---|---|---|
| $SiH_4:CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎. . . Very good
○ . . . Good
Δ . . . Practically satisfactory
X . . . Image defect formed

TABLE 3M

| Sample No. | 301M | 302M | 303M | 304M | 305M | 306M | 307M | 308M |
|---|---|---|---|---|---|---|---|---|
| $SiH_4:SiF_4:CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality | Δ | ○ | ◎ | ◎ | ◎ | ○ | Δ | X |

TABLE 3M-continued

| Sample No. | 301M | 302M | 303M | 304M | 305M | 306M | 307M | 308M |
|---|---|---|---|---|---|---|---|---|
| evaluation | | | | | | | | |

◎. . . Very good
○ . . . Good
Δ . . . Practically satisfactory
X . . . Image defect formed

TABLE 4M

| Sample No. | Thickness of surface layer (μ) | Results |
|---|---|---|
| 401M | 0.001 | Image defect liable to occur |
| 402M | 0.02 | No image defect formed up to successive copying for 20,000 times |
| 403M | 0.05 | Stable up to successive copying for 50,000 times |
| 404M | 1 | Stable up to successive copying for 200,000 times |

TABLE 5M

| NO. | 101M | 102M | 103M | 104M | 105M | 106M | 107M | 108M |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6M

| | NO. | | | | | | | |
|---|---|---|---|---|---|---|---|---|
| | 111M | 112M | 113M | 114M | 115M | 116M | 117M | 118M |
| | Cylinder No. | | | | | | | |
| | 101M | 102M | 103M | 104M | 105M | 106M | 107M | 108M |
| Difference in layer thickness (μm) | 0.06 | 0.08 | 0.16 | 0.18 | 0.41 | 0.31 | 0.11 | 3.2 |
| Interference fringe | X | X | ○ | ◎ | ◎ | ◎ | Δ | X |

X . . . Practically unusable
Δ . . . Practically satisfactory
○ . . . Practically very good
◎. . . Practically excellent

TABLE 7M

| Layer constitution | Starting gas | Flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $B_2H_6/H_2$ (= 3000 vol ppm) | $GeH_4$ + $SiH_4$ = 100 | | | |
| | NO | 12 | | | |
| Second layer | $H_2$ | 300 | 300 | 24 | 20 |
| | $SiH_4$ | 300 | | | |
| Surface layer | $SiH_4$ | 20 | 150 | 1 | 0.32 |
| | $CH_4$ | 60 | | | |

TABLE 7M-continued

| Layer constitution | Starting gas | Flow rate (SCCM) | Discharging power (W) | Deposition rate (Å/Sec) | Layer thickness (μm) |
|---|---|---|---|---|---|
| | $B_2H_6/H_2$ (= 3000 vol ppm) | $GeH_4$ + $SiH_4$ = 100 | | | |
| | NO | 12 | | | |
| Second layer | $H_2$ | 300 | 300 | 24 | 20 |
| | $SiH_4$ | 300 | | | |
| Surface layer | $SiH_4$ | 20 | 150 | 1 | 0.32 |
| | $CH_4$ | 60 | | | |

TABLE 8M

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ (= 3000 vol ppm) | 100 | | | |
| | | | $GeH_4$ + $SiH_4$ = 100 | | | |
| | | $NH_3$ | 8 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | $NH_3$ | 8 | | | |
| | Layer B | $H_2$ | 300 | 300 | 24 | 20 |
| | | $SiH_4$ | 300 | | | |
| | | $NH_3$ | 8 | | | |

TABLE 9M

| Layer constitution | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ (= 3000 vol ppm) | 100 | | | |
| | | $GeH_4$ + $SiH_4$ = 100 | | | |
| | $N_2O$ | 10 → 0 | | | |
| Second layer | $H_2$ | 300 | 300 | 24 | 20 |
| | $SiH_4$ | 300 | | | |

TABLE 10M

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ (= 3000 vol ppm) | 50 | | | |
| | | | $GeH_4 + SiH_4$ = 100 | | | |
| | | NO | 10 → ※ | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | NO | ※→※※ | | | |
| | Layer B | $H_2$ | 300 | 300 | 24 | 20 |
| | | $SiH_4$ | 300 | | | |
| | | NO | ※※→ 0 | | | |

TABLE 11M

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | | $GeH_4 + SiH_4$ = 100 | | | |
| | | $NH_3$ | 10 → ※ | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | $NH_3$ | ※→※※ | | | |
| | Layer B | $H_2$ | 300 | 300 | 24 | 20 |
| | | $SiH_4$ | 300 | | | |
| | | $NH_3$ | ※※→ 0 | | | |

TABLE 12M

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 1.5 |
| | | $GeH_4$ | 100 → 0 | | | |
| | | $SiH_4$ | 0 → 100 | | | |
| | | $B_2H_6/H_2$ (= 3000 vol ppm) | 100 | | | |
| | | $N_2O$ | 10 → ※ | | | |
| | Layer B | $H_2$ | 300 | 100 | 10 | 1.5 |
| | | $GeH_4$ | 50 → 0 | | | |
| | | $SiH_4$ | 50 → 100 | | | |
| | | $N_2O$ | ※ → ※※ | | | |
| Second layer | | $H_2$ | 300 | 300 | 24 | 20 |
| | | $SiH_4$ | 300 | | | |
| | | $N_2O$ | ※※→ 0 | | | |

TABLE 1N

| Sample No. | 101N | 102N | 103N | 104N | 105N | 106N* | 107N |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎. . . Very good
○ . . . Good
Δ . . . Practically satisfactory
X . . . Image defect formed

TABLE 2N

| Sample No. | 201N | 202N | 203N | 204N | 205N | 206N | 207N | 208N |
|---|---|---|---|---|---|---|---|---|
| $SiH_4$:$CH_4$ (Flow rate ratio | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | O | ◎ | ◎ | ◎ | O | Δ | X |

◎. . . Very good
O . . . Good
Δ . . . Practically satisfactory
X . . . Image defect formed

TABLE 3N

| Sample No. | 301N | 302N | 303N | 304N | 305N | 306N | 307N | 308N |
|---|---|---|---|---|---|---|---|---|
| $SiH_4$:$SiF_4$:$CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | O | ◎ | ◎ | ◎ | O | Δ | X |

◎. . . Very good
O . . . Good
Δ . . . Practically satisfactory
X . . . Image defect formed

TABLE 4N

| Sample No. | Thickness of surface layer (μ) | Results |
|---|---|---|
| 401N | 0.001 | Image defect liable to occur |
| 402N | 0.02 | No image defect formed up to successive copying for 20,000 times |
| 403N | 0.05 | Stable up to successive copying for 50,000 times |
| 404N | 1 | Stable up to successive copying for 200,000 times |

TABLE 5N

| NO. | 101N | 102N | 103N | 104N | 105N | 106N | 107N | 108N |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6N

| | No. | | | | | | | |
|---|---|---|---|---|---|---|---|---|
| | 111N | 112N | 113N | 114N | 115N | 116N | 117N | 118N |
| | Cylinder No. | | | | | | | |
| | 101N | 102N | 103N | 104N | 105N | 106N | 107N | 108N |
| Difference in layer thickness (μm) | 0.06 | 0.08 | 0.16 | 0.18 | 0.41 | 0.31 | 0.11 | 3.2 |
| Interference fringe | X | X | O | ◎ | ◎ | ◎ | Δ | X |

X . . . Practically unusable
Δ . . . Practically satisfactory
O . . . Practically very good
◎. . . Practically excellent

TABLE 7N

| | Starting gas | Flow rate (SCCM) | Discharging power (W) | Deposition rate (Å/Sec) | Layer thickness (μm) |
|---|---|---|---|---|---|
| First layer | $H_2$ | 300 | 100 | 10 | 1 |
| | $GeH_4$ | 100 | | | |
| | $SiH_4$ | 100 | | | |
| | $B_2H_6/H_2$ (= 3000 vol ppm) | $B_2H_6/(GeH_4 + SiH_4)$ = 3/100 → 0 | | | |
| | NO | 12 | | | |
| Second layer | $H_2$ | 300 | 300 | 24 | 20 |
| | $SiH_4$ | 300 | | | |
| Surface layer | $SiH_4$ | 20 | 150 | 1 | 0.5 |
| | $CH_4$ | 600 | | | |

TABLE 8N

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 14 | 3 |
| | $GeH_4$ | 100 | | | |
| | $SiH_4$ | 50 | | | |
| | $B_2H_6/H_2$ (= 3000 vol ppm) | $B_2H_6/(GeH_4 + SiH_4)$ = 5/100 → 0 | | | |
| | $NH_3$ | 10 | | | |
| Second layer | $H_2$ | 300 | 300 | 24 | 20 |
| | $SiH_4$ | 300 | | | |
| | $NH_3$ | 10 | | | |

TABLE 9N

| | Starting gas | Gas flow rate (SCCM) | Discharging power (W) | Deposition rate (Å/Sec) | Layer thickness (μm) |
|---|---|---|---|---|---|
| First | $H_2$ | 300 | 100 | 12 | 5 |

TABLE 9N-continued

| | Starting gas | Gas flow rate (SCCM) | Dis-charging power (W) | Deposition rate (Å/Sec) | Layer thick-ness (μm) |
|---|---|---|---|---|---|
| layer | $GeH_4$ | 50 | | | |
| | $SiH_4$ | 100 | | | |
| | $B_2H_6/H_2$ (= 3000 vol ppm) | $B_2H_6$/($GeH_4$ + $SiH_4$) = 1/100 → 0 | | | |
| | $N_2O$ | 15 | | | |
| Second layer | $H_2$ | 300 | 300 | 24 | 20 |
| | $SiH_4$ | 300 | | | |

TABLE 10N

| | Starting gas | Gas flow rate (SCCM) | Dis-charging power (W) | Deposition rate (Å/Sec) | Layer thick-ness (μm) |
|---|---|---|---|---|---|
| First layer | $H_2$ | 300 | 100 | 8 | 7 |
| | $GeH_4$ | 15 | | | |
| | $SiH_4$ | 135 | | | |
| | $B_2H_6/H_2$ (= 3000 vol ppm) | $B_2H_6$/($GeH_4$ + $SiH_4$) = 1/100 → 0 | | | |
| | NO | 15 | | | |
| Second layer | $H_2$ | 300 | 300 | 24 | 20 |
| | $SiH_4$ | 300 | | | |
| | NO | 15 | | | |

TABLE 11N

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 → 110 | | | |
| | | $NH_3$ | 10 → 0 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 110 → 0 | | | |
| | Layer B | $H_2$ | 300 | 300 | 24 | 20 |
| | | $SiH_4$ | 300 | | | |

TABLE 12N

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 → 0 | | | |
| | | $N_2O$ | 10 → 0 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 13N

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $SiH_4$ | 50 | | | |
| | | $GeH_4$ | 50 | | | |
| | | NO | 10 → ※ | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 → 0 | | | |
| | | NO | ※ → ※※ | | | |
| Second layer | | $H_2$ | 300 | 300 | 24 | 20 |
| | | $SiH_4$ | 300 | | | |
| | | NO | ※※ → 0 | | | |

TABLE 14N

| Layer constitution | Starting gas | Gas flow rate (SCCM) | Discharging power (W) | Deposition rate (Å/Sec) | Layer thickness (μm) |
|---|---|---|---|---|---|
| First | $H_2$ | 300 | 100 | 10 | 2 |

TABLE 14N-continued

| Layer constitution | | Starting gas | Gas flow rate (SCCM) | Discharging power (W) | Deposition rate (Å/Sec) | Layer thickness (μm) |
|---|---|---|---|---|---|---|
| layer | | $SiH_4$ | 50 | | | |
| | | $GeH_4$ | 50 | | | |
| | | $B_2H_6/H_2$ (= 3000 vol ppm) | 50 → | | | |
| | | $NH_3$ | 10 → | | | |
| Second layer | Layer A | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | → 0 | | | |
| | | $NH_3$ | → | | | |
| | Layer B | $H_2$ | 300 | 300 | 24 | 20 |
| | | $SiH_4$ | 300 | | | |
| | | $NH_3$ | → 0 | | | |

TABLE 1P

| Sample No. | 101P | 102P | 103P | 104P | 105P | 106P | 107P |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎. . . Very good
○ . . . Good
Δ . . . Practically satisfactory
X . . . Image defect formed

TABLE 2P

| Sample No. | 201P | 202P | 203P | 204P | 205P | 206P | 207P | 208P |
|---|---|---|---|---|---|---|---|---|
| $SiH_4:CH_4$ (Flow rate ratio) | 9:1 | 3:4 | 4:3 | 1:10 | 1:30 | 1:60 | 1:100 | 1:150 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎. . . Very good
○ . . . Good
Δ . . . Practically satisfactory
X . . . Image defect formed

TABLE 3P

| Sample No. | 301P | 302P | 303P | 304P | 305P | 306P | 307P | 308P |
|---|---|---|---|---|---|---|---|---|
| $SiH_4:SiF_4:CH_4$ (Flow rate ratio) | 5:4:1 | 3:3.5:3.5 | 1:1:6 | 1:1:20 | 1:0.4:30 | 1:1:100 | 1:0.5:150 | 1:1:200 |
| Si:C (Content ratio) | 9:1 | 7:3 | 5.5:4.5 | 4:6 | 3:7 | 2:8 | 1.2:8.8 | 0.8:9.2 |
| Image | Δ | ○ | ◎ | ◎ | ◎ | ○ | Δ | X |

◎. . . Very good
○ . . . Good
Δ . . . Practically satisfactory
X . . . Image defect formed

TABLE 4P

| Sample No. | Thickness of surface layer (μ) | Results |
|---|---|---|
| 401P | 0.001 | Image defect liable to occur |
| 402P | 0.02 | No image defect formed up to successive copying for 20,000 times |
| 403P | 0.05 | Stable up to successive copying for 50,000 times |

TABLE 4P-continued

| Sample No. | Thickness of surface layer (μ) | Results |
|---|---|---|
| 404P | 1 | Stable up to successive copying for 200,000 times |

TABLE 5P

| NO. | 101P | 102P | 103P | 104P | 105P | 106P | 107P | 108P |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 6P

| | No. | | | | | | | |
|---|---|---|---|---|---|---|---|---|
| | 111P | 112P | 113P | 114P | 115P | 116P | 117P | 118P |
| | Cylinder No. | | | | | | | |
| | 101P | 102P | 103P | 104P | 105P | 106P | 107P | 108P |
| Difference in layer thickness (μm) | 0.06 | 0.08 | 0.16 | 0.18 | 0.41 | 0.31 | 0.11 | 3.2 |
| Interference fringe | X | X | O | ◎ | ◎ | ◎ | Δ | X |

X . . . Practically unusable
Δ . . . Practically satisfactory
O . . . Practically very good
◎. . . Practically excellent

TABLE 7P

| | Starting gas | Flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | ($GeH_4$ + | | | |

TABLE 7P-continued

| | Starting gas | Flow rate (SCCM) | Discharging power (W) | Deposition rate (Å/Sec) | Layer thickness (μm) |
|---|---|---|---|---|---|
| | | $SiH_4$) = 100 | | | |
| | $B_2H_6/H_2$ (= 3000 vol ppm) | 150 → 0 | | | |
| | NO | 12 | | | |
| Second layer | $H_2$ | 300 | 300 | 24 | 20 |
| | $SiH_4$ | 300 | | | |
| Surface layer | $SiH_4$ | 20 | 150 | 1 | 0.5 |
| | $CH_4$ | 600 | | | |

TABLE 8P

| | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | | $GeH_4$ + $SiH_4$ = 100 | | | |
| | $B_2H_6/H_2$ (= 3000 vol ppm) | 50 → 0 | | | |
| | $NH_3$ | 12 | | | |
| Second layer | $H_2$ | 300 | 300 | 24 | 20 |
| | $SiH_4$ | 300 | | | |
| | $NH_3$ | 12 | | | |

TABLE 9P

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $N_2O$ | 15 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 100 → 0 | | | |
| | Layer B | $H_2$ | 300 | 300 | 24 | 20 |
| | | $SiH_4$ | 300 | | | |

TABLE 10P

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $B_2H_6/H_2$ (= 3000 vol ppm) | 100 → ※ | | | |
| | | NO | 10 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | ※ → 0 | | | |
| | | NO | 10 | | | |
| | Layer B | $H_2$ | 300 | 300 | 24 | 20 |
| | | $SiH_4$ | 300 | | | |
| | | NO | 10 | | | |

TABLE 11P

| Layer constitution | | Starting gas | Gas Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 → 25 | | | |

TABLE 11P-continued

| Layer constitution | | Starting gas | Gas Flow rate (SCCM) | Discharging power (W) | Deposition rate (Å/Sec) | Layer thickness (μm) |
|---|---|---|---|---|---|---|
| | | $SiH_4$ | 50 → 75 | | | |
| | | $B_2H_6/H_2$ (= 3000 vol ppm) | 100 → 0 | | | |
| | | $NH_3$ | 10 | | | |
| | Layer B | $H_2$ | 300 | 100 | 10 | 2 |
| | | $GeH_4$ | 25 → 0 | | | |
| | | $SiH_4$ | 75 → 100 | | | |
| | | $NH_3$ | 10 | | | |
| Second layer | | $H_2$ | 300 | 300 | 24 | 20 |
| | | $SiH_4$ | 300 | | | |

TABLE 12P

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $B_2H_6/H_2$ (= 3000 vol ppm) | 150 → 110 | | | |
| | | $NH_3$ | 10 → 0 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 110 → 0 | | | |
| | Layer B | $H_2$ | 300 | 300 | 24 | 20 |
| | | $SiH_4$ | 300 | | | |

TABLE 13P

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 → ※ | | | |
| | | $SiH_4$ | 50 → ※※ | | | |
| | | $B_2H_6/H_2$ (= 3000 vol ppm) | 100 → 0 | | | |
| | | $N_2O$ | 10 → 0 | | | |
| | Layer B | $H_2$ | 300 | 100 | 10 | 2 |
| | | $GeH_4$ | ※ → 0 | | | |
| | | $SiH_4$ | ※※ → 100 | | | |
| Second layer | | $H_2$ | 300 | 300 | 24 | 20 |
| | | $SiH_4$ | 300 | | | |

TABLE 14P

| Layer constitution | | Starting gas | Flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | NO | 10 → ※ | | | |
| | Layer B | $H_2$ | 300 | 100 | 10 | 2 |
| | | $GeH_4$ | 50 → 0 | | | |
| | | $SiH_4$ | 50 → 100 | | | |
| | | $B_2H_6/H_2$ (= 3000 vol ppm) | 100 → 0 | | | |
| | | NO | ※ → | | | |
| Second layer | | $H_2$ | 300 | 300 | 24 | 20 |
| | | $SiH_4$ | 300 | | | |
| | | NO | ※※ → 0 | | | |

TABLE 15P

| Layer constitution | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 10 | 2 |
| | $GeH_4$ | 50 | | | |
| | $SiH_4$ | 50 | | | |

TABLE 15P-continued

| Layer constitution | | Starting gas | Gas flow rate (SCCM) | Discharging power (W) | Deposition rate (Å/Sec) | Layer thickness (μm) |
|---|---|---|---|---|---|---|
| | | $B_2H_6/H_2$ (= 3000 vol ppm) | 100 → ※※※ | | | |
| | | $NH_3$ | 10 → ※ | | | |
| Second layer | Layer A | $H_2$ | 300 | 100 | 8 | 3 |
| | | $GeH_4$ | 50 → 0 | | | |
| | | $SiH_4$ | 50 → 100 | | | |
| | | $B_2H_6/H_2$ (= 3000 vol ppm) | ※※※ → 0 | | | |
| | | $NH_3$ | ※ → ※※ | | | |
| | Layer B | $H_2$ | 300 | 300 | 24 | 20 |
| | | $SiH_4$ | 300 | | | |
| | | $NH_3$ | ※※ → 0 | | | |

Note: The symbol represents continuity of change in the gas flow rate.

What is claimed is:

1. A light-receiving member comprising a substrate and a light-receiving layer of a multi-layer structure having at least one photosensitive layer and a surface layer comprising an amorphous material containing silicon atoms and carbon atoms, said light-receiving layer having at least one pair of non-parallel interfaces within a short range and said non-parallel interfaces being arranged in a large number in at least one direction within the plane perpendicular to the layer thickness direction, said nonparallel interfaces being connected to one another smoothly in the direction in which they are arranged.

2. An electrophotographic system comprising a light-receiving member as defined below:

a light-receiving member comprising a substrate and a light-receiving layer of a multi-layer structure having at least one photosensitive layer and a surface layer comprising an amorphous material containing silicon atoms and carbon atoms, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

3. The invention according to claim 1 or 2, wherein the arrangement is made regularly.

4. The invention according to claim 1 or 2, wherein the arrangement is made in cycles.

5. The invention according to claim 1 or 2, wherein the short range is 0.3 to 500 μm.

6. The invention according to claim 1 or 2, wherein the non-parallel interfaces are formed on the basis of the smooth unevenness arranged regularly provided on the surface of the substrate.

7. The invention according to claim 6, wherein the smooth unevenness is formed by sinusoidal linear projections.

8. The invention according to claim 1 or 2, wherein the substrate is cylindrical.

9. The invention according to claim 8, wherein the sinusoidal linear projection has a spiral structure within the surface of the substrate.

10. An electrophotographic system according to claim 9, wherein the spiral structure is a multiple spiral structure.

11. An electrophotographic system according to claim 7, wherein the sinusoidal linear projection is divided in its edge line direction.

12. An electrophotographic system according to claim 8, wherein the edge line direction of the sinusoidal linear projection is along the center axis of the cylindrical substrate.

13. An electrophotographic system according to claim 6, wherein the smooth unevenness has slanted planes.

14. An electrophotographic system according to claim 13, wherein the slanted planes are mirror finished.

15. The invention according to claim 6, wherein on the free surface of the light-receiving layer is formed a smooth unevenness arranged with the same pitch as the smooth unevenness provided on the substrate surface.

16. The invention according to claim 1 or 2, wherein the photosensitive layer comprises an amorphous material containing silicon atoms.

17. The invention according to claim 16, wherein hydrogen atoms are contained in the photosensitive layer.

18. The invention according to claim 1 or 2, wherein the surface layer is constituted of $A\text{-}(Si_xC_{1-x})_y(H,X)_{1-y}$ (where $0<x, y\leqq 1$).

19. The invention according to claim 1 or 2, wherein the content of carbon atoms contained in the surface layer is in the range of from $1\times10^{-3}$ to 90 atomic %.

20. The invention according to claim 1 or 2, wherein the surface layer has a layer thickness of 0.003 to 30 μm.

21. The invention according to claim 1 or 2, wherein the light-receiving layer has a charge injection preventive layer between the substrate and the layer having photosensitivity.

22. The invention according to claim 21, wherein the charge injection preventive layer contains at least one of hydrogen atoms and halogen atoms and also a substance (C) for controlling conductivity.

23. The invention according to claim 22, wherein the substance (C) for controlling conductivity is a p-type impurity 24. The invention according to claim 22, wherein the substance (C) for controlling conductivity is an n-type impurity.

25. The invention according to claim 22, wherein the content of the substance (C) for controlling conductivity contained in the charge injection preventive layer is 0.001 to $5\times10^4$ atomic ppm.

26. The invention according to claim 22, wherein the charge injection preventive layer has a layer thickness of 30 Å to 10 μm.

27. The invention according to claim 1 or 2, wherein a substance (C) for controlling conductivity is contained in the layer having photosensitivity.

28. The invention according to claim 27, wherein the content the substance (C) for controlling conductivity in the layer having photosensitivity is 0.001 to 1000 atomic ppm.

29. The invention according to claim 1 or 2, wherein the layer having photosensitivity has a layer thickness of 1 to 100 μm.

30. The invention according to claim 1 or 2, wherein at least one of hydrogen atoms and halogen atoms are contained in the layer having photosensitivity.

31. The invention according to claim 1 or 2, wherein 1 to 40 atomic % of hydrogen atoms are contained in the layer having photosensitivity.

32. The invention according to claim 1 or 2, wherein 1 to 40 atomic % of halogen atoms are contained in the layer having photosensitivity.

33. The invention according to claim 1 or 2, wherein 1 to 40 atomic % as total of hydrogen atoms and halogen atoms are contained in the layer having photosensitivity.

34. The invention according to claim 1 or 2, wherein the layer having photosensitivity contains at least one kind of atoms selected from oxygen atoms and nitrogen atoms.

35. The invention according to claim 1 or 2, wherein the layer having photosensitivity has a layer region (ON) containing at least one kind of atoms selected from oxygen atoms and nitrogen atoms.

36. The invention according to claim 35, wherein the layer region (ON) is provided at the end portion on the substrate side of the layer having photosensitivity.

37. The invention according to claim 35, wherein the layer region (ON) contains 0.001 to 50 atomic % of oxygen atoms.

38. The invention according to claim 35, wherein the layer region (ON) contains 0.001 to 50 atomic % nitrogen atoms.

39. The invention according to claim 35, wherein the layer region (ON) contains oxygen atoms in nonuniform distribution state in the layer thickness direction.

40. The invention according to claim 35, wherein the layer region (ON) contains oxygen atoms in uniform distribution state in the layer thickness direction.

41. The invention according to claim 35, wherein the layer region (ON) contains nitrogen atoms in nonuniform distribution state in the layer thickness direction.

42. The invention according to claim 35, wherein the layer region (ON) contains nitrogen atoms in uniform distribution state in the layer thickness direction.

43. A light-receiving member comprising a substrate; and a light-receiving layer of a multi-layer structure having a first layer comprising an amorphous material containing silicon atoms and germanium atoms, a second layer comprising an amorphous material containing silicon aotms and exhibiting photoconductivity and a surface layer comprising an amorphous material containing silicon atoms and carbon atoms provided successively from the substrate side, said lightreceiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

44. The invention according to claim 43, wherein the light-receiving layer has a layer thickness of 1 to 100 μm.

45. The invention according to claim 43, wherein the layer thickness $T_B$ of the first layer and the layer thickness T of the second layer satisfy the relationship of $TB/T \leqq 1$.

46. An electrophotographic system comprising a light-receiving member as defined below:

a light-receiving member comprising a substrate; and a light-receiving layer of a multi-layer structure having a first layer comprising an amorphous material containing silicon atoms and germanium atoms, a second layer comprising an amorphous material containing silicon atoms and exhibiting photoconductivity and a surface layer comprising an amorphous material containing silicon atoms and carbon atoms provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

47. The invention according to claim 43 or 46, wherein the arrangement is made regularly.

48. The invention according to claim 43 or 46, wherein the arrangement is made in cycles.

49. The invention according to claim 46, wherein the short range is 0.3 to 500 μm.

50. The invention according to claim 43 or 46, wherein the non-parallel interfaces are formed on the basis of the smooth unevenness arranged regularly provided on the surface of the substrate.

51. The invention according to claim 50, wherein the smooth unevenness is formed by sinusoidal linear projections.

52. The invention according to claim 43 or 46, wherein the substrate is cylindrical.

53. The invention according to claim 52, wherein the sinusoidal linear projection has a spiral structure within the surface of the substrate.

54. The invention according to claim 53, wherein the spiral structure is a multiple spiral structure.

55. The invention according to claim 51, wherein the sinusoidal linear projection is divided in its edge line direction.

56. The invention according to claim 52, wherein the edge line direction of the sinusoidal linear projection is along the center axis of the cylindrical substrate.

57. The invention according to claim 50, wherein the smooth unevenness has slanted planes.

58. The invention according to claim 57, wherein the slanted planes are mirror finished.

59. The invention according to claim 50, wherein on the free surface of the light-receiving layer is formed a smooth unevenness arranged with the same pitch as the smooth unevenness provided on the substrate surface.

60. The invention according to claim 43 or 46, wherein the distribution state of germanium atoms in the first layer is nonuniform in the layer thickness direction.

61. The invention according to claim 60, the nonuniform distribution state of germanium atoms is more enriched toward the substrate side.

62. The invention according to claim 43 or 46, wherein a substance for controlling conductivity is contained in the first layer.

63. The invention according to claim 43 or 46, wherein the substance for controlling conductivity is an atom belonging to the group III or the group V of the periodic table.

64. The invention according to claim 43 or 46, wherein a substance for controlling conductivity is contained in the second layer.

65. The invention according to claim 64, wherein the substance for controlling conductivity is an atom belonging to the group III or the group V of the periodic table.

66. The invention according to claim 43 or 46, wherein the light-receiving layer has a layer region (PN) containing a substance for controlling conductivity.

67. The invention according to claim 66, wherein the distribution state of the substance for controlling conductivity in the layer region (PN) is nonuniform in the layer thickness direction.

68. The invention according to claim 66, wherein the distribution state of the substance for controlling conductivity in the layer region (PN) is uniform in the layer thickness direction.

69. The invention according to claim 66, wherein the substance for controlling conductivity is an atom belonging to the group III or the group V of the periodic table.

70. The invention according to claim 66, wherein the layer region (PN) is provided in the first layer.

71. The invention according to claim 66, wherein the layer region (PN) is provided in the second layer.

72. The invention according to claim 66, wherein the layer region (PN) is provided at the end portion on the substrate side of the light-receiving layer.

73. The invention according to claim 66, wherein the layer region (PN) is provided over both the first layer and the second layer.

74. The invention according to claim 66, wherein the layer region (PN) occupies a part of the layer region in the light-receiving layer.

75. The invention according to claim 74, wherein the content of the substance for controlling conductivity in the layer region (PN) is 0.01 to $5\times10^4$ atomic ppm.

76. The invention according to claim 43 or 46, wherein at least one of hydrogen atoms and halogen atoms are contained in the first layer.

77. The invention according to claim 43 or 46, wherein 0.01 to 40 atomic % of hydrogen atoms are contained in the first layer.

78. The invention according to claim 43 or 46, wherein 0.01 to 40 atomic % of halogen atoms are contained in the first layer.

79. The invention according to claim 43 or 46, wherein 0.01 to 40 atomic % as a total of hydrogen atoms and halogen atoms are contained in the first layer.

80. The invention according to claim 43 or 46, wherein 1 to 40 atomic % of hydrogen atoms are contained in the second layer.

81. The invention according to claim 43 or 46, wherein 1 to 40 atomic % of halogen atoms are contained in the second layer.

82. The invention according to claim 43 or 46, wherein 1 to 40 atomic % as a total of hydrogen atoms and halogen atoms are contained in the second layer.

83. The invention according to claim 43 or 46, wherein at least one of hydrogen atoms and halogen atoms are contained in the second layer.

84. The invention according to claim 43 or 46, wherein the light-receiving layer contains at least one kind of atoms selected from oxygen atoms and nitrogen atoms.

85. The invention according to claim 43 or 46, wherein the light-receiving layer has a layer region (ON) containing at least one kind of atoms selected from oxygen atoms and nitrogen atoms.

86. The invention according to claim 85, wherein the layer region (ON) is provided at the end portion on the substrate side of the light-receiving layer.

87. The invention according to claim 86, wherein the layer region (ON) contains 0.001 to 50 atomic % of oxygen atoms.

88. The invention according to claim 86, wherein the layer region (ON) contains 0.001 to 50 atomic % of nitrogen atoms.

89. The invention according to claim 86, wherein oxygen atoms are contained in the layer region (ON) in nonuniform distribution state in the layer thickness direction.

90. The invention according to claim 86, wherein oxygen atoms are contained in the layer region (ON) in uniform distribution state in the layer thickness direction.

91. The invention according to claim 86, wherein nitrogen atoms are contained in the layer region (ON) in nonuniform distribution state in the layer thickness direction.

92. The invention according to claim 86, wherein nitrogen atoms are contained in the layer region (ON) in uniform distribution state in the layer thickness direction.

93. The invention according to claim 43 or 46, wherein the first layer has a layer thickness of 30 Å to 50 μm.

94. The invention according to claim 43 or 46, wherein the second layer has a layer thickness of 0.5 to 90 μm.

95. The invention according to claim 43 or 46, wherein the surface layer is constituted of $A\text{-}(Si_xC_{1-x})_y$ (where $0<x,y\leqq1$).

96. The invention according to claim 43 or 46, wherein the content of carbon atoms contained in the surface layer is in the range of from $1\times10^{-3}$ to 90 atomic %.

97. The invention according to claim 43 or 46, wherein the surface layer has a layer thickness of 0.003 to 30 μm.

98. An electrophotographic image forming process comprising:

(a) applying a charging treatment to the light receiving member of claim 1 or 43;

(b) irradiating the light receiving member with a laser beam carrying information to form an electrostatic latent image; and (c) developing said electrostatic latent image.

* * * * *

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

On the Title Page,

AT [56] IN THE REFERENCES CITED

U.S. Patent Documens, "4,600,611" should read --4,600,671--.

AT [57] IN THE ABSTRACT

Line 4, "morphous" should read --amorphous--.

COLUMN 1

Line 11, "752,920" should be deleted.
Line 18, "rays visible" should read --rays, visible--.
Lines 36-37, "electrophotograhy" should read --electrophotography--.

COLUMN 2

Line 7, "easiness" should read --ease--.
Line 15, "an" should read --a--.

COLUMN 3

Line 12, "sized" should read --sizes--.
Line 22, "sufficinent" should read --sufficient--.
Line 58, "may be" should read --is--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 4

Line 3, "so much" should read --greatly--.
Line 36, "interferance" should read --interference--.

COLUMN 5

Line 19, "amorphlus" should read --amorphous--.

COLUMN 6

Line 19, "accompnaying" should read --accompanying--.

COLUMN 7

Line 22, "as" should be deleted.
Line 47, "bite" should read --bit--.
Line 65, "spital" should read --spiral--.

COLUMN 9

Line 66, "preferablly" should read --preferably--.
Line 68, "mechnical" should read --mechanical--.

COLUMN 10

Line 11, "so called" should read --so-called--.
Line 14, "imprurities" should read --impurities--.
Line 28, "suitably be" should read --suitably--.
Line 64, "the" should read --The--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 13

Line 64, "of" should read --by--.

COLUMN 15

Line 2, insert a comma --,-- after "9".
Line 2, "preferably" should read --preferably,--.
Line 12, "bormine" should read --bromine--.
Line 15, "x-ray" should read --may--.
Line 47, "easiness" should read --ease--.
Line 55, "easiness" should read --ease--.

COLUMN 16

Line 9, "so called" should read --so-called--.
Line 39, "ion plating" should read --ion-plating--.

COLUMN 17

Line 6, "$siH_2I_2$," should read --$SiH_2I_2$,--.
Line 36, "0.1.to" should read --0.1 to--.
Line 53, "a-Si(H,X)" should read --A-Si(H,X)--.

COLUMN 18

Line 46, "depending on" should be deleted.

COLUMN 19

Line 9, "so called" should read --so-called--.
Lines 11-12, "condutivity" should read --conductivity--.
Line 27, "suitably be" should read --suitably--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 20

Line 19, "so called" should read --so-called--.
Lines 24-25, "so called" should read --so-called--.

COLUMN 21

Line 1, "$t_T$. gradually" should read --$t_T$ gradually--.
Line 19, "the $t_4$" should read --the position $t_4$--.
Line 56, "shown" should read --shown in--.

COLUMN 22

Line 32, "etc" should read --etc.--.

COLUMN 24

Line 41, "concentraticn" should read --concentration--.

COLUMN 26

Line 42, "xaterials" should read --materials--.

COLUMN 28

Line 45, "($C_2H_6$) propane" should read --($C_2H_6$), propane--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 29

Line 11, "in to" should read --into--.
Line 24, "into a a" should read --into a--.

COLUMN 30

Line 62, "0-d, e<1)." should read --0<d, e<1).--.

COLUMN 31

Line 55, "borne" should read --formed--.

COLUMN 33

Line 8, "contaiing" should read --containing--.
Line 36, "2029 2030" should read --2029, 2030--.
Line 59, "$B_2H_6$" should read --$B_2H_6/H_2$--.
Line 62, "period time," should read --period of time,--.

COLUMN 34

Line 16, "consisiting" should read --consisting--.

COLUMN 35

Line 4, "1161" should read --1162--.
Line 33, "frequence" should read --frequency--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 36

Line 16, "photosensitie" should read --photosensitive--.
Line 25, "ccnditions" should read --conditions--.
Line 67, "Example 12" should read --Example 1--.

COLUMN 38

Line 21, "susbstrates" should read --substrates--.

COLUMN 40

Line 10, "1161" should read --1162--.
Line 47, "aluminun" should read --aluminum--.

COLUMN 41

Line 27, "photosensitie" should read --photosensitive--.
Line 56, "$SiH_4$ gas" should read --$SiH_4$ gas;--.

COLUMN 45

Line 10, "SSCM," should read --SCCM--.
Line 14, "1161" should read --1162--.
Line 38, "no" should read --on--.
Line 55, "depositione" should read --deposition--.

COLUMN 46

Line 38, "photosensitie" should read --photosensitive--.
Line 66, "$SiH_4$ gas" should read --$SiH_4$ gas,--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 48

Line 41, "The photosensitive" should read --the photosensitive--.

COLUMN 49

Lines 38-39, "satisfactory" should read --satisfactory,--.
Line 39, "characteirstics" should read --characteristics--.
Lines 55-56, "satisfactory" should read --satisfactory,--.
Line 65, "150 W" should read --160 W--.

COLUMN 50

Line 20, "outerdiameter" should read --outer diameter--.
Line 32, "$SiH_4/CH_4$1/30" should read --$SiH_4/CH_4$=1/30--.

COLUMN 52

Line 35, "exposured" should read --exposure--.
Line 68, "100.000" should read --100,000--.

COLUMN 53

Line 52, "outerdiameter" should read --outer diameter--.

COLUMN 54

Line 41, "or" should read --for--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 56

Line 18, "papers Such" should read --papers. Such--.

COLUMN 57

Line 31, "outerdiameter" should read --outer diameter--.

COLUMN 58

Line 16, "or" should read --for--.

COLUMN 59

Line 41, "exposured" should read --exposure--.

COLUMN 62

Line 12, "58." should read --58,--.

COLUMN 63

Line 54, "outerdiameter" should read --outer diameter--.
Line 64, "shcwn" should read --shown--.
Line 66, "resPective" should read --respective--.

COLUMN 64

Line 41, "or" should read --for--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 66

Line 5, "Iable" should read --Table--.
Lines 23-24, "copYing" should read --copying--.
Line 28, "electrophctography" should read --electrophotography--.
Line 63, "proces:" should read --process--.

COLUMN 67

Lines 24-25, "copYing" should read --copying--.

COLUMN 68

Line 15, "memters" should read --members--.
Line 17, "follcwed" should read --followed--.
Line 41, "60 μm)," should read --80 μm),--.
Line 42, "obtair" should read --obtain--.

COLUMN 69

Line 5, "outerdiameter" should read --outer diameter--.
Line 9, "proceduree" should read --procedures--.
Line 40, "shcwn" should read --shown--.
Line 42, "beam: 80nm," should read --beam: 780nm,--.

COLUMN 71

Line 9, "thickress" should read --thickness--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 72

Line 21, "oy" should read --by--.

COLUMN 73

Line 35, "fcr" should read --for--.
Line 63, "providion" should read --provision--.

COLUMN 74

Line 7, "outerdiameter" should read --outer diameter--.
Line 15, "conrolled" should read --controlled--.
Line 23, "gas flow rate relative to the $SiH_4$" should be in regular print.
Line 35, "layar" should read --layer--.
Line 41, "a shown" should read --as shown--.

COLUMN 75

Line 5, "ttereby" should read --thereby--.

COLUMN 76

Line 63, "Such as" should read --Such an--.

COLUMN 77

Line 55, "B" should read --$B_2H_6/H_2$--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 78

Line 10, "$GeH_2$," should read --$GeH_4$,--.
Line 32, "electrography" should read --electrophotography--.
Line 51, "was formed" should be deleted.

COLUMN 82

Line 30, "301" should read --8301--.

COLUMN 83

Line 63, "curvesas" should read --curves as--.

COLUMN 84

Line 61, "electrography" should read --electrophotography--.
Line 65, "Instrement" should read --Instrument--.

COLUMN 85

Line 2, "meber" should read --member--.
Line 11, "outerdiameter" should read --outer diameter--.

COLUMN 86

Line 25, "No. 1-K" should read --No. 1-1K--.
Line 64, "differece" should read --difference--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 91

Line 5, "outerdiameter" should read --outer diameter--.
Lines 36-37, "aluminum ¶ substrate" should read --aluminum substrate--.
Line 40, "FIG. 27" should read --FIG. 26--.

COLUMN 93

Line 16, "FIG. 27" should read --FIG. 26--.

COLUMN 94

Line 67, "oase" should read --case--.

COLUMN 95

Line 46, "rate $SiH_4$" should read --rate and $SiH_4$--.

COLUMN 96

Line 1, "$SiH_4$" should read --and $SiH_4$--.
Lines 22-23, "rate $SiH_4$" should read --rate and $SiH_4$--.

COLUMN 97

Lines 49-50, "was formed" should be deleted.
Line 60, "$GEH_4$" should read --$GeH_4$--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 98

Line 6, "both" should be deleted.
Line 41, "an" should read --on--.

COLUMN 99

Line 35, "to the" should read --to--.

COLUMN 100

Line 2, "exposured" should read --exposure--.
Line 31, "A A-Si" should read --An A-Si--.
Line 51, "A A-Si" should read --An A-Si--.
Line 52, "conduction" should read --condition--.

COLUMN 104

Line 67, "outerdiameter" should read --outer diameter--.

COLUMN 105

Line 34, "FIG. 30" should read --FIG. 26--.
Line 51, "or" should read --for--.
Line 58, "50 W" should read --150 W--.

COLUMN 106

Line 62, "substrate" should read --substrates--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 107

Line 7, "exposured" should read --exposure--.

COLUMN 112

Line 54, "outerdiameter" should read --outer diameter--.

COLUMN 113

Line 2, "lfow" shoul read --flow--.
Line 35, "electrophotography" should read --electrophotographic--.

COLUMN 116

Lines 12-13, "electrphotography" should read --electrophotography--.

COLUMN 118

Line 55, "$B_2N_6/H_2$" should read --$B_2H_6/H_2$--.

COLUMN 120

Line 42, "$B_2N_6/H_2$" should read --$B_2H_6/H_2$--.

COLUMN 122

Line 30, "$P_2H_6$" should read --$B_2H_6$--.

UNITED STATES PATENT AND TRADEMARK OFFICE

CERTIFICATE OF CORRECTION

DATED : September 29, 1987

INVENTOR(S) : KEISHI SAITOH, ET AL.

It is certified that error appears in the above-identified patent and that said Letters Patent is hereby corrected as shown below:

COLUMN 126

Table 11A, "203A" should read --203A--.
0.04 0.4

COLUMN 131

Table 6C, "508" should read --508C--.

COLUMN 134

Table 12C, $B_2H$" should read --$B_2H_6$--.

COLUMN 135

Table 15C continued,
"◎ ... Practically very good"
○ ... Practically excellent
should read
-- ○ ... Practically very good--".
◎ ... Practically excellent
Table 18C, "0.0001 NO" should read --0.0001--.
NO
Table 19C, "0.0001 NO" should read --0.0001--.
NO
Table 20C, "0/0001" should read --0.0001--.

COLUMN 137

Table 5D, "108" should read --108D--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 143

Table 4F, "4002E" should read --4002F--.

COLUMN 149

Table 20F, "300" should read --300--.

| | |
|---|---|
| 100 | 300 |

Table 20F,

| "(Å/Sec) | (μm)" should read --(Å/Sec) | (μm)--. |
|---|---|---|
| 10 | 2 | 10 | 2 |
| 8 | 3 | 10 | 2 |

COLUMN 153

Table 12G, "100" should read --100--.

| | |
|---|---|
| 100 | 100 |
| 100 | 300 |

COLUMN 156

Table 10H, "$SiH_4$)=1" should read --$SiH_4$)=1/--.

COLUMN 161

Table 10I, "100 → " should read -- 100 → X --.

| | |
|---|---|
| 300 | 300 |
| 100 | 100 |
| → 0 | X → 0 |

Table 10I, "The symbol represents" should read --The symbol X represents--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 169

Table 7K, "$GeH_4$ + " should read --$GeH_4$ +--.
$SiH_4$ + 100 $SiH_4$ = 100.

COLUMN 170

Table 13K, "10 → ☆ " should read --10 → ·X· --.

COLUMN 171

Table 13K continued, " ☆ → 0" should read -- ·X· → 0--.
Table 13K continued, "symbol ☆ " should read
--symbol ·X· --.

COLUMNS 173-174

Table 8L,
"Layer B $H_2$ 300"
$SiH_4$
should read
--Layer B $H_2$ 300--.
$SiH_4$ 300

COLUMN 177

Table 16L, "The symbols and represent" should read
--The symbols ·X· and ·X· ·X· represent--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 179

Table 19L, "Layer" should read --Layer--.
E B

COLUMN 181

Table 7M, "First" should read --First--.
layer

COLUMN 189

Table 14N continued,
"50 → " should read -- 5 → ⊗ ⊗ ⊗ --.
10 → 10 → ⊗
300 300
50 50
50 50
→ 0 ⊗ ⊗ ⊗ → 0
→ ⊗ → ⊗ ⊗
300 300
300 300
→ 0 ⊗ ⊗ → 0

Table 3P,
" " should read --Image quality evaluation --.

| Image | Image quality evaluation |
|---|---|
| ◎ ... Very good | ⓞ ... Very good |

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMNS 191-192

Table 10P,

| "constitution | starting gas | (SCCM) | (W) | (Å/sec) | (μm)" |
|---|---|---|---|---|---|
| First | $H_2$ | 300 | 100 | 10 | 2 |

should read

| --constitution | starting gas | (SCCM) | (W) | (Å/sec) | (μm)-- |
|---|---|---|---|---|---|
| First | $H_2$ | 300 | 100 | 10 | 2 |

COLUMN 193

Table 14P, " ·X· → " should read -- ·X· → ·X· ·X· --.

COLUMN 195

Line 30, "nonparallel" shoul read --non-parallel--.
Table 15P continued, "The symbol represents" should read --The symbol ·X· ·X· ·X· represents--.

COLUMN 197

Line 5, "content the" should read --content of the--.
Line 21, "as total" should read --as a total--.
Line 61, "lightreceiving" should read --light-receiving--.

UNITED STATES PATENT AND TRADEMARK OFFICE

CERTIFICATE OF CORRECTION

PATENT NO. : 4,696,881

DATED : September 29, 1987

INVENTOR(S) : KEISHI SAITOH, ET AL.

It is certified that error appears in the above-identified patent and that said Letters Patent is hereby corrected as shown below:

COLUMN 198

Line 7, "TB/T≦1." should read --$T_B/T \leq 1$.--.
Line 31, "claim 46," should read --claim 43 or 46,--.
Line 66, "claim 60, the" should read --claim 60, wherein the--.

COLUMN 200

Line 47, "A-$(Si_xC_{1-x})_y$" should read --A-$(Si_xC_{1-x})_y(H,X)_{1-y}$--.

Signed and Sealed this

Thirtieth Day of May, 1989

*Attest:*

*Attesting Officer*

DONALD J. QUIGG

*Commissioner of Patents and Trademarks*